US009908352B2

(12) United States Patent
Kimura et al.

(10) Patent No.: US 9,908,352 B2
(45) Date of Patent: Mar. 6, 2018

(54) LIQUID EJECTION SYSTEM, VENTILATION UNIT, LIQUID SUPPLY APPARATUS

(71) Applicant: Seiko Epson Corporation, Tokyo (JP)

(72) Inventors: Naomi Kimura, Okaya (JP); Munehide Kanaya, Azumino (JP); Shoma Kudo, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/285,742

(22) Filed: Oct. 5, 2016

(65) Prior Publication Data

US 2017/0096024 A1 Apr. 6, 2017

(30) Foreign Application Priority Data

Oct. 6, 2015 (JP) ..... 2015-198271

(51) Int. Cl.
*B41J 29/377* (2006.01)
*B41J 2/175* (2006.01)

(52) U.S. Cl.
CPC ..... *B41J 29/377* (2013.01); *B41J 2/17503* (2013.01); *B41J 2/17553* (2013.01); *B41J 2202/02* (2013.01)

(58) Field of Classification Search
CPC .. B41J 29/377; B41J 2/17553; B41J 2/17503; B41J 2202/02
See application file for complete search history.

(56) References Cited

U.S. PATENT DOCUMENTS

2002/0105564 A1* 8/2002 Matsumoto ..... B41J 2/17556 347/85
2015/0109386 A1 4/2015 Koike et al.
2015/0202878 A1 7/2015 Mokhamad et al.

FOREIGN PATENT DOCUMENTS

EP 1 013 448 A2 6/2000
EP 1 559 559 A2 8/2005
JP 2015-080907 A 4/2015

OTHER PUBLICATIONS

Extended European Search Report for Application No. EP 16 19 2389 dated Mar. 17, 2017 (7 pages).

* cited by examiner

*Primary Examiner* — Sharon A Polk
(74) *Attorney, Agent, or Firm* — Harness, Dickey & Pierce, P.L.C.

(57) ABSTRACT

A liquid ejection system includes a liquid ejection head configured to ejecting liquid, a liquid storage container that includes a liquid storage portion capable of storing the liquid that is to be supplied to the liquid ejection head, and a ventilation unit that constitutes at least a portion of an air introduction portion that is in communication with the liquid storage portion and is configured to introducing air into the liquid storage portion, and is detachable from the liquid storage container. The ventilation unit includes an introduction passage that constitutes at least a portion of a path of air flowing toward the liquid storage portion in the air introduction portion, and an air chamber that constitutes at least a portion of the introduction passage. The ventilation unit is arranged in the periphery of the liquid storage container.

20 Claims, 65 Drawing Sheets

LIQUID EJECTION SYSTEM, VENTILATION UNIT, LIQUID SUPPLY APPARATUS

CROSS REFERENCE TO RELATED APPLICATION

This application claims priority to Japanese Patent Application No. 2015-198271 filed on Oct. 6, 2015, and the entire contents of this application are incorporated by reference herein.

BACKGROUND

1. Technical Field

The present invention relates to a liquid ejection system, a ventilation unit, a liquid supply apparatus, and the like.

2. Related Art

Inkjet printers have been known as examples of a liquid ejection device. With an inkjet printer, printing can be performed on a printing medium such as a printing sheet by discharging ink, which is one example of a liquid, from a liquid ejection head. Such an inkjet printer has been known to have a configuration in which ink stored in a tank, which is one example of a liquid storage container, is supplied to the liquid ejection head. Such a tank is known to have a configuration in which air can be introduced from an air communication opening into a storage portion that can store ink, via a communication portion. JP-A-2015-80907 proposes a configuration that, in such a tank, makes it possible to suppress cases in which ink in the storage portion leaks from the air communication opening to the outside of the tank through the communication portion (e.g., see JP-A-2015-80907). Note that in the following, the expression "liquid ejection system" is sometimes used to refer to a configuration in which a liquid storage container such as a tank has been added to a liquid ejection device such as an inkjet printer.

JP-A-2015-80907 is an example of related art.

JP-A-2015-80907 does not propose a configuration for achieving a further improvement, that is to say, the ability to further suppress cases where a liquid leaks out from the liquid storage container.

SUMMARY

The invention can solve at least the above-described issues, and can be realized in the following aspects or application examples.

Application Example 1

A liquid ejection system according to an aspect of the invention includes: a liquid ejection head configured to eject liquid; a liquid storage container including a liquid storage portion configured to store the liquid that is to be supplied to the liquid ejection head; and a ventilation unit that constitutes at least a portion of an air introduction portion that is in communication with the liquid storage portion and is configured to introduce air into the liquid storage portion, and is detachable from the liquid storage container. The ventilation unit includes an introduction passage that constitutes at least a portion of a path of air flowing toward the liquid storage portion in the air introduction portion, and an air chamber that constitutes at least a portion of the introduction passage, and the ventilation unit is arranged in a periphery of the liquid storage container.

This liquid ejection system is provided with the ventilation unit that constitutes at least a portion of the air introduction portion that can introduce air into the liquid storage portion. The ventilation unit has the introduction passage that constitutes at least a portion of the path of air, and the air chamber that constitutes at least a portion of the introduction passage. According to this configuration, even if the liquid in the liquid storage portion enters the air introduction portion, the advancement of the liquid is readily stopped in the air chamber of the ventilation unit. Accordingly, this readily prevents liquid in the liquid storage portion from leaking to the outside of the liquid storage container through the air introduction portion. Also, the ventilation unit is configured to be detachable from the liquid storage container. In other words, the liquid storage container and the ventilation unit are configured to be separate from each other. According to this configuration, it is possible to add the air introduction portion to the liquid storage container and extend the air introduction portion. Accordingly, this more readily prevents the liquid from leaking out from the liquid storage container.

Application Example 2

In the liquid ejection system according to the above aspect, it is preferable that the liquid storage container includes a liquid injection portion, through which the liquid is injected into the liquid storage portion, when the liquid storage container is in use orientation of the liquid storage container, the liquid injection portion is arranged at a position that is biased to one side in the liquid storage container in a plan view of the liquid storage container from vertically above in the use orientation, and when a side of the liquid storage container on which the liquid injection portion is defined as a front surface side, the ventilation unit is arranged on a side of the liquid storage container that is opposite to the front surface side.

In the liquid ejection system according to this aspect, the ventilation unit can be arranged on the side of the liquid storage container that is opposite to the front surface side.

Application Example 3

In the liquid ejection system according to the above aspect, it is preferable that the liquid storage container includes a liquid injection portion, through which the liquid is injected into the liquid storage portion, when the liquid storage container is in use orientation of the liquid storage container, the liquid injection portion is arranged at a position that is biased to one side in the liquid storage container in a plan view of the liquid storage container from vertically above in the use orientation, and when a side of the liquid storage container on which the liquid injection portion is defined as a front surface side, a direction from the front surface side toward an opposite side of the liquid storage container is defined as an X direction, a vertically upward direction in the use orientation is defined as a Z direction, and a direction orthogonal to the X direction and the Z direction is defined as a Y direction, the ventilation unit is arranged on a Y direction side of the liquid storage container in a view of the liquid storage container in the X direction.

In the liquid ejection system according to this aspect, the ventilation unit can be arranged on the Y direction side of the liquid storage container in a view of the liquid storage container in the X direction.

Application Example 4

In the liquid ejection system according to the above aspect, it is preferable that the liquid storage container includes a liquid injection portion through which the liquid is injected into the liquid storage portion, when the liquid storage container is in use orientation of the liquid storage container, the liquid injection portion is arranged at a position that is biased to one side in the liquid storage container in a plan view of the liquid storage container from vertically above in the use orientation, and when a side of the liquid storage container on which the liquid injection portion is defined as a front surface side, a direction from the front surface side toward an opposite side of the liquid storage container is defined as an X direction, a vertically upward direction in the use orientation is defined as a Z direction, and a direction orthogonal to the X direction and the Z direction is defined as a Y direction, the ventilation unit is arranged on a side that is opposite to a Y direction side of the liquid storage container in a view of the liquid storage container in the X direction.

In the liquid ejection system according to this aspect, the ventilation unit can be arranged on the side that is opposite to the Y direction side of the liquid storage container in a view of the liquid storage container in the X direction.

Application Example 5

In the liquid ejection system according to the above aspect, it is preferable that the liquid storage container includes a liquid injection portion through which the liquid is injected into the liquid storage portion, when the liquid storage container is in use orientation of the liquid storage container, the liquid injection portion is arranged at a position that is biased to one side in the liquid storage container in a plan view of the liquid storage container from vertically above in use orientation, and when a side of the liquid storage container on which the liquid injection portion is defined as a front surface side, a direction from the front surface side toward an opposite side of the liquid storage container defined as an X direction, a vertically upward direction in the use orientation defined as a Z direction, and a direction orthogonal to the X direction and the Z direction defined as a Y direction, the ventilation unit is arranged on a Z direction side of the liquid storage container in a view of the liquid storage container in the X direction.

In the liquid ejection system according to this aspect, the ventilation unit can be arranged on the Z direction side of the liquid storage container in a view of the liquid storage container in the X direction.

Application Example 6

In the liquid ejection system according to the above aspect, it is preferable that the liquid storage container includes a liquid injection portion through which the liquid is injected into the liquid storage portion, when the liquid storage container is in use orientation of the liquid storage container, the liquid injection portion is arranged at a position that is biased to one side in the liquid storage container in a plan view of the liquid storage container from vertically above in the use orientation, and when a side of the liquid storage container on which the liquid injection portion is defined as a front surface side, a direction from the front surface side toward an opposite side of the liquid storage container is defined as an X direction, a vertically upward direction in the use orientation is defined as a Z direction, and a direction orthogonal to the X direction and the Z direction is defined as a Y direction, the ventilation unit is arranged on a side that is opposite to a Z direction side of the liquid storage container in a view of the liquid storage container in the X direction.

In the liquid ejection system according to this aspect, the ventilation unit can be arranged on the side that is opposite to the Z direction side of the liquid storage container in a view of the liquid storage container in the X direction.

Application Example 7

In the liquid ejection system according to the above aspect, it is preferable that a waterproof ventilation member that blocks the introduction passage is arranged upstream of the air chamber in the path of air.

In the liquid ejection system according to this aspect, the advancement of the liquid can be prevented by the waterproof ventilation member, thus more readily preventing the liquid that flowed from the liquid storage portion into the air introduction portion from leaking to the outside of the liquid storage container through the air introduction portion.

Application Example 8

In the liquid ejection system according to the above aspect, it is preferable that the waterproof ventilation member is a valve that allows air to flow into the air chamber from a location upstream of the air chamber through the path of air, and is also configured to prevent a flow of the liquid from the air chamber to a location upstream of the air chamber.

In the liquid ejection system according to this aspect, the advancement of the liquid can be prevented by the valve, thus more readily preventing the liquid that flowed from the liquid storage portion into the air introduction portion from leaking to the outside of the liquid storage container through the air introduction portion.

Application Example 9

In the liquid ejection system according to the above aspect, it is preferable that the waterproof ventilation member is a waterproof ventilation sheet.

In the liquid ejection system according to this aspect, the advancement of the liquid can be prevented by the waterproof ventilation sheet, thus more readily preventing the liquid that flowed from the liquid storage portion into the air introduction portion from leaking to the outside of the liquid storage container through the air introduction portion.

Application Example 10

In the liquid ejection system according to the above aspect, it is preferable that the liquid ejection system includes a plurality of the liquid storage portions. The ventilation unit includes a plurality of connection portions that are in communication with the introduction passage, the connection portions are in one-to-one correspondence with the liquid storage portions, the connection portions are in communication with the liquid storage portions in a state in which the connection portions are connected to the air introduction portion at a location downstream of the ventilation unit in the path of air, and the plurality of connection portions are provided in an integrated manner in the ventilation unit.

In the liquid ejection system according to this aspect, the air introduction portions of multiple liquid storage portions can be connected to one ventilation unit.

Application Example 11

In the liquid ejection system according to the above aspect, it is preferable that the plurality of connection portions are in communication with the same introduction passage in the ventilation unit.

In the liquid ejection system according to this aspect, the air introduction portions of multiple liquid storage portions can be connected to the same introduction passage in one ventilation unit.

Application Example 12

In the liquid ejection system according to the above aspect, it is preferable that the liquid storage container and the ventilation unit are connected via a tube.

In the liquid ejection system according to this aspect, the setting of the position of the ventilation unit relative to the liquid storage container can be readily changed according to the setting of the length and arrangement of the tube.

Application Example 13

In the liquid ejection system according to the above aspect, it is preferable that the liquid ejection system includes a casing that covers the liquid ejection head, the liquid storage container, and the ventilation unit.

In the liquid ejection system according to this aspect, the liquid ejection head, the liquid storage container, and the ventilation unit can be protected by the casing.

Application Example 14

A ventilation unit according to an aspect of the invention is a ventilation unit that is configured to be applied to a liquid ejection system that includes a liquid ejection head configured to eject liquid and a liquid storage container including a liquid storage portion configured to store the liquid that is to be supplied to the liquid ejection head. The ventilation unit constitutes at least a portion of an air introduction portion that is configured to introduce air into the liquid storage portion and is in communication with the liquid storage portion, and is detachable from the liquid storage container, and includes: an introduction passage that constitutes at least a portion of a path of air flowing toward the liquid storage portion in the air introduction portion; an air chamber that constitutes at least a portion of the introduction passage; and a waterproof ventilation member that blocks the introduction passage and is arranged upstream of the air chamber in the path of air.

This ventilation unit constitutes at least a portion of the air introduction portion that can introduce air into the liquid storage portion. The ventilation unit has the introduction passage that constitutes at least a portion of the path of air, and the air chamber that constitutes at least a portion of the introduction passage. According to this configuration, even if the liquid in the liquid storage portion enters the air introduction portion, the advancement of the liquid is readily stopped in the air chamber of the ventilation unit. Accordingly, this readily prevents liquid in the liquid storage portion from leaking to the outside of the liquid storage container through the air introduction portion. Furthermore, the waterproof ventilation member is arranged upstream of the air chamber in this ventilation unit. Accordingly, this more readily prevents liquid in the liquid storage portion from leaking to the outside of the liquid storage container through the air introduction portion. Also, the ventilation unit is configured to be detachable from the liquid storage container. In other words, the liquid storage container and the ventilation unit are configured to be separate from each other. According to this configuration, it is possible to add the air introduction portion to the liquid storage container and extend the air introduction portion. Accordingly, this more readily prevents the liquid from leaking out from the liquid storage container.

Application Example 15

In the ventilation unit according to the above aspect, it is preferable that the liquid ejection system includes a plurality of the liquid storage portions, the ventilation unit includes a plurality of connection portions that are in communication with the introduction passage, the connection portions are in one-to-one correspondence with the liquid storage portions, the connection portions is configured to be in communication with the liquid storage portions when the connection portions are connected to the air introduction portion at a location downstream of the ventilation unit in the path of air, and the plurality of connection portions are provided in an integrated manner in the ventilation unit.

This ventilation unit can be connected to the air introduction portions of multiple liquid storage portions.

Application Example 16

A liquid supply apparatus according to an aspect of the invention is a liquid supply apparatus that is configured to be applied to a liquid ejection device that includes a liquid ejection head configured to eject liquid, the liquid supply apparatus including: a liquid storage container including a liquid storage portion configured to store the liquid that is to be supplied to the liquid ejection head; an air introduction portion that is in communication with the liquid storage portion and is configured to introduce air into the liquid storage portion; and a ventilation unit that constitutes at least a portion of an air introduction portion that is configured to introduce air into the liquid storage portion and is in communication with the liquid storage portion, and is detachable from the liquid storage container. The ventilation unit includes an introduction passage that constitutes at least a portion of a path of air flowing toward the liquid storage portion in the air introduction portion, and an air chamber that constitutes at least a portion of the introduction passage, and a waterproof ventilation member that blocks the introduction passage is arranged upstream of the air chamber in the path of air.

This liquid supply apparatus is provided with the ventilation unit that constitutes at least a portion of the air introduction portion that can introduce air into the liquid storage portion. The ventilation unit has the introduction passage that constitutes at least a portion of the path of air, and the air chamber that constitutes at least a portion of the introduction passage. According to this configuration, even if the liquid in the liquid storage portion enters the air introduction portion, the advancement of the liquid is readily stopped in the air chamber of the ventilation unit. Accordingly, this readily prevents liquid in the liquid storage portion from leaking to the outside of the liquid storage container through the air introduction portion. Furthermore, the waterproof ventilation member is arranged upstream of the air chamber in this ventilation unit. Accordingly, this more readily prevents liquid in the liquid storage portion from leaking to the outside of the liquid storage container through the air introduction portion. Also, the ventilation unit is configured to be detachable from the liquid storage container. In other words, the liquid storage container and the ventilation unit are configured to be separate from each other. According to this configuration, it is possible to add the air introduction portion to the liquid storage container and extend the air introduction portion. Accordingly, this more readily prevents the liquid from leaking out from the liquid storage container.

Application Example 17

In the liquid supply apparatus according to the above aspect, it is preferable that the waterproof ventilation member is a valve that allows air to move into the air chamber from a location upstream of the air chamber through the path of air, and is also configured to prevent movement of the liquid from the air chamber to a location upstream of the air chamber.

In the liquid supply apparatus according to this aspect, the advancement of the liquid can be prevented by the valve, thus more readily preventing the liquid that flowed from the liquid storage portion into the air introduction portion from leaking to the outside of the liquid storage container through the air introduction portion.

Application Example 18

In the liquid supply apparatus according to the above aspect, it is preferable that the waterproof ventilation member is a waterproof ventilation sheet.

In the liquid supply apparatus according to this aspect, the advancement of the liquid can be prevented by the waterproof ventilation sheet, thus more readily preventing the liquid that flowed from the liquid storage portion into the air introduction portion from leaking to the outside of the liquid storage container through the air introduction portion.

Application Example 19

In the liquid supply apparatus according to the above aspect, it is preferable that the ventilation unit is arranged in a periphery of the liquid storage container.

In the liquid supply apparatus according to this aspect, the ventilation unit is configured to be detachable from the liquid storage container, thus making it possible to arrange the ventilation unit in the periphery of the liquid storage container.

Application Example 20

In the liquid supply apparatus according to the above aspect, it is preferable that the liquid storage container includes a liquid injection portion through which the liquid is injected into the liquid storage portion, when the liquid storage container is in use orientation of the liquid storage container, the liquid injection portion is arranged at a position that is biased to one side in the liquid storage container in a plan view of the liquid storage container from vertically above in the use orientation, and when a side of the liquid storage container on which the liquid injection portion is defined as a front surface side, the ventilation unit is arranged on a side of the liquid storage container that is opposite to the front surface side.

In the liquid supply apparatus according to this aspect, the ventilation unit can be arranged on the side of the liquid storage container that is opposite to the front surface side.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
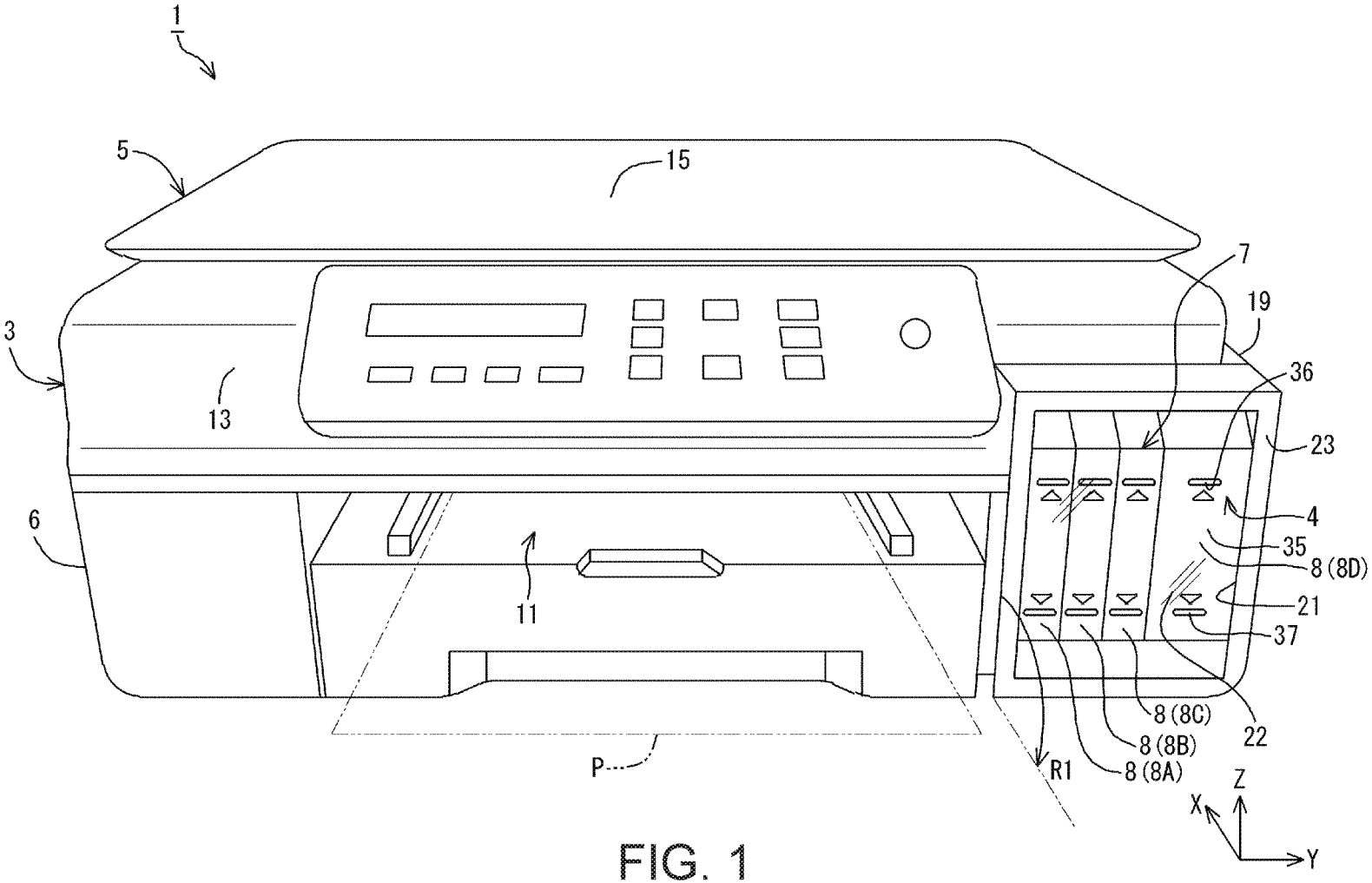
FIG. 1 is a perspective view of a relevant configuration of a liquid ejection system according to a first embodiment.

Embodiments of the invention will be described below with reference to the drawings by way of example of a liquid ejection system that includes an inkjet printer (referred to hereinafter as a printer), which is one example of a liquid ejection device. Note that the various configurations in the drawings are shown at recognizable sizes, and therefore the configurations and members are not necessarily drawn to scale.

First Embodiment

As shown in FIG. 1, a liquid ejection system 1 of this embodiment has a printer 3 as one example of a liquid ejection device, an ink supply apparatus 4 as one example of a liquid supply apparatus, and a scanner unit 5. The printer 3 has a casing 6. The casing 6 constitutes the outer shell of the printer 3. Also, in the liquid ejection system 1, the ink supply apparatus 4 is stored inside the casing 6. The ink supply apparatus 4 has a tank 7 as one example of a liquid storage container. Multiple (two, or a number greater than two) liquid storage portions 8 are provided in the tank 7.

In this embodiment, four liquid storage portions 8 are provided. Hereinafter, when individually identifying the four liquid storage portions 8, the four liquid storage portions 8 will be respectively denoted as the liquid storage portion 8A, the liquid storage portion 8B, the liquid storage portion 8C, and the liquid storage portion 8D.

The casing 6 and the scanner unit 5 constitute the outer shell of the liquid ejection system 1. Note that the liquid ejection system 1 can also have a configuration that omits the scanner unit 5. The tank 7 is one example of a liquid storage container. The liquid ejection system 1 can perform printing on a recording medium P such as a recording sheet using ink as one example of a liquid.

FIG. 1 includes X, Y, and Z axes that are mutually orthogonal coordinate axes. The X, Y, and Z axes are included as necessary in the other figures referenced below as well. In such cases, the X, Y, and Z axes in these figures correspond to the X, Y, and Z axes in FIG. 1. In this embodiment, a state in which the liquid ejection system 1 is arranged on a horizontal plane defined by the X axis and the Y axis (i.e., the XY plane) is the in-use state of the liquid ejection system 1. The orientation of the liquid ejection system 1 when the liquid ejection system 1 is arranged on the XY plane will be referred to as the in-use orientation of the liquid ejection system 1.

The terms "X axis", "Y axis", and "Z axis" used to indicate constituent parts and units of the liquid ejection system 1 in the figures and descriptions given below refer to the X axis, the Y axis, and the Z axis in a state in which the constituent parts and units have been incorporated (mounted) in the liquid ejection system 1. Also, the orientations of the constituent parts and units in the in-use orientation of the liquid ejection system 1 will be referred to as the in-use orientations of the constituent parts and units. Moreover, the descriptions of the liquid ejection system 1, the constituent parts and units thereof, and the like given below are assumed to be descriptions in the in-use orientations thereof unless particularly stated otherwise.

The Z axis is the axis that is orthogonal to the horizontal plane. In the in-use state of the liquid ejection system 1, the Z axis direction is the vertically upward direction. Also, in the in-use state of the liquid ejection system 1, the −Z axis direction is the vertically downward direction in FIG. 1. Note that the directions of the arrows on the X, Y, and Z axes indicate + (positive) directions, and the directions opposite to the arrow directions indicate − (negative) directions.

Note that the four liquid storage portions 8 mentioned above are arranged side-by-side along the Y axis. For this reason, the Y axis direction can also be defined as the direction along which the four liquid storage portions 8 are aligned. Also, the liquid storage portion 8A, the liquid storage portion 8B, the liquid storage portion 8C, and the liquid storage portion 8D are arranged side-by-side in the stated order beginning from the −Y axis direction. In other words, among the four liquid storage portions 8, the liquid storage portion 8A is located the farthest on the −Y axis direction side. The liquid storage portion 8B is located on the Y axis direction side of the liquid storage portion 8A. The liquid storage portion 8C is located on the Y axis direction side of the liquid storage portion 8B. The liquid storage portion 8D is located on the Y axis direction side of the liquid storage portion 8C.

Figure 2:
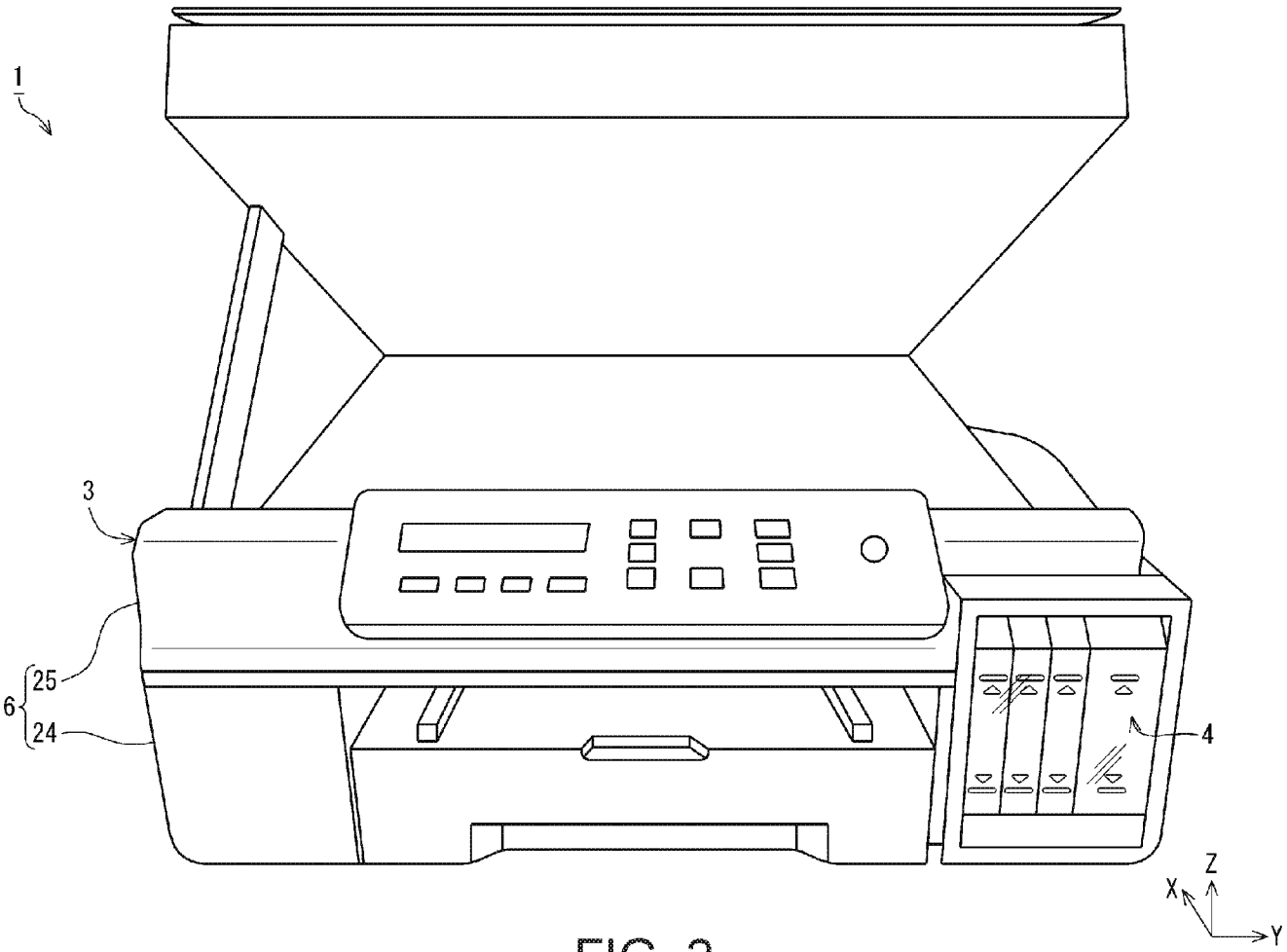
FIG. 2 is a perspective view of the relevant configuration of the liquid ejection system according to the first embodiment.

In the liquid ejection system 1, the printer 3 and the scanner unit 5 are overlapped with each other. When the printer 3 is used, the scanner unit 5 is located vertically above the printer 3. The scanner unit 5 is a flatbed type of scanner unit, and has an image pickup device (not shown) such as an image sensor. The scanner unit 5 can read images and the like recorded on a medium such as a sheet, as image data via the image pickup device. For this reason, the scanner unit 5 functions as a reading apparatus for reading images and the like. The scanner unit 5 is configured to be capable of pivoting relative to the printer 3. The scanner unit 5 also functions as a cover for the printer 3. As shown in FIG. 2, an operator can pivot the scanner unit 5 relative to the printer 3 by lifting the scanner unit 5 in the Z axis direction. Accordingly, the scanner unit 5 that functions as a cover for the printer 3 can be opened relative to the printer 3.

As shown in FIG. 1, the printer 3 is provided with a sheet discharge portion 11. A recording medium P is discharged from the sheet discharge portion 11 of the printer 3. The surface of the printer 3 on which the sheet discharge portion 11 is provided is considered to be a front surface 13 of the printer 3. The liquid ejection system 1 also has an upper surface 15 that intersects the front surface 13, and a side portion 19 that intersects the front surface 13 and the upper surface 15. The ink supply apparatus 4 is provided on the side portion 19 side of the printer 3. The casing 6 is provided with a window portion 21. The window portion 21 is provided in the front surface 13 of the casing 6.

The window portion 21 has translucency. Also, the tank 7 is provided at a position that is overlapped with the window portion 21. For this reason, the operator who is using the liquid ejection system 1 can view the tank 7 through the window portion 21. In this embodiment, the window portion 21 is provided as an opening formed in the casing 6. Also, the window portion 21 provided as an opening is blocked with a member 22 that has translucency. For this reason, the operator can view the tank 7 through the window portion 21, which is an opening. Note that it is also possible to employ a configuration that omits the member 22 that blocks the window portion 21. Even if the member 22 that blocks the window portion 21 is omitted, the operator can view the tank 7 through the window portion 21, which is an opening.

In this embodiment, at least a portion of the section of the tank 7 that faces the window portion 21 has translucency. The ink in the liquid storage portions 8 of the tank 7 can be viewed through the section of the tank 7 that has translucency. Accordingly, by viewing the four liquid storage portions 8 through the window portion 21, the operator can view the amount of ink in the liquid storage portions 8. In other words, at least a portion of the section of the tank 7 that faces the window portion 21 can be utilized as a viewing portion that allows viewing of the amount of ink.

The casing 6 has a cover 23. The cover 23 is configured to be able to pivot in an R1 direction in the figure relative to the casing 6. The cover 23 is provided on the front surface 13 of the printer 3. In a view of the printer 3 in the X axis direction, the cover 23 is provided at a position that is overlapped with the tank 7 on the front surface 13 of the printer 3. When the cover 23 is pivoted in the R1 direction in the figure relative to the casing 6, the cover 23 is opened relative to the casing 6. By opening the cover 23 relative to the casing 6, the operator can access the liquid injection portions (described later) of the tank 7 from outside the casing 6.

Also, as shown in FIG. 2, the casing 6 includes a first casing 24 and a second casing 25. The first casing 24 and the second casing 25 are overlapped with each other along the Z axis. The first casing 24 is located on the −Z axis direction side of the second casing 25. The tank 7, a mechanism unit (described later), and the like are stored between the first casing 24 and the second casing 25. In other words, the tank 7 and the mechanism unit are covered by the casing 6. For this reason, the tank 7 and the mechanism unit can be protected by the casing 6.

Figure 3:
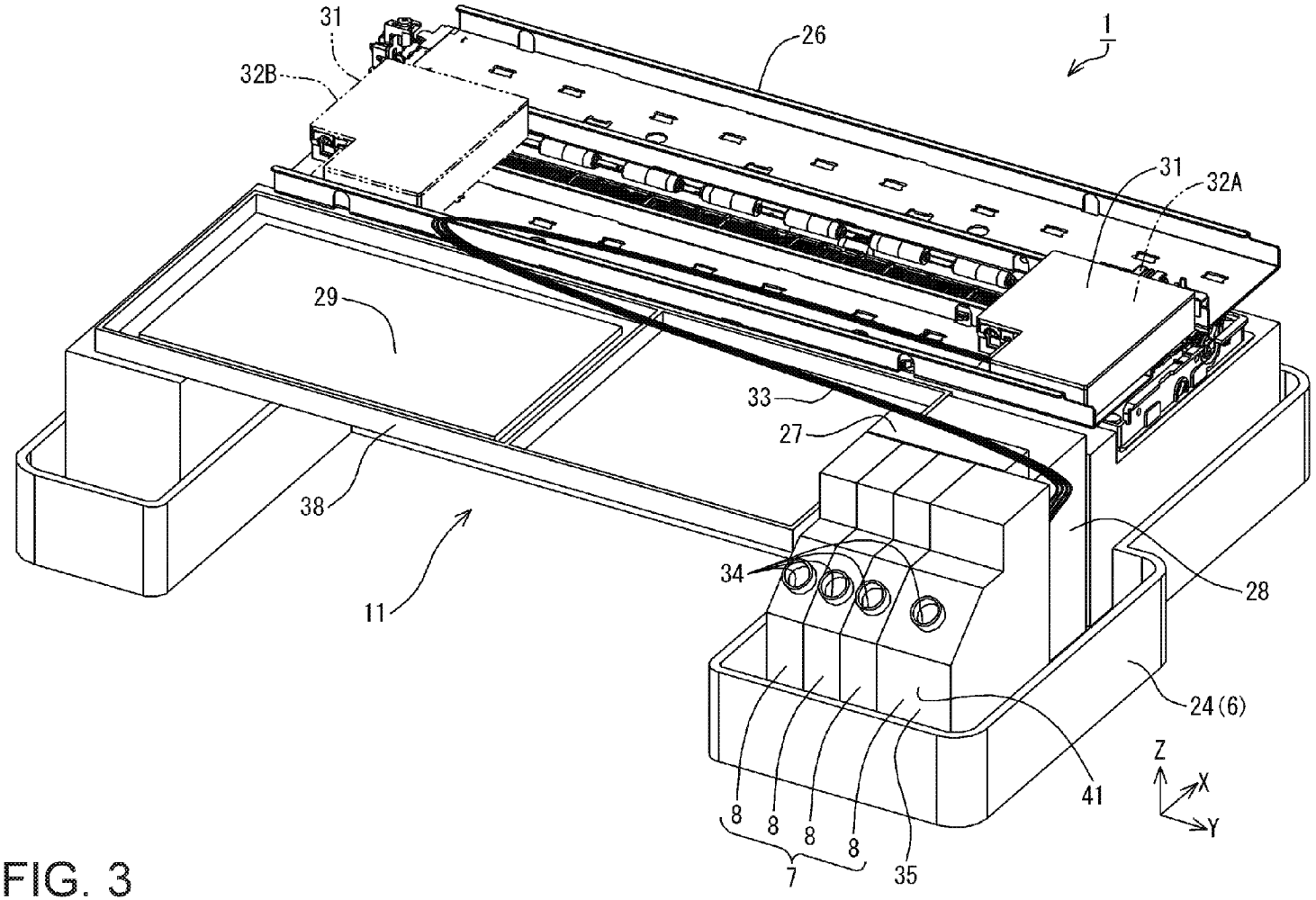
FIG. 3 is a perspective view of the relevant configuration of the liquid ejection system according to the first embodiment.

When the scanner unit 5 and the second casing 25 are detached from the liquid ejection system 1, the tank 7, a mechanism unit 26, and the like are exposed, as shown in FIG. 3. Besides the tank 7 and the mechanism unit 26, a buffer unit 27, a waste liquid absorbing unit 28, an electrical wiring board 29, and the like are also arranged inside the casing 6. The buffer unit 27 is connected to the tank 7, and constitutes a portion of a later-described air introduction portion. The waste liquid absorbing unit 28 includes an absorbing material that is capable of absorbing ink discharged from a recording portion 31 of the mechanism unit 26. A control circuit, which is for controlling the driving of the liquid ejection system 1, electrical components, electronic components, and the like are mounted on the electrical wiring board 29. The control circuit, electrical components, electronic components, and the like are electrically wired to each other on the electrical wiring board 29. The electrical wiring board 29 has the functionality of a control unit that controls the driving of the liquid ejection system 1.

The mechanism unit 26 has a recording portion 31. The mechanism unit 26 also has a conveying apparatus (not shown) that conveys the recording medium P in the −X axis direction, a moving apparatus (not shown) that moves the recording portion 31 back and forth along the Y axis, and the like. Due to the moving apparatus, the recording portion 31 can move back and forth along the Y axis between a first standby position 32A and a second standby position 32B. In this embodiment, the region between the first standby position 32A and the second standby position 32B is the mobility region of the recording portion 31. In the printer 3, the recording portion 31 is covered by the casing 6. Accordingly, the recording portion 31 can be protected by the casing 6.

Ink in the tank 7 is supplied to the recording portion 31 via ink supply tubes 33. The recording portion 31 is provided with a recording head (not shown), which is one example of a liquid ejection head. Nozzle openings (not shown) that face the recording medium P are formed in the recording head. Ink supplied from the tank 7 to the recording portion 31 via the ink supply tubes 33 is supplied to the recording head. The ink supplied to the recording portion 31 is then discharged as ink droplets from the nozzle openings of the recording head toward the recording medium P. Note that although the printer 3 and the ink supply apparatus 4 are described as individual configurations in the above example, the ink supply apparatus 4 can also be included in the configuration of the printer 3.

A maintenance apparatus (not shown) for maintaining the properties of the recording head is provided at a location that faces the recording head of the recording portion 31 at the first standby position 32A. The maintenance apparatus includes a suction apparatus that can suction ink from the recording head. Ink suctioned from the recording head by the suction apparatus is absorbed by and held by the absorbing material of the waste liquid absorbing unit 28. The waste liquid absorbing unit 28 has a function for holding ink discharged from the recording head as waste liquid.

In the liquid ejection system 1 having the above-described configuration, recording is performed on the recording medium P by causing the recording head of the recording portion 31 to discharge ink droplets at predetermined positions on the recording medium P while conveying the recording medium P in the −X axis direction as well as moving the recording portion 31 back and forth along the Y axis. Note that in this embodiment, the tank 7 of the ink supply apparatus 4 has multiple (four) liquid storage portions 8. However, the number of liquid storage portions 8 is not limited to four, and the number of liquid storage portions that are employed can be three, a number lower than three, or a number greater than four.

Here, the term "direction along the X axis" is not limited to a direction that is completely parallel with the X axis, and also encompasses directions that are inclined relative to the X axis by a margin of error, a tolerance, or the like, while excluding a direction that is orthogonal to the X axis. Similarly, the term "direction along the Y axis" is not limited to a direction that is completely parallel with the Y axis, and also encompasses directions that are inclined relative to the Y axis by a margin of error, a tolerance, or the like, while excluding a direction that is orthogonal to the Y axis. The term "direction along the Z axis" is not limited to a direction that is completely parallel with the Z axis, and also encompasses directions that are inclined relative to the Z axis by a margin of error, a tolerance, or the like, while excluding a direction that is orthogonal to the Z axis. In other words, directions along any axis or plane are not limited to directions that are completely parallel to such axes or planes, and also encompass directions that are inclined relative to such axes or planes by a margin of error, a tolerance, or the like, while excluding directions that are orthogonal to such axes or planes.

The ink is not limited to being either water-based ink or oil-based ink. Also, water-based ink may have a configuration in which a solute such as a dye is dissolved in an aqueous solvent, or may have a configuration in which a dispersoid such as a pigment is dispersed in an aqueous dispersion medium. Also, oil-based ink may have a configuration in which a solute such as a dye is dissolved in an oil-based solvent, or may have a configuration in which a dispersoid such as a pigment is dispersed in an oil-based dispersion medium.

Furthermore, sublimation transfer ink can be used as the ink. Sublimation transfer ink is ink that includes a sublimation color material such as a sublimation dye. One example of a printing method is a method in which sublimation transfer ink is ejected onto a transfer medium by a liquid ejection device, a printing target is brought into contact with the transfer medium and heated to cause the color material to sublimate and be transferred to the printing target. The printing target is a T-shirt, a smartphone, or the like. In this way, if the ink includes a sublimation color material, printing can be performed on a diverse range of printing targets (printing media).

As shown in FIG. 3, the tank 7 is provided with a liquid injection portion 34 for each of the liquid storage portions 8. With the tank 7, ink can be injected into the tank 7 from outside the tank 7 via the liquid injection portions 34. As previously described, in the liquid ejection system 1 shown in FIG. 1, the operator can access the liquid injection portions 34 of the tank 7 from outside the casing 6 by opening the cover 23 relative to the casing 6. Also, the surface of the tank 7 that faces the −X axis direction is set as a viewing surface 35. The viewing surface 35 faces the window portion 21. The operator can view the amount of ink in each of the liquid storage portions 8 by viewing the viewing surface 35 of the tank 7 through the window portion 21.

In this embodiment, caps (not shown) are attached to the liquid injection portions 34 in the state where the liquid ejection system 1 is used in printing. The caps are configured to be able to be attached to and detached from the tank 7. When injecting ink into the tank 7, the operator detaches a cap to free a liquid injection portion 34, and then the operator can inject ink into the liquid injection portion 34.

Note that as shown in FIG. 1, the tank 7 can also have a configuration in which upper limit marks 36, lower limit marks 37, and the like are provided on the viewing surface 35 that enables viewing of the stored amount of ink. In this embodiment, the upper limit mark 36 and the lower limit mark 37 are provided for each of the liquid storage portions 8. The operator can find out of the amount of ink in the tank 7 by using the upper limit mark 36 and the lower limit mark 37 as a guide. Note that the upper limit mark 36 indicates a guide regarding the amount of ink that can be injected through the liquid injection portion 34 without overflowing from the liquid injection portion 34. Also, the lower limit mark 37 indicates a guide regarding an ink amount for prompting ink injection. There is no limitation to a configuration in which both the upper limit marks 36 and the lower limit marks 37 are provided, and a configuration can be employed in which only either the upper limit marks 36 or the lower limit marks 37 are provided on the tank 7.

Figure 4:
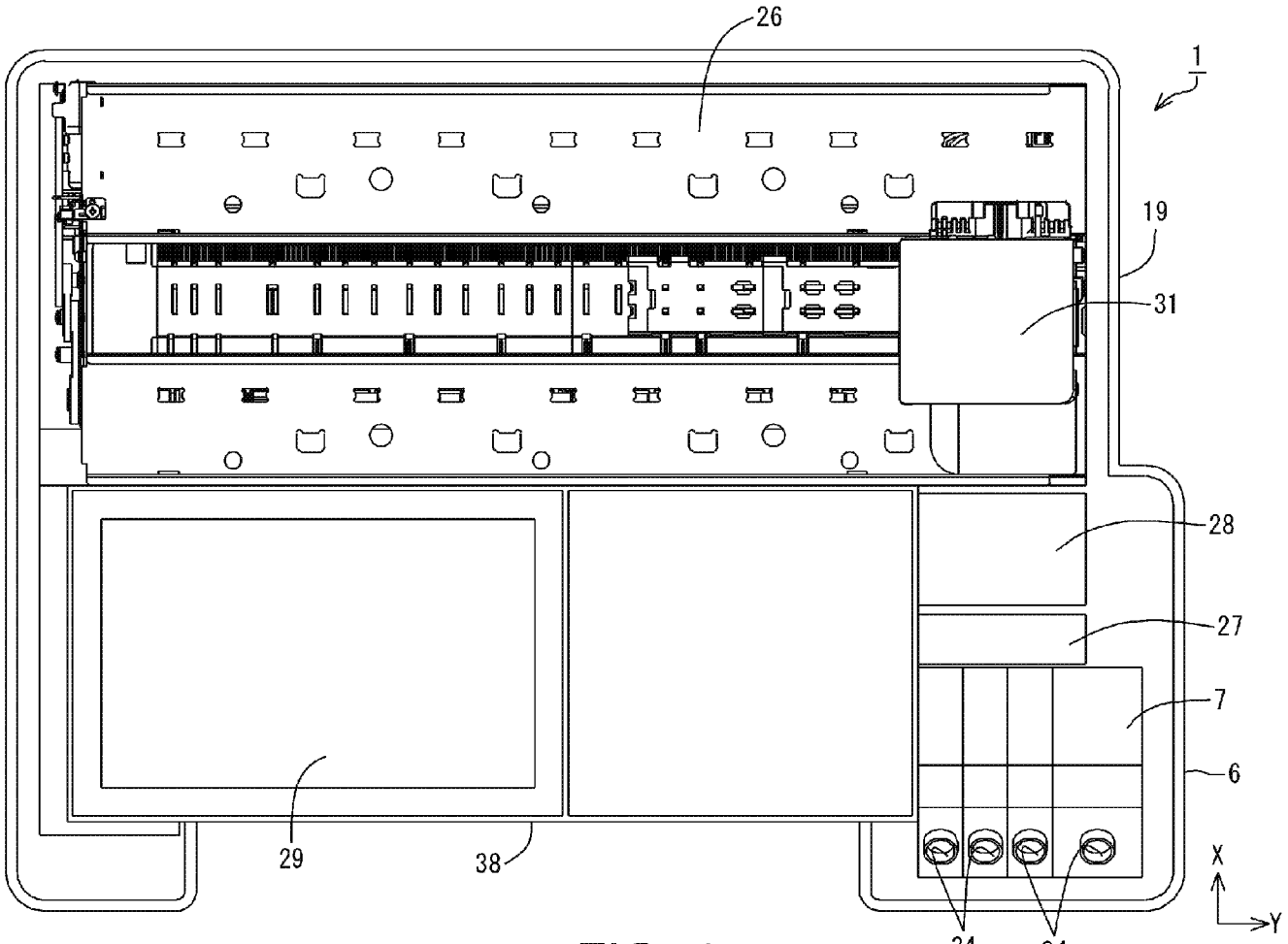
FIG. 4 is a plan view of the relevant configuration of the liquid ejection system according to the first embodiment.

In a plan view of the liquid ejection system 1 in a plan view from the Z axis direction to the −Z axis direction, as shown in FIG. 4, the mechanism unit 26 is arranged on the X axis direction side of the tank 7, the buffer unit 27, the waste liquid absorbing unit 28, and the electrical wiring board 29. In other words, the mechanism unit 26 is arranged the farthest on the X axis direction side among these members. The tank 7 is arranged on the −X axis direction side of the mechanism unit 26. The buffer unit 27 is arranged on the −X axis direction side of the mechanism unit 26, and on the X axis direction side of the tank 7.

The waste liquid absorbing unit 28 is arranged on the −X axis direction side of the mechanism unit 26, and on the X axis direction side of the buffer unit 27. The tank 7, the buffer unit 27, and the waste liquid absorbing unit 28 are arranged side-by-side along the X axis in the stated order beginning from the −X axis direction. The electrical wiring board 29 is arranged on the −X axis direction side of the mechanism unit 26, and on the −Y axis direction side of the tank 7, the buffer unit 27, and the waste liquid absorbing unit 28. The electrical wiring board 29 is arranged on a board tray 38. The region on the −Z axis direction side of the board tray 38 is set as a region for the sheet discharge portion 11 (FIG. 3).

Here, as shown in FIG. 4, the positions of the liquid injection portions 34 in the X axis direction in the tank 7 are biased to one side relative to the tank 7. In other words, the liquid injection portions 34 of the tank 7 are arranged at biased positions on the tank 7. Also, the side of the tank 7 on which the liquid injection portions 34 are located is defined as the front surface side. Based on this definition, as shown in FIG. 3, the surface of the tank 7 that is located the farthest on the −X axis direction side is considered to be a front surface 41. Also, the viewing surface 35 of the tank 7 is located on the front surface 41 side. For this reason, the viewing surface 35 of the tank 7 corresponds to the front surface 41.

In this embodiment, the front surface 41 of the tank 7 faces the −X axis direction. In the liquid ejection system 1 of this embodiment, the direction from the front surface 41 side toward the opposite side of the tank 7 is defined as the X axis direction. Also, the vertically upward direction in the in-use orientation of the tank 7 is defined as the Z axis direction. Moreover, the direction orthogonal to both the X axis direction and the Z axis direction is defined as the Y axis direction. The X axis direction corresponds to the X direction, the Y axis direction corresponds to the Y direction, and the Z axis direction corresponds to the Z direction. Note that in this embodiment, the buffer unit 27 can be considered to be arranged on the side opposite to the front surface 41 side of the tank 7. Also, in this embodiment, a configuration can be employed in which the Y axis direction and −Y axis direction are reversed.

Various working examples of the tank 7 and the buffer unit 27 will be described below. Note that in order to identify the tank 7 and the buffer unit 27 in the respective working examples below, different alphabet letters, signs, and the like are appended to reference signs for the tank 7 and the buffer unit 27 in each working example.

First Working Example

Figure 5:
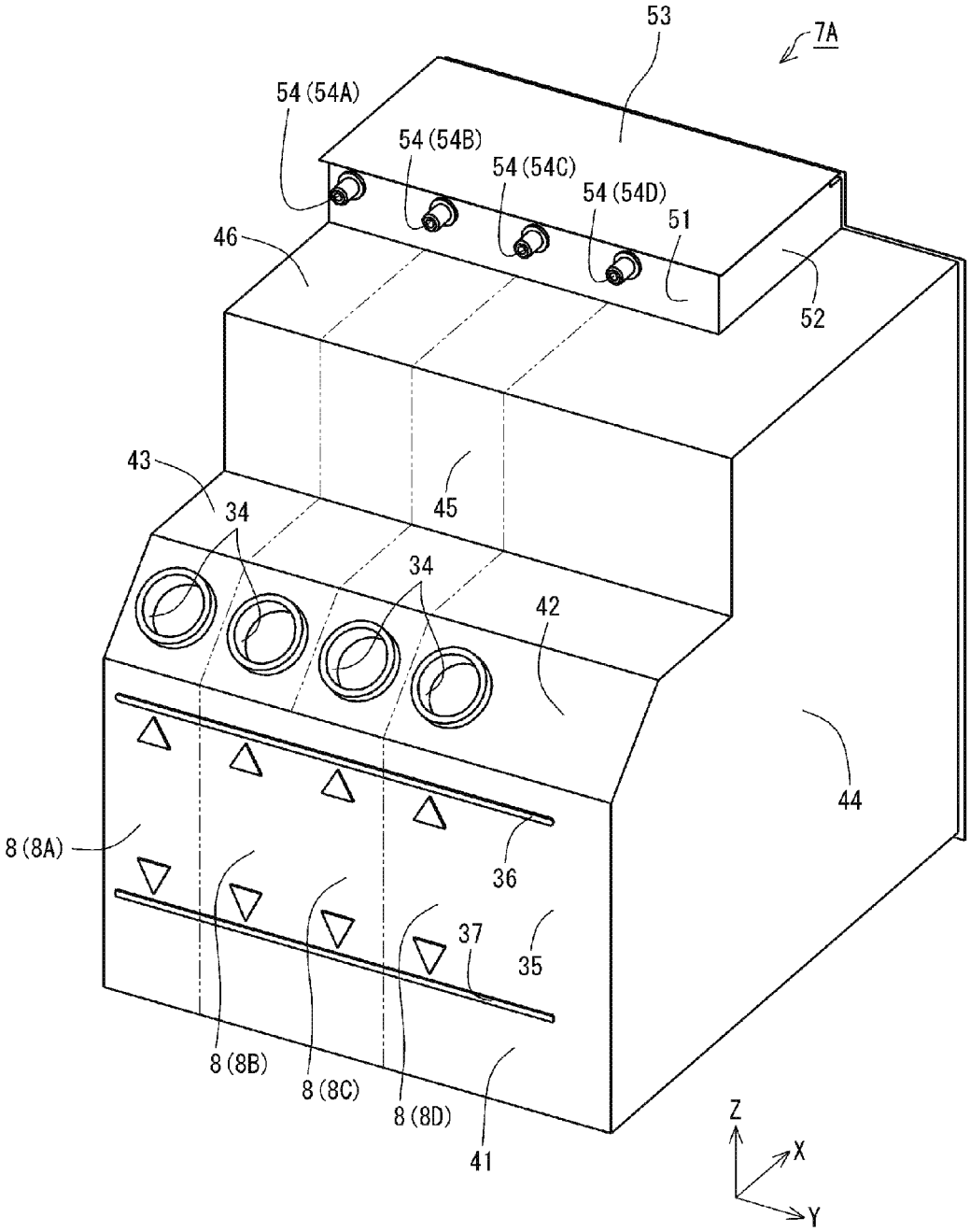
FIG. 5 is a perspective view of a tank in a first working example.
Figure 6:
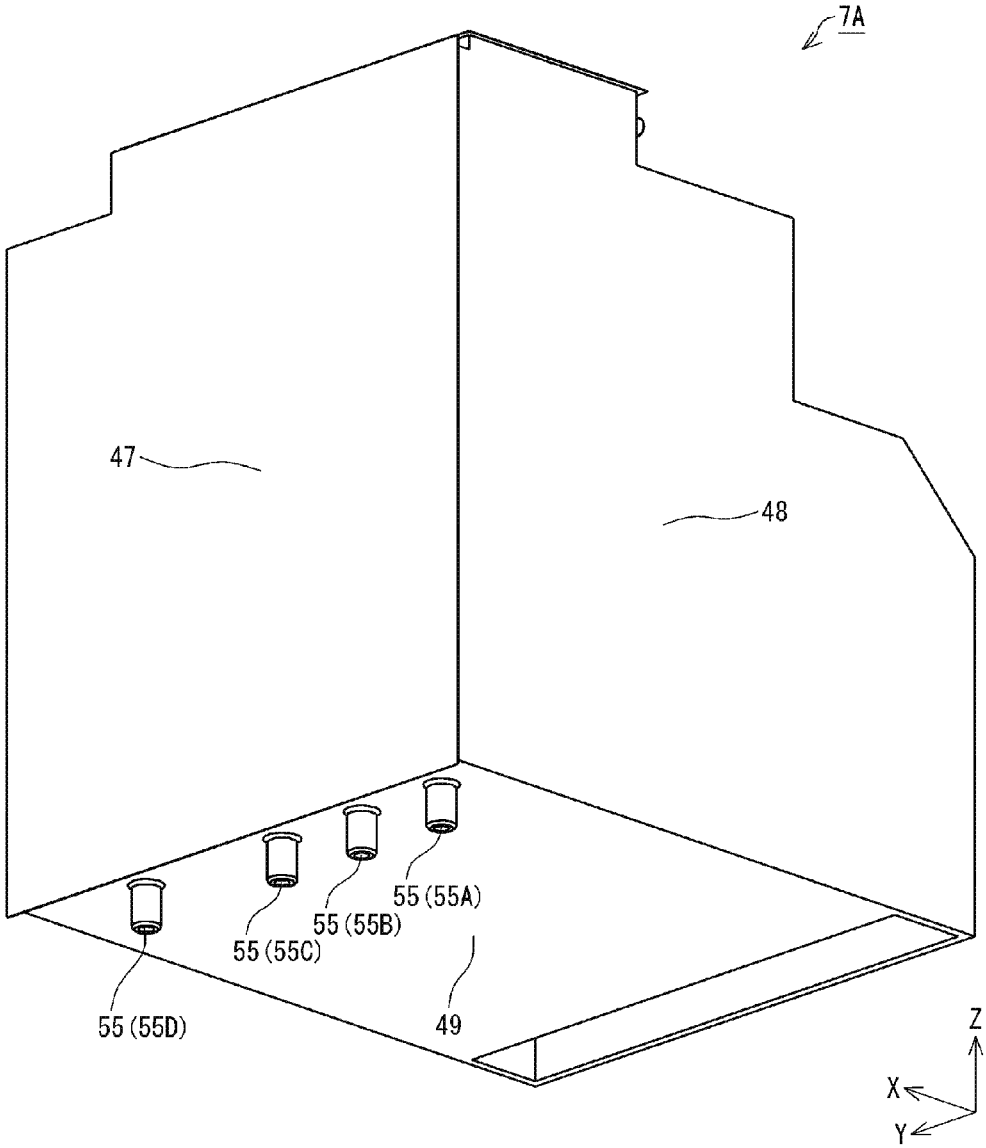
FIG. 6 is a perspective view of the tank in the first working example.

As shown in FIG. 5, a tank 7A of a first working example has the front surface 41, an inclined surface 42, an upper surface 43, a side surface 44, a side surface 45, and an upper surface 46. The front surface 41, the inclined surface 42, the upper surface 43, the side surface 44, the side surface 45, and the upper surface 46 are surfaces of the tank 7A that face outward. As previously described, the front surface 41 is set as the viewing surface 35. Also, as shown in FIG. 6, the tank 7A has a rear surface 47, a side surface 48, and a lower surface 49. The rear surface 47, the side surface 48, and the lower surface 49 are surfaces of the tank 7A that face outward.

As shown in FIG. 5, the inclined surface 42 is located on the Z axis direction side of the front surface 41. The front surface 41 extends along the YZ plane. The inclined surface 42 intersects both the YZ plane and the XY plane. The inclined surface 42 is inclined so as to rise in the Z axis direction as it extends in the X axis direction. The end portion, on the −Z axis direction side, of the inclined surface 42 intersects the front surface 41. The four liquid injection portions 34 are provided in the inclined surface 42.

The upper surface 43 is located on the X axis direction side of the inclined surface 42. The upper surface 43 extends along the XY plane. The upper surface 43 faces the Z axis direction. The end portion, on the −X axis direction side, of the upper surface 43 intersects the inclined surface 42. The end portion, on the Z axis direction side, of the inclined surface 42 intersects the upper surface 43. For this reason, the inclined surface 42 is interposed between the front surface 41 and the upper surface 43.

The side surface 44 is located on the Y axis direction side of the front surface 41, the inclined surface 42, the upper surface 43, the side surface 45, and the upper surface 46. The side surface 44 extends along the XZ plane. The side surface 44 faces the Y axis direction. The side surface 44 intersects the front surface 41, the inclined surface 42, the upper surface 43, the side surface 45, and the upper surface 46. The side surface 45 is located on the X axis direction side of the upper surface 43. The side surface 45 extends along the YZ plane. The side surface 45 faces the −X axis direction. The end portion, on the −Z axis direction side, of the side surface 45 intersects the upper surface 43.

The upper surface 46 is located on the Z axis direction side of the side surface 45. The upper surface 46 extends along the XY plane. The upper surface 46 faces the Z axis direction. The end portion, on the −X axis direction side, of the upper surface 46 intersects the side surface 45. According to the above-described configuration, the side surface 45 is interposed between the upper surface 43 and the upper surface 46. Also, the upper surface 43 is interposed between the inclined surface 42 and the side surface 45.

As shown in FIG. 6, the side surface 48 faces the −Y axis direction. The side surface 48 extends along the XZ plane. The side surface 48 is located on the side opposite to the side surface 44 (FIG. 5). The side surface 48 intersects the front surface 41, the inclined surface 42, the upper surface 43, the side surface 45, and the upper surface 46 on the side opposite to the side surface 44 (FIG. 5).

As shown in FIG. 6, the rear surface 47 faces the X axis direction. The rear surface 47 extends along the YZ plane. The rear surface 47 is located on the side opposite to the front surface 41 (FIG. 5). For this reason, the front surface 41 and rear surface 47 have a mutually opposing surface relationship. The rear surface 47 intersects the side surface 44, the upper surface 46, and the side surface 48 (FIG. 6) on the side opposite to the front surface 41 (FIG. 5).

As shown in FIG. 6, the lower surface 49 faces the −Z axis direction. The lower surface 49 extends along the XY plane. The lower surface 49 is located on the −Z axis direction side of the rear surface 47, the side surface 48, the front surface 41 (FIG. 5), and the side surface 44. The lower surface 49 intersects the rear surface 47, the side surface 48, the front surface 41 (FIG. 5), and the side surface 44 on the −Z axis direction side of the rear surface 47, the side surface 48, the front surface 41 (FIG. 5), and the side surface 44.

Also, as shown in FIG. 5, the tank 7A has a front surface 51, a side surface 52, and an upper surface 53 on the Z axis direction side of the upper surface 46. The front surface 51 is located on the X axis direction side of the side surface 45, and extends along the YZ plane. The front surface 51 faces the −X axis direction. The front surface 51 intersects the upper surface 46. The side surface 52 is located on the −Y axis direction side of the side surface 44, and extends along the XZ plane. The side surface 52 faces the Y axis direction. The side surface 52 intersects the upper surface 46 and the front surface 51.

The upper surface 53 is located on the Z axis direction side of the upper surface 46, and extends along the XY plane. The upper surface 53 faces the Z axis direction. The upper surface 53 intersects the front surface 51 and the side surface 52. The upper surface 53 also intersects the rear surface 47 (FIG. 6) and the side surface 48. Note that another flat surface, curved surface, or the like may be interposed between two surfaces that intersect each other among the front surface 41, the inclined surface 42, the upper surface 43, the side surface 44, the side surface 45, the upper surface 46, the rear surface 47, the side surface 48, the lower surface 49, the front surface 51, the side surface 52, and the upper surface 53.

Note that the term "surface extending along the XZ plane" is not limited to a surface that extends completely parallel to the XZ plane, and also encompasses surfaces that are inclined relative to the XZ plane by a margin of error, a tolerance, or the like, while excluding a surface that is orthogonal to the XZ plane. Similarly, the term "surface extending along the YZ plane" is not limited to a surface that extends completely parallel to the YZ plane, and also encompasses surfaces that are inclined relative to the YZ plane by a margin of error, a tolerance, or the like, while excluding a surface that is orthogonal to the YZ plane. The term "surface extending along the XY plane" is not limited to a surface that extends completely parallel to the XY plane, and also encompasses surfaces that are inclined relative to the XY plane by a margin of error, a tolerance, or the like, while excluding a surface that is orthogonal to the XY plane. Also, the front surface 41, the inclined surface 42, the upper surface 43, the side surface 44, the side surface 45, the upper surface 46, the rear surface 47, the side surface 48, the lower surface 49, the front surface 51, the side surface 52, and the upper surface 53 are not limited to being flat surfaces, and may include unevenness, a step, or the like.

Also, the term "two surfaces intersect" refers to a positional relationship in which two surfaces are not parallel to each other. Besides the case where the two surfaces are directly in contact with each other, even in a positional relationship where two surfaces are separated from each other rather than being in direct contact, it can be said that the two surfaces intersect if an extension of the plane of one surface intersects an extension of the plane of the other surface. The angle formed by the two intersecting surfaces may be a right angle, an obtuse angle, or an acute angle.

As shown in FIG. 5, four communication portions 54 are provided in the front surface 51 of the tank 7A. The four communication portions 54 protrude from the front surface 51 in the −X axis direction. Hereinafter, when individually identifying the four communication portions 54, the four communication portions 54 will be respectively denoted as the communication portion 54A, the communication portion 54B, the communication portion 54C, and the communication portion 54D. The four communication portions 54 are arranged side-by-side along the Y axis. Among the four communication portions 54, the communication portion 54A is located the farthest on the −Y axis direction side. The communication portion 54B is located on the Y axis direction side of the communication portion 54A. The communication portion 54C is located on the Y axis direction side of the communication portion 54B. The communication portion 54D is located on the Y axis direction side of the communication portion 54C.

The four communication portions 54 are each in communication with the interior of the tank 7A. The four communication portions 54 are respectively in communication with the liquid storage portions 8 of the tank 7A. One communication portion 54 is provided for each liquid storage portion 8 in the tank 7A. The communication portion 54A corresponds to the liquid storage portion 8A, the communication portion 54B corresponds to the liquid storage portion 8B, the communication portion 54C corresponds to the liquid storage portion 8C, and the communication portion 54D corresponds to the liquid storage portion 8D. In other words, the communication portion 54A is in communication with the liquid storage portion 8A, the communication portion 54B is in communication with the liquid storage portion 8B, the communication portion 54C is in communication with the liquid storage portion 8C, and the communication portion 54D is in communication with the liquid storage portion 8D. The four communication portions 54 are introduction portions for introducing air into the corresponding liquid storage portions 8. In this embodiment, the four communication portions 54 each also function as a connection portion for connection to the buffer unit 27.

Also, as shown in FIG. 6, four liquid supply portions 55 are provided in the lower surface 49 of the tank 7A. The four liquid supply portions 55 protrude from the lower surface 49 in the −Z axis direction. Hereinafter, when individually identifying the four liquid supply portions 55, the four liquid supply portions 55 will be respectively denoted as the liquid supply portion 55A, the liquid supply portion 55B, the liquid supply portion 55C, and the liquid supply portion 55D. The four liquid supply portions 55 are arranged side-by-side along the Y axis. Among the four liquid supply portions 55, the liquid supply portion 55A is located the farthest on the −Y axis direction side. The liquid supply portion 55B is located on the Y axis direction side of the liquid supply portion 55A. The liquid supply portion 55C is located on the Y axis direction side of the liquid supply portion 55B. The liquid supply portion 55D is located on the Y axis direction side of the liquid supply portion 55C.

The four liquid supply portions 55 are each in communication with the interior of the tank 7A. The four liquid supply portions 55 are respectively in communication with the liquid storage portions 8 of the tank 7A. One liquid supply portion 55 is provided for each liquid storage portion 8 in the tank 7A. The liquid supply portion 55A corresponds to the liquid storage portion 8A, the liquid supply portion 55B corresponds to the liquid storage portion 8B, the liquid supply portion 55C corresponds to the liquid storage portion 8C, and the liquid supply portion 55D corresponds to the liquid storage portion 8D. In other words, the liquid supply portion 55A is in communication with the liquid storage portion 8A, the liquid supply portion 55B is in communication with the liquid storage portion 8B, the liquid supply portion 55C is in communication with the liquid storage portion 8C, and the liquid supply portion 55D is in communication with the liquid storage portion 8D. Ink stored in the liquid storage portions 8 of the tank 7A is supplied to the ink supply tubes 33 (FIG. 3) via the liquid supply portions 55.

Figure 7:
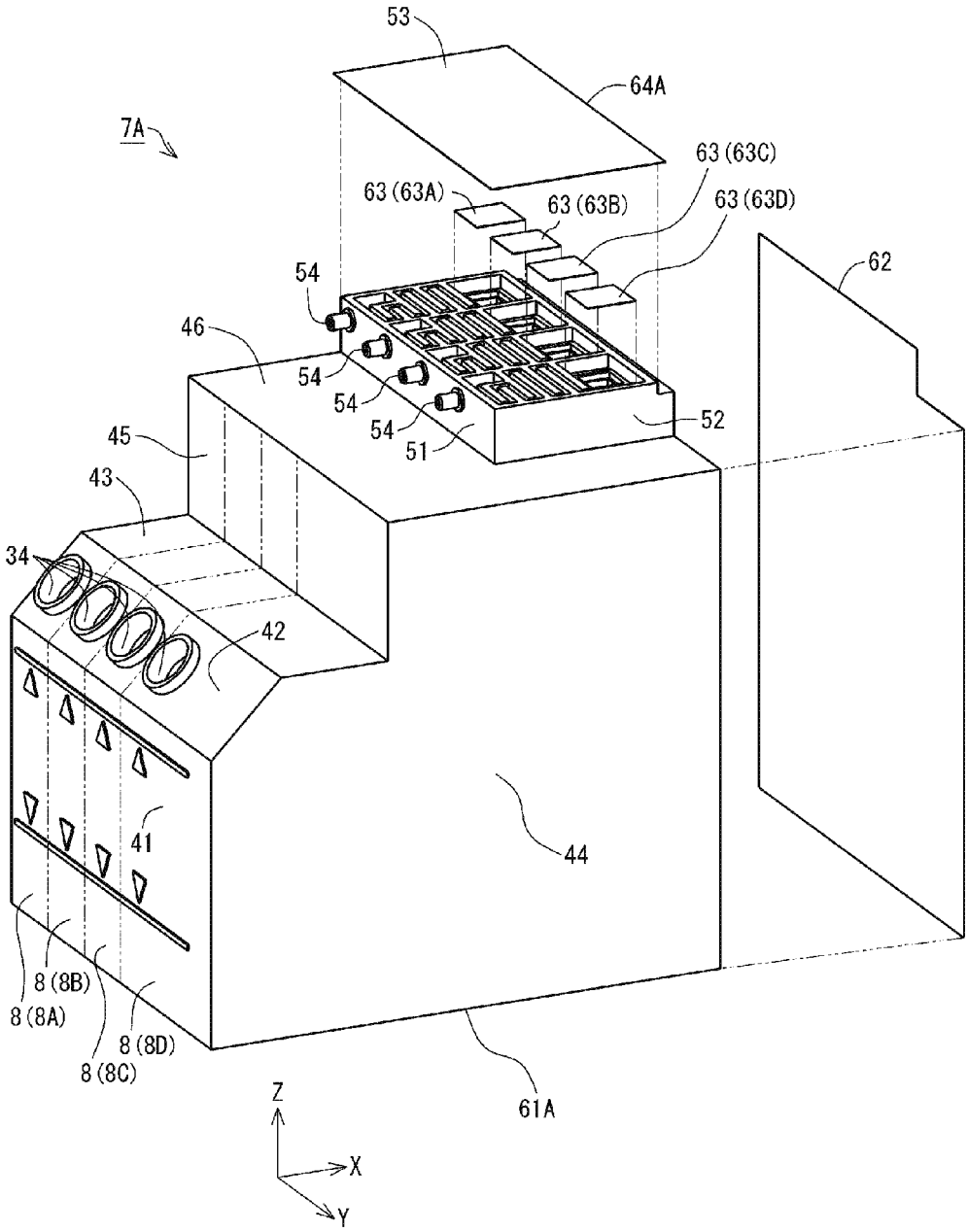
FIG. 7 is an exploded perspective view of the tank in the first working example.

As shown in FIG. 7, the tank 7A has a case 61A, which is one example of a tank main body, a sheet member 62, four waterproof ventilation films 63, and a sheet member 64A. The case 61A is constituted by a synthetic resin such as nylon or polypropylene, for example. Also, the sheet member 62 and the sheet member 64A are each formed in the shape of a film using a synthetic resin (e.g., nylon or polypropylene), and are bendable. In this embodiment, the surface of the sheet member 62 that faces the X axis direction corresponds to the rear surface 47 (FIG. 6) of the tank 7A. Also, the surface of the sheet member 64A that faces the Z axis direction corresponds to the upper surface 53 (FIG. 5) of the tank 7A.

In the tank 7A, the sheet member 62 is located on the X axis direction side of the case 61A. The sheet member 64A is located on the Z axis direction side of the case 61A. The four waterproof ventilation films 63 are interposed between the sheet member 64A and the case 61A. The four waterproof ventilation films 63 are constituted by a material that is highly waterproof with respect to liquids (i.e., has a low liquid permeability) and has a high air permeability, and are formed in the shape of films. Hereinafter, when individually identifying the four waterproof ventilation films 63, the four waterproof ventilation films 63 will be respectively denoted as the waterproof ventilation film 63A, the waterproof ventilation film 63B, the waterproof ventilation film 63C, and the waterproof ventilation film 63D.

The four waterproof ventilation films 63 are arranged side-by-side along the Y axis. Among the four waterproof ventilation films 63, the waterproof ventilation film 63A is located the farthest on the −Y axis direction side. The waterproof ventilation film 63B is located on the Y axis direction side of the waterproof ventilation film 63A. The waterproof ventilation film 63C is located on the Y axis direction side of the waterproof ventilation film 63B. The waterproof ventilation film 63D is located on the Y axis direction side of the waterproof ventilation film 63C.

One waterproof ventilation film 63 is provided for each liquid storage portion 8 in the tank 7A. The waterproof ventilation film 63A corresponds to the liquid storage portion 8A, the waterproof ventilation film 63B corresponds to the liquid storage portion 8B, the waterproof ventilation film 63C corresponds to the liquid storage portion 8C, and the waterproof ventilation film 63D corresponds to the liquid storage portion 8D.

Figure 8:
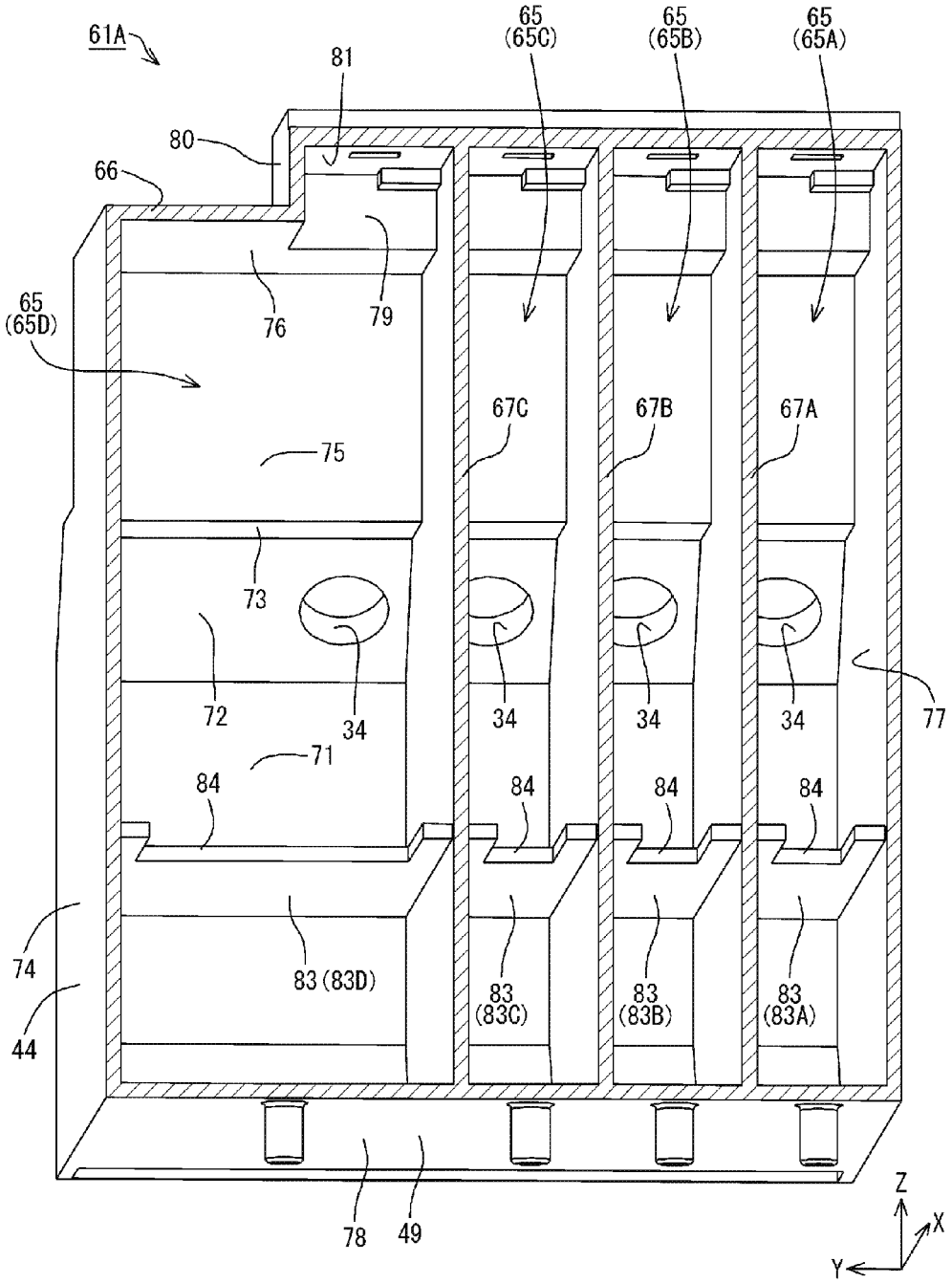
FIG. 8 is a perspective view of a case of the tank in the first working example.

As shown in FIG. 8, four recessed portions 65 are formed in the case 61A. The four recessed portions 65 are each formed so as to recede in the −X axis direction. Also, the four recessed portions 65 are each open in the X axis direction. Hereinafter, when individually identifying the four recessed portions 65, the four recessed portions 65 will be respectively denoted as the recessed portion 65A, the recessed portion 65B, the recessed portion 65C, and the recessed portion 65D. The four recessed portions 65 are arranged side-by-side along the Y axis. Among the four recessed portions 65, the recessed portion 65A is located the farthest on the −Y axis direction side. The recessed portion 65B is located on the Y axis direction side of the recessed portion 65A. The recessed portion 65C is located on the Y axis direction side of the recessed portion 65B. The recessed portion 65D is located on the Y axis direction side of the recessed portion 65C.

Also, the case 61A is provided with a joining portion 66. The joining portion 66 is hatched in FIG. 8 in order to facilitate understanding of the configuration. The sheet member 62 (FIG. 7) is joined to the joining portion 66. In this embodiment, the case 61A and the sheet member 62 are joined by adhesion. When the sheet member 62 is joined to the case 61A, the four recessed portions 65 are blocked by the sheet member 62. The spaces enclosed by the sheet member 62 and the four recessed portions 65 constitute the liquid storage portions 8. Among the four recessed portions 65, the recessed portion 65A constitutes the liquid storage portion 8A, the recessed portion 65B constitutes the liquid storage portion 8B, the recessed portion 65C constitutes the liquid storage portion 8C, and the recessed portion 65D constitutes the liquid storage portion 8D. Ink is stored in each of the liquid storage portions 8.

The liquid storage portion 8A and the liquid storage portion 8B are separated from each other by a partition wall 67A. The liquid storage portion 8B and the liquid storage portion 8C are separated from each other by a partition wall 67B. The liquid storage portion 8C and the liquid storage portion 8D are separated from each other by a partition wall 67C. Accordingly, the four liquid storage portions 8 are separated from each other. For this reason, even if different types of ink are stored in the four liquid storage portion 8, it is possible to avoid the mixing of ink between the liquid storage portions 8. Note that among the four recessed portions 65, the volume of the recessed portion 65D is larger than the volumes of the other recessed portions 65. For this reason, among the four liquid storage portions 8, the amount of ink that can be stored in the liquid storage portion 8D is larger than the amounts of ink that can be stored in the other liquid storage portions 8. This configuration is favorable in the case where, for example, the liquid storage portion 8D stores a type of ink that has a high frequency of use. This is because the type of ink that has a high frequency of use can be stored in a larger amount than the other types of ink.

As shown in FIG. 8, the case 61A has a wall 71, a wall 72, a wall 73, a wall 74, a wall 75, a wall 76, a wall 77, a wall 78, a wall 79, a wall 80, and a wall 81. The wall 71 extends along the YZ plane. Note that the surface of the wall 71 of the case 61A that faces the −X axis direction, that is to say the surface of the wall 71 on the side opposite to the recessed portion 65 side, corresponds to the front surface 41 of the tank 7A shown in FIG. 7.

As shown in FIG. 8, the wall 72 intersects the wall 71. The wall 72 is inclined relative to both the YZ plane and XY plane. The wall 72 protrudes from the wall 71 in the X axis direction and the Z axis direction. The wall 72 is inclined so as to rise in the Z axis direction as it extends from the wall 71 in the X axis direction. The end portion, on the −Z axis direction side, of the wall 72 intersects the wall 71. Note that the four liquid injection portions 34 are provided in the wall 72. Also, the surface of the wall 72 of the case 61A on the side opposite to the recessed portion 65 side corresponds to the inclined surface 42 of the tank 7A shown in FIG. 7.

As shown in FIG. 8, the wall 73 extends along the XY plane. The wall 73 intersects the wall 72. The wall 73 is located on the X axis direction side of the wall 72. The wall 73 extends along the XY plane. The end portion, on the −X axis direction side, of the wall 73 intersects the wall 72. The end portion, on the Z axis direction side, of the wall 72 intersects the wall 73. Accordingly, the wall 72 is interposed between the wall 71 and the wall 73. The surface of the wall 73 of the case 61A on the side opposite to the recessed portion 65 side corresponds to the upper surface 43 of the tank 7A shown in FIG. 7.

As shown in FIG. 8, the wall 74 is located on the Y axis direction side of the wall 71, the wall 72, the wall 73, the wall 75, the wall 76, and the wall 78. The wall 74 extends along the XZ plane. The wall 74 intersects the wall 71, the wall 72, the wall 73, the wall 75, the wall 76, and the wall 78. The wall 71, the wall 72, the wall 73, the wall 75, the wall 76, and the wall 78 protrude from the wall 74 in the −Y axis direction. The surface of the wall 74 on the side opposite to the recessed portion 65 side corresponds to the side surface 44 of the tank 7A shown in FIG. 7.

As shown in FIG. 8, the wall 75 is located on the X axis direction side of the wall 73. The wall 75 extends along the YZ plane. The end portion, on the −Z axis direction side, of the wall 75 intersects the wall 73. The wall 75 protrudes from the wall 73 in the Z axis direction. The surface of the wall 75 on the side opposite to the recessed portion 65 side corresponds to the side surface 45 of the tank 7A shown in FIG. 7.

As shown in FIG. 8, the wall 76 is located on the Z axis direction side of the wall 75. The wall 76 extends along the XY plane. The end portion, on the −X axis direction side, of the wall 76 intersects the wall 75. The wall 76 protrudes from the wall 75 in the X axis direction. According to the above-described configuration, the wall 75 is interposed between the wall 73 and the wall 76. Also, the wall 73 is interposed between the wall 72 and the wall 75. The surface of the wall 76 on the side opposite to the recessed portion 65 side corresponds to the upper surface 46 of the tank 7A shown in FIG. 7.

As shown in FIG. 8, the wall 77 is located on the −Y axis direction side of the wall 71, the wall 72, the wall 73, the wall 75, the wall 76, and the wall 78. The wall 77 opposes the wall 74 with the wall 71, the wall 72, the wall 73, the wall 75, the wall 76, and the wall 78 therebetween. The wall 77 extends along the XZ plane. The wall 77 intersects the wall 71, the wall 72, the wall 73, the wall 75, the wall 76, and the wall 78. The wall 71, the wall 72, the wall 73, the wall 75, the wall 76, and the wall 78 protrude from the wall 77 in the Y axis direction. The surface of the wall 77 on the side opposite to the recessed portion 65 side corresponds to the side surface 48 of the tank 7A shown in FIG. 6.

As shown in FIG. 8, the wall 78 is located on the −Z axis direction side of the wall 71, the wall 74, and the wall 77. The wall 78 extends along the XY plane. The wall 78 intersects the wall 71, the wall 74, and the wall 77. In a plan view of the case 61A in the −X axis direction, the wall 78 opposes the wall 76 with the wall 71, the wall 72, the wall 73, and the wall 75 therebetween. The wall 71, the wall 74, and the wall 77 protrude from the wall 78 in the Z axis direction. The surface of the wall 78 on the side opposite to the recessed portion 65 side corresponds to the lower surface 49 of the tank 7A shown in FIG. 6.

As shown in FIG. 8, the wall 79 extends along the YZ plane. The wall 79 intersects the wall 76. The wall 79 protrudes from the wall 76 in the Z axis direction. The wall 79 is located on the Z axis direction side of the wall 75. The end portion, on the −Z axis direction side, of the wall 79 intersects the wall 76. Also, the end portion, on the −Y axis direction side, of the wall 79 intersects the wall 77. The surface of the wall 79 on the side opposite to the recessed portion 65 side corresponds to the front surface 51 of the tank 7A shown in FIG. 7.

As shown in FIG. 8, the wall 80 extends along the XZ plane. The wall 80 intersects the wall 76 and the wall 79. The wall 80 protrudes from the wall 76 in the Z axis direction. The wall 80 is located on the −Y axis direction side of the wall 74, and is located on the Y axis direction side of the wall 77. The wall 80 protrudes farther in the Z axis direction than the wall 74 does. The wall 80 opposes the wall 77 with the wall 79 therebetween. The surface of the wall 80 on the side opposite to the recessed portion 65 side corresponds to the side surface 52 of the tank 7A shown in FIG. 7.

As shown in FIG. 8, the wall 81 extends along the XY plane. The wall 81 intersects the wall 79, the wall 80, and the wall 77. The wall 81 protrudes from the wall 79 in the X axis direction. The wall 81 is located on the Z axis direction side of the wall 76. In a plan view of the case 61A in the −X axis direction, the wall 81 opposes the wall 78 with the wall 71, the wall 72, the wall 73, the wall 75, the wall 76, and the wall 79 therebetween. The sheet member 64A of the tank 7A shown in FIG. 7 is arranged on the side of the wall 81 that is opposite to the recessed portion 65 side.

According to the above-described configuration, in a plan view of the case 61A in the −X axis direction, the wall 74, the wall 76, the wall 80, the wall 81, the partition wall 67C, and the wall 78 surround the wall 71, the wall 72, the wall 73, the wall 75, and the wall 79. This configures the recessed portion 65D that has the wall 71, the wall 72, the wall 73, the wall 75, and the wall 79 as its bottom.

Also, the partition wall 67C, the wall 76, the wall 81, the partition wall 67B, and the wall 78, surround the wall 71, the wall 72, the wall 73, the wall 75, and the wall 79. This configures the recessed portion 65C that has the wall 71, the wall 72, the wall 73, the wall 75, and the wall 79 as its bottom.

Also, the partition wall 67B, the wall 76, the wall 81, the partition wall 67A, and the wall 78, surround the wall 71, the wall 72, the wall 73, the wall 75, and the wall 79. This configures the recessed portion 65B that has the wall 71, the wall 72, the wall 73, the wall 75, and the wall 79 as its bottom.

Also, the partition wall 67A, the wall 76, the wall 81, the wall 77, and the wall 78 surround the wall 71, the wall 72, the wall 73, the wall 75, and the wall 79. This configures the recessed portion 65A that has the wall 71, the wall 72, the wall 73, the wall 75, and the wall 79 as its bottom. Note that the walls 71 to 81 are not limited to being flat walls, and may include unevenness, a step, or the like.

Also, in the case 61A, baffle walls 83 are provided between the wall 72 and the wall 78. One baffle wall 83 is provided for each of the recessed portions 65. Hereinafter, when individually identifying the baffle walls 83, the four baffle walls 83 will be respectively denoted as the baffle wall 83A, the baffle wall 83B, the baffle wall 83C, and the baffle wall 83D. The baffle walls 83 extend along the XY plane. The four baffle walls 83 each protrude from the wall 71 in the X axis direction. A cutout portion 84 is formed in the end portion, on the X axis direction side, of each of the four baffle walls 83. The cutout portions 84 in the baffle walls 83 are each formed so as to recede in the −X axis direction from the end portion, on the X axis direction side, of the baffle wall 83, that is to say so as to recede from the end portion, on the X axis direction side, of the baffle wall 83 toward the wall 71 side.

The baffle wall 83A intersects the wall 71, the wall 77, and the partition wall 67A. The baffle wall 83B intersects the wall 71, the partition wall 67B, and the partition wall 67A. The baffle wall 83C intersects the wall 71, the partition wall 67C, and the partition wall 67B. The baffle wall 83D intersects the wall 71, the partition wall 67C, and the wall 74. The baffle walls 83 have a function of mitigating shock from the falling of ink injected into the recessed portions 65 through the liquid injection portions 34. The baffle walls 83 readily suppress the bubbling of ink when ink is injected into the recessed portions 65 through the liquid injection portions 34.

Figure 9:
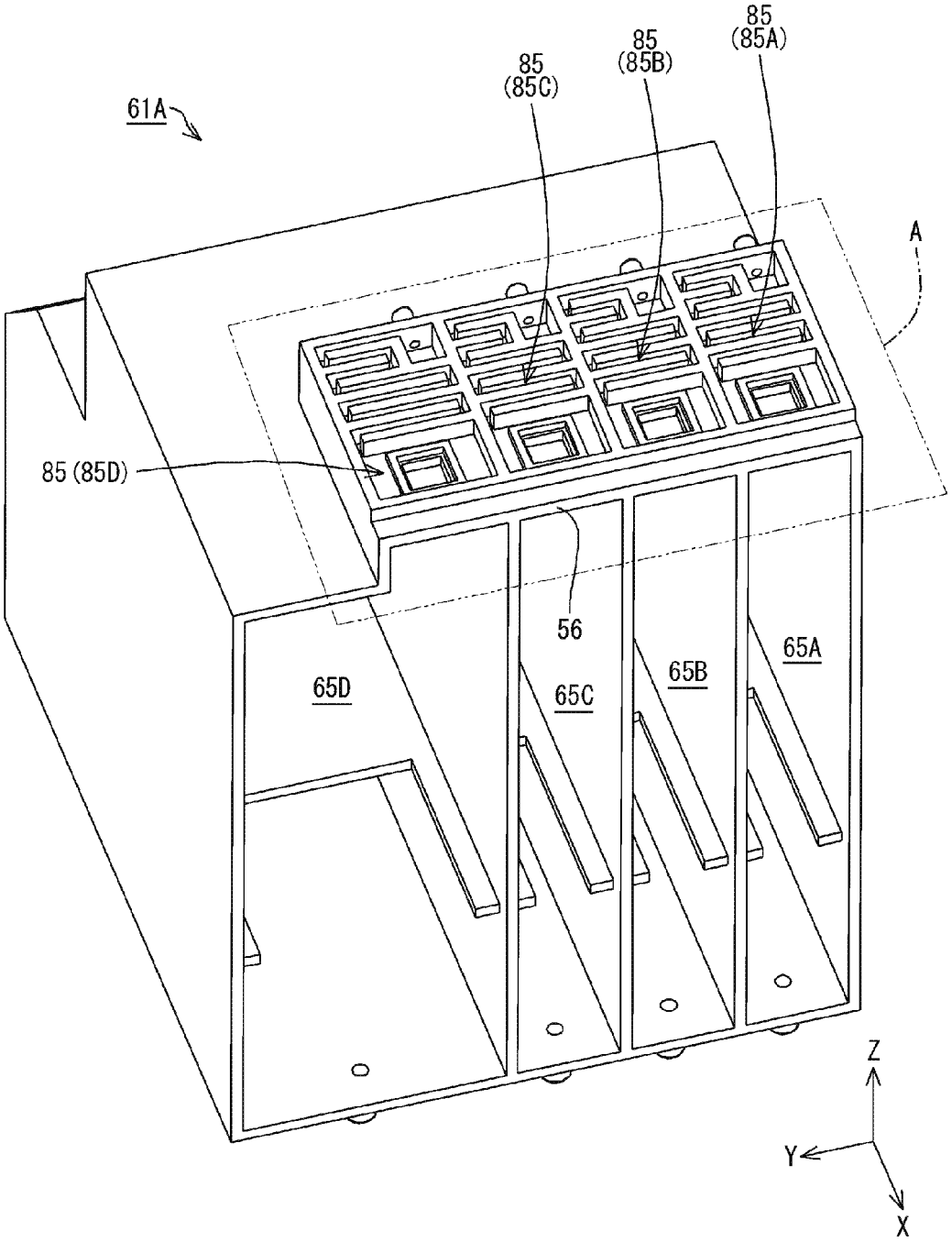
FIG. 9 is a perspective view of the case of the tank in the first working example.

As shown in FIG. 9, in the case 61A, four recessed portions 85 are formed on the side of the wall 81 that is opposite to the recessed portion 65 side, that is to say on the Z axis direction side of the wall 81. The four recessed portions 85 are each formed so as to recede in the −Z axis direction. Also, the four recessed portions 85 are each open in the Z axis direction. Hereinafter, when individually identifying the four recessed portions 85, the four recessed portions 85 will be respectively denoted as the recessed portion 85A, the recessed portion 85B, the recessed portion 85C, and the recessed portion 85D.

The four recessed portions 85 are arranged side-by-side along the Y axis. Among the four recessed portions 85, the recessed portion 85A is located the farthest on the −Y axis direction side. The recessed portion 85B is located on the Y axis direction side of the recessed portion 85A. The recessed portion 85C is located on the Y axis direction side of the recessed portion 85B. The recessed portion 85D is located on the Y axis direction side of the recessed portion 85C. The four recessed portions 85 respectively correspond to the four recessed portions 65. The recessed portion 85A is provided in correspondence with the recessed portion 65A. Also, the recessed portion 85B is provided in correspondence with the recessed portion 65B, the recessed portion 85C is provided in correspondence with the recessed portion 65C, and the recessed portion 85D is provided in correspondence with the recessed portion 65D.

Figure 10:
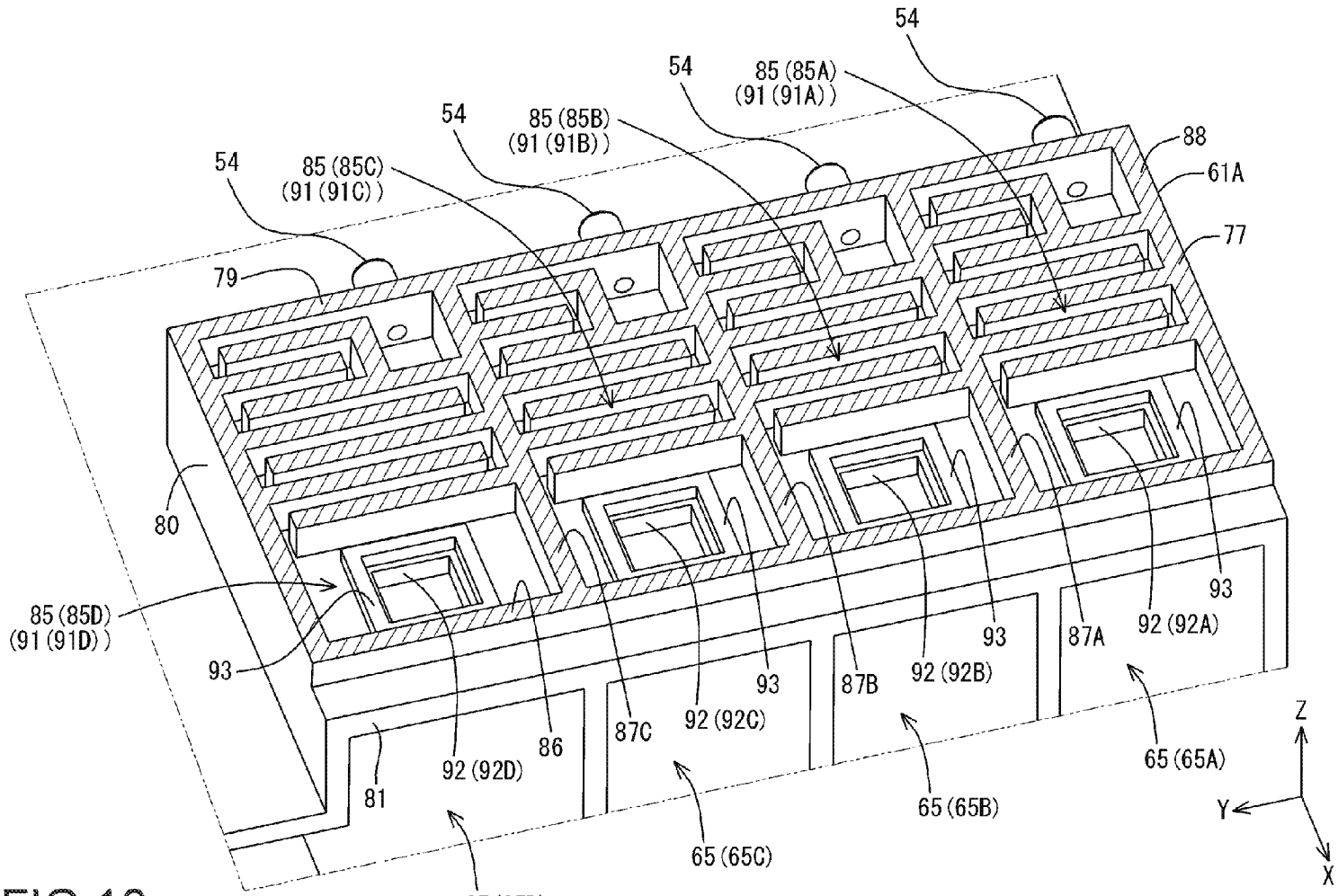
FIG. 10 is an enlarged view of portion A in FIG. 9.

As shown in FIG. 10, which is an enlarged view of portion A in FIG. 9, the wall 81 is provided with a partition wall 86, a partition wall 87A, a partition wall 87B, and a partition wall 87C. The partition wall 86, the partition wall 87A, the partition wall 87B, and the partition wall 87C are provided on the Z axis direction side of the wall 81. The partition wall 86, the partition wall 87A, the partition wall 87B, and the partition wall 87C protrude from the wall 81 in the Z axis direction. The partition wall 86 extends along the Y axis. The partition wall 87A, the partition wall 87B, and the partition wall 87C extend along the X axis. The end portions, on the X axis direction side, of the partition wall 87A, the partition wall 87B, and the partition wall 87C each intersect the partition wall 86. Also, the end portions, on the −X axis direction side, of the partition wall 87A, the partition wall 87B, and the partition wall 87C intersect the wall 79. Moreover, the end portions, on the X axis direction side, of the wall 77 and the wall 80 also intersect the partition wall 86.

According to the above-described configuration, in a plan view of the case 61A in the −Z axis direction, the wall 77, the wall 79, the partition wall 86, and the partition wall 87A surround the wall 81. This configures the recessed portion 85A that has the wall 81 as its bottom. Also, the wall 79, the partition wall 86, the partition wall 87A, and the partition wall 87B surround the wall 81. This configures the recessed portion 85B that has the wall 81 as its bottom. Also, the wall 79, the partition wall 86, the partition wall 87B, and the partition wall 87C surround the wall 81. This configures the recessed portion 85C that has the wall 81 as its bottom. Also, the wall 79, the partition wall 86, the partition wall 87C, and the wall 80 surround the wall 81. This configures the recessed portion 85D that has the wall 81 as its bottom.

The recessed portion 85A and the recessed portion 85B are separated from each other by the partition wall 87A. The recessed portion 85B and the recessed portion 85C are separated from each other by the partition wall 87B. The recessed portion 85C and the recessed portion 85D are separated from each other by the partition wall 87C. The end portions, on the Z axis direction side, of the wall 77, the wall 79, the wall 80, the partition wall 86, the partition wall 87A, the partition wall 87B, and the partition wall 87C are set as a joining portion 88.

The sheet member 64A (FIG. 7) is joined to the joining portion 88. In this embodiment, the case 61A and the sheet member 64A are joined by adhesion. When the sheet member 64A is joined to the case 61A, the four recessed portions 85 (FIG. 10) are blocked by the sheet member 64A. The spaces enclosed by the sheet member 64A and the four recessed portions 85 constitute air introduction passages 91. In this embodiment, there are four recessed portions 85, and therefore four air introduction passages 91 are configured. Hereinafter, when individually identifying the four air introduction passages 91, the four air introduction passages 91 will be respectively denoted as the air introduction passage 91A, the air introduction passage 91B, the air introduction passage 91C, and the air introduction passage 91D. The air introduction passage 91A corresponds to the recessed portion 85A. Also, the air introduction passage 91B corresponds to the recessed portion 85B, the air introduction passage 91C corresponds to the recessed portion 85C, and the air introduction passage 91D corresponds to the recessed portion 85D.

Here, as shown in FIG. 10, through-holes 92 are formed in the wall 81. One through-hole 92 is formed in each of the recessed portions 85. Hereinafter, when individually identifying the four through-holes 92, the four through-holes 92 will be respectively denoted as the through-hole 92A, the through-hole 92B, the through-hole 92C, and the through-hole 92D. The through-hole 92A corresponds to the recessed portion 85A, the through-hole 92B corresponds to the recessed portion 85B, the through-hole 92C corresponds to the recessed portion 85C, and the through-hole 92D corresponds to the recessed portion 85D. The through-holes 92 pass through the wall 81 along the Z axis. For this reason, the recessed portions 65 and the recessed portions 85 are in communication via the through-holes 92.

A joining portion 93 is provided so as to surround each of the through-holes 92 on the Z axis direction side of the wall 81. In a plan view of the case 61A in the −Z axis direction, the joining portions 93 surround the through-holes 92. The waterproof ventilation films 63 (FIG. 7) are joined to the joining portions 93. In this embodiment, the joining portions 93 and the waterproof ventilation films 63 are joined by adhesion. The waterproof ventilation films 63 have a size and shape capable of covering the through-holes 92. For this reason, when the waterproof ventilation films 63 are joined to the joining portions 93, the through-holes 92 (FIG. 10) are blocked in the Z axis direction by the waterproof ventilation films 63. Accordingly, it is possible to suppress cases where ink in the liquid storage portions 8 flows into the air introduction passages 91 via the through-holes 92.

Here, as shown in FIG. 10, the communication portions 54 pass through the wall 79 along the X axis and are in communication with the recessed portions 85. For this reason, in the tank 7A, the liquid storage portions 8 are in communication with the outside of the tank 7A via the air introduction passages 91 and the communication portions 54. Accordingly, the tank 7A has a configuration in which air outside the tank 7A can be introduced into the liquid storage portions 8 via the communication portions 54 and the air introduction passages 91. Note that each of the air introduction passages 91 is provided with walls between the through-hole 92 and the communication portion 54, and these walls form a tortuous path between the through-hole 92 and the communication portion 54. Accordingly, when air travels from the through-hole 92 toward the communication portion 54, it travels through a tortuous path from the through-hole 92 to the communication portion 54. These tortuous paths readily hinder the evaporation of the liquid component of the ink in the liquid storage portions 8.

Second Working Example

Figure 11:
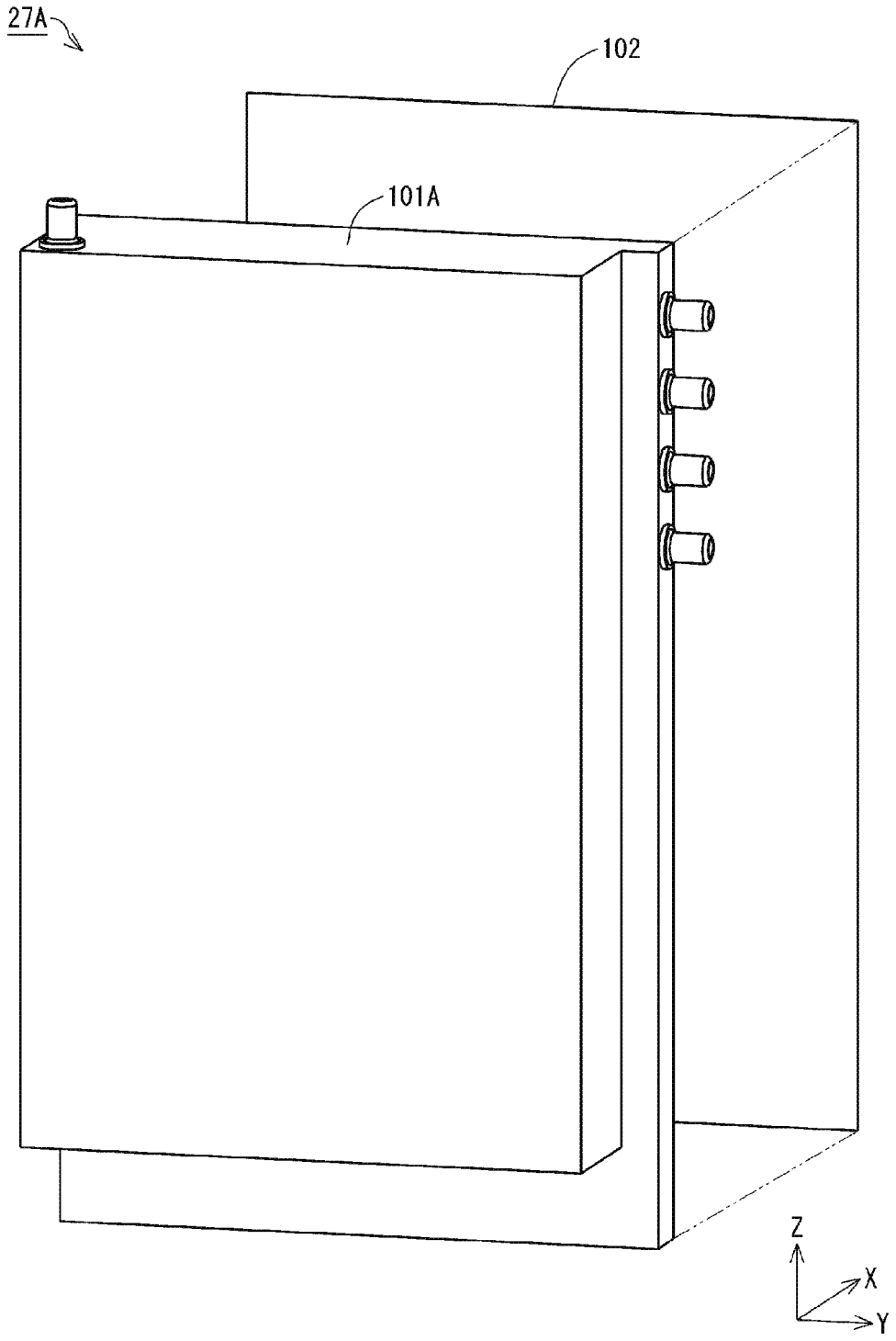
FIG. 11 is an exploded perspective view of a buffer unit in a second working example.

As shown in FIG. 11, a buffer unit 27A of a second working example has a case 101A and a sheet member 102. The case 101A is constituted by a synthetic resin such as nylon or polypropylene, for example. Also, the sheet member 102 is formed in the shape of a film using a synthetic resin (e.g., nylon or polypropylene), and is bendable. In the buffer unit 27A, the sheet member 102 is located on the X axis direction side of the case 101A.

Figure 12:
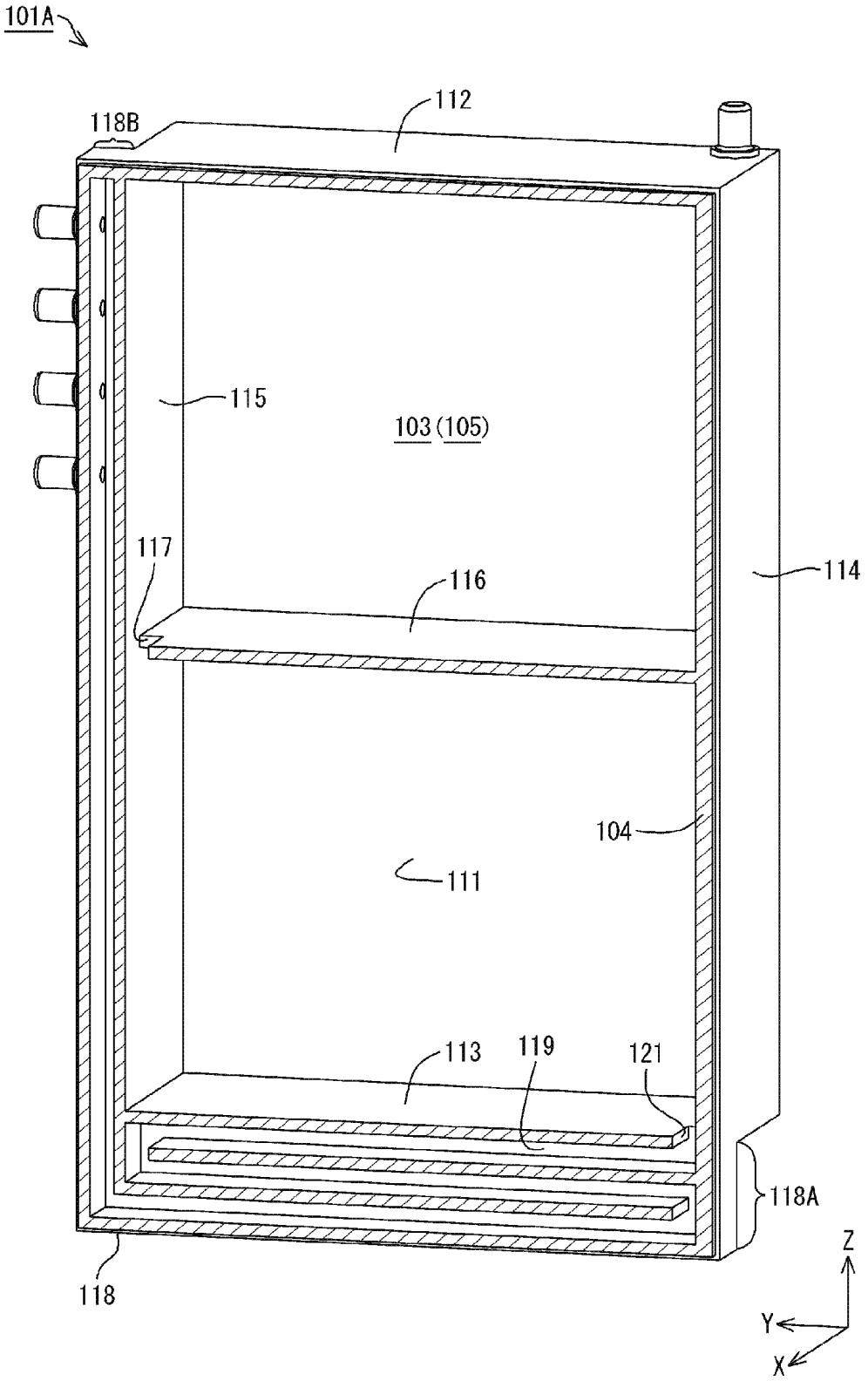
FIG. 12 is a perspective view of a case of the buffer unit in the second working example.

As shown in FIG. 12, a recessed portion 103 is formed in the case 101A. The recessed portion 103 is formed so as to recede in the −X axis direction. Also, the recessed portion 103 is open in the X axis direction. The case 101A is provided with a joining portion 104. The joining portion 104 is hatched in FIG. 12 in order to facilitate understanding of the configuration. The sheet member 102 (FIG. 11) is joined to the joining portion 104. In this embodiment, the case 101A and the sheet member 102 are joined by adhesion.

When the sheet member 102 is joined to the case 101A, the recessed portion 103 is blocked by the sheet member 102. The space enclosed by the recessed portion 103 and the sheet member 102 constitutes a buffer chamber 105. The buffer chamber 105 has a function of storing ink that has leaked from the inside the tank 7A to the outside of the tank 7A via the air introduction passages 91 (FIG. 10).

As shown in FIG. 12, the case 101A has a wall 111, a wall 112, a wall 113, a wall 114, and a wall 115. The wall 111 extends along the YZ plane. The wall 112 and the wall 113 each extend along the XY plane. In a plan view of the wall 111 in the −X axis direction, the wall 112 and the wall 113 oppose each other while sandwiching the wall 111 along the Z axis. The wall 112 is located on the Z axis direction side of the wall 113.

The wall 114 and the wall 115 each extend along the XZ plane. In a plan view of the wall 111 in the −X axis direction, the wall 114 and the wall 115 oppose each other while sandwiching the wall 111 along the Y axis. The wall 114 is located on the −Y axis direction side of the wall 115. The walls 112 to 115 are located on the X axis direction side of the wall 111, and protrude from the wall 111 in the X axis direction. The wall 112 and the wall 113 each intersect the wall 114 and the wall 115. The end portions, on the −Y axis direction side, of the wall 112 and the wall 113 each intersect the wall 114. Also, the end portions, on the Y axis direction side, of the wall 112 and the wall 113 each intersect the wall 115. In other words, in a plan view of the wall 111 in the −X axis direction, the walls 112 to 115 surround the wall 111. This configures the recessed portion 103 that has the wall 111 as its bottom.

In the case 101A, a dividing wall 116 is provided between the wall 112 and the wall 113. The dividing wall 116 extends along the XY plane. The dividing wall 116 faces the wall 112 and the wall 113. The dividing wall 116 is located on the Z axis direction side of the wall 113, and is located on the −Z axis direction side of the wall 112. The dividing wall 116 is provided on the X axis direction side of the wall 111, and protrudes from the wall 111 in the X axis direction. The end portion, on the −Y axis direction side, of the dividing wall 116 intersects the wall 114. Also, the end portion, on the Y axis direction side, of the dividing wall 116 intersects the wall 115.

A cutout portion 117 is formed in a portion of the dividing wall 116 that intersects the wall 115. The cutout portion 117 is formed in the end portion on the X axis direction side of the dividing wall 116, and is formed so as to recede from the X axis direction side toward the −X axis direction side. In this working example, the cutout portion 117 has a configuration obtained by cutting out a portion of the dividing wall 116 along the X axis. However, the cutout portion 117 may have a configuration obtained by cutting out a region of the dividing wall 116 that extends along the X axis to the wall 111.

As shown in FIG. 12, an extension portion 118 is provided on the case 101A. The extension portion 118 includes an extension portion 118A that extends from the wall 113 in the −Z axis direction, and an extension portion 118B that extends from the wall 115 in the Y axis direction. The extension portion 118A is located on the −Z axis direction side of the wall 113, and protrudes from the wall 113 in the −Z axis direction. The extension portion 118B is located on the Y axis direction side of the wall 115, and protrudes from the wall 115 in the Y axis direction.

A groove 119 is formed in the extension portion 118. The groove 119 is formed so as to recede in the −X axis direction. The groove 119 is in communication with the recessed portion 103 via the cutout portion 121 formed in the wall 113. The cutout portion 121 is formed in the end portion on the X axis direction side of the wall 113, and is formed so as to recede in the −X axis direction. The cutout portion 121 is formed in the end portion on the −Y axis direction side of the wall 113, that is to say the portion that intersects with the wall 114.

In the extension portion 118A, the groove 119 begins at the cutout portion 121, extends in the Y axis direction, turns back and extends in the −Y axis direction at the intersection with the wall 115, then turns back again and extends in the Y axis direction at the intersection with the wall 114, and arrives at the extension portion 118B. In this way, the groove 119 extends along a tortuous path in the extension portion 118A. Upon arriving at the extension portion 118B, the groove 119 bends in the Z axis direction at the portion that arrives at the extension portion 118B. In the extension portion 118B, the groove 119 extends in the Z axis direction and arrives at the intersection with the wall 112. Note that the joining portion 104 is provided so as to surround the extension portion 118 as well in a plan view of the wall 111 in the −X axis direction.

Figure 13:
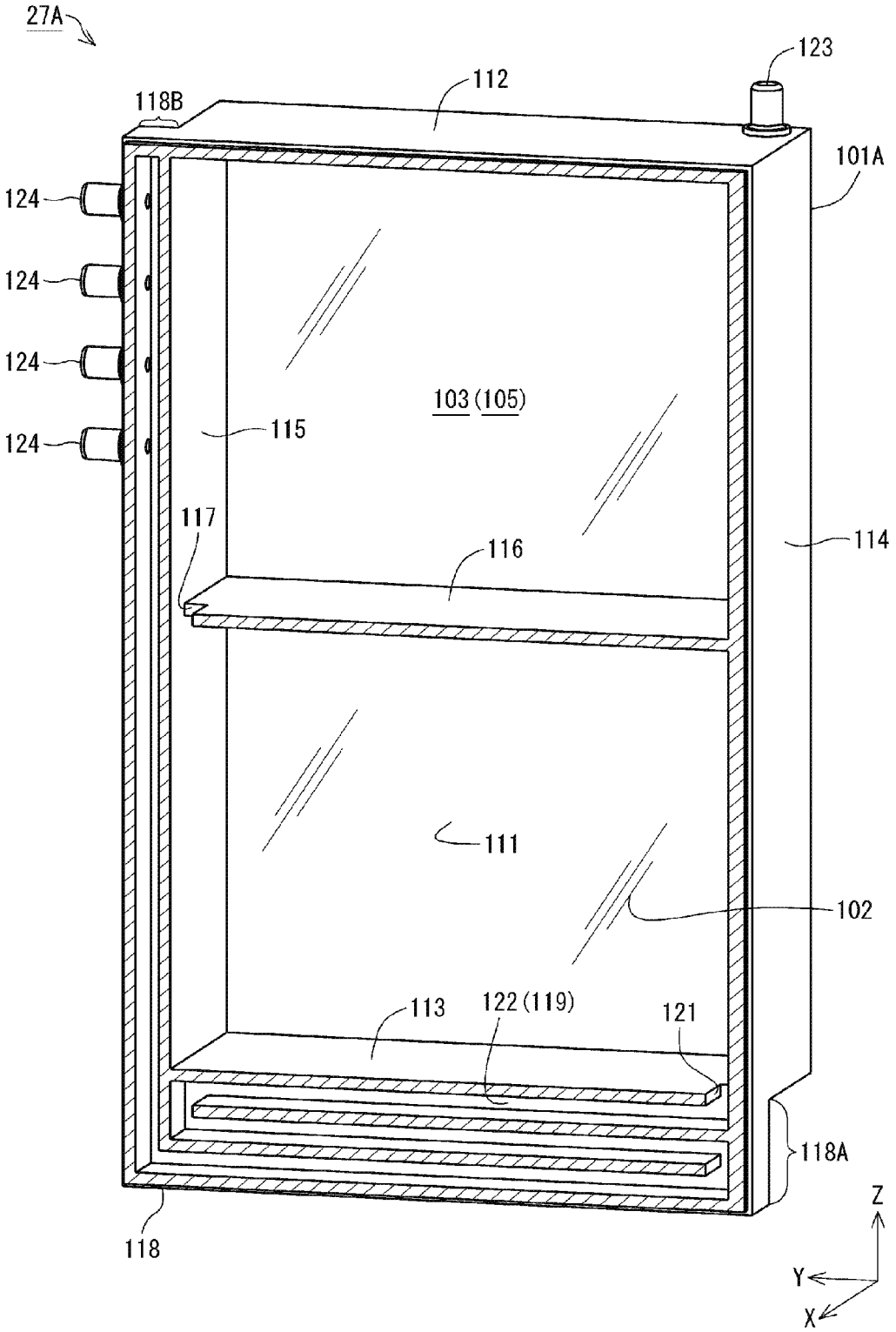
FIG. 13 is a perspective view of the buffer unit in the second working example.

As shown in FIG. 13, the sheet member 102 has a size and shape capable of covering the recessed portion 103 and the extension portion 118 in a plan view of the wall 111 in the −X axis direction. The sheet member 102 is adhered to the joining portion 104. Accordingly, the recessed portion 103 and the groove 119 are sealed by the sheet member 102. For this reason, the sheet member 102 can be considered to be a lid for the case 101A. When the recessed portion 103 and the groove 119 are sealed by the sheet member 102, the buffer chamber 105 and a communication passage 122 are formed. The space enclosed by the recessed portion 103 and the sheet member 102 constitutes the buffer chamber 105, and the space enclosed by the groove 119 and the sheet member 102 constitutes the communication passage 122. Note that FIG. 13 shows a state in which the buffer unit 27A is viewed from the sheet member 102 side, and the case 101A is shown through the sheet member 102 in order to facilitate understanding of the configuration.

Also, the buffer unit 27A is provided with an air inlet portion 123 and connection/communication portions 124. In this working example, four connection/communication portions 124 are provided. The air inlet portion 123 is provided on the wall 112 of the case 101A. The air inlet portion 123 is provided on the Z axis direction side of the wall 112, and protrudes from the wall 112 in the Z axis direction. The four connection/communication portions 124 are provided on the extension portion 118B of the case 101A. The four connection/communication portions 124 are provided on the Y axis direction side of the extension portion 118B, and protrude from the extension portion 118B in the Y axis direction.

The air inlet portion 123 is in communication with the buffer chamber 105. Air can be introduced into the buffer chamber 105 through the air inlet portion 123. The four connection/communication portions 124 are in communication with the communication passage 122. Air can be introduced into the communication passage 122 via each of the four connection/communication portions 124. According to the above configuration, the buffer unit 27A is configured such that air introduced into the buffer chamber 105 through the air inlet portion 123 can be discharged, via the communication passage 122, to the outside of the buffer unit 27A through each of the four connection/communication portions 124.

Figure 14:
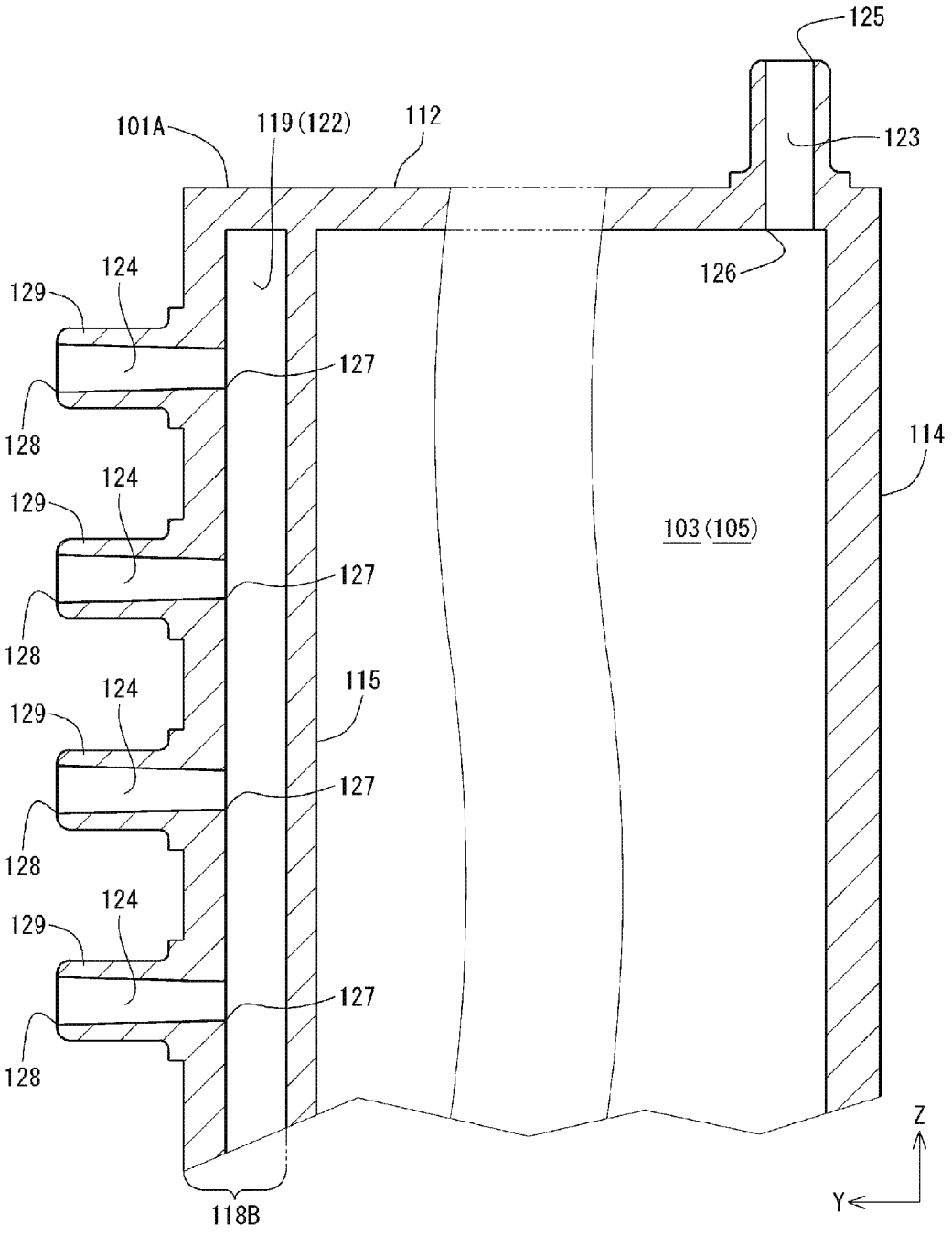
FIG. 14 is a cross-sectional view of an air inlet portion and a connection/communication portion of the case of the buffer unit in the second working example.

As shown in FIG. 14, which is a cross-sectional view showing the air inlet portion 123 and the connection/communication portions 124, the air inlet portion 123 has an air inlet 125 and an introduction opening 126. The air inlet 125 is an opening that is open toward the outside of the case 101A. The introduction opening 126 is an opening that is open toward the interior of the recessed portion 103. Also, the introduction opening 126 can be considered to be an opening formed in the intersection portion where the inner wall of the buffer chamber 105 and the air inlet portion 123 intersect each other. In other words, the introduction opening 126 is the portion where the air inlet portion 123 is connected to the buffer chamber 105.

Air outside the case 101A enters the air inlet portion 123 through the air inlet 125, which is the entrance to the air inlet portion 123. The air that has entered the air inlet portion 123 is guided toward the recessed portion 103 (buffer chamber 105) by the air inlet portion 123, and exits into the recessed portion 103 through the introduction opening 126, which is the exit of the air inlet portion 123. Note that in order to facilitate understanding of the configuration, FIG. 14 shows a cross-section of the case 101A taken along a YZ plane that passes through the air inlet portion 123 and a YZ plane that passes through the four connection/communication portions 124.

In this working example, the air inlet portion 123 is in a mode in which it protrudes from the wall 112 toward the outside of the case 101A. However, the mode of the air inlet portion 123 is not limited in this way. The air inlet portion 123 can be in a mode in which it does not protrude from the wall 112, that is to say, the end thereof is at a location on the −Z axis direction side of the wall 112. Examples of the mode in this case include a mode in which the height of the air inlet portion 123 is set to the thickness of the wall 112 or less, and a mode in which it protrudes from the wall 112 into the recessed portion 103. For example, by providing the wall 112 with a hole that passes from the outside of the case 101A to the interior of the recessed portion 103, the air inlet portion 123 can be given the same thickness as the wall 112. In a mode in which the air inlet portion 123 has the same thickness as the wall 112, the air inlet 125 is open at the surface of the wall 112 on the side opposite to the recessed portion 103 side, and the introduction opening 126 is open at the surface of the wall 112 on the recessed portion 103 side.

Also, by connecting a tube, a pipe, or the like to the air inlet portion 123, the air inlet portion 123 can also have a configuration in which a tube, a pipe, or the like has been added thereto. Furthermore, a configuration is possible in which another part or unit is added, and the air inlet portion 123 is open to the atmosphere via that other part or unit.

As shown in FIG. 14, the connection/communication portions 124 each have a communication opening 127 and a release opening 128. The communication opening 127 is an opening that is open toward the interior of the communication passage 122 (groove 119). Also, the communication opening 127 can be considered to be an opening formed in the intersection portion where the inner wall of the communication passage 122 (groove 119) and the connection/communication portion 124 intersect each other. In other words, the communication opening 127 is the portion where the connection/communication portion 124 is connected to the communication passage 122. The release opening 128 is an opening that is open toward the outside of the case 101A. Note that the portion of the connection/communication portion 124 that protrudes from the extension portion 118B will be referred to as a connection portion 129. The connection portion 129 is a side wall that surrounds the connection/communication portion 124. The connection/communication portion 124 passes through the connection portion 129 along the Y axis and is in communication with the communication passage 122 (groove 119).

Figure 15:
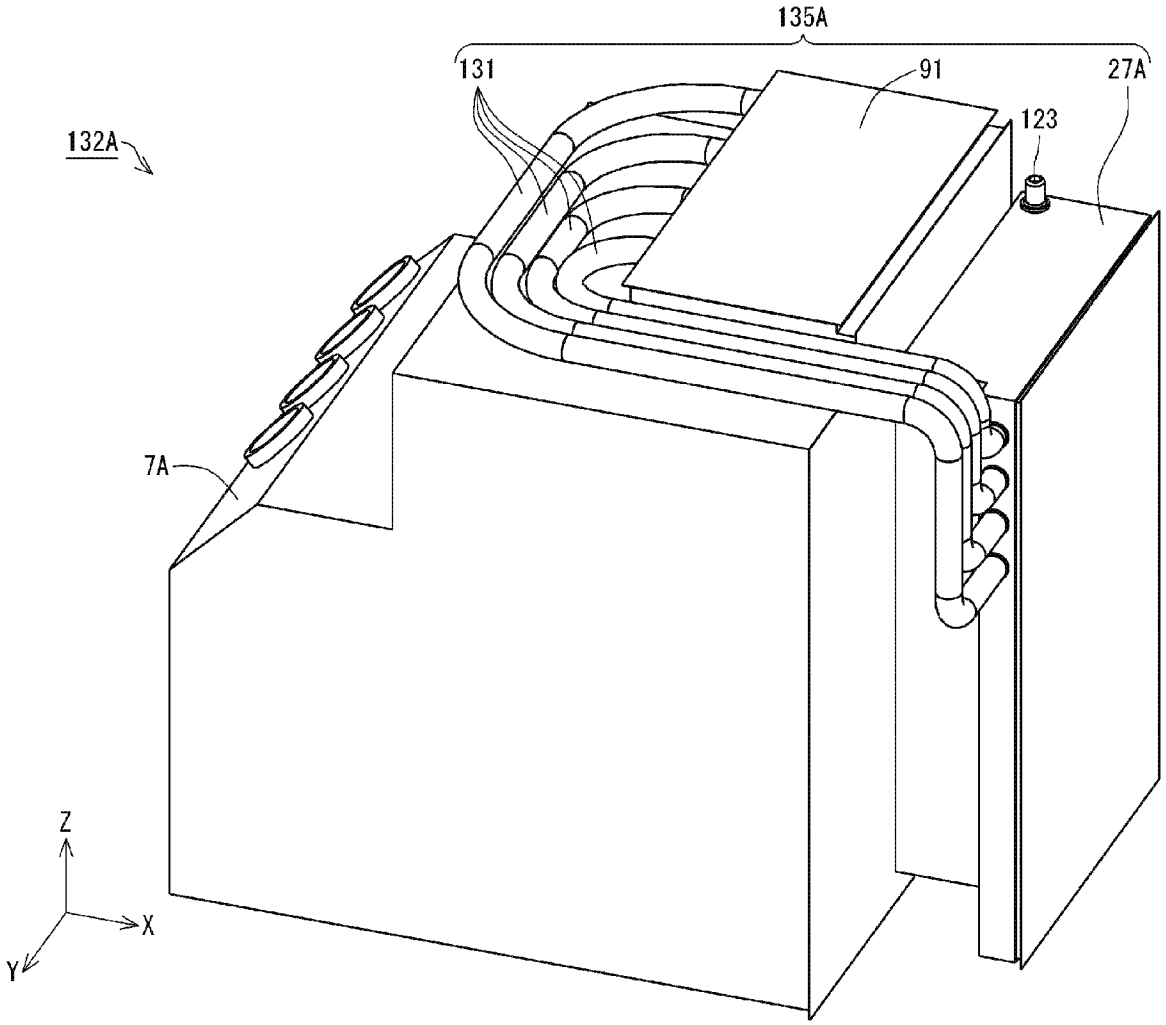
FIG. 15 is a perspective view of a liquid supply unit that connects the tank in the first working example to the buffer unit in the second working example.

As shown in FIG. 15, the buffer unit 27A having the above-described configuration is connected to the tank 7A via four tubes 131. The configuration in which the buffer unit 27A is connected to the tank 7A will be referred to as the liquid supply unit 132A. Note that the buffer unit 27A is configured to be detachable from the tank 7A. In this working example, in the liquid supply unit 132A, the tank 7A and the buffer unit 27A are connected to each other via the tubes 131. In the liquid supply unit 132A, ends of the tubes 131 on one side are connected to the communication portions 54 (FIG. 7) of the tank 7A. Also, in the liquid supply unit 132A, the ends of the tubes 131 on the other side are connected to the connection portions 129 (FIG. 14).

In this working example, the ends of the tubes 131 on the one side are inserted into the communication portions 54 that protrude from the front surface 51 (FIG. 7) in the −X axis direction. Also, the ends of the tubes 131 on the other side are inserted into the connection portions 129 that protrude from the extension portion 118B. Accordingly, in this working example, the ends of the tubes 131 on one side are connected to the communication portions 54 (FIG. 7) of the tank 7A, and the ends of the tubes 131 on the other side are connected to the connection portions 129 (FIG. 14).

In this working example, one communication portion 54 (FIG. 7) is connected to one connection portion 129 (FIG. 14) via one tube 131. Note that there are no limitations on the combination of a communication portion 54 and a connection portion 129 that are connected via one tube 131. Any one of the four communication portions 54 can be connected to any one of the four connection portions 129, and there are no limitations in this regard. For this reason, the liquid supply unit 132A can be assembled without paying attention to the combination in which the communication portions 54 and the connection portions 129 are connected, thus making it possible to easily assemble the liquid supply unit 132A.

As shown in FIG. 15, in the liquid supply unit 132A, an air introduction portion 135A is configured to include the buffer unit 27A, the tubes 131, and the air introduction passages 91 (FIG. 10) provided in the tank 7A. In this working example, the air introduction portion 135A includes the buffer unit 27A, the tubes 131, and the air introduction passages 91 (FIG. 10) provided in the tank 7A. For this reason, the buffer unit 27A constitutes at least a portion of the air introduction portion 135A.

Note that the liquid supply unit 132A can also have a configuration that omits the air introduction passages 91 of the tank 7A. In this configuration, the buffer unit 27A is connected to the liquid storage portions 8 of the tank 7A via the tubes 131. Furthermore, the liquid supply unit 132A can also have a configuration that omits the air introduction passages 91 of the tank 7A and the tubes 131. In this configuration, the buffer unit 27A is directly connected to the liquid storage portions 8 of the tank 7A. In this configuration, the buffer unit 27A constitutes the air introduction portion 135A.

Figure 16:
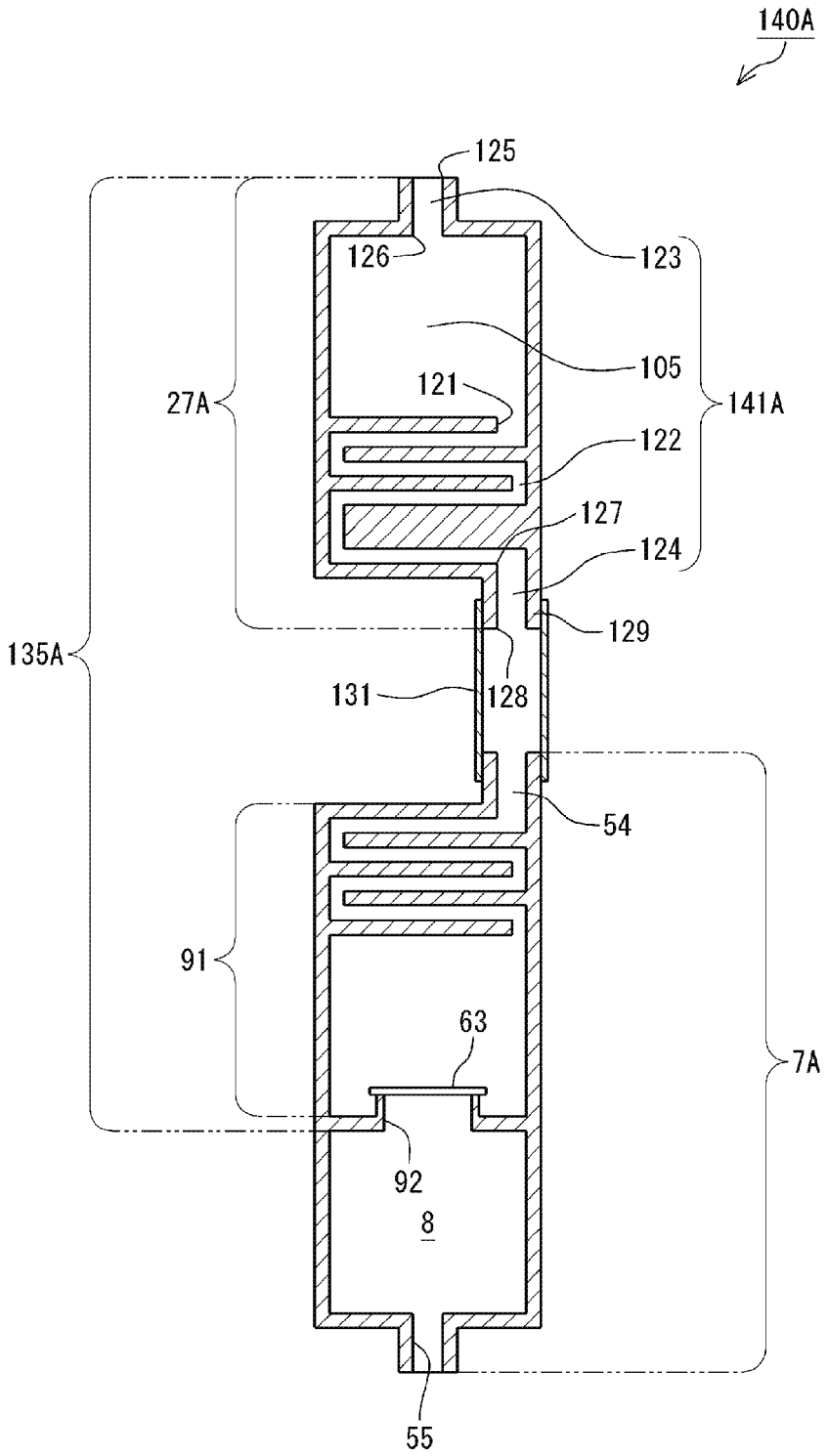
FIG. 16 is a diagram schematically showing a flow channel in the second working example.

The flow channel (also called a path) from the air inlet 125 to one of the liquid supply portions 55 will be described below with reference to a schematic diagram. Here, in order to facilitate understanding, the flow channel from the air inlet 125 to the liquid supply portion 55 will be described schematically. Note that the flow direction of the liquid is a direction from the air inlet 125 toward the liquid supply portion 55. This direction serves as a reference for the terms "upstream" and "downstream". As shown in FIG. 16, a flow channel 140A from the air inlet 125 to the liquid supply portion 55 includes the air introduction portion 135A, the liquid storage portion 8, and the liquid supply portion 55.

The air introduction portion 135A includes the air inlet portion 123, the buffer chamber 105, the communication passage 122, the connection/communication portion 124, the tube 131, the communication portion 54, the air introduction passage 91, and the through-hole 92. Here, the air inlet portion 123, the buffer chamber 105, the communication passage 122, and the connection/communication portion 124 of the buffer unit 27A constitute an introduction passage 141A. In other words, in this working example, the buffer unit 27A has the introduction passage 141A. Also, the buffer chamber 105, which is one example of an air chamber, constitutes at least a portion of the introduction passage 141A. For this reason, the buffer unit 27A has the buffer chamber 105 that constitutes at least a portion of the introduction passage 141A.

The buffer chamber 105 is provided on the downstream side of the air inlet portion 123. The buffer chamber 105 is a region surrounded by the sheet member 102 and the recessed portion 103 (FIG. 12) of the case 101A of the buffer unit 27A. As shown in FIG. 16, the communication passage 122 is provided on the downstream side of the buffer chamber 105. The communication passage 122 is a region surrounded by the sheet member 102 and the groove 119 (FIG. 12) of the case 101A of the buffer unit 27A. The connection/communication portion 124 is provided on the downstream side of the communication passage 122.

The tube 131 is provided on the downstream side of the connection/communication portion 124. The tank 7A is provided on the downstream side of the tube 131. The communication portion 54 of the tank 7A is provided on the downstream side of the tube 131. The air introduction passage 91 is provided on the downstream side of the communication portion 54. The air introduction passage 91 is a region surrounded by the sheet member 64A (FIG. 7) and the recessed portion 85 (FIG. 10) of the case 61A of the tank 7A.

The liquid storage portion 8 is provided on the downstream side of the air introduction passage 91. The liquid storage portion 8 and the air introduction passage 91 are in communication with each other via the through-hole 92. The waterproof ventilation film 63 is provided on the air introduction passage 91 side of the through-hole 92. The waterproof ventilation film 63 covers the through-hole 92 on the air introduction passage 91 side. The liquid supply portion 55 is provided on the downstream side of the liquid storage portion 8. In this working example, the flow channel 140A from the air inlet 125 to the liquid supply portion 55 has the above-described configuration.

When ink in the liquid storage portion 8 is supplied to the recording portion 31 (FIG. 3) via the liquid supply portion 55, the amount of ink in the liquid storage portion 8 decreases. When the amount of ink in the liquid storage portion 8 decreases, the pressure inside the liquid storage portion 8 tends to fall below atmospheric pressure. In this working example, the air introduction portion 135A, which extends from the air inlet 125 to the through-hole 92, is in communication with the liquid storage portion 8. For this reason, when the amount of ink in the liquid storage portion 8 decreases, and the pressure inside the liquid storage portion 8 falls below atmospheric pressure, air can be introduced into the liquid storage portion 8 via the air introduction portion 135A. As a result, the pressure inside the liquid storage portion 8 is readily maintained at atmospheric pressure.

At this time, the air introduced into the liquid storage portion 8 flows from the air inlet 125, through the air inlet portion 123, and then into the buffer chamber 105. The air that flowed into the buffer chamber 105 then flows through the cutout portion 121 and into the communication passage 122, passes through the communication opening 127 and the connection/communication portion 124, and then flows through the release opening 128 to the outside of the buffer unit 27A. The air that flowed to the outside of the buffer unit 27A through the release opening 128 then flows through the tube 131, and then through the communication portion 54 and into the air introduction passage 91 of the tank 7A. Then air that flowed into the air introduction passage 91 of the tank 7A then flows through the waterproof ventilation film 63 and then through the through-hole 92 and into the liquid storage portion 8.

In this working example, the buffer unit 27A constitutes at least a portion of the air introduction portion 135A that can introduce air into the liquid storage portion 8 of the tank 7A. The buffer unit 27A, which is one example of a ventilation unit, has the introduction passage 141A that constitutes at least a portion of an air path, and the buffer chamber 105 that constitutes at least a portion of the introduction passage 141A. According to this configuration, even if ink in the liquid storage portion 8 flows into the air introduction portion 135A, the advancement of the ink is readily stopped in the buffer chamber 105 of the buffer unit 27A. Accordingly, this readily prevents ink in the liquid storage portion 8 from leaking to the outside of the tank 7A through the air introduction portion 135A.

Also, in this working example, the buffer unit 27A is configured to be detachable from the tank 7A. In other words, the tank 7A and the buffer unit 27A are configured to be separate from each other. According to this configuration, it is possible to add the air introduction portion 135A to the tank 7A and extend the air introduction portion 135A. Accordingly, this more readily prevents ink from leaking out from the tank 7A. Accordingly, the configuration of the liquid supply unit 132A (FIG. 15) can be changed for various types (also called models, etc.) of the liquid ejection system 1. As a result, the degree of freedom in design of the liquid ejection system 1 is readily improved.

Also, in this working example, the buffer unit 27A is configured to be detachable from the tank 7A, and therefore the position of the buffer unit 27A relative to the tank 7A can be readily changed. Accordingly, the position of the buffer unit 27A relative to the tank 7A can be changed for various types of the liquid ejection system 1. As a result, the degree of freedom in design of the liquid ejection system 1 is readily improved.

Also, in this working example, the dividing wall 116 (FIG. 13) is provided in the buffer chamber 105. The dividing wall 116 is provided between the communication passage 122 and the air inlet portion 123, and separates the communication passage 122 from the air inlet portion 123. Accordingly, when ink in the liquid storage portion 8 flows through the connection/communication portion 124 and into the communication passage 122 for example, it is possible to minimize cases where the ink in the communication passage 122 reaches the air inlet portion 123. Accordingly, this more readily prevents ink from leaking out from the tank 7A.

Also, in this working example, the tank 7A has multiple liquid storage portions 8, and the buffer unit 27A has multiple connection/communication portions 124. The connection/communication portions 124 are provided so as to be integrated with the buffer unit 27A. Also, the connection/communication portions 124 and the liquid storage portions 8 are in one-to-one correspondence with each other. According to this configuration, the air introduction passages 91 of the liquid storage portions 8 can be collectively connected to the one buffer unit 27A.

Also, in this working example, in the buffer unit 27A, the connection/communication portions 124 are in communication with the same introduction passage 141A. Accordingly, the air introduction passages 91 of the liquid storage portions 8 can be in communication with the same introduction passage 141A in the one buffer unit 27A. According to this configuration, it is possible to provide only one introduction passage 141A, thus saving space compared to the case of providing an introduction passage 141A for each of the liquid storage portions 8.

Also, in this working example, the tank 7A and the buffer unit 27A are connected via the tubes 131. According to this configuration, the setting of the position of the buffer unit 27A relative to the tank 7A can be readily changed according to the setting of the length and arrangement of the tubes 131. As a result, the degree of freedom in design of the liquid ejection system 1 is readily improved.

Third Working Example

Figure 17:
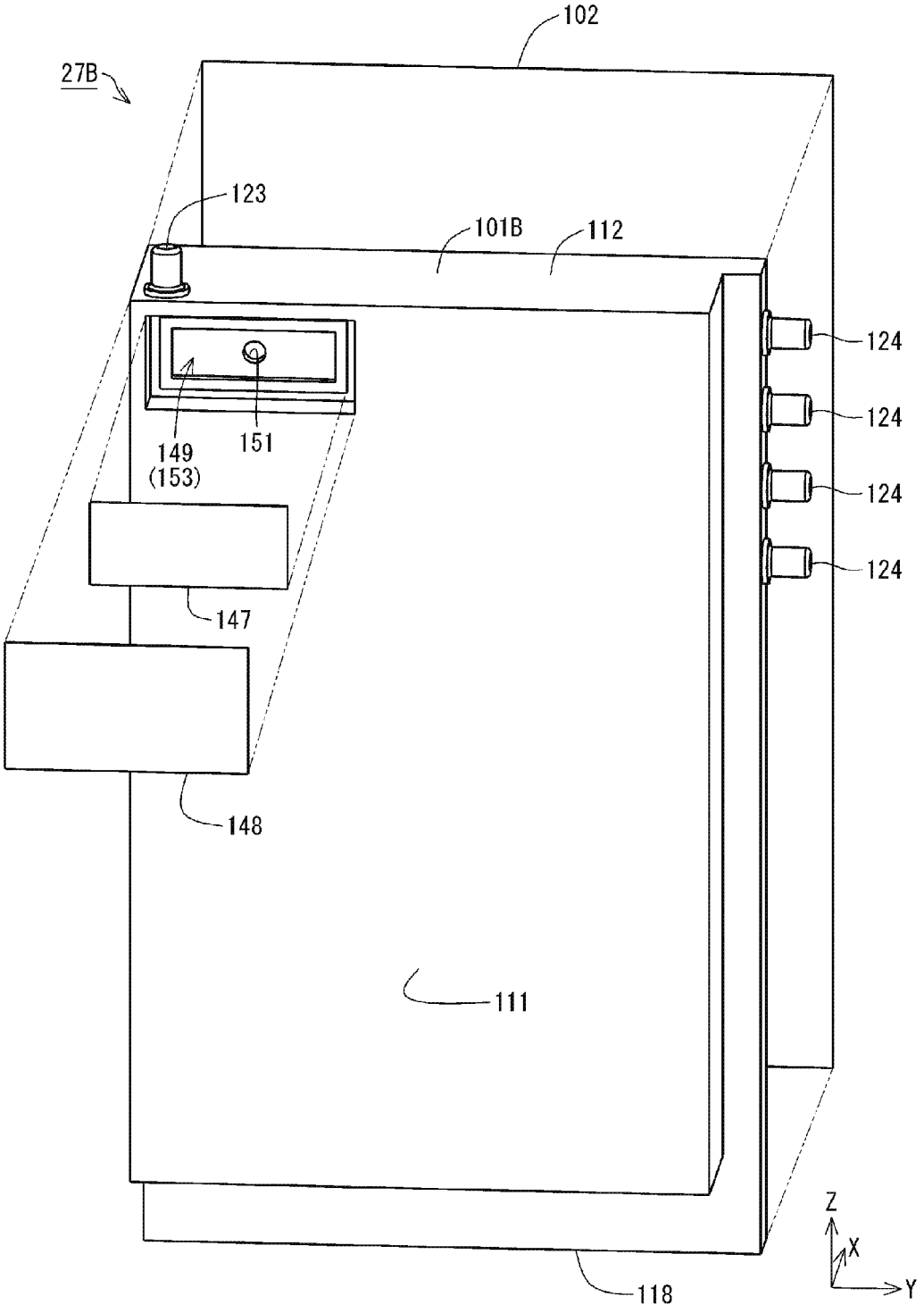
FIG. 17 is an exploded perspective view of a buffer unit in a third working example.

As shown in FIG. 17, a buffer unit 27B of a third working example has a case 101B, the sheet member 102, a waterproof ventilation film 147, and a sheet member 148. The buffer unit 27B of the third working example has a configuration in which the case 101A in the buffer unit 27A of the second working example is replaced with the case 101B, and the waterproof ventilation film 147 and the sheet member 148 have been added. With the exception of the above points, the buffer unit 27B of the third working example has the same configuration as the buffer unit 27A of the second working example. For this reason, configurations in the third working example that are the same as in the second working example will be denoted using the same reference signs as in the second working example, and will not be described in detail.

Figure 18:
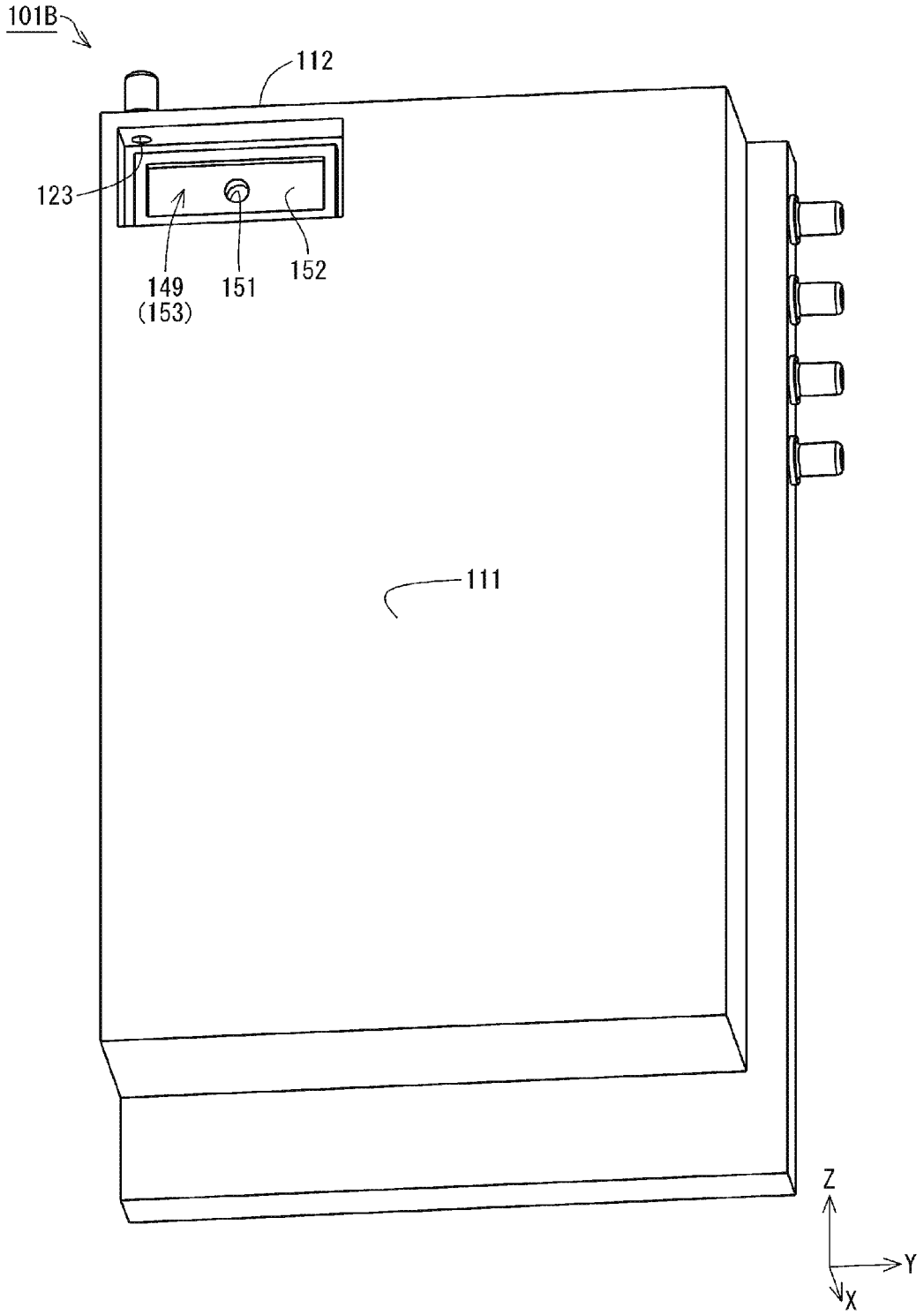
FIG. 18 is a perspective view of a case of the buffer unit in the third working example.

A recessed portion 149 and a communication hole 151 are formed in the case 101B. Also, in the case 101B, the air inlet portion 123 passes through the wall 112 and is in communication with the recessed portion 149, as shown in FIG. 18. With the exception of the above points, the case 101B has the same configuration as the case 101A of the second working example.

Figure 19:
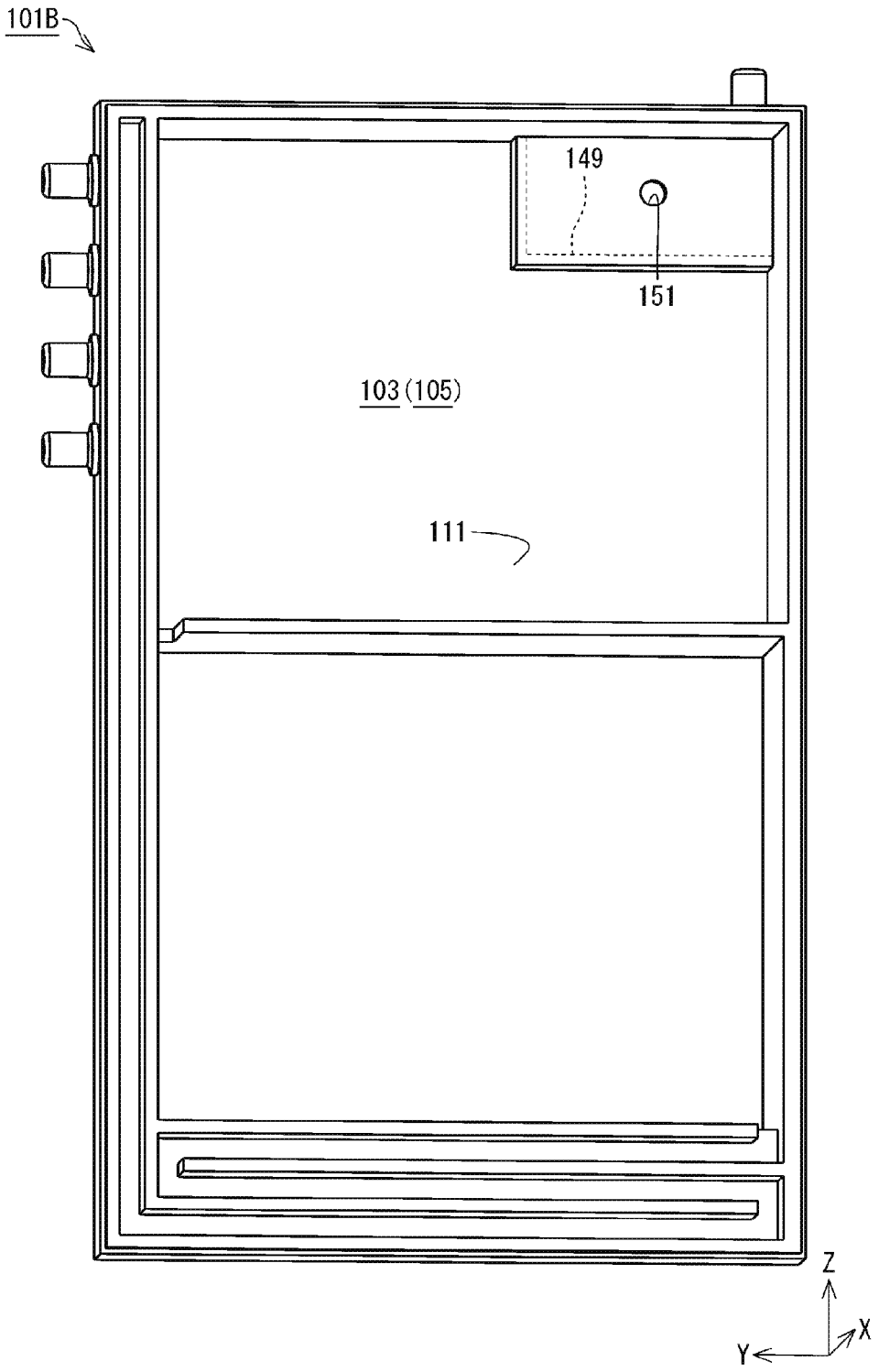
FIG. 19 is a perspective view of the case of the buffer unit in the third working example.

In the case 101B, the recessed portion 149 is formed in the wall 111. The recessed portion 149 is formed so as to recede from the wall 111 in the X axis direction. The communication hole 151 is formed in the recessed portion 149, and passes through a bottom portion 152 of the recessed portion 149 along the X axis. As shown in FIG. 19, the communication hole 151 passes through the recessed portion 103 of the case 101B. Note that the region of the recessed portion 103 that is overlapped with the recessed portion 149 protrudes from the wall 111 in the X axis direction. Accordingly, as shown in FIG. 18, it is possible to form the recessed portion 149 on the X axis direction side of the wall 111.

The waterproof ventilation film 147, which is one example of a waterproof ventilation member, has the same functions as the waterproof ventilation films 63, and can be constituted by the same material as the waterproof ventilation films 63. As shown in FIG. 17, the waterproof ventilation film 147 has a size and shape capable of being accommodated in the recessed portion 149. Also, the waterproof ventilation film 147 has a size and shape capable of covering the communication hole 151. The waterproof ventilation film 147 covers the communication hole 151 on the −X axis direction side inside the recessed portion 149. Accordingly, the communication hole 151 is blocked by the waterproof ventilation film 147 on the −X axis direction side.

The sheet member 148 is constituted by the same material as the sheet member 102. The sheet member 148 is located on the −X axis direction side of the wall 111, and has a size and shape capable of covering the recessed portion 149. The sheet member 148 is joined to the wall 111, and covers the recessed portion 149 on the −X axis direction side. Accordingly, the recessed portion 149 is blocked by the sheet member 148 on the −X axis direction side. When the recessed portion 149 is blocked by the sheet member 148, the region surrounded by the recessed portion 149 and the sheet member 148 constitutes the buffer chamber 153.

Figure 20:
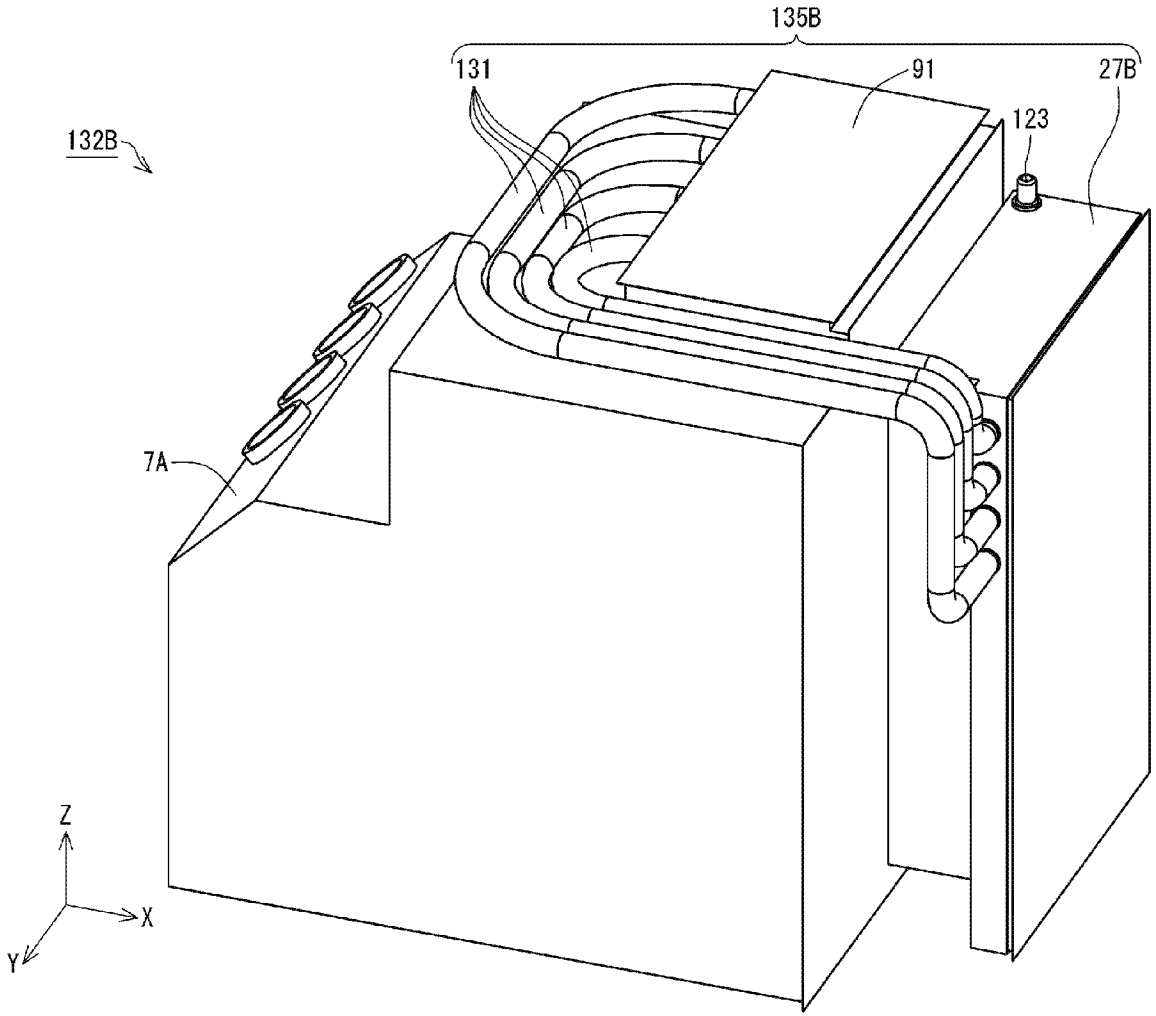
FIG. 20 is a perspective view of a liquid supply unit that connects the tank in the first working example to the buffer unit in the third working example.

In the buffer unit 27B of the third working example as well, similarly to the buffer unit 27A of the second working example, the connection/communication portions 124 are connected to the communication portions 54 of the tank 7A via the tubes 131. Accordingly, as shown in FIG. 20, a liquid supply unit 132B is constituted by connecting the tank 7A and the buffer unit 27B via the tubes 131.

Figure 21:
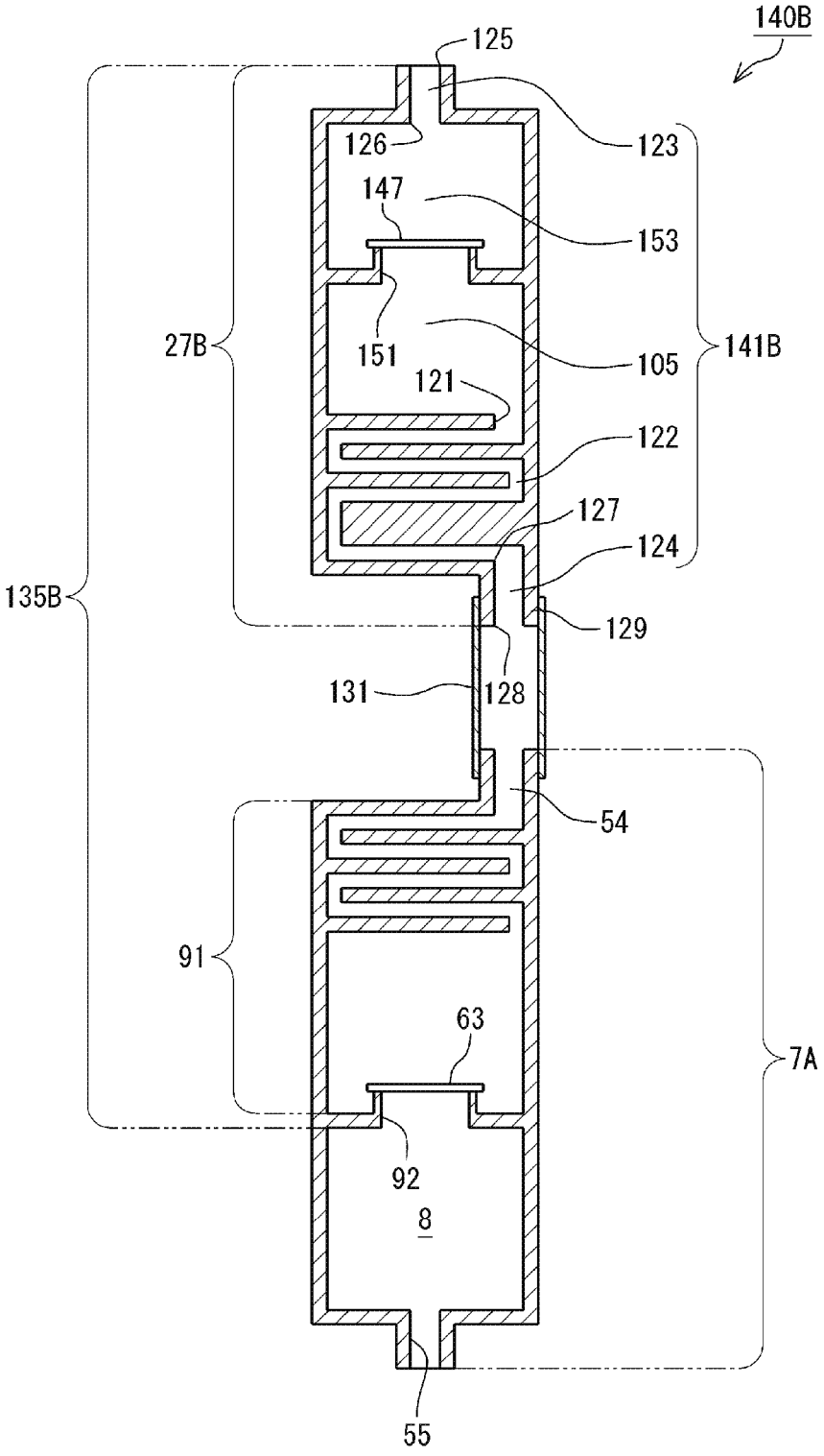
FIG. 21 is a diagram schematically showing a flow channel in the third working example.

As shown in FIG. 21, a flow channel 140B in the liquid supply unit 132B includes the buffer chamber 153 that is interposed between the air inlet portion 123 and the buffer chamber 105. With the exception of the above point, the flow channel 140B of the third working example has the same configuration as the flow channel 140A of the second working example. For this reason, hereinafter, configurations that are the same as in the flow channel 140A of the second working example will be denoted by the same reference signs as in the second working example, and will not be described in detail.

Note that as shown in FIG. 21, in the liquid supply unit 132B, an air introduction portion 135B is configured to include the buffer unit 27B, the tubes 131, and the air introduction passages 91 (FIG. 10) provided in the tank 7A. In this working example, the air introduction portion 135B includes the buffer unit 27B, the tubes 131, and the air introduction passages 91 (FIG. 10) provided in the tank 7A. For this reason, the buffer unit 27B constitutes at least a portion of the air introduction portion 135B. Also, in the buffer unit 27B, the air inlet portion 123, the buffer chamber 153, the buffer chamber 105, the communication passage 122, and the connection/communication portion 124 constitute an introduction passage 141B.

The buffer chamber 153 is provided on the downstream side of the air inlet portion 123. The buffer chamber 105 is provided on the downstream side of the buffer chamber 153. The buffer chamber 153 and the buffer chamber 105 are in communication via the communication hole 151. The communication hole 151 is blocked by the waterproof ventilation film 147 on the upstream side. Accordingly, the introduction passage 141B is blocked by the waterproof ventilation film 147 on the upstream side of the buffer chamber 105.

Air that has flowed through the air inlet 125 and into the air inlet portion 123 flows through the introduction opening 126 and into the buffer chamber 153. The air that flowed into the buffer chamber 153 then passes through the waterproof ventilation film 147 and flows through the communication hole 151 and then into the buffer chamber 105. The subsequent flow path is the same as in the second working example, and therefore will not be described in detail.

The same effects as in the second working example are obtained in the third working example as well. Furthermore, in the third working example, the buffer chamber 153 is interposed between the air inlet portion 123 and the buffer chamber 105. For this reason, even if ink in the liquid storage portion 8 flows into the buffer chamber 105 for example, the advancement of the ink is readily stopped in the buffer chamber 153 provided on the upstream side of the buffer chamber 105. This therefore more readily prevents ink in the liquid storage portion 8 from leaking to the outside of the tank 7A through the air introduction portion 135B.

Furthermore, in the third working example, the communication hole 151, which puts the buffer chamber 105 and the buffer chamber 153 into communication with each other, is blocked by the waterproof ventilation film 147. For this reason, when ink in the liquid storage portion 8 flows into the buffer chamber 105 for example, it is possible to suppress the case where the ink in the buffer chamber 105 flows into the buffer chamber 153. This therefore more readily prevents ink in the liquid storage portion 8 from leaking to the outside of the tank 7A through the air introduction portion 135B. Note that the waterproof ventilation film 147 is also one example of a waterproof ventilation sheet.

Fourth Working Example

Figure 22:
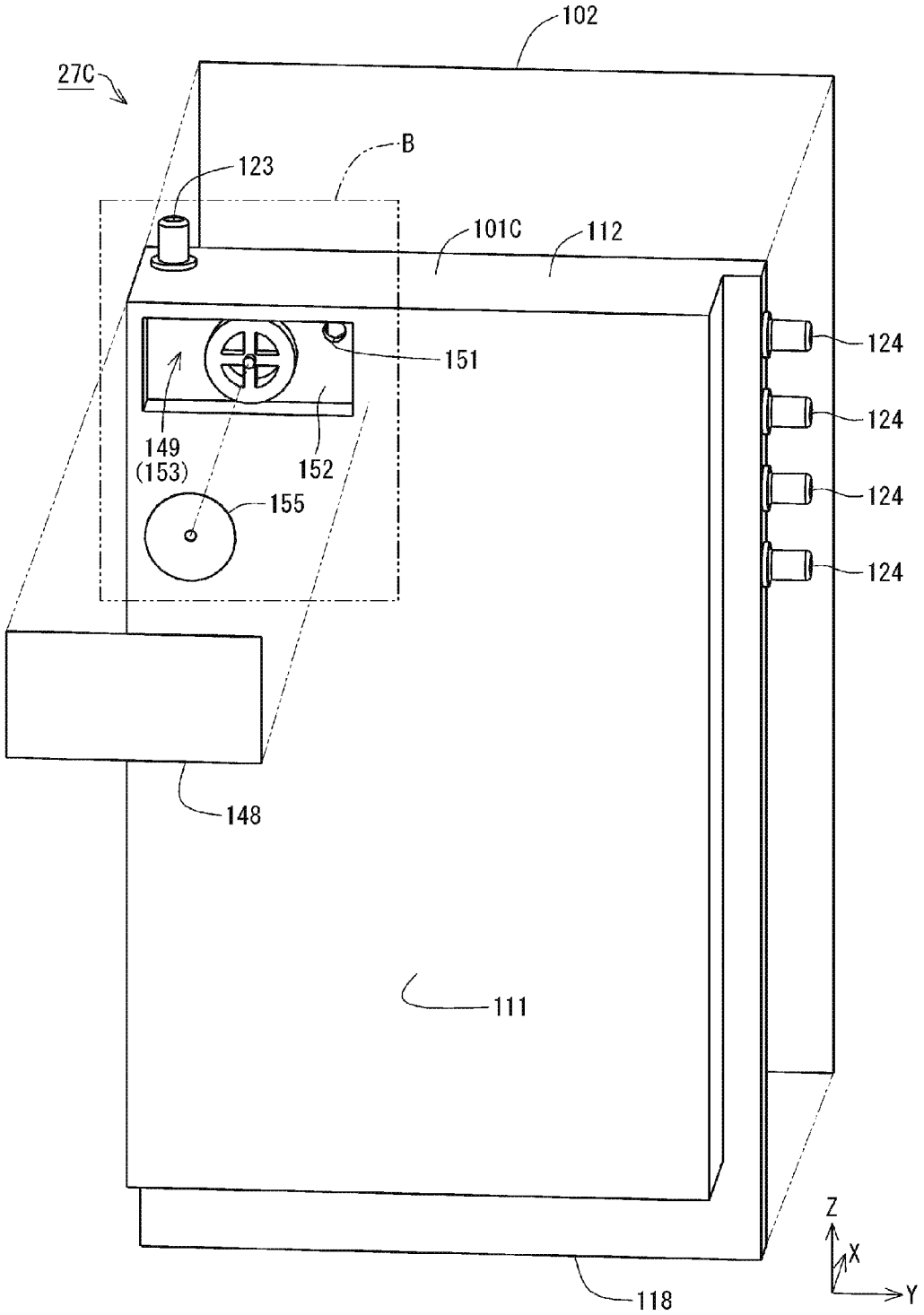
FIG. 22 is an exploded perspective view of a buffer unit in a fourth working example.

As shown in FIG. 22, a buffer unit 27C of a fourth working example has a case 101C, the sheet member 102, an air introduction valve 155 that is example of a waterproof ventilation member, and the sheet member 148. The buffer unit 27C of the fourth working example has a configuration in which the case 101A in the buffer unit 27A of the second working example is replaced with the case 101C, and the air introduction valve 155 and the sheet member 148 have been added. With the exception of the above points, the buffer unit 27C of the fourth working example has the same configuration as the buffer unit 27A of the second working example. For this reason, configurations in the fourth working example that are the same as in the second working example will be denoted using the same reference signs as in the second working example, and will not be described in detail.

Figure 23:
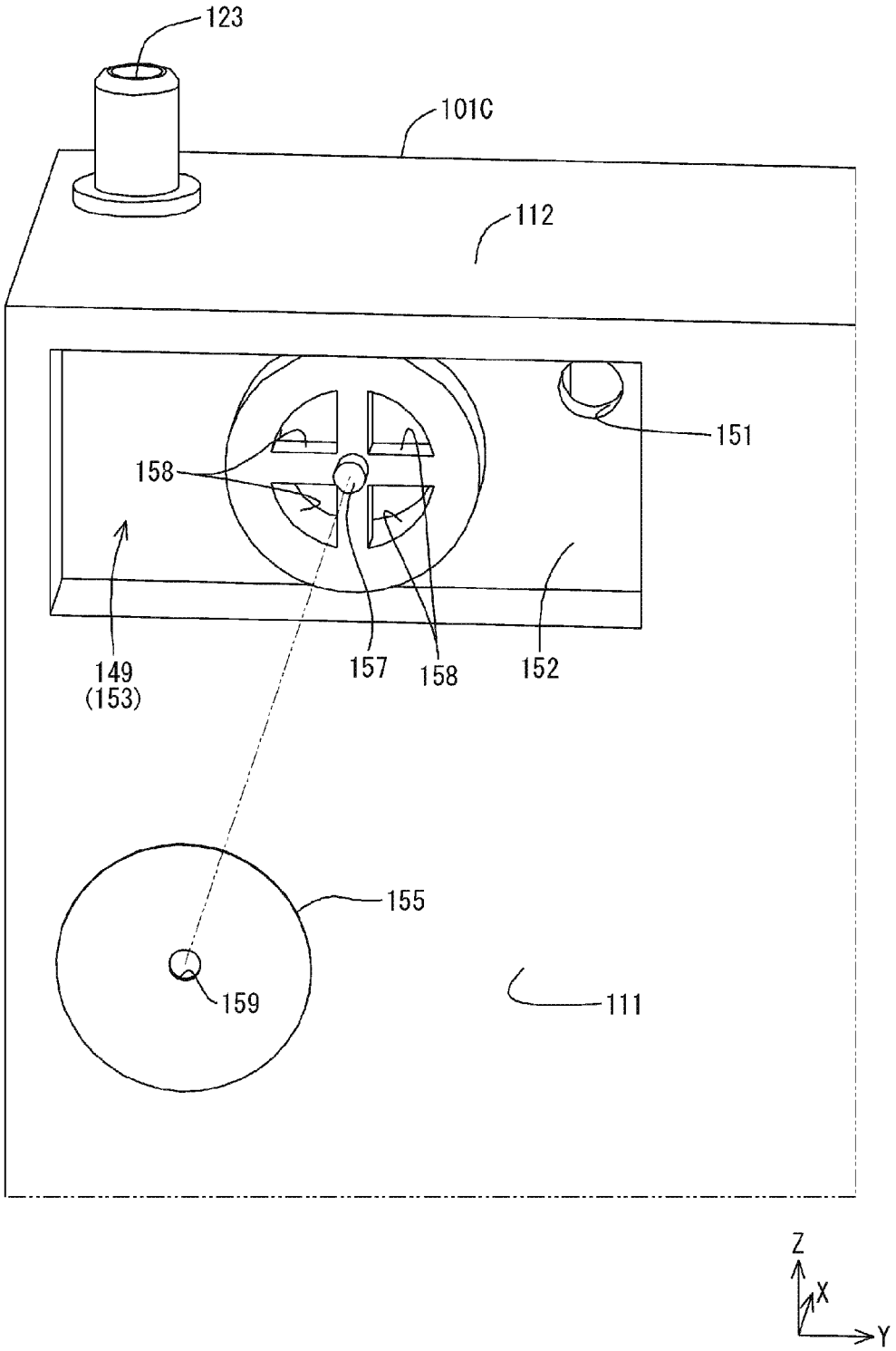
FIG. 23 is an enlarged view of portion B in FIG. 22.

As shown in FIG. 23, which is an enlarged view of portion B in FIG. 22, the recessed portion 149 and the communication hole 151 are formed in the case 101C. The recessed portion 149 and the communication hole 151 have the same configurations as in the third working example, and therefore will not be described in detail.

Furthermore, a shaft portion 157 and through-holes 158 are provided inside the recessed portion 149 of the case 101C. The shaft portion 157 protrudes in the −X axis direction in the recessed portion 149. The amount of protrusion of the shaft portion 157 from the bottom portion 152 is smaller than the depth of the recessed portion 149 in the X axis direction. For this reason, the shaft portion 157 is entirely contained within the recessed portion 149. The through-holes 158 are formed in the periphery of the shaft portion 157. The through-holes 158 pass through the bottom portion 152 of the recessed portion 149 in the X axis direction.

The air introduction valve 155 is constituted by an elastic material such as rubber or an elastomer, and has a plate-like appearance. A through-hole 159 is formed in the air introduction valve 155. The through-hole 159 of the air introduction valve 155 is fitted around the shaft portion 157 in the recessed portion 149. The air introduction valve 155 has a size and shape capable of covering the through-holes 158. For this reason, when the through-hole 159 of the air introduction valve 155 is fitted around the shaft portion 157, the through-holes 158 are blocked by the air introduction valve 155.

In the state where the through-holes 158 are blocked by the air introduction valve 155, the sheet member 148 shown in FIG. 22 blocks the recessed portion 149. For this reason, the air introduction valve 155 is accommodated inside the buffer chamber 153.

Figure 24:
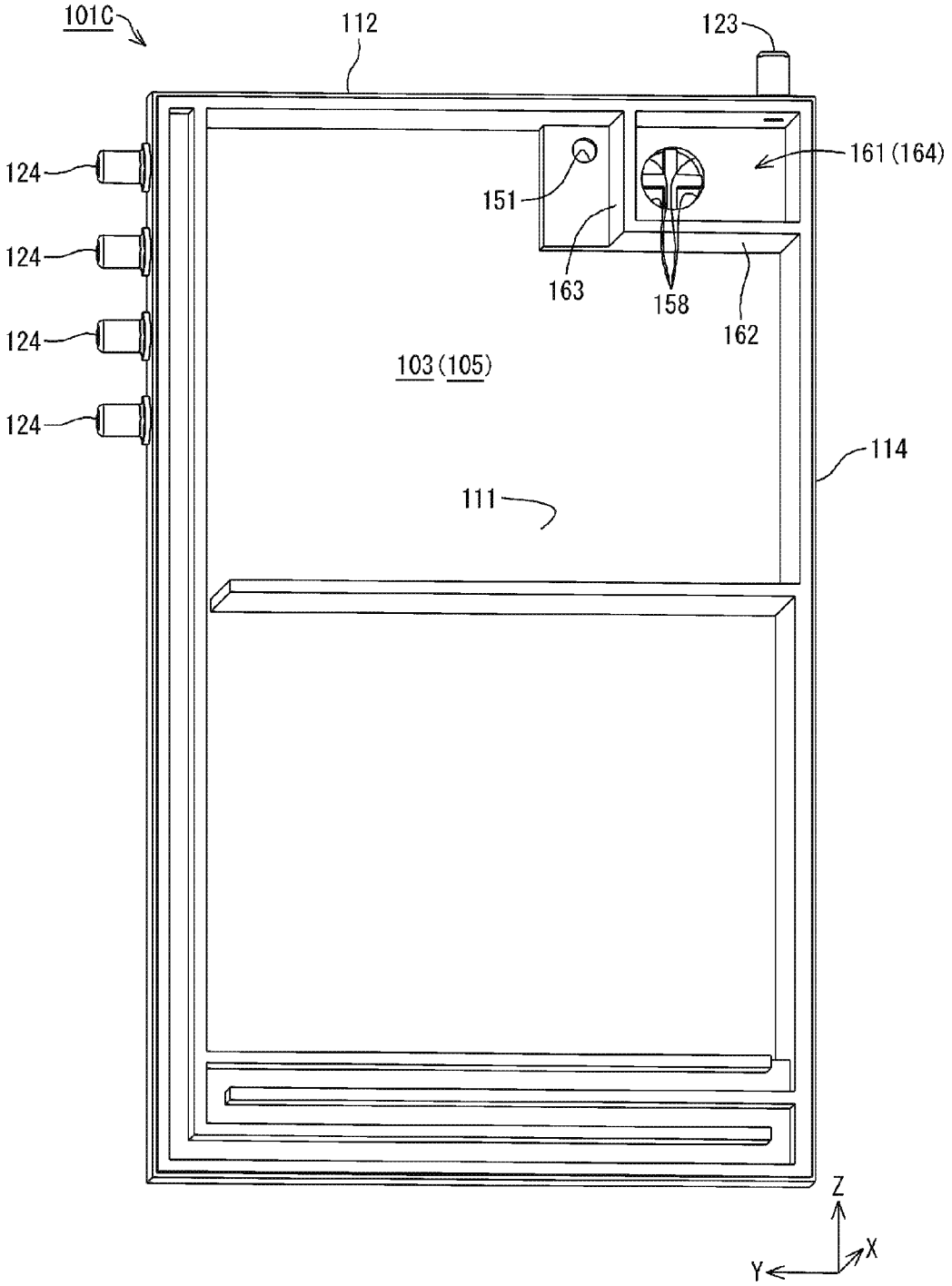
FIG. 24 is a perspective view of a case of the buffer unit in the fourth working example.

As shown in FIG. 24, a recessed portion 161 is formed on the sheet member 102 (FIG. 22) side of the bottom portion 152. The recessed portion 161 is formed so as to recede in the −X axis direction. In other words, the recessed portion 161 is open in the X axis direction. The recessed portion 161 is formed at a position that is overlapped with the recessed portion 149 (FIG. 23) with the bottom portion 152 therebetween. The through-holes 158 pass through the bottom portion 152 and are in communication with the recessed portion 161. For this reason, the recessed portion 161 is in communication with the recessed portion 149 (FIG. 23) via the through-holes 158.

The recessed portion 161 is surrounded by the wall 112, the wall 114, a wall 162, and a wall 163. The wall 162 is provided on the wall 111, and extends along the XY plane. The wall 162 protrudes from the wall 111 in the X axis direction, and intersects the wall 114. The wall 163 is provided on the bottom portion 152, and extends along the XZ plane. The wall 163 protrudes from the bottom portion 152 in the X axis direction, and intersects the wall 112 and the wall 162. According to the above configuration, the recessed portion 161 is constituted by the bottom portion 152 along with the wall 112, the wall 114, the wall 162, and the wall 163 that surround the bottom portion 152.

Note that the communication hole 151 is located on the Y axis direction side of the wall 163. For this reason, the communication hole 151 is located outside of the recessed portion 161. The communication hole 151 is in communication with the recessed portion 103 outside of the recessed portion 161. Accordingly, the recessed portion 103 is in communication with the recessed portion 149 (FIG. 23) via the communication hole 151. Also, in this working example, the air inlet portion 123 is in communication with the recessed portion 161. The amounts of protrusion of the wall 162 and the wall 163, which define the recessed portion 161, from the wall 111 are the same as the amounts of protrusion of the wall 112 and the wall 114 from the wall 111. For this reason, when the sheet member 102 is joined to the case 101C, the region surrounded by the recessed portion 161 and the sheet member 102 is separated from the buffer chamber 105. The region surrounded by the recessed portion 161 and the sheet member 102 will be referred to as a buffer chamber 164.

The buffer chamber 164 is in communication with the buffer chamber 153 (FIG. 22) via the through-holes 158. The through-holes 158 are blocked by the air introduction valve 155. For this reason, the communication between the buffer chamber 164 and the buffer chamber 153 is obstructed by the air introduction valve 155. As previously described, the air introduction valve 155 is provided inside the buffer chamber 153. For this reason, the passage between the buffer chamber 164 and the buffer chamber 153 is closed by the air introduction valve 155 on the buffer chamber 153 side.

Figure 25:
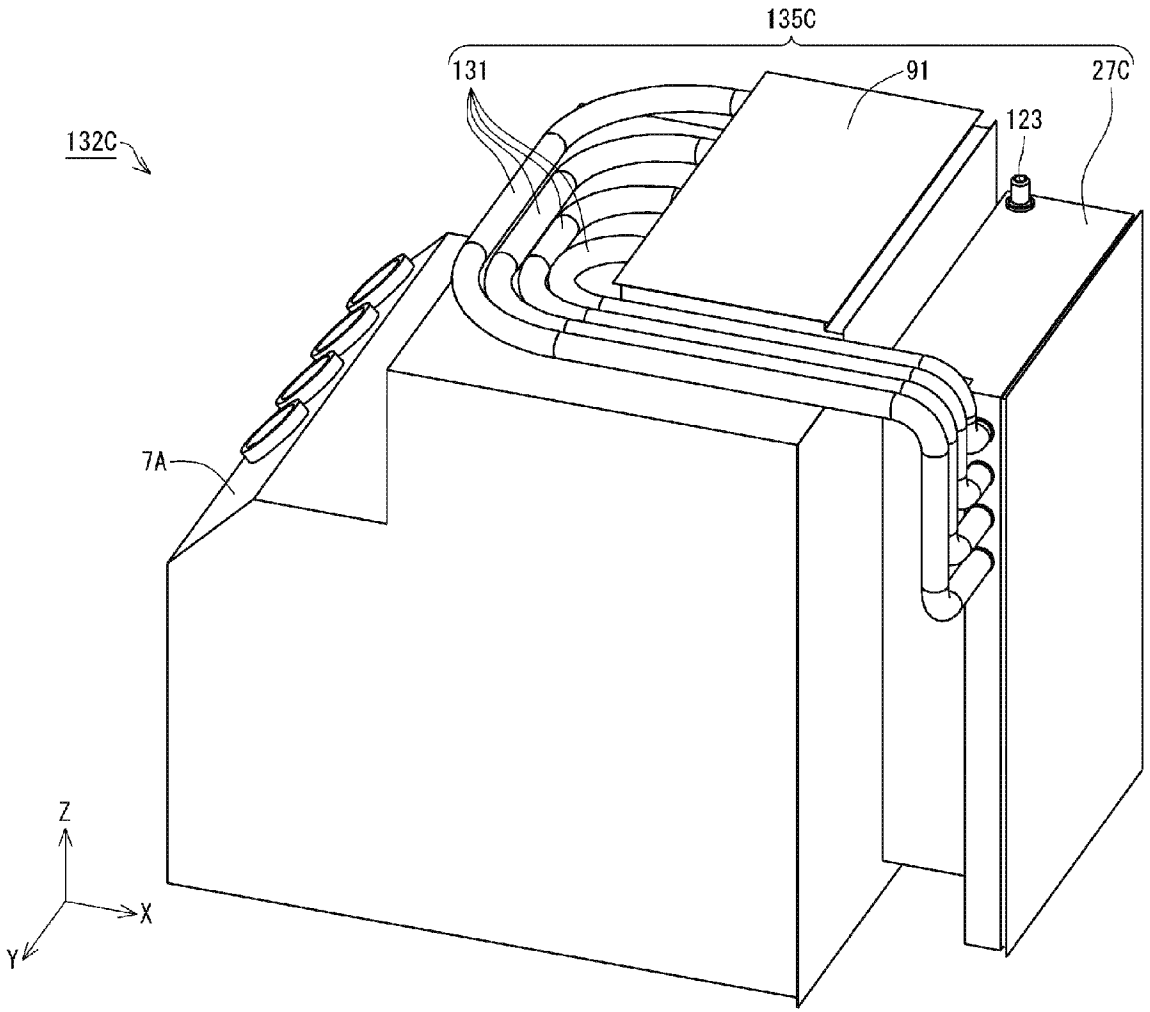
FIG. 25 is a perspective view of a liquid supply unit that connects the tank in the first working example to the buffer unit in the fourth working example.

In the buffer unit 27C of the fourth working example as well, similarly to the buffer unit 27A of the second working example, the connection/communication portions 124 are connected to the communication portions 54 of the tank 7A via the tubes 131. Accordingly, as shown in FIG. 25, a liquid supply unit 132C is constituted by connecting the tank 7A and the buffer unit 27C via the tubes 131.

Figure 26:
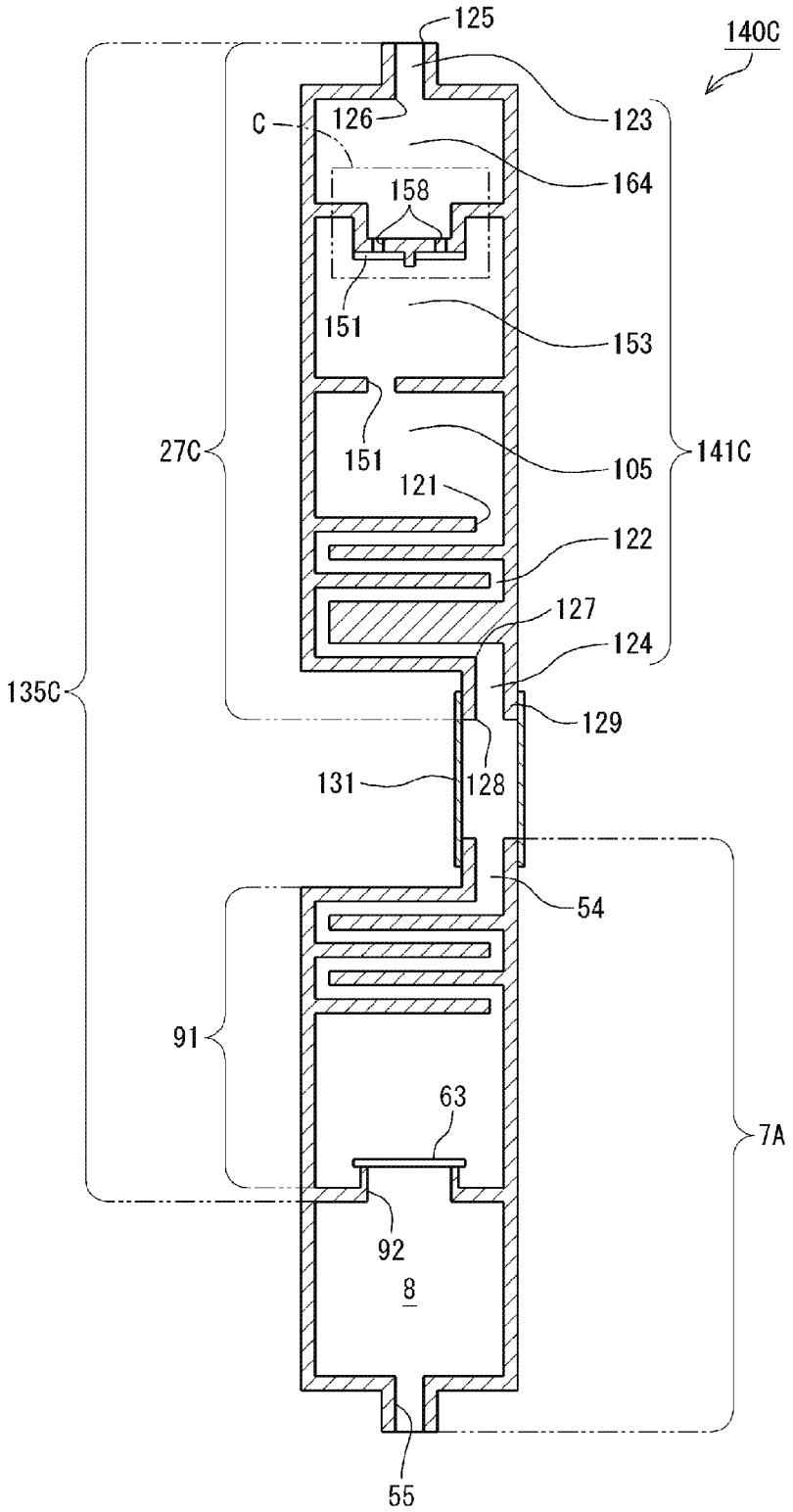
FIG. 26 is a diagram schematically showing a flow channel in the fourth working example.

As shown in FIG. 26, a flow channel 140C in the liquid supply unit 132C includes the buffer chamber 164 and the buffer chamber 153 that are interposed between the air inlet portion 123 and the buffer chamber 105. With the exception of the above point, the flow channel 140C of the fourth working example has the same configuration as the flow channel 140A of the second working example. For this reason, hereinafter, configurations that are the same as in the flow channel 140A of the second working example will be denoted by the same reference signs as in the second working example, and will not be described in detail.

Note that as shown in FIG. 26, in the liquid supply unit 132C, an air introduction portion 135C is configured to include the buffer unit 27C, the tubes 131, and the air introduction passages 91 (FIG. 10) provided in the tank 7A. In this working example, the air introduction portion 135C includes the buffer unit 27C, the tubes 131, and the air introduction passages 91 (FIG. 10) provided in the tank 7A. For this reason, the buffer unit 27C constitutes at least a portion of the air introduction portion 135C. Also, in the buffer unit 27C, the air inlet portion 123, the buffer chamber 164, the buffer chamber 153, the buffer chamber 105, the communication passage 122, and the connection/communication portion 124 constitute an introduction passage 141C.

The buffer chamber 164 is provided on the downstream side of the air inlet portion 123. The buffer chamber 153 is provided on the downstream side of the buffer chamber 164. The buffer chamber 153 and the buffer chamber 105 are in communication via the through-holes 158. The through-holes 158 are blocked by the air introduction valve 155 on the upstream side. Accordingly, the introduction passage 141C is blocked by the air introduction valve 155 on the upstream side of the buffer chamber 105.

Figure 27:
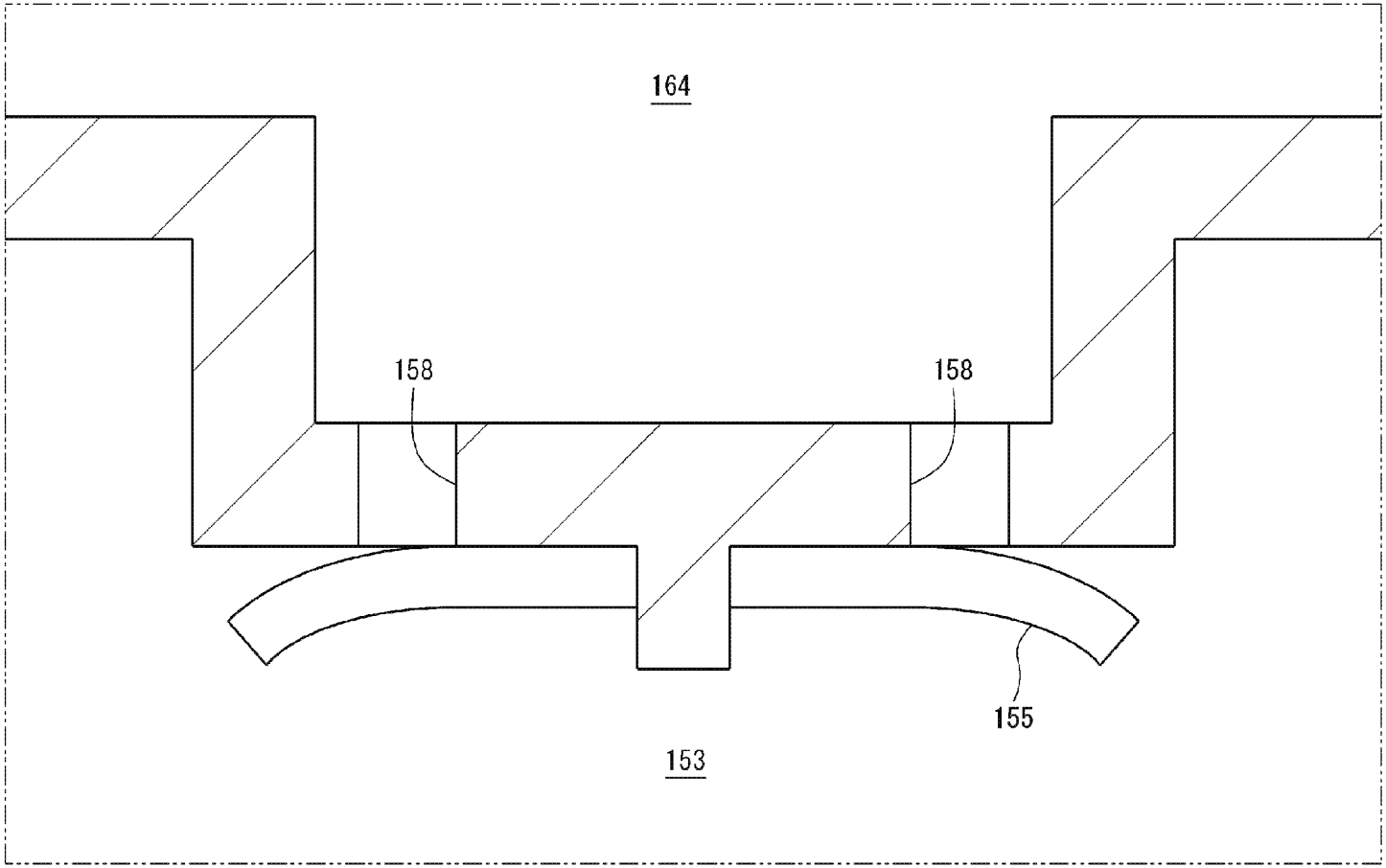
FIG. 27 is an enlarged view of portion C in FIG. 26.

As printing is performed by the recording portion 31 (FIG. 3), the pressure inside the liquid storage portion 8 falls below atmospheric pressure. When the pressure inside the liquid storage portion 8 falls below atmospheric pressure, as shown in FIG. 27, which is an enlarged view of portion C in FIG. 26, the air introduction valve 155 bends from the buffer chamber 164 side toward the buffer chamber 153 side due to the pressure difference between the buffer chamber 164 and the buffer chamber 153. Accordingly, the through-holes 158 become unblocked, and the buffer chamber 164 and the buffer chamber 153 are put into communication with each other. As a result, the passage between the buffer chamber 164 and the buffer chamber 153 is opened. Accordingly, air can flow from the buffer chamber 164 into the buffer chamber 153. The subsequent flow path is the same as in the second working example, and therefore will not be described in detail.

As described above, air is fed into the liquid storage portion 8 through the air introduction portion 135C. Accordingly, the pressure inside the liquid storage portion 8 is readily kept at atmospheric pressure. When the pressure inside the liquid storage portion 8 approaches atmospheric pressure, the air introduction valve 155 returns to its original shape due to its elasticity. Accordingly, when the pressure inside the liquid storage portion 8 approaches atmospheric pressure, the passage between the buffer chamber 164 and the buffer chamber 153 is closed.

In the state where the through-holes 158 are blocked by the air introduction valve 155, that is to say in the state where the passage between the buffer chamber 164 and the buffer chamber 153 is closed, the flow of ink from the buffer chamber 153 toward the buffer chamber 164 is obstructed. In other words, the air introduction valve 155 is a valve that allows air to flow into the buffer chamber 105 from a location upstream of the buffer chamber 105, and can also prevent the flow of ink from the buffer chamber 105 to a location upstream of the buffer chamber 105.

The same effects as in the second working example are obtained in the fourth working example as well. Furthermore, in the fourth working example, the buffer chamber 164 and the buffer chamber 153 are interposed between the air inlet portion 123 and the buffer chamber 105. For this reason, even if ink in the liquid storage portion 8 flows into the buffer chamber 105 for example, the advancement of the ink is readily stopped in the buffer chamber 153 provided on the upstream side of the buffer chamber 105. Furthermore, even if ink in the liquid storage portion 8 flows into the buffer chamber 153, the advancement of the ink is readily stopped in the buffer chamber 164 provided on the upstream side of the buffer chamber 153. This therefore more readily prevents ink in the liquid storage portion 8 from leaking to the outside of the tank 7A through the air introduction portion 135C.

Furthermore, in the fourth working example, the through-holes 158, which put the buffer chamber 153 and the buffer chamber 164 into communication with each other, are blocked by the air introduction valve 155. The flow of ink from the buffer chamber 153 to the buffer chamber 164 can be prevented by the air introduction valve 155. For this reason, when ink in the liquid storage portion 8 flows into the buffer chamber 153 for example, it is possible to suppress the case where the ink in the buffer chamber 153 flows into the buffer chamber 164. This therefore more readily prevents ink in the liquid storage portion 8 from leaking to the outside of the tank 7A through the air introduction portion 135C.

Fifth Working Example

Figure 28:
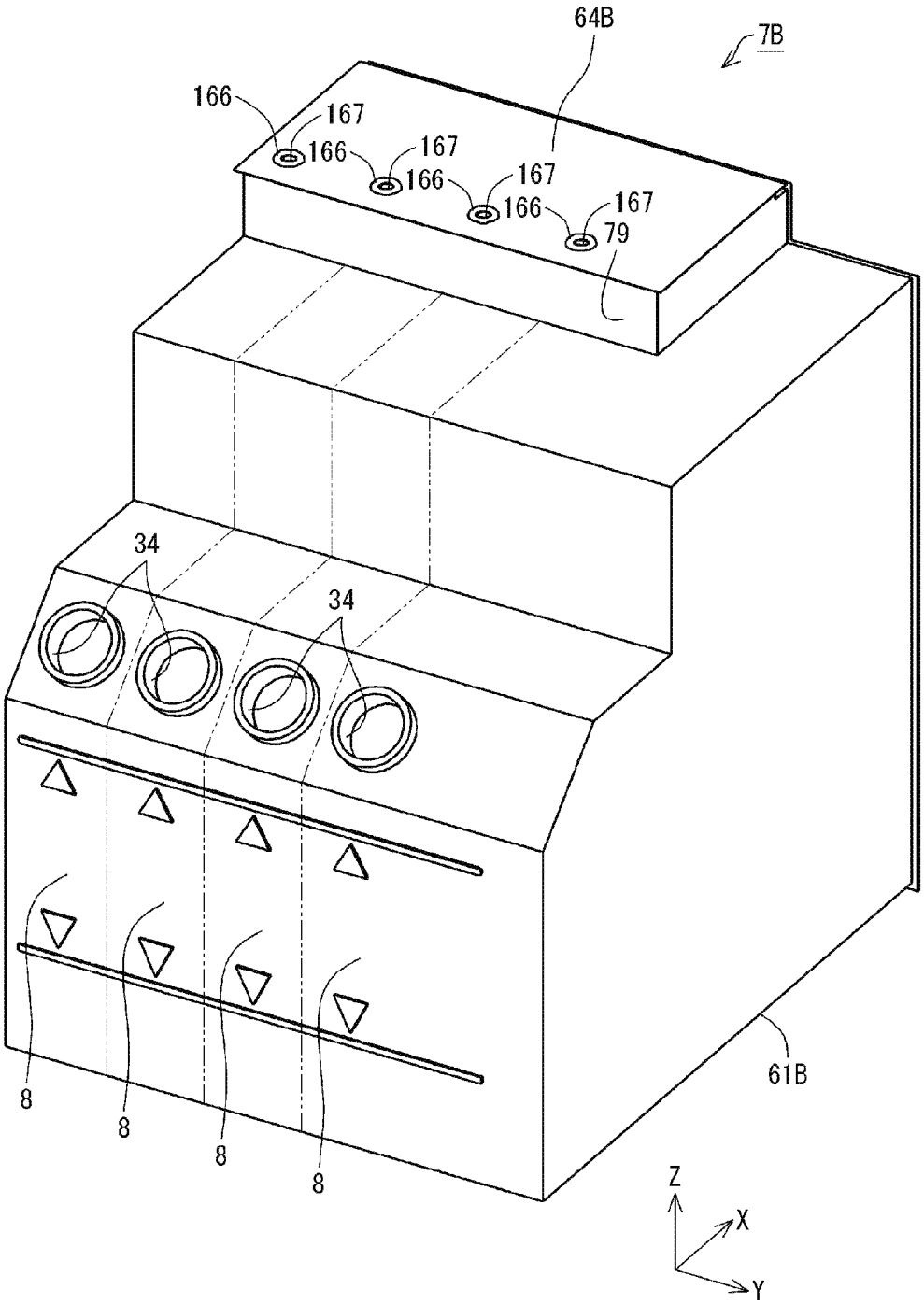
FIG. 28 is a perspective view of a tank in a fifth working example.

The following describes a tank 7B of a fifth working example. As shown in FIG. 28, the tank 7B of the fifth working example has a case 61B, a sheet member 64B, and sealing members 166. The tank 7B of the fifth working example has a configuration in which the case 61A of the tank 7A of the first working example is replaced with the case 61B, and the sheet member 64A of the tank 7A of the first working example is replaced with the sheet member 64B. Also, the sealing members 166 have been added in the tank 7B of the fifth working example. With the exception of the above points, the tank 7B of the fifth working example has the same configuration as the tank 7A of the first working example. For this reason, configurations in the tank 7B of the fifth working example that are the same as configurations in the first working example will be denoted by the same reference signs as in the first working example, and will not be described in detail.

The case 61B has a configuration in which the communication portions 54 (FIG. 7) of the case 61A in the first working example have been omitted. The wall 79 (FIG. 10) of the case 61A in the first working example is provided with the communication portions 54 that pass through the wall 79. In contrast, the wall 79 of the case 61B shown in FIG. 28 is not provided with openings that pass through the wall 79. With the exception of the above point, the case 61B has the same configuration as the case 61A. For this reason, configurations in the case 61B that are the same as configurations in the case 61A will be denoted by the same reference signs as the configurations in the case 61A, and will not be described in detail.

Figure 29:
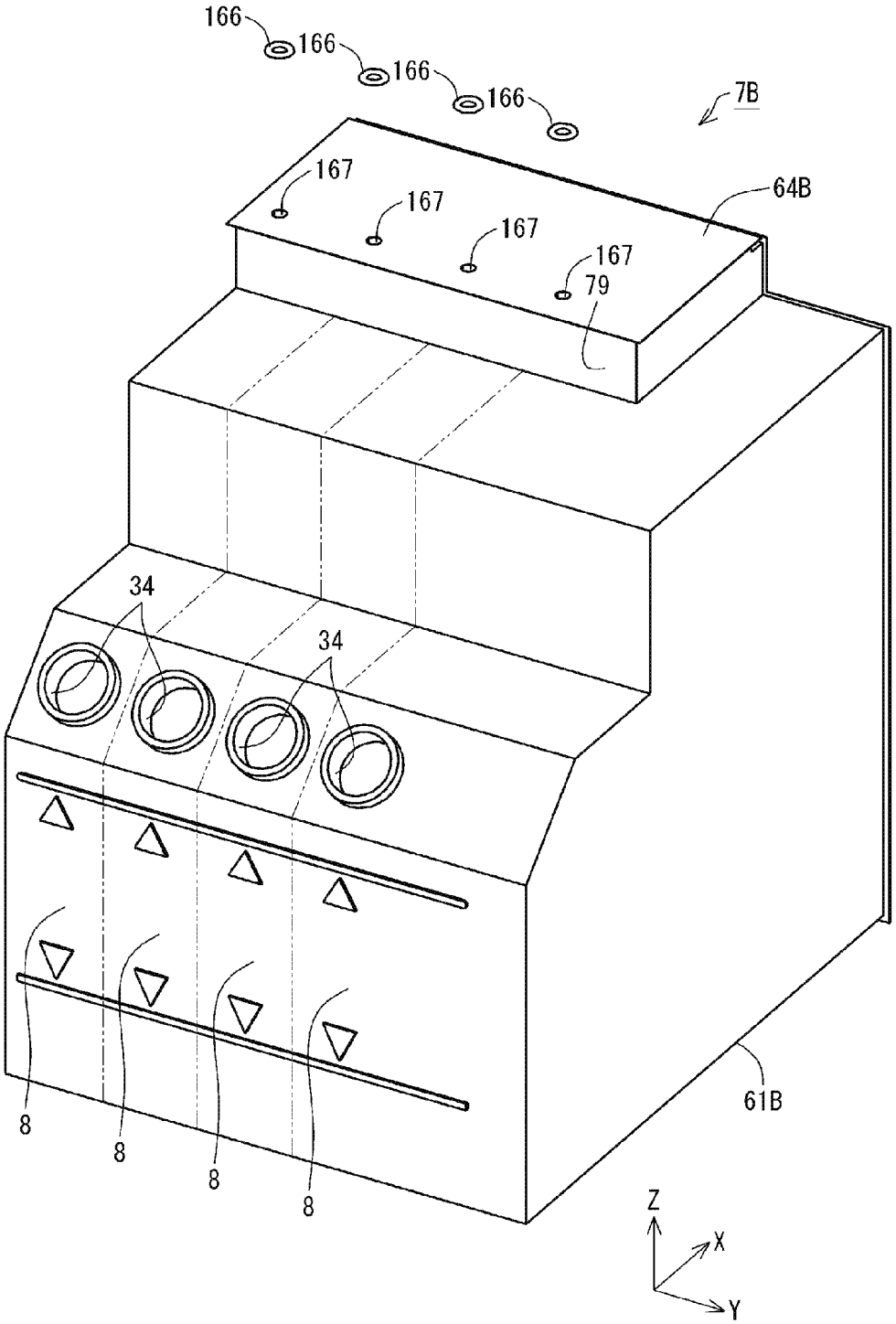
FIG. 29 is an exploded perspective view of the tank in the fifth working example.

As shown in FIG. 29, communication openings 167 are formed in the sheet member 64B. With the exception of the above point, the sheet member 64B has the same configuration as the sheet member 64A. One communication opening 167 is provided for each liquid storage portion 8. The communication openings 167 and the liquid storage portions 8 are formed in one-to-one correspondence with each other. The communication openings 167 pass through the sheet member 64B along the Z axis. Accordingly, the liquid storage portions 8 are in communication with the outside of the tank 7B via the communication openings 167.

One sealing member 166 is provided for each of the communication openings 167. The sealing members 166 have a ring-like appearance. The sealing members 166 are joined to the sheet member 64B so as to surround the corresponding communication openings 167. The sealing members 166 are constituted by an elastic material such as rubber or an elastomer. Note that various types of joining methods such as adhesion and welding can be employed as the method for joining the sealing members 166 to the sheet member 64B.

Figure 30:
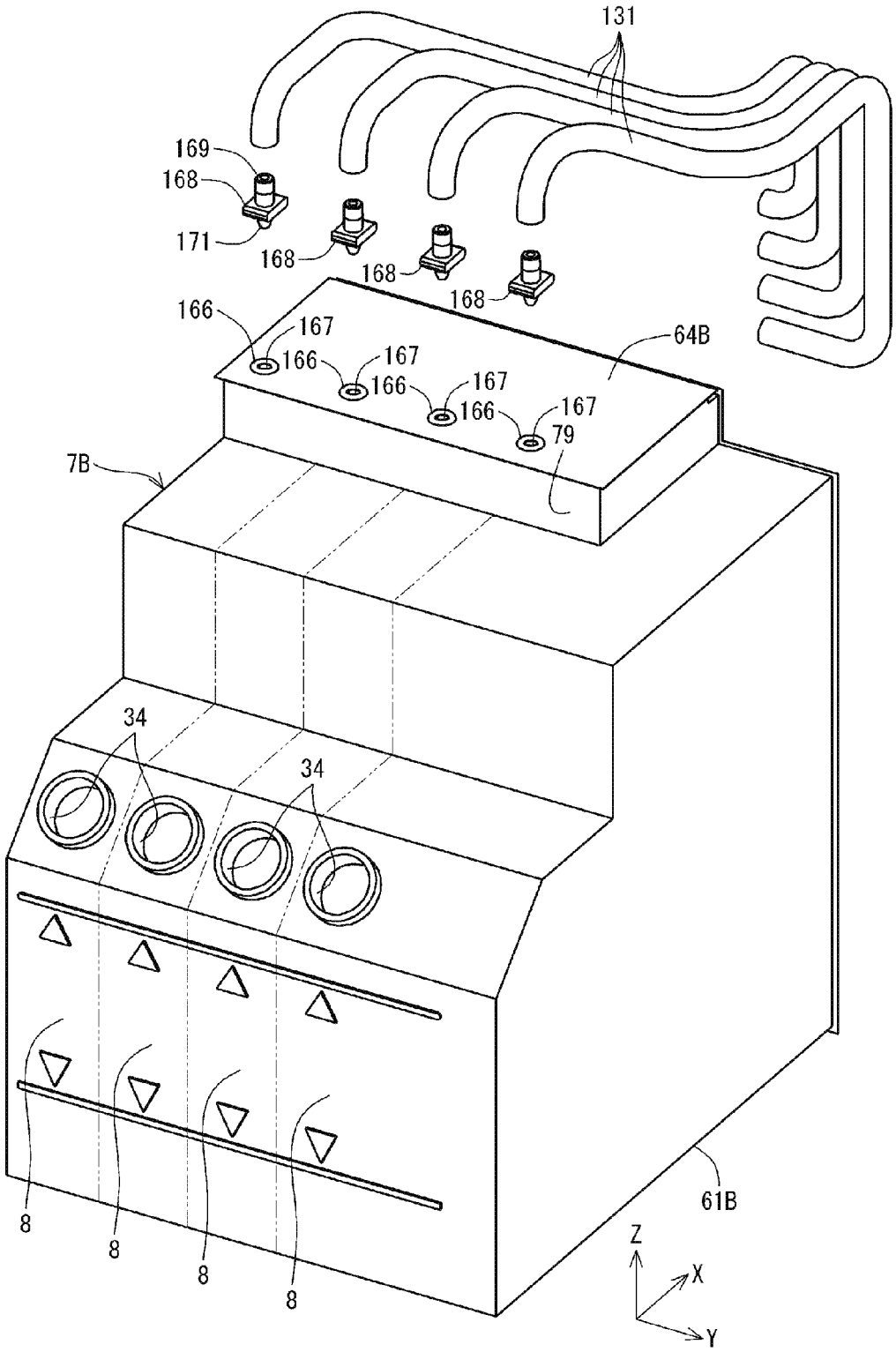
FIG. 30 is an exploded perspective view of the tank, connection members, and tubes in the fifth working example.

As shown in FIG. 30, in the fifth working example, the tank 7B and the tubes 131 are connected via connection members 168. The connection members 168 each have a hollow tube-like appearance, and include a tube connection portion 169 for insertion into one of the tubes 131 and a seal connection portion 171 for insertion into one of the sealing members 166. According to the above configuration, the liquid storage portions 8 of the tank 7B can be put into communication with the tubes 131. The same effects as in the first working example are obtained in the fifth working example as well.

The following describes an example of inspection items in the manufacturing process for the tank 7A and the tank 7B. The manufacturing process for the tank 7A and the tank 7B includes a step for inspecting the joined state of the sheet member 62, the sheet member 64A, and the sheet member 64B (referred to hereinafter as joining inspection). In this inspection, the pressure inside the sealed tank 7A and tank 7B is maintained at a pressure higher than atmospheric pressure, and it is examined whether pressure leakage from the joining portion of the sheet member 62, the sheet member 64A, and the sheet member 64B is lower than a prescribed value. By performing this joining inspection, it is possible to determine whether or not the joined state is favorable. Note that this joining inspection is carried out for each of the liquid storage portions 8.

In the joining inspection for the tank 7A, it is possible to employ a method in which any two out of the liquid injection portion 34 (FIG. 5), the communication portion 54, and the liquid supply portion 55 (FIG. 6) are sealed, and a pressurization pump or the like is used to pressurize the interior of the tank 7A through the remaining one.

Also, in the joining inspection for the tank 7B as well, it is possible to employ a method in which any two out of the liquid injection portion 34 (FIG. 28), the communication opening 167, and the liquid supply portion 55 (FIG. 6) are sealed, and a pressurization pump or the like is used to pressurize the interior of the tank 7B through the remaining one.

Furthermore, with the tank 7B, it is possible to employ a manufacturing method in which the joining inspection is carried out before the communication openings 167 are formed in the sheet member 64B (FIG. 28). In this manufacturing method, a method is employed in which the sheet member 64B is joined to the case 61B before the communication openings 167 are formed in the sheet member 64B. In this manufacturing method, firstly, the sheet member 64B is joined to the case 61B before forming the communication openings 167. Next, the joining inspection is carried out. The communication openings 167 are then formed in the sheet member 64B.

According to this manufacturing method, in the joining inspection, it is possible to employ a method in which either the liquid injection portion 34 (FIG. 28) or the liquid supply portion 55 (FIG. 6) is sealed, and a pressurization pump or the like is used to pressurize the interior of the tank 7B through the remaining one. The communication openings 167 are formed in the sheet member 64B after the joining inspection. According to this method, the portion that is to be sealed before pressurizing the interior of the tank 7B in the joining inspection can be selected out of the liquid injection portion 34 and the liquid supply portion 55. For this reason, the number of portions that are to be sealed can be reduced compared to the method of forming the communication openings 167 in the sheet member 64B and then carrying out the joining inspection, thus making it possible to reduce the amount of time and labor involved in manufacturing.

Note that the step of joining the sealing members 166 to the sheet member 64B may be performed before the step of forming the communication openings 167 in the sheet member 64B, or after the step of forming the communication openings 167 in the sheet member 64B. In the manufacturing method in which the joining inspection is carried out before forming the communication openings 167 in the sheet member 64B, it is possible to employ a sequence in which the sealing members 166 are joined to the sheet member 64B before the joining inspection, or a sequence in which the sealing members 166 are joined to the sheet member 64B after the joining inspection, and then the communication openings 167 are formed. It is also possible to employ a sequence in which the communication openings 167 are formed in the sheet member 64B after the joining inspection, and then the sealing members 166 are joined.

The sequence in which the sealing members 166 are joined to the sheet member 64B before forming the communication openings 167 is preferable in that the sheet member 64B can be reinforced by the sealing members 166. If the sheet member 64B is reinforced by the sealing members 166, it is possible to readily prevent the sheet member 64B from ripping apart in the periphery of the communication openings 167 when the communication openings 167 are formed.

Note that the step of joining the sealing members 166 to the sheet member 64B and the step of forming the communication openings 167 in the sheet member 64B may be performed before the step of joining the sheet member 64B to the case 61B.

In the first embodiment, including the working examples described above, the buffer unit 27 is arranged on the side of the tank 7 that is opposite to the front surface 41 side, and on the −X axis direction side of the waste liquid absorbing unit 28, as shown in FIG. 3. In other words, in the first embodiment, the buffer unit 27 is arranged between the tank 7 and the waste liquid absorbing unit 28. However, the arrangement of the buffer unit 27 is not limited to this, and a configuration is possible in which it is arranged in a gap that extends along the Y axis between the waste liquid absorbing unit 28 shown in FIG. 4 and the casing 6. In this arrangement, a configuration is possible in which even if the buffer unit 27 protrudes farther in the Z axis direction than the tank 7 does, the buffer unit 27 does not extend farther in the −Z axis direction than the tank 7 does.

Also, the buffer unit 27 may be arranged at various positions in the periphery of the tank 7, such as on the Y axis direction side or −Y axis direction side of the tank 7, or the Z axis direction or −Z axis direction side of the tank 7. In these arrangements, a configuration is possible in which even if the buffer unit 27 protrudes farther in the Z axis direction than the tank 7 does, the buffer unit 27 does not extend farther in the −Z axis direction than the tank 7 does.

For example, in the case where the buffer unit 27 is arranged on the Y axis direction side of the tank 7, a configuration is possible in which it is arranged in a gap that extends along the Y axis between the tank 7 and the casing 6 as shown in FIG. 4. Also, for example, in the case where the buffer unit 27 is arranged on the −Y axis direction side (the side opposite to the Y axis direction side) of the tank 7, a configuration is possible in which it is arranged in a gap that extends along the Y axis between the tank 7 and the board tray 38 shown in FIG. 4. This configuration can be realized by providing a gap that is capable of accommodating the buffer unit 27 and extends along the Y axis between the tank 7 and the board tray 38.

Also, for example, in the case where the buffer unit 27 is arranged on the −Y axis direction side (the side opposite to the Y axis direction side) of the tank 7, a configuration is possible in which it is arranged on the Z axis direction side of the board tray 38 shown in FIG. 3, that is to say on the board tray 38. In this configuration, the buffer unit 27 can be placed on a region on the board tray 38 that is on the Y axis direction side of the electrical wiring board 29.

For example, in the case where the buffer unit 27 is arranged on the Z axis direction side of the tank 7, a configuration is possible in which it is arranged vertically above the tank 7 shown in FIG. 3. In this configuration, a configuration may be applied in which, even if the buffer unit 27 protrudes from the region of the tank 7 in a plan view of the buffer unit 27 and the tank 7 in the −Z axis direction, the buffer unit 27 is contained within the region of the tank 7.

For example, in the case where the buffer unit 27 is arranged on the −Z axis direction side of the tank 7, a configuration is possible in which it is arranged at a position that is vertically below the tank 7 shown in FIG. 3 and vertically above the casing 6. In this configuration, the buffer unit 27 is located between the casing 6 and the tank 7 in the Z axis direction. In this configuration, a configuration may be applied in which, even if the buffer unit 27 protrudes from the region of the tank 7 in a plan view of the buffer unit 27 and the tank 7 in the −Z axis direction, the buffer unit 27 is contained within the region of the tank 7.

Also, in the first embodiment, including the working examples described above, a configuration is employed in which one buffer unit 27 is connected to the tank 7. However, the number of buffer units 27 is not limited to one, and two or a number greater than two (hereinafter, referred to as "multiple") may be provided. In this case, a configuration is possible in which multiple buffer units 27 are connected, for example. In such a case, any number of buffer units 27 may be connected.

Furthermore, in this case, the types of buffer units 27 that are connected may be selected from any of the three types described above, namely the buffer unit 27A, the buffer unit 27B, and the buffer unit 27C. Examples of configurations include a configuration in which the connected buffer units 27 are all of the same type, and a configuration in which different types of buffer units 27 are included among the connected buffer units 27. Furthermore, in the case where different types of buffer units 27 are connected, they may be connected in any sequence. Also, in the configuration in which multiple buffer units 27 are connected, the buffer units 27 may each be arranged at any position.

Second Embodiment

Figure 31:
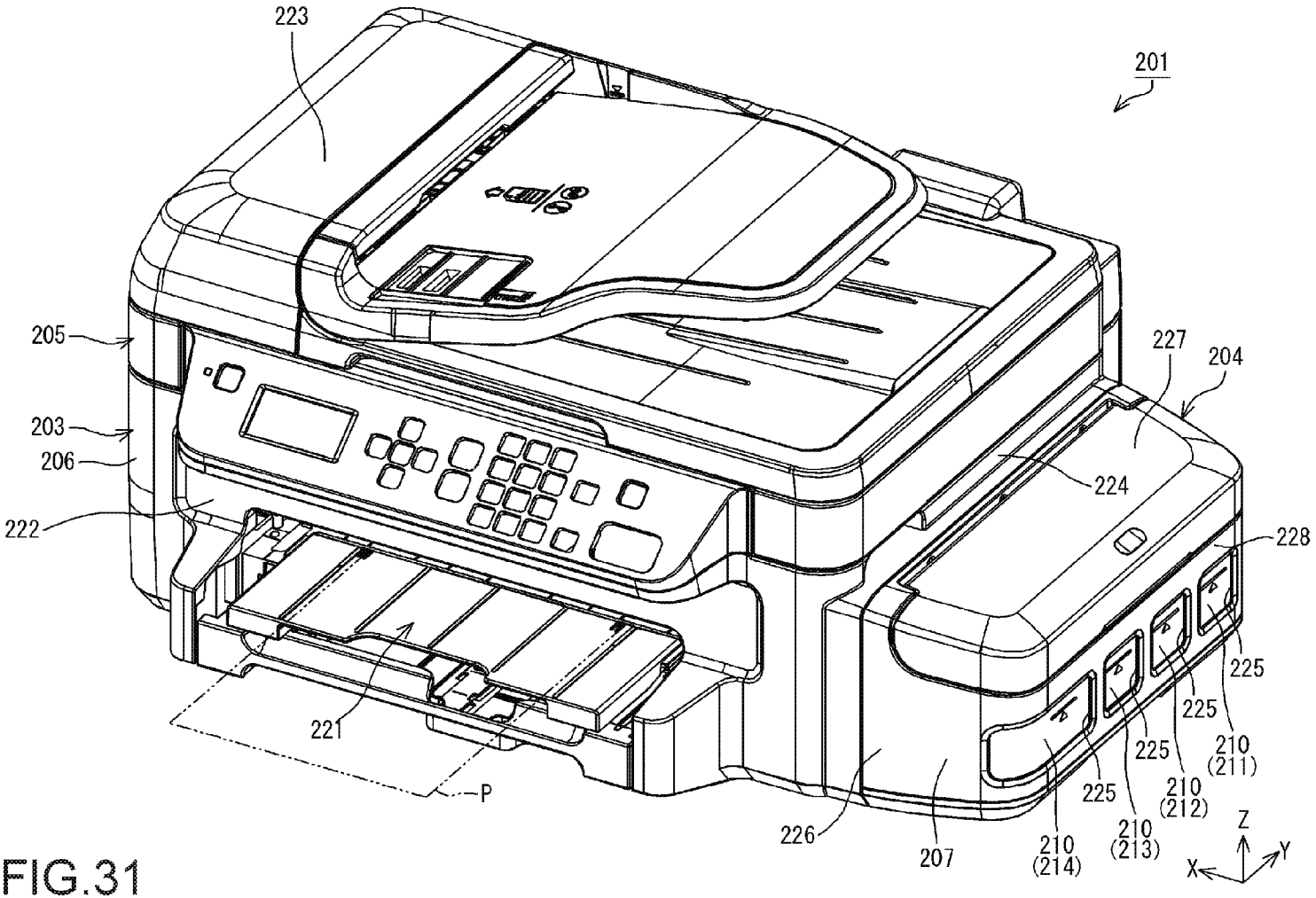
FIG. 31 is a perspective view of a relevant configuration of a liquid ejection system according to a second embodiment.

As shown in FIG. 31, a liquid ejection system 201 of this embodiment has a printer 203 as one example of a liquid ejection device, an ink supply apparatus 204 as one example of a liquid supply apparatus, and a scanner unit 205. The printer 203 has a casing 206. The casing 206 constitutes the outer shell of the printer 203. The ink supply apparatus 204 has a casing 207, which is one example of a liquid storage container mounting portion, and multiple (two or a number greater than two) tanks 210.

In this embodiment, four tanks 210 are provided. Hereinafter, when individually identifying the four tanks 210, the four tanks 210 will be respectively denoted as a tank 211, a tank 212, a tank 213, and a tank 214.

The casing 206, the casing 207, and the scanner unit 205 constitute the outer shell of the liquid ejection system 201. Note that the liquid ejection system 201 can also have a configuration that omits the scanner unit 205. The tanks 210 are one example of a liquid storage container. The liquid ejection system 201 can perform printing on a recording medium P such as a recording sheet using ink as one example of a liquid.

FIG. 31 includes X, Y, and Z axes that are mutually orthogonal coordinate axes. The X, Y, and Z axes are included as necessary in the other figures referenced below as well. In such cases, the X, Y, and Z axes in these figures correspond to the X, Y, and Z axes in FIG. 31. In this embodiment, a state in which the liquid ejection system 201 is arranged on a horizontal plane defined by the X axis and the Y axis (i.e., the XY plane) is the in-use state of the liquid ejection system 201. The orientation of the liquid ejection system 201 when the liquid ejection system 201 is arranged on the XY plane will be referred to as the in-use orientation of the liquid ejection system 201.

The terms "X axis", "Y axis", and "Z axis" used to indicate constituent parts and units of the liquid ejection system 201 in the figures and descriptions given below refer to the X axis, the Y axis, and the Z axis in a state in which the constituent parts and units have been incorporated (mounted) in the liquid ejection system 201. Also, the orientations of the constituent parts and units in the in-use orientation of the liquid ejection system 201 will be referred to as the in-use orientations of the constituent parts and units. Moreover, the descriptions of the liquid ejection system 201, the constituent parts and units thereof, and the like given below are assumed to be descriptions in the in-use orientations thereof unless particularly stated otherwise.

The Z axis is the axis that is orthogonal to the horizontal plane. In the in-use state of the liquid ejection system 201, the Z axis direction is the vertically upward direction. Also, in the in-use state of the liquid ejection system 201, the −Z axis direction is the vertically downward direction in FIG. 31. Note that the directions of the arrows on the X, Y, and Z axes indicate + (positive) directions, and the directions opposite to the arrow directions indicate − (negative) directions.

Note that the four tanks 210 mentioned above are arranged side-by-side along the Y axis. For this reason, the Y axis direction can also be defined as the direction along which the four tanks 210 are aligned. Also, the tank 211, the tank 212, the tank 213, and the tank 214 are arranged side-by-side in the −Y axis direction in the stated order. In other words, among the four tanks 210, the tank 211 is located the farthest on the Y axis direction side. The tank 212 is located on the −Y axis direction side of the tank 212. The tank 213 is located on the −Y axis direction side of the tank 212. The tank 214 is located on the −Y axis direction side of the tank 213.

In the liquid ejection system 201, the printer 203 and the scanner unit 205 are overlapped with each other. When the printer 203 is used, the scanner unit 205 is located vertically above the printer 203. The scanner unit 205 is a flatbed type of scanner unit, and has an image pickup device (not shown) such as an image sensor. The scanner unit 205 can read images and the like recorded on a medium such as a sheet, as image data via the image pickup device. For this reason, the scanner unit 205 functions as a reading apparatus for reading images and the like. The scanner unit 205 is configured to be capable of pivoting relative to the printer 203. The scanner unit 205 also functions as a cover for the printer 203. An operator can pivot the scanner unit 205 relative to the printer 203 by lifting the scanner unit 205 in the Z axis direction. Accordingly, the scanner unit 205 that functions as a cover for the printer 203 can be opened relative to the printer 203.

The printer 203 is provided with a sheet discharge portion 221. A recording medium P is discharged from the sheet discharge portion 221 of the printer 203. The surface of the printer 203 on which the sheet discharge portion 221 is provided is considered to be a front surface 222 of the printer 203. The liquid ejection system 201 also has an upper surface 223 that intersects the front surface 222, and a side portion 224 that intersects the front surface 222 and the upper surface 223. The ink supply apparatus 204 is provided on the side portion 224. The casing 207 is provided with window portions 225. The window portions 225 are provided in a side portion 228 of the casing 207 that intersects the front surface 226 and the upper surface 227.

The window portions 225 have translucency. The four tanks 210 described above are provided at positions that are overlapped with the window portions 225. For this reason, the operator who is using the liquid ejection system 201 can view the four tanks 210 through the window portions 225. In this embodiment, the window portions 225 are provided as openings formed in the casing 207. The operator can view the four tanks 210 through the window portions 225, which are openings. Note that the window portions 225 are not limited to being openings, and may be configured by members that have translucency, for example.

In this embodiment, at least a portion of the section of each of the tanks 210 that faces the window portion 225 has translucency. The ink in the tanks 210 can be viewed through the sections of the tanks 210 that have translucency. Accordingly, by viewing the four tanks 210 through the window portions 225, the operator can view the amount of ink in the tanks 210. In other words, at least a portion of the section of each of the tanks 210 that faces the window portion 225 can be utilized as a viewing portion that allows viewing of the amount of ink.

Figure 32:
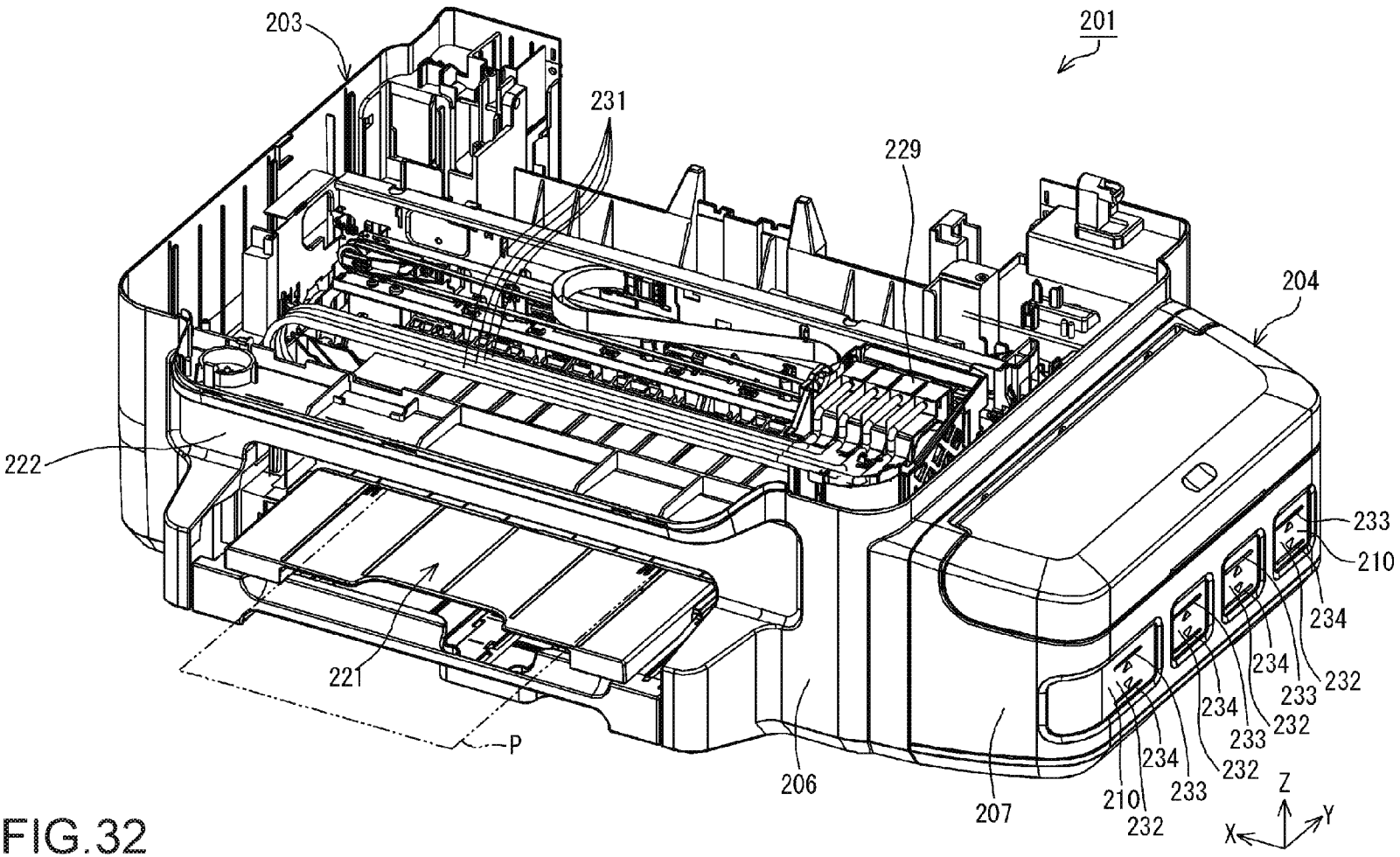
FIG. 32 is a perspective view of the relevant configuration of the liquid ejection system according to the second embodiment.

As shown in FIG. 32, the printer 203 has a recording portion 229. In the printer 203, the recording portion 229 is accommodated in the casing 206. The recording portion 229 performs recording on a recording medium P, which is conveyed in the −Y axis direction by a conveying apparatus (not shown), using ink as one example of a liquid. Note that the conveying apparatus (not shown) intermittently conveys the recording medium P (a recording sheet or the like) in the −Y axis direction. The recording portion 229 is configured to be able to be moved back and forth along the X axis by a moving apparatus (not shown). The ink supply apparatus 204 supplies ink to the recording portion 229. Note that in the liquid ejection system 201, at least a portion of the ink supply apparatus 204 protrudes outward from the casing 206. Note that the recording portion 229 is accommodated in the casing 206. Accordingly, the recording portion 229 can be protected by the casing 206.

Here, the term "direction along the X axis" is not limited to a direction that is completely parallel with the X axis, and also encompasses directions that are inclined relative to the X axis by a margin of error, a tolerance, or the like, while excluding a direction that is orthogonal to the X axis. Similarly, the term "direction along the Y axis" is not limited to a direction that is completely parallel with the Y axis, and also encompasses directions that are inclined relative to the Y axis by a margin of error, a tolerance, or the like, while excluding a direction that is orthogonal to the Y axis. The term "direction along the Z axis" is not limited to a direction that is completely parallel with the Z axis, and also encompasses directions that are inclined relative to the Z axis by a margin of error, a tolerance, or the like, while excluding a direction that is orthogonal to the Z axis. In other words, directions along any axis or plane are not limited to directions that are completely parallel to such axes or planes, and also encompass directions that are inclined relative to such axes or planes by a margin of error, a tolerance, or the like, while excluding directions that are orthogonal to such axes or planes.

The ink supply apparatus 204 has the tanks 210 as one example of a liquid storage container. In this embodiment, the ink supply apparatus 204 has multiple (four in this embodiment) tanks 210. The tanks 210 each protrude outward from the casing 206 of the printer 203. The tanks 210 are accommodated inside the casing 207. Accordingly, the tanks 210 can be protected by the casing 207. The casing 207 protrudes from the casing 206.

Note that in this embodiment, the ink supply apparatus 204 has multiple (four in this embodiment) tanks 210. However, the number of tanks 210 is not limited to four, and the number of tanks that are employed can be three, a number lower than three, or a number greater than four.

Furthermore, in this embodiment, the tanks 210 are configured to be separate from each other. However, the configuration of the tanks 210 is not limited in this way.

Regarding the tank 210 configuration, a configuration is possible in which multiple tanks 210 are integrated into one tank 210. In this case, the one tank 210 is provided with multiple liquid storage portions. The liquid storage portions are configured to be individually separated from each other and be able to store different types of liquids. In this case, for example, different colors of ink can be separately stored in respective liquid storage portions.

As shown in FIG. 32, ink supply tubes 231 are respectively connected to the tanks 210. Ink in the tanks 210 is supplied from the ink supply apparatus 204 to the recording portion 229 via ink supply tubes 231. The recording portion 229 is provided with a recording head (not shown), which is one example of a liquid ejection head. Nozzle openings (not shown) that face the recording medium P are formed in the recording head. Ink supplied from the ink supply apparatus 204 to the recording portion 229 via the ink supply tubes 231 is supplied to the recording head. The ink supplied to the recording portion 229 is then discharged as ink droplets from the nozzle openings of the recording head toward the recording medium P. Note that although the printer 203 and the ink supply apparatus 204 are described as individual configurations in the above example, the ink supply apparatus 204 can also be included in the configuration of the printer 203.

Note that the tanks 210 may have a configuration in which upper limit marks 233, lower limit marks 234, and the like are provided on a viewing surface 232 that enables viewing of the stored amount of ink. The viewing surface 232 is one example of a viewing portion. Also, the upper limit mark 233 is one example of an upper limit indicator portion. The operator can find out of the amount of ink in the tanks 210 by using the upper limit marks 233 and the lower limit marks 234 as a guide. Note that the upper limit marks 233 indicate a guide regarding the amount of ink that can be injected through later-described liquid injection portions 235 without overflowing from the liquid injection portions 235. Also, the lower limit marks 234 indicate a guide regarding an ink amount for prompting ink injection. A configuration is possible in which only either the upper limit marks 233 or the lower limit marks 234 are provided on the tanks 210.

Also, the casing 207 and the casing 206 may be separate from each other, or may be integrated. In the case where the casing 207 and the casing 206 are integrated with each other, the tanks 210 can be accommodated inside the casing 206 along with the recording portion 229 and the ink supply tubes 231. In the case where the casing 207 and the casing 206 are integrated with each other, the casing 206 corresponds to an exterior portion that accommodates the liquid storage containers and the liquid ejection head.

In the liquid ejection system 201 having the above-described configuration, recording is performed on the recording medium P by causing the recording head of the recording portion 229 to discharge ink droplets at predetermined positions on the recording medium P while conveying the recording medium P in the −Y axis direction as well as moving the recording portion 229 back and forth along the X axis.

The ink is not limited to being either water-based ink or oil-based ink. Also, water-based ink may have a configuration in which a solute such as a dye is dissolved in an aqueous solvent, or may have a configuration in which a dispersoid such as a pigment is dispersed in an aqueous dispersion medium. Also, oil-based ink may have a configuration in which a solute such as a dye is dissolved in an oil-based solvent, or may have a configuration in which a dispersoid such as a pigment is dispersed in an oil-based dispersion medium.

Furthermore, sublimation transfer ink can be used as the ink. Sublimation transfer ink is ink that includes a sublimation color material such as a sublimation dye. One example of a printing method is a method in which sublimation transfer ink is ejected onto a transfer medium by a liquid ejection device, and a printing target is brought into contact with the transfer medium and heated to cause the color material to sublimate and be transferred to the printing target. The printing target is a T-shirt, a smartphone, or the like. In this way, if the ink includes a sublimation color material, printing can be performed on a diverse range of printing targets (printing media).

Figure 33:
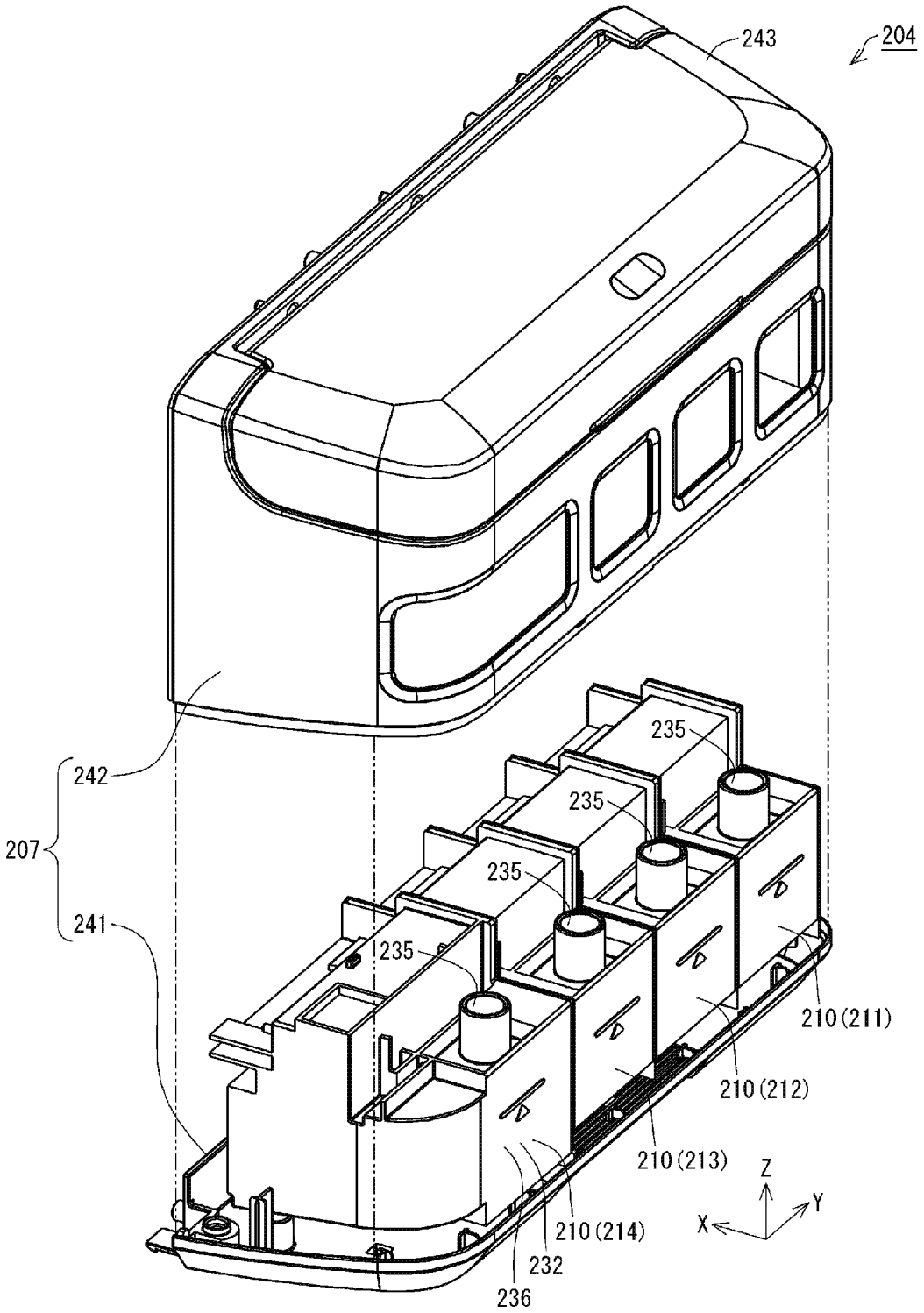
FIG. 33 is an exploded perspective view of a relevant configuration of an ink supply apparatus according to the second embodiment.

As shown in FIG. 33, the casing 207 of the ink supply apparatus 204 includes a first casing 241 and a second casing 242. A liquid injection portion 235 is formed in each of the tanks 210. With each of the tanks 210, ink can be injected into the tank 210 from outside the tank 210 via the liquid injection portion 235. Note that the operator can access the liquid injection portions 235 of the tanks 210 from outside of the casing 207.

Here, as shown in FIG. 33, the positions of the liquid injection portions 235 in the X axis direction in the tanks 210 are biased to one side relative to the tanks 210. In other words, the liquid injection portions 235 of the tanks 210 are arranged at biased positions on the tanks 210. Also, the side of the tanks 210 on which the liquid injection portions 235 are located is defined as the front surface side. Based on this definition, as shown in FIG. 33, the surfaces of the tanks 210 that are located the farthest on the −X axis direction side are considered to be front surfaces 236. Also, the viewing surfaces 232 of the tanks 210 are located on the front surface 236 side. For this reason, the viewing surfaces 232 of the tanks 210 correspond to the front surfaces 236.

In this embodiment, the front surfaces 236 of the tanks 210 face the −X axis direction. In the liquid ejection system 201 of this embodiment, the direction from the front surface 236 side toward the opposite side of the tanks 210 is defined as the X axis direction. Also, the vertically upward direction in the in-use orientation of the tanks 210 is defined as the Z axis direction. Moreover, the direction orthogonal to both the X axis direction and the Z axis direction is defined as the Y axis direction. The X axis direction corresponds to the X direction, the Y axis direction corresponds to the Y direction, and the Z axis direction corresponds to the Z direction.

As shown in FIG. 33, the first casing 241 is located on the −Z axis direction side of the tanks 210. The tanks 210 are supported to the first casing 241. The second casing 242 is located on the Z axis direction side of the first casing 241, and covers the tanks 210 on the Z axis direction side of the first casing 241. The tanks 210 are covered by the first casing 241 and the second casing 242.

Among the four tanks 210, the tank 211, the tank 212, and the tank 213 have the same shape as each other. The tank 214 has a different shape from the other tanks 210. The volume of the tank 214 is larger than volume of the other tanks 210. With the exception of the above point, the tank 214 has the same configuration as the other tanks 210. This configuration is favorable in the case where, for example, the tank 214 stores a type of ink that has a high frequency of use. This is because the type of ink that has a high frequency of use can be stored in a larger amount than the other types of ink.

Figure 34:
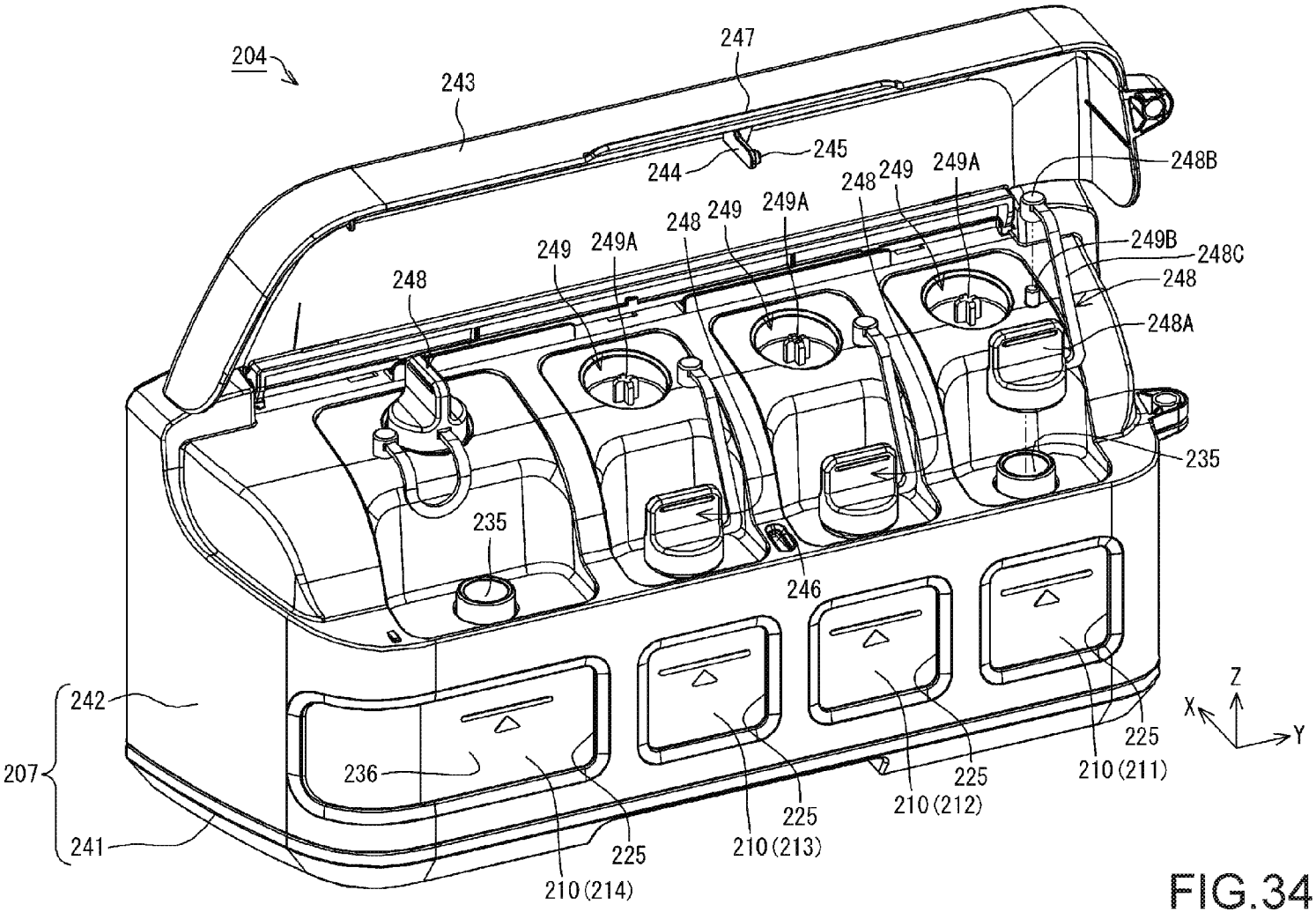
FIG. 34 is a perspective view of the relevant configuration of the ink supply apparatus according to the second embodiment.

The second casing 242 has a cover 243. The cover 243 is located at the end portion, on the Z axis direction side, of the second casing 242. As shown in FIG. 34, the cover 243 is configured to be capable of pivoting relative to the second casing 242. FIG. 34 shows a state in which the cover 243 is opened relative to the second casing 242. When the cover 243 is opened relative to the second casing 242, the liquid injection portions 235 of the tanks 210 are exposed. Accordingly, the operator can access the liquid injection portions 235 of the tanks 210 from outside of the casing 207.

The cover 243 is provided with a locking portion 244. As shown in FIG. 34, the locking portion 244 is provided on the first casing 241 side of the cover 243. When the cover 243 is in the closed state, the locking portion 244 protrudes from the cover 243 toward the first casing 241. A projection portion 245 is formed on the locking portion 244. The projection portion 245 is formed on the side of the locking portion 244 that is opposite to the cover 243 side. The projection portion 245 protrudes from the locking portion 244 in the Y axis direction. An engaging hole 246 is formed in a portion of the second casing 242 that opposes the locking portion 244. The engaging hole 246 is formed in a portion of the second casing 242 that is overlapped with the locking portion 244 when the cover 243 is closed.

When the cover 243 is in the closed state, the locking portion 244 is inserted into the engaging hole 246 of the second casing 242. At this time, the projection portion 245 of the locking portion 244 engages with the engaging hole 246. Accordingly, a clicking sensation is felt when the cover 243 is closed and the projection portion 245 of the locking portion 244 engages with the engaging hole 246. Also, when the cover 243 is closed with strong momentum for example, the momentum of the cover 243 can be mitigated by the engagement of the projection portion 245 with the engaging hole 246. Accordingly, it is possible to alleviate shock when the cover 243 comes into contact with the second casing 242 when closing the cover 243.

Also, as shown in FIG. 34, a grasp portion 247 is formed on the cover 243. The grasp portion 247 is provided on the end portion of the cover 243 that is on the −X axis direction side and the −Z axis direction side. The operator can place a finger on the grasp portion 247 and pivot the cover 243 in the Z axis direction. At this time, the grasp portion 247 is easily caught by the finger, and therefore the operator can easily place the finger on the grasp portion 247 and pivot the cover 243.

Note that the liquid injection portions 235 are sealed by plug members 248. When ink is to be injected into one of the tanks 210, the plug member 248 is detached from the liquid injection portion 235 so as to open the liquid injection portion 235, and then ink is injected.

The second casing 242 also has multiple plug member arrangement portions 249 and multiple attaching portions 249B. The plug member arrangement portions 249 and the attaching portions 249B are arranged on the surface, on the Z axis direction side, of the second casing 242. In the second casing 242, the plug member arrangement portions 249 and the attaching portions 249B are provided on the surface that opposes the cover 243. For this reason, when the cover 243 is closed, the plug member arrangement portions 249 and the attaching portions 249B are covered by the cover 243. The plug member arrangement portions 249 are arranged side-by-side along the Y axis. The attaching portions 249B are arranged side-by-side along the Y axis.

The plug member arrangement portions 249 are each configured such that a plug main body 248A of the corresponding plug member 248 can be arranged thereon. In other words, the plug member arrangement portions 249 are portions for the arrangement of the plug main bodies 248A of the plug members 248 when they are detached from the liquid injection portions 235.

The plug member arrangement portions 249 are recessed portions formed in the surface, on the Z axis direction side, of the second casing 242. These recessed portions receive insertion of the plug main bodies 248A of the plug members 248. The plug member arrangement portions 249 can hold ink due to being recessed portions. The plug member arrangement portions 249 each have a projection 249A. The projections 249A project in the vertically upward direction from the surface, on the Z axis direction side, of the second casing 242. The plug main bodies 248A of the plug members 248 are mounted (held) by the projections 249A being inserted into the plug main bodies 248A. Note that it is preferable that the plug member arrangement portions 249 are configured to be able to hold ink. For example, the plug member arrangement portions 249 may be recessed portions as in this embodiment, or may be porous members arranged on the surface, on the Z axis direction side, of the second casing 242.

The attaching portions 249B are portions that can attach attachment portions 248B of the corresponding plug members 248. The attaching portions 249B are each a column-shaped projection that protrudes in the Z axis direction from the surface, on the Z axis direction side, of the second casing 242. The plug main body 248A and the attachment portion 248B of each of the plug members 248 are connected to each other via a connection portion 248C. This therefore readily prevents the plug main body 248A from falling or becoming lost when the plug main body 248A is detached from the liquid injection portion 235.

The following is a detailed description of the tanks 210. Note that as mentioned above, among the four tanks 210, the tank 214 and the other tanks 210 have the same configuration as each other, with the exception of having different volumes. For this reason, the tanks 210 will be described in detail below taking the example of the tank 211, and a detailed description will not be given for the tank 214.

Figure 35:
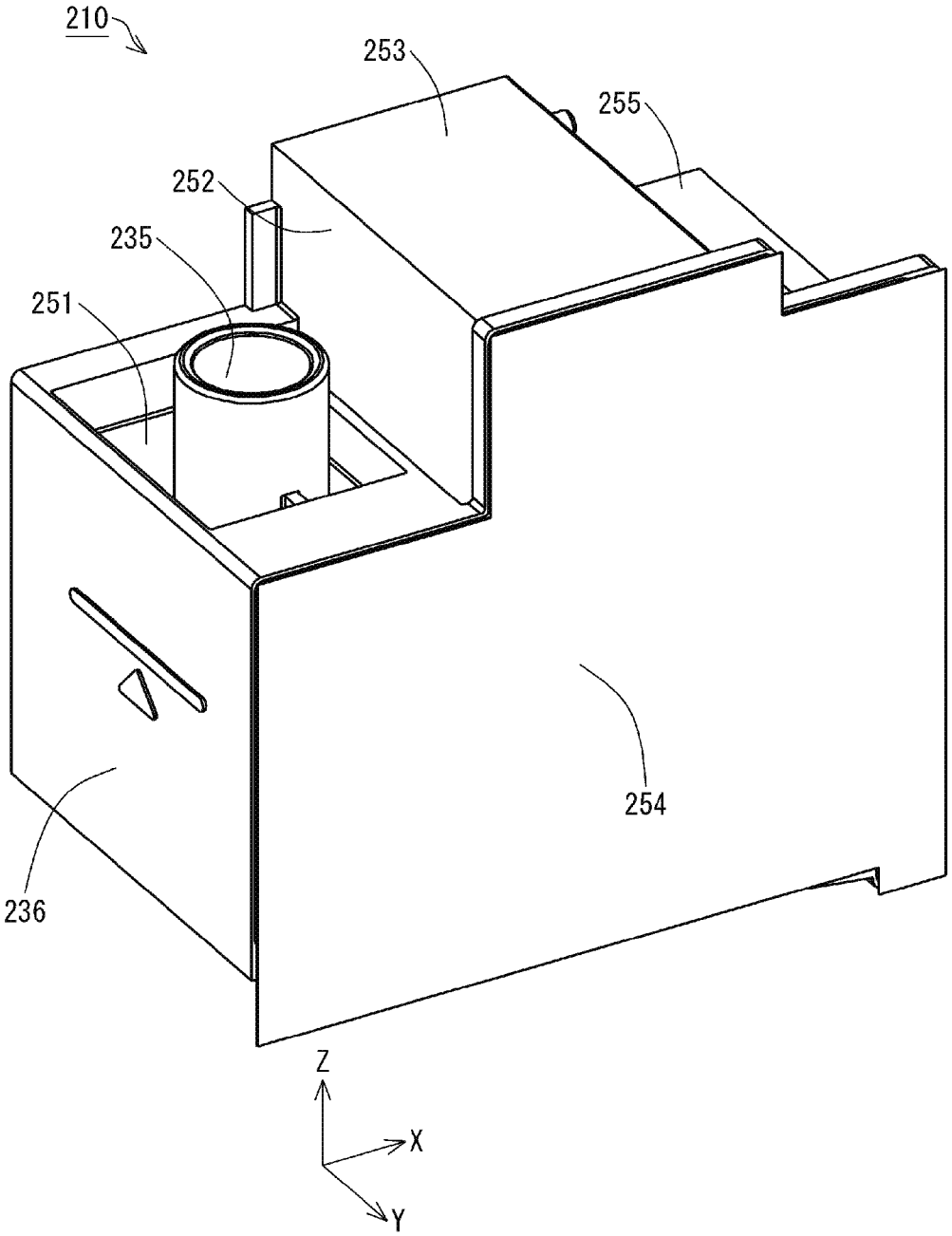
FIG. 35 is a perspective view of a tank according to the second embodiment.
Figure 36:
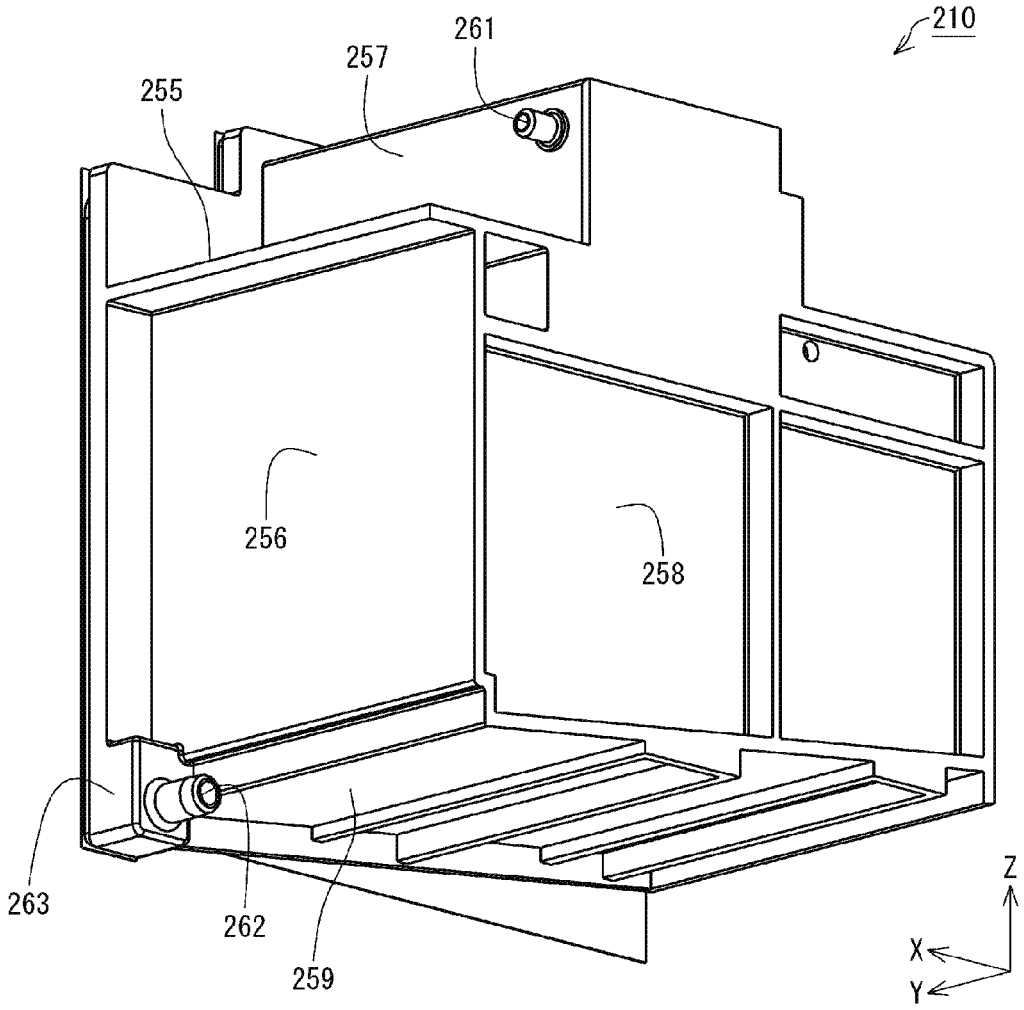
FIG. 36 is a perspective view of the tank according to the second embodiment.

As shown in FIG. 35, the tank 210 has a front surface 236, an upper surface 251, a side surface 252, an upper surface 253, a side surface 254, and an upper surface 255. The front surface 236, the upper surface 251, the side surface 252, the upper surface 253, the side surface 254, and the upper surface 255 are surfaces of the tank 210 that face outward. As previously described, the front surface 236 is set as the viewing surface 232. Also, as shown in FIG. 36, the tank 210 has a rear surface 256, a side surface 257, a side surface 258, and a lower surface 259. The rear surface 256, the side surface 257, the side surface 258, and the lower surface 259 are surfaces of the tank 210 that face outward.

As shown in FIG. 35, the side surface 252 is located on the Z axis direction side of the front surface 236. The front surface 236 and the side surface 252 extend along the YZ plane. The front surface 236 and the side surface 252 face the −X axis direction. The upper surface 251 is located on the −Z axis direction side of the side surface 252. The upper surface 251 extends along the XY plane. For this reason, the upper surface 251 intersects the front surface 236 and the side surface 252. The end portion, on the X axis direction side, of the upper surface 251 intersects the side surface 252, and the end portion on the −X axis direction side intersects the front surface 236. The liquid injection portion 235 is provided on the upper surface 251. The liquid injection portion 235 protrudes from the upper surface 251 in the Z axis direction.

The upper surface 253 is located on the X axis direction side of the side surface 252. The upper surface 253 extends along the XY plane. The upper surface 253 faces the Z axis direction. The end portion, on the −X axis direction side, of the upper surface 253 intersects the side surface 252. The end portion, on the Z axis direction side, of the side surface 252 intersects the upper surface 253.

The side surface 254 is located on the Y axis direction side of the front surface 236, the upper surface 251, the side surface 252, and the upper surface 253. The side surface 254 extends along the XZ plane. The side surface 254 faces the Y axis direction. The end portions, on the Y axis direction side, of the front surface 236, the upper surface 251, the side surface 252, and the upper surface 253 intersect the side surface 254.

The upper surface 255 is located on the X axis direction side of the upper surface 253. The upper surface 255 extends along the XY plane. The upper surface 255 faces the Z axis direction. The end portion, on the Y axis direction side, of the upper surface 255 intersects the side surface 254.

As shown in FIG. 36, the rear surface 256 faces the X axis direction. The rear surface 256 extends along the YZ plane. The rear surface 256 is located on the side opposite to the front surface 236 (FIG. 35). For this reason, the front surface 236 and rear surface 256 have a mutually opposing surface relationship. The rear surface 256 intersects the upper surface 255 and the side surface 254 (FIG. 35) on the side opposite to the front surface 236 (FIG. 35).

As shown in FIG. 36, the side surface 257 faces the X axis direction. The side surface 257 extends along the YZ plane. The side surface 257 is located on the side opposite to the side surface 252 (FIG. 35), that is to say on the X axis direction side of the side surface 252. The end portion, on the Z axis direction side, of the side surface 257 intersects the upper surface 253 (FIG. 35), and the end portion on the −Z axis direction side intersects the upper surface 255.

As shown in FIG. 36, the side surface 258 faces the −Y axis direction. The side surface 258 extends along the XZ plane. The side surface 258 is located on the side opposite to the side surface 254 (FIG. 35), that is to say on the −Y axis direction side of the side surface 254. The side surface 258 intersects the front surface 236, the upper surface 251, the side surface 252, the upper surface 253, the upper surface 255, the side surface 257, and the rear surface 256 on the side opposite to the side surface 254 (FIG. 35).

As shown in FIG. 36, the lower surface 259 is located on the −Z axis direction side of the rear surface 256 and the side surface 258. Also, the lower surface 259 is located on the −Z axis direction side of the front surface 236 (FIG. 35) and the side surface 254. The lower surface 259 intersects the front surface 236 (FIG. 35), the side surface 254, the rear surface 256, and the side surface 258 on the −Z axis direction side of the front surface 236 (FIG. 35), the side surface 254, the rear surface 256, and the side surface 258. Note that in this embodiment, the lower surface 259 intersects both the YZ plane and the XY plane. The lower surface 259 is inclined so as to descend in the −Z axis direction as it extends from the front surface 236 toward the rear surface 256.

Also, as shown in FIG. 36, the tank 210 is provided with a communication portion 261 and a liquid supply portion 262. The communication portion 261 is provided on the side surface 257. The communication portion 261 protrudes in the X axis direction from the side surface 257. The liquid supply portion 262 is provided on a protrusion portion 263 that protrudes in the X axis direction from the rear surface 256. The liquid supply portion 262 protrudes from the protrusion portion 263 toward the −Y axis direction side. Ink stored in the tank 210 is supplied to the ink supply tube 231 (FIG. 32) via the liquid supply portion 262.

Note that the term "surface extending along the XZ plane" is not limited to a surface that extends completely parallel to the XZ plane, and also encompasses surfaces that are inclined relative to the XZ plane by a margin of error, a tolerance, or the like, while excluding a surface that is orthogonal to the XZ plane. Similarly, the term "surface extending along the YZ plane" is not limited to a surface that extends completely parallel to the YZ plane, and also encompasses surfaces that are inclined relative to the YZ plane by a margin of error, a tolerance, or the like, while excluding a surface that is orthogonal to the YZ plane. The term "surface extending along the XY plane" is not limited to a surface that extends completely parallel to the XY plane, and also encompasses surfaces that are inclined relative to the XY plane by a margin of error, a tolerance, or the like, while excluding a surface that is orthogonal to the XY plane.

Also, the term "two surfaces intersect" refers to a positional relationship in which two surfaces are not parallel to each other. Besides the case where the two surfaces are directly in contact with each other, even in a positional relationship where two surfaces are separated from each other rather than being in direct contact, it can be said that the two surfaces intersect if an extension of the plane of one surface intersects an extension of the plane of the other surface. The angle formed by the two intersecting surfaces may be a right angle, an obtuse angle, or an acute angle.

Also, the front surface 236, the upper surface 251, the side surface 252, the upper surface 253, the side surface 254, the upper surface 255, the rear surface 256, the side surface 257, the side surface 258, and the lower surface 259 are not limited to being flat surfaces, and may include unevenness, a step, or the like. Moreover, another flat surface, curved surface, or the like may be interposed between two surfaces that intersect each other among the front surface 236, the upper surface 251, the side surface 252, the upper surface 253, the side surface 254, the upper surface 255, the rear surface 256, the side surface 257, the side surface 258, and the lower surface 259.

Figure 37:
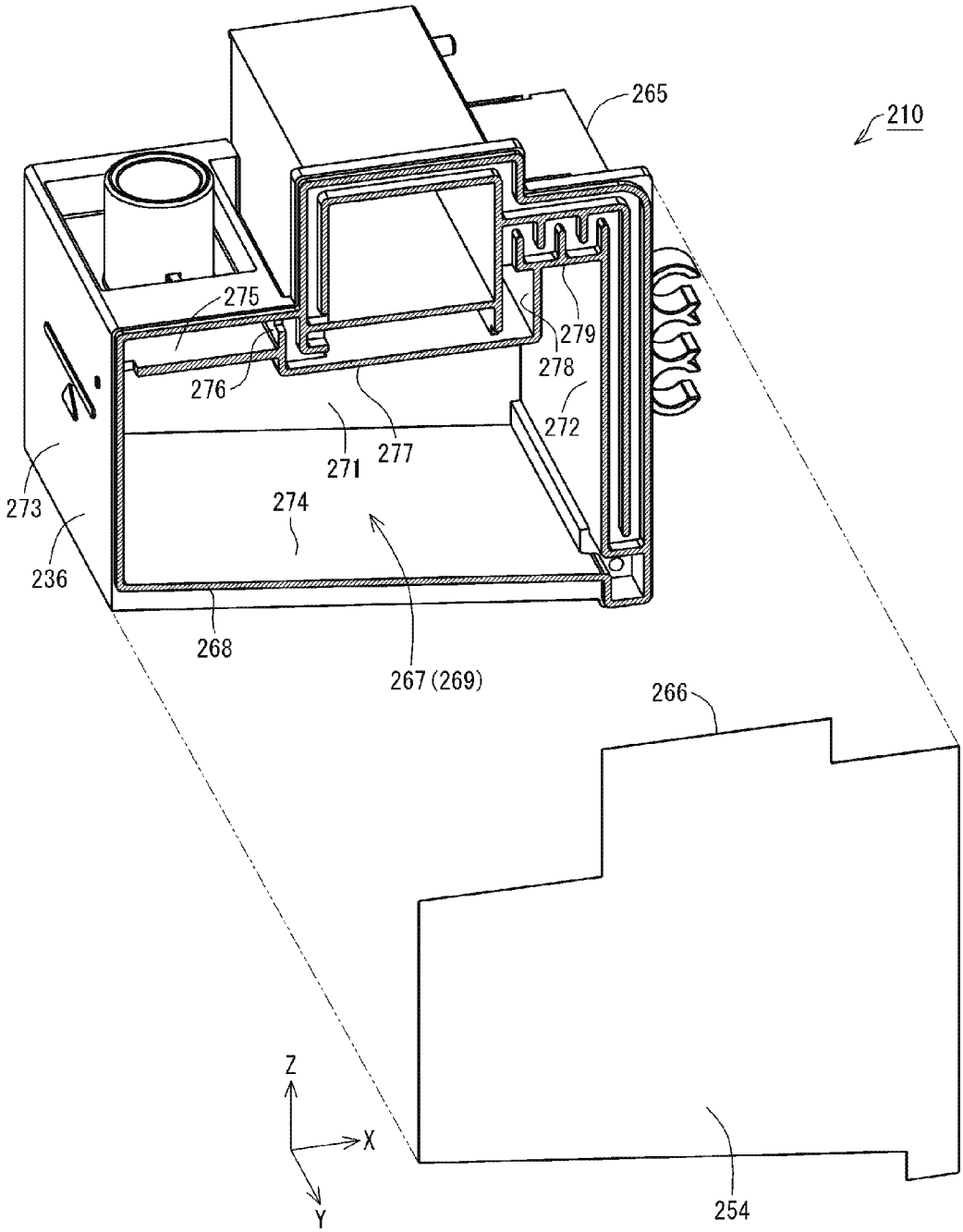
FIG. 37 is an exploded perspective view of the tank according to the second embodiment.

As shown in FIG. 37, the tank 210 has a case 265, which is one example of a tank main body, and a sheet member 266. The case 265 is constituted by a synthetic resin such as nylon or polypropylene, for example. Also, the sheet member 266 is formed in the shape of a film using a synthetic resin (e.g., nylon or polypropylene), and is bendable.

As shown in FIG. 37, a recessed portion 267 is formed in the case 265. Also, the case 265 is provided with a joining portion 268. The joining portion 268 is hatched in FIG. 37 in order to facilitate understanding of the configuration. The sheet member 266 is joined to the joining portion 268. In this working example, the case 265 and the sheet member 266 are joined by adhesion. When the sheet member 266 is joined to the case 265, the recessed portion 267 is blocked by the sheet member 266. The space enclosed by the recessed portion 267 and the sheet member 266 will be referred to as a liquid storage portion 269. Ink is stored in the liquid storage portion 269.

The case 265 has a wall 271, a wall 272, a wall 273, a wall 274, a wall 275, a wall 276, a wall 277, a wall 278, and a wall 279. The wall 271 extends along the XZ plane. The eight walls 272 to 279 intersect the wall 271. The eight walls 272 to 279 protrude from the wall 271 in the Y axis direction. In a plan view of the wall 271 in the −Y axis direction, the eight walls 272 to 279 surround the wall 271. The wall 271 and the eight walls 272 to 279 configure the recessed portion 267 that has the wall 271 as its bottom.

Note that the walls 271 to 279 are not limited to being flat walls, and may include unevenness, a step, or the like.

The wall 272 and the wall 273 are provided at positions that oppose each other via a gap along the X axis, and each extend along the YZ plane. The wall 273 is located on the −X axis direction side of the wall 272. The wall 274 is located on the −Z axis direction side of the wall 272 and the wall 273, and intersects the wall 272 and the wall 273. In a plan view of the wall 271 in the −Y axis direction, the walls 275 to 279 are located on the Z axis direction side of the wall 274. The wall 275 is located the farthest on the −X axis direction side among the walls 275 to 279, and intersects the wall 273. The wall 279 is located the farthest on the X axis direction side among the walls 275 to 279, and intersects the wall 272. The wall 276 is located on the X axis direction side of the wall 275, and extends along the YZ plane. The wall 277 is located on the X axis direction side of the wall 276, and extends along the XY plane. The wall 278 is located on the X axis direction side of the wall 277, and extends along the YZ plane. The wall 279 is located on the X axis direction side of the wall 278, and extends along the XY plane.

Figure 38:
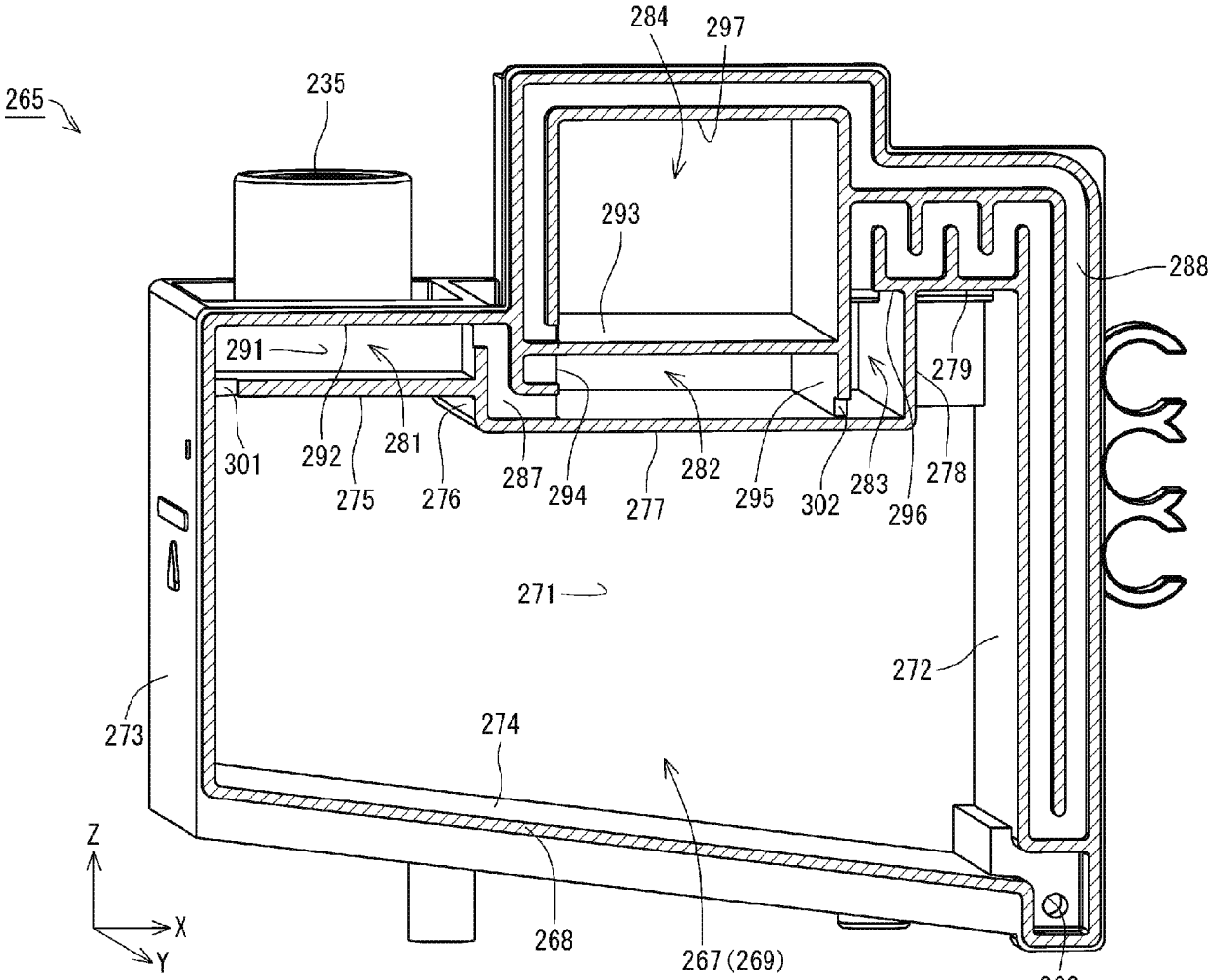
FIG. 38 is a perspective view of a case according to the second embodiment.

Also, as shown in FIG. 38, a recessed portion 281, a recessed portion 282, a recessed portion 283, a recessed portion 284, a groove portion 287, and a groove portion 288 are formed in the case 265. The recessed portion 281 is located on the Z axis direction side of the recessed portion 267. The recessed portion 281 is located on the Z axis direction side of the wall 275. The recessed portion 281 is defined by the wall 273, the wall 275, the wall 276, a wall 291, and a wall 292. The wall 291 extends along the XZ plane and is located on the Y axis direction side of the wall 271. The wall 292 extends along the XY plane and is located on the Z axis direction side of the wall 275. The wall 273, the wall 275, the wall 276, and the wall 292 protrude from the wall 291 in the Y axis direction. In a plan view of the wall 291 in the −Y axis direction, the wall 273, the wall 275, the wall 276, and the wall 292 surround the wall 291. This configures the recessed portion 281 that has the wall 291 as its bottom.

The recessed portion 282 is located on the Z axis direction side of the recessed portion 267. The recessed portion 282 is located on the Z axis direction side of the wall 277. The recessed portion 282 is defined by the wall 271, the wall 277, a wall 293, a wall 294, and a wall 295. Note that the wall 271 of the recessed portion 267 and the wall 271 of the recessed portion 282 are the same wall as each other. In other words, in this working example, the recessed portion 267 and the recessed portion 282 share the wall 271 with each other. The recessed portion 267 and the recessed portion 282 share the wall 277 as well. The wall 293 extends along the XY plane and is located on the Z axis direction side of the wall 277. The wall 294 extends along the YZ plane and is located on the X axis direction side of the wall 276. The wall 295 extends along the YZ plane and is located on the X axis direction side of the wall 294. The wall 277, the wall 293, the wall 294, and the wall 295 protrude from the wall 271 in the Y axis direction. In a plan view of the wall 271 in the −Y axis direction, the wall 277, the wall 293, the wall 294, and the wall 295 surround the wall 271. This configures the recessed portion 282 that has the wall 271 as its bottom.

The recessed portion 283 is located on the Z axis direction side of the recessed portion 267, and is located on the X axis direction side of the recessed portion 282. The recessed portion 283 is located on the Z axis direction side of the wall 277. The recessed portion 283 is defined by the wall 271, the wall 277, the wall 278, the wall 295, and a wall 296. Note that the recessed portion 267 and the recessed portion 283 share the wall 271, the wall 277, and the wall 278 with each other. Also, the recessed portion 282 and the recessed portion 283 share the wall 295. The wall 296 extends along the XY plane and is located on the Z axis direction side of the wall 277. The wall 277, the wall 278, the wall 295, and the wall 296 protrude from the wall 271 in the Y axis direction. In a plan view of the wall 271 in the −Y axis direction, the wall 277, the wall 278, the wall 295, and the wall 296 surround the wall 271. This configures the recessed portion 283 that has the wall 271 as its bottom.

The recessed portion 284 is located on the Z axis direction side of the recessed portion 282. The recessed portion 284 is located on the Z axis direction side of the wall 293. The recessed portion 284 is defined by the wall 271, the wall 293, the wall 294, the wall 295, and a wall 297. Note that the recessed portion 282 and the recessed portion 284 share the wall 271, the wall 293, the wall 294, and the wall 295 with each other. The wall 297 extends along the XY plane and is located on the Z axis direction side of the wall 293. The wall 293, the wall 294, the wall 295, and the wall 297 protrude from the wall 271 in the Y axis direction. In a plan view of the wall 271 in the −Y axis direction, the wall 293, the wall 294, the wall 295, and the wall 297 surround the wall 271. This configures the recessed portion 284 that has the wall 271 as its bottom.

The groove portion 287 is formed between the wall 276 and the wall 295 in a plan view of the wall 271 in the −Y axis direction. The groove portion 287 is formed between the recessed portion 281 and the recessed portion 282. The recessed portion 281 and the recessed portion 282 are connected via the groove portion 287. The groove portion 288 begins at a position on the Z axis direction side of the wall 293 at the intersection between the wall 293 and the wall 294, and, in a plan view of the wall 271 in the −Y axis direction, the groove portion 288 curves around the outer side of the recessed portion 284 in the clockwise direction, extends along the X axis direction side of the wall 272, then turns around and meanders before reaching the recessed portion 283. Note that the recessed portion 267 and the recessed portion 281 are connected via a cutout portion 301 that is formed in the wall 275. Also, the recessed portion 282 and the recessed portion 283 are connected via a cutout portion 302 that is formed in the wall 295.

The recessed portion 267, the recessed portions 281 to 284, the groove portion 287, and the groove portion 288, as well as the cutout portion 301 and the cutout portion 302 are formed so as to recede from the Y axis direction side toward the −Y axis direction side. The recessed portion 267, the recessed portions 281 to 284, the groove portion 287, and the groove portion 288, as well as the cutout portion 301 and the cutout portion 302 are surrounded by the joining portion 268 in a plan view of the wall 271 in the −Y axis direction.

Note that in a plan view of the tank 210 in the −Y axis direction, the sheet member 266 (FIG. 37) has a size and shape capable of covering the joining portion 268 that surrounds the recessed portion 267, the recessed portions 281 to 284, the groove portion 287, and the groove portion 288, as well as the cutout portion 301 and the cutout portion 302. For this reason, when the sheet member 266 is joined to the joining portion 268 of the case 265, the recessed portion 267, the recessed portions 281 to 284, the groove portion 287, and the groove portion 288, as well as the cutout portion 301 and the cutout portion 302 are blocked by the sheet member 266. Accordingly, the recessed portion 267 and the recessed portions 281 to 284 are compartments that are separated from each other.

Note that the surface, on the −Y axis direction side, of the wall 271 of the case 265 shown in FIG. 38, that is to say the surface of the wall 271 on the side opposite to the recessed portion 267 side, corresponds to the side surface 258 of the tank 210 shown in FIG. 36. Also, the surface, on the X axis direction side, of the wall 272 shown in FIG. 38, that is to say the surface of the wall 272 on the side opposite to the recessed portion 267 side, corresponds to the rear surface 256 of the tank 210 shown in FIG. 36.

Also, the surface, on the −X axis direction side, of the wall 273 shown in FIG. 38, that is to say the surface of the wall 273 on the side opposite to the recessed portion 267 side, corresponds to the front surface 236 shown in FIG. 35. Also, the surface, on the −Z axis direction side, of the wall 274 shown in FIG. 38, that is to say the surface of the wall 274 on the side opposite to the recessed portion 267 side, corresponds to the lower surface 259 shown in FIG. 36.

Also, the surface, on the Z axis direction side, of the wall 275 shown in FIG. 38, that is to say the surface of the wall 275 on the side opposite to the recessed portion 267 side, corresponds to the upper surface 251 shown in FIG. 35. Also, the surface, on the −X axis direction side, of the wall 294 shown in FIG. 38, that is to say the surface of the wall 294 on the side opposite to the recessed portion 267 side, corresponds to the side surface 252 shown in FIG. 35.

Also, the surface, on the X axis direction side, of the wall 295 shown in FIG. 38, that is to say the surface of the wall 295 on the side opposite to the recessed portion 267 side, corresponds to the side surface 257 shown in FIG. 36. Also, the surface, on the Z axis direction side, of the wall 297 shown in FIG. 38, that is to say the surface of the wall 297 on the side opposite to the recessed portion 284 side, corresponds to the upper surface 253 shown in FIG. 35. Also, the surface, on the Z axis direction side, of the wall 279 shown in FIG. 38, that is to say the surface of the wall 279 on the side opposite to the recessed portion 267 side, corresponds to the upper surface 255 shown in FIG. 35.

Figure 39:
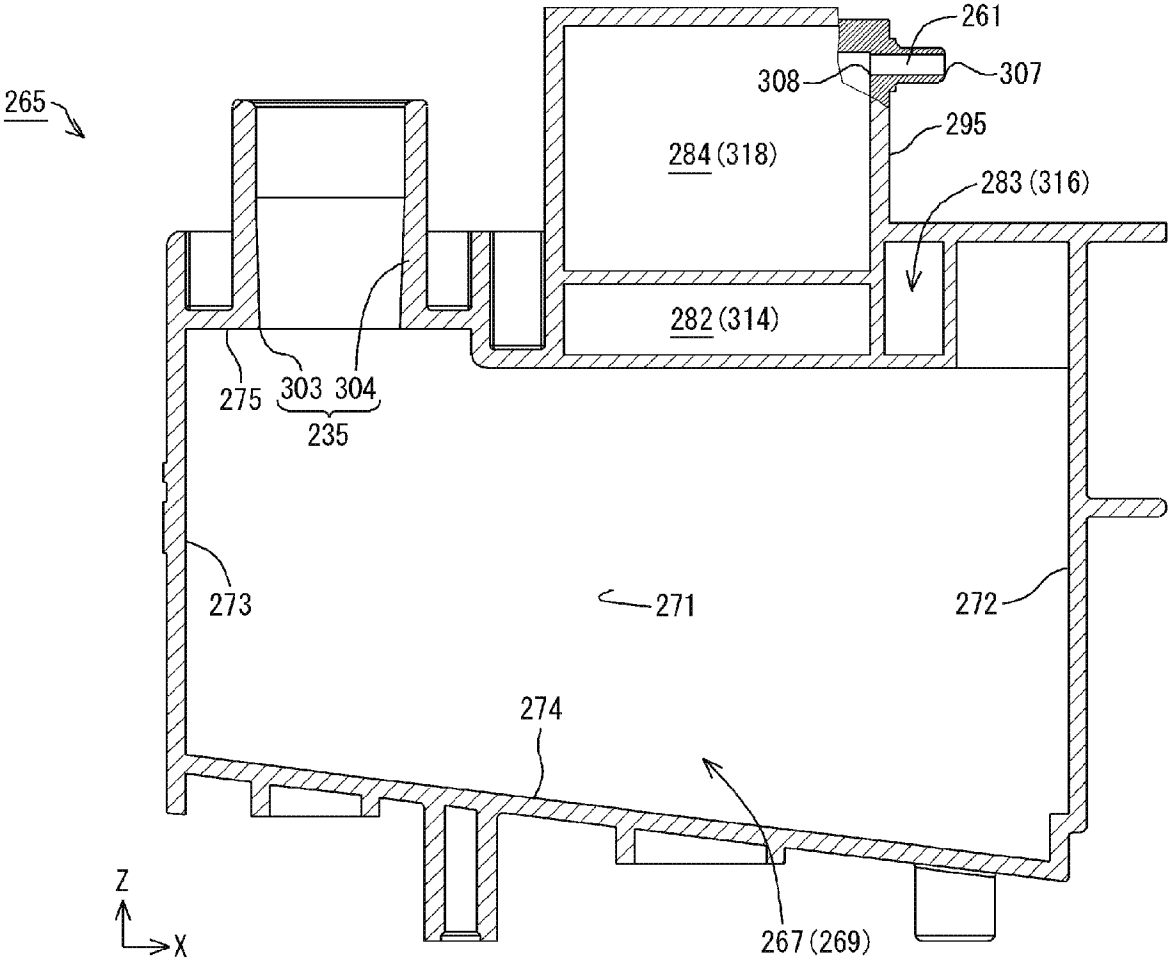
FIG. 39 is a cross-sectional view of the tank according to the second embodiment.

Here, the liquid injection portion 235 is in communication with the recessed portion 267 as shown in FIG. 39, which is a cross-sectional view of the case 265. Note that FIG. 39 shows a cross-section of the case 265 taken along an XZ plane that passes through the liquid injection portion 235. The liquid injection portion 235 has a liquid injection opening 303 and a side wall 304. The liquid injection opening 303 is the opening of a through-hole provided in the wall 275, and is open toward the recessed portion 267. The liquid injection opening 303 is the intersection portion where the liquid injection portion 235 and the recessed portion 267 (liquid storage portion 269) intersect.

The interior of the recessed portion 267 is in communication with the outside of the recessed portion 267 via the liquid injection opening 303, which is a through-hole. The side wall 304 is provided on the Z axis direction side of the wall 275, surrounds the liquid injection opening 303, and forms an ink injection path. The side wall 304 protrudes from the wall 275 in the Z axis direction. Note that the liquid injection portion 235 can have a configuration in which the side wall 304 protrudes into the recessed portion 267. Even with a configuration in which the side wall 304 protrudes into the recessed portion 267, the liquid injection opening 303 is defined as the intersection portion where the liquid injection portion 235 and the recessed portion 267 intersect.

Figure 40:
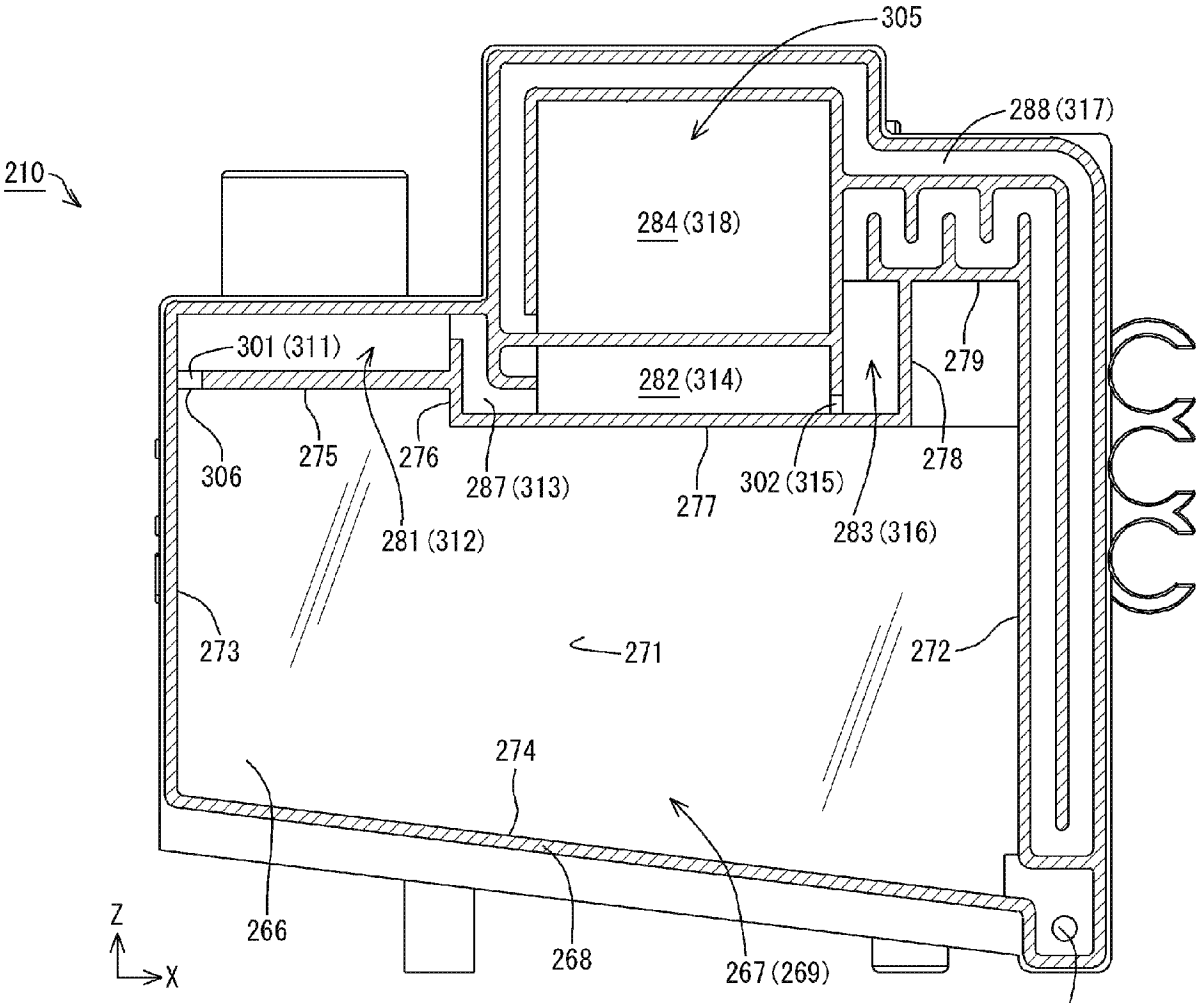
FIG. 40 is a side view in which the tank according to the second embodiment is viewed from the sheet member side.

When the sheet member 266 is joined to the case 265 having the above-described configuration, the liquid storage portion 269 and an air introduction passage 305 are configured in the tank 210 as shown in FIG. 40. Note that FIG. 40 shows a state in which the tank 210 is viewed from the sheet member 266 side, and the case 265 is shown through the sheet member 266.

The air introduction passage 305 configured in the tank 210 is a region surrounded by the recessed portions 281 to 284, the groove portion 287, the groove portion 288, the cutout portion 301, and the cutout portion 302 shown in FIG. 38, as well as the sheet member 266 (FIG. 37). Here, as shown in FIG. 40, the cutout portion 301 is formed in the wall 275. The opening of the cutout portion 301 that faces the recessed portion 267 corresponds to a connection opening 306 between the air introduction passage 305 and the liquid storage portion 269.

Also, the air introduction passage 305 includes the communication portion 261 shown in FIG. 39 as well. The communication portion 261 includes a communication opening 307 and an introduction opening 308. The communication opening 307 is defined as an opening of the communication portion 261 that is open toward the outside of the tank 210. The introduction opening 308 is an opening that is open toward the interior of the recessed portion 284. Also, the introduction opening 308 can be considered to be an opening formed in the intersection portion where the inner wall of the recessed portion 284 and the communication portion 261 intersect. In other words, the introduction opening 308 is the location where the communication portion 261 is connected to the recessed portion 284. The communication portion 261 constitutes a flow channel for air that is introduced into the tank 210 through the communication opening 307 that is open toward the outside of the tank 210.

The communication portion 261 protrudes from the wall 295 in the X axis direction. The communication portion 261 includes the thickness of the wall 295 and a portion that protrudes from the wall 295 in the X axis direction. For this reason, the passage length of the communication portion 261 is equal to the sum of the length of the portion that protrudes from the wall 295 in the X axis direction and the thickness dimension of the wall 295. Note that a configuration is possible in which the portion of the communication portion 261 that protrudes in the X axis direction is omitted. In a tank 210 in which the portion of the communication portion 261 that protrudes in the X axis direction is omitted, the passage length of the communication portion 261 is the same as the thickness dimension of the wall 295.

As described above, the tank 210 is provided with the air introduction passage 305 that extends from the communication opening 307 to the connection opening 306. Accordingly, the tank 210 is configured to be able to introduce air into the liquid storage portion 269 through the air introduction passage 305. In other words, the air introduction passage 305 is in communication with the liquid storage portion 269. Accordingly, the tank 210 is provided with a flow channel that extends from the communication opening 307, passes through the liquid storage portion 269, and is connected to the liquid supply portion 262.

Note that in the tank 210, the region surrounded by the cutout portion 301 shown in FIG. 40 and the sheet member 266 will be referred to as a communication passage 311. Also, the region surrounded by the recessed portion 281 and the sheet member 266 will be referred to as a first buffer chamber 312. Similarly, the region surrounded by the groove portion 287 and the sheet member 266 will be referred to as a communication passage 313. Also, the region surrounded by the recessed portion 282 and the sheet member 266 will be referred to as a second buffer chamber 314.

Also, the region surrounded by the cutout portion 302 and the sheet member 266 will be referred to as a communication passage 315. Moreover, the region surrounded by the recessed portion 283 and the sheet member 266 will be referred to as a third buffer chamber 316. Also, the region surrounded by the groove portion 288 and the sheet member 266 will be referred to as a communication passage 317. Moreover, the region surrounded by the recessed portion 284 and the sheet member 266 will be referred to as a fourth buffer chamber 318.

In the second embodiment as well, similarly to the first embodiment, the buffer unit 27 is provided in the liquid ejection system 201. Various working examples of the buffer unit 27 of the second embodiment will be described below. Note that in order to identify the buffer unit 27 in the respective working examples below, different alphabet letters, signs, and the like are appended to reference signs for the buffer unit 27 in each working example.

Sixth Working Example

Figure 41:
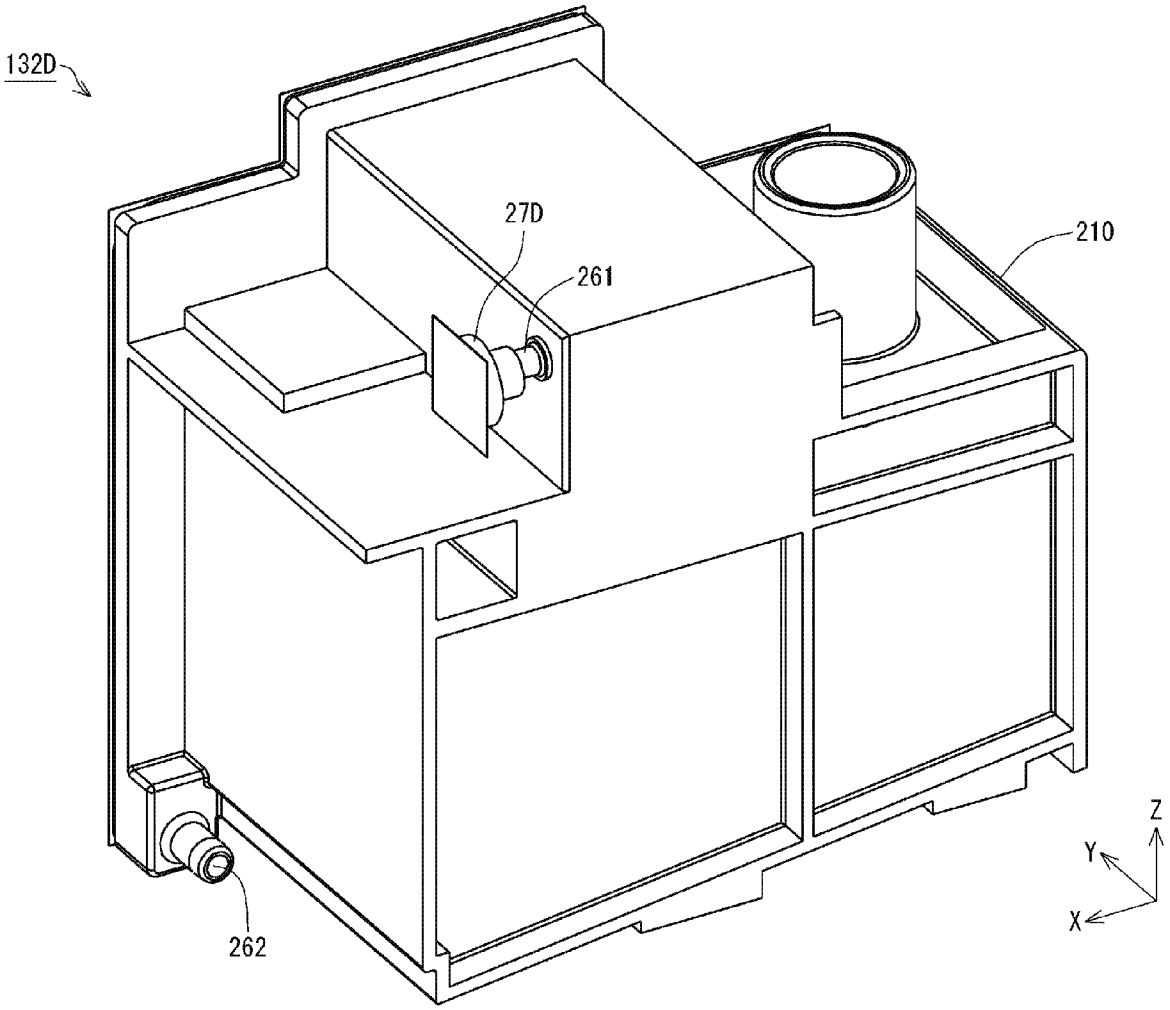
FIG. 41 is a perspective view of a liquid supply unit that connects the tank according to the second embodiment to a buffer unit in a sixth working example.
Figure 42:
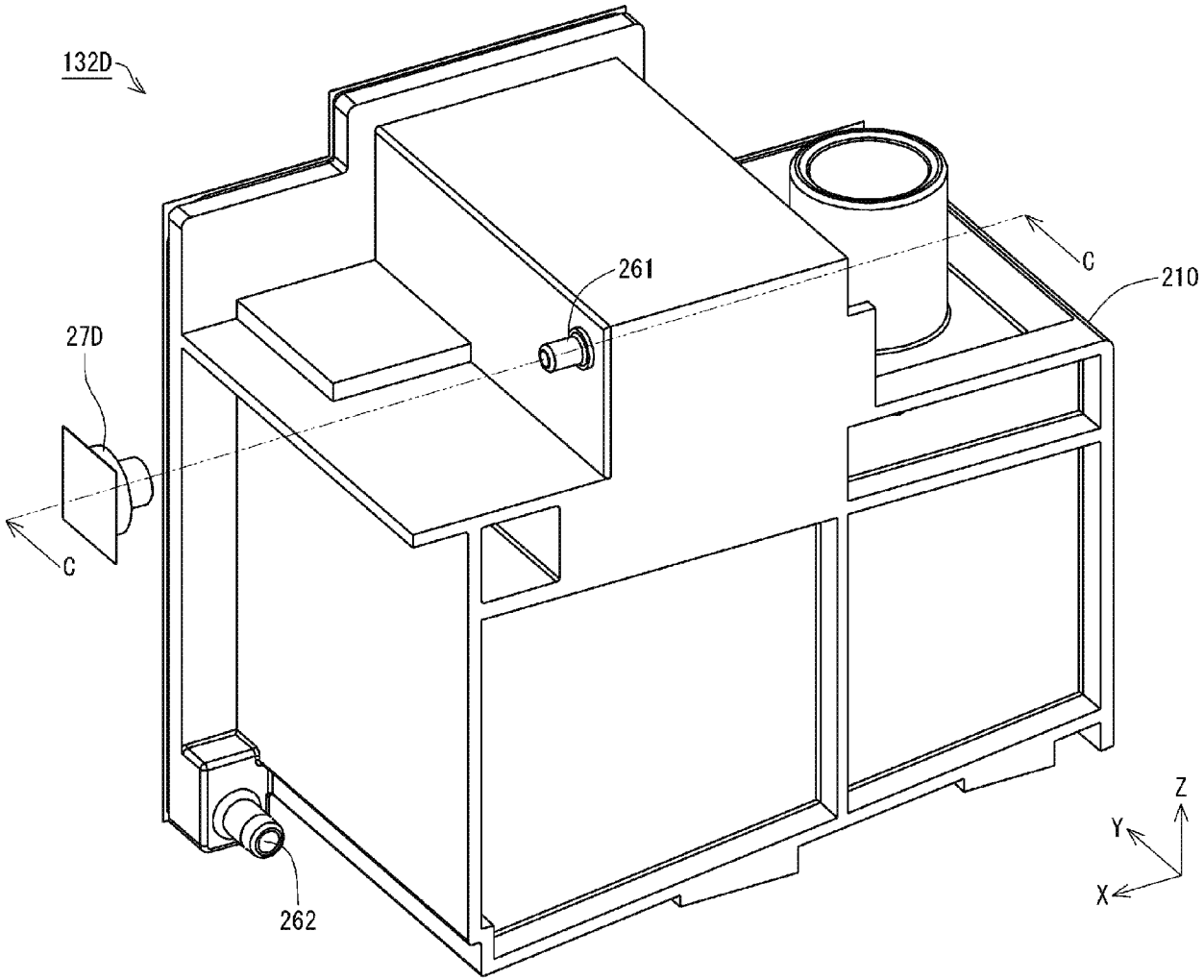
FIG. 42 is an exploded perspective view of the liquid supply unit that connects the tank according to the second embodiment to the buffer unit in the sixth working example.

As shown in FIG. 41, a buffer unit 27D of a sixth working example is configured to be able to be connected to the communication portion 261 of the tank 210. Note that the configuration in which the buffer unit 27D is connected to the tank 210 will be referred to as a liquid supply unit 132D. In the liquid supply unit 132D, the buffer unit 27D is configured to be detachable from the tank 210 as shown in FIG. 42.

Figure 43:
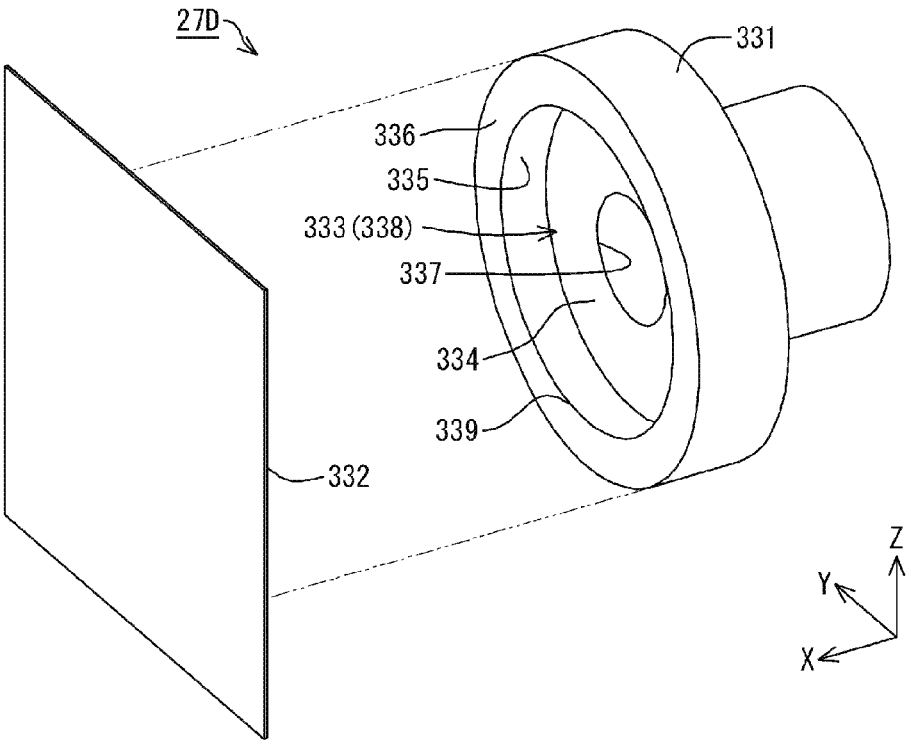
FIG. 43 is an exploded perspective view of the buffer unit in the sixth working example.

As shown in FIG. 43, the buffer unit 27D has a connection member 331 and a waterproof ventilation film 332. The connection member 331 is constituted by a synthetic resin such as nylon or polypropylene, for example. A recessed portion 333 is formed in the connection member 331. The recessed portion 333 is defined by a bottom portion 334 and a side wall 335. The recessed portion 333 is formed so as to recede in the −X axis direction. The side wall 335 is provided on the bottom portion 334, and protrudes from the bottom portion 334 in the X axis direction. The side wall 335, which protrudes from the bottom portion 334, surrounds the bottom portion 334. Accordingly, the recessed portion 333 is constituted by the bottom portion 334 and the side wall 335 that surrounds the bottom portion 334.

A joining portion 336 is provided on an end portion, on the X axis direction side, of the side wall 335. The waterproof ventilation film 332 is joined to the joining portion 336. The waterproof ventilation film 332, which is one example of a waterproof ventilation member, is constituted by a material that is highly waterproof with respect to liquids (i.e., has a low liquid permeability) and has a high air permeability, and is formed in the shape of a film. The waterproof ventilation film 332 has a size and shape capable of covering the joining portion 336 that surrounds the recessed portion 333. In this working example, the connection member 331 and the waterproof ventilation film 332 are joined by adhesion.

When the waterproof ventilation film 332 is joined to the connection member 331, the recessed portion 333 is blocked by the waterproof ventilation film 332. For this reason, when the waterproof ventilation film 332 is joined to the connection member 331, the recessed portion 333 is blocked in the X axis direction by the waterproof ventilation film 332. The space enclosed by the recessed portion 333 and the waterproof ventilation film 332 constitutes a buffer chamber 338.

A communication hole 337 is formed in the connection member 331. The communication hole 337 extends from the bottom portion 334 of the connection member 331 and passes through the connection member 331 in the −X axis direction. For this reason, in the buffer unit 27D, the buffer chamber 338 is in communication with the outside of the buffer chamber 338 via the communication hole 337. Note that in the buffer unit 27D, the edge portion of the opening of the recessed portion 333 of the connection member 331 that faces the X axis direction side corresponds to an air inlet 339. The air inlet 339 is an introduction opening for air that is to be guided from the buffer unit 27D into the tank 210.

Figure 44:
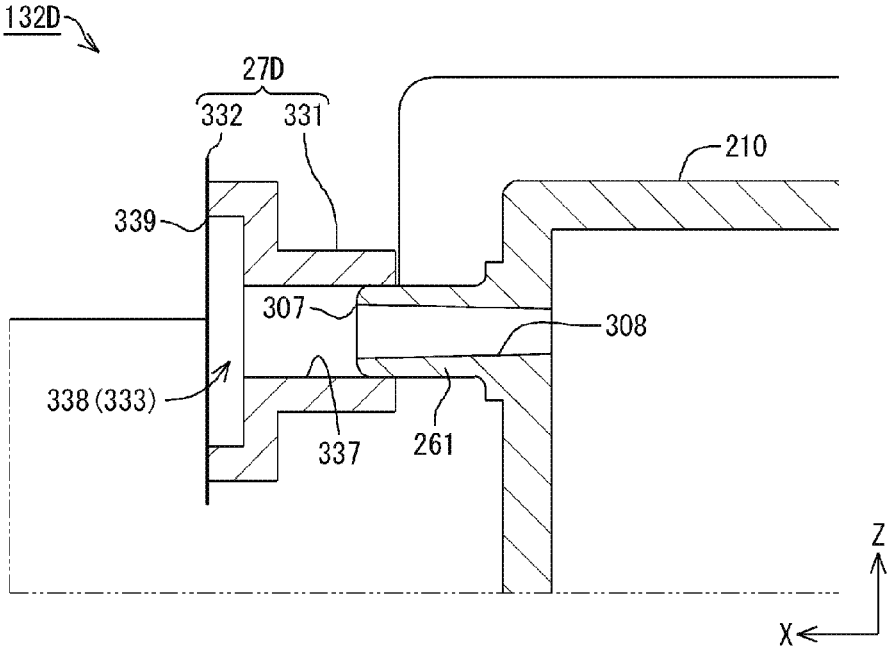
FIG. 44 is a cross-sectional view taken along line C-C in FIG. 42.

As shown in FIG. 44, which is a cross-sectional view taken along line C-C in FIG. 42, in the liquid supply unit 132D of the sixth working example, the communication portion 261 of the tank 210 is inserted into the communication hole 337 of the buffer unit 27D. The buffer unit 27D is connected to the tank 210 in this way.

Figure 45:
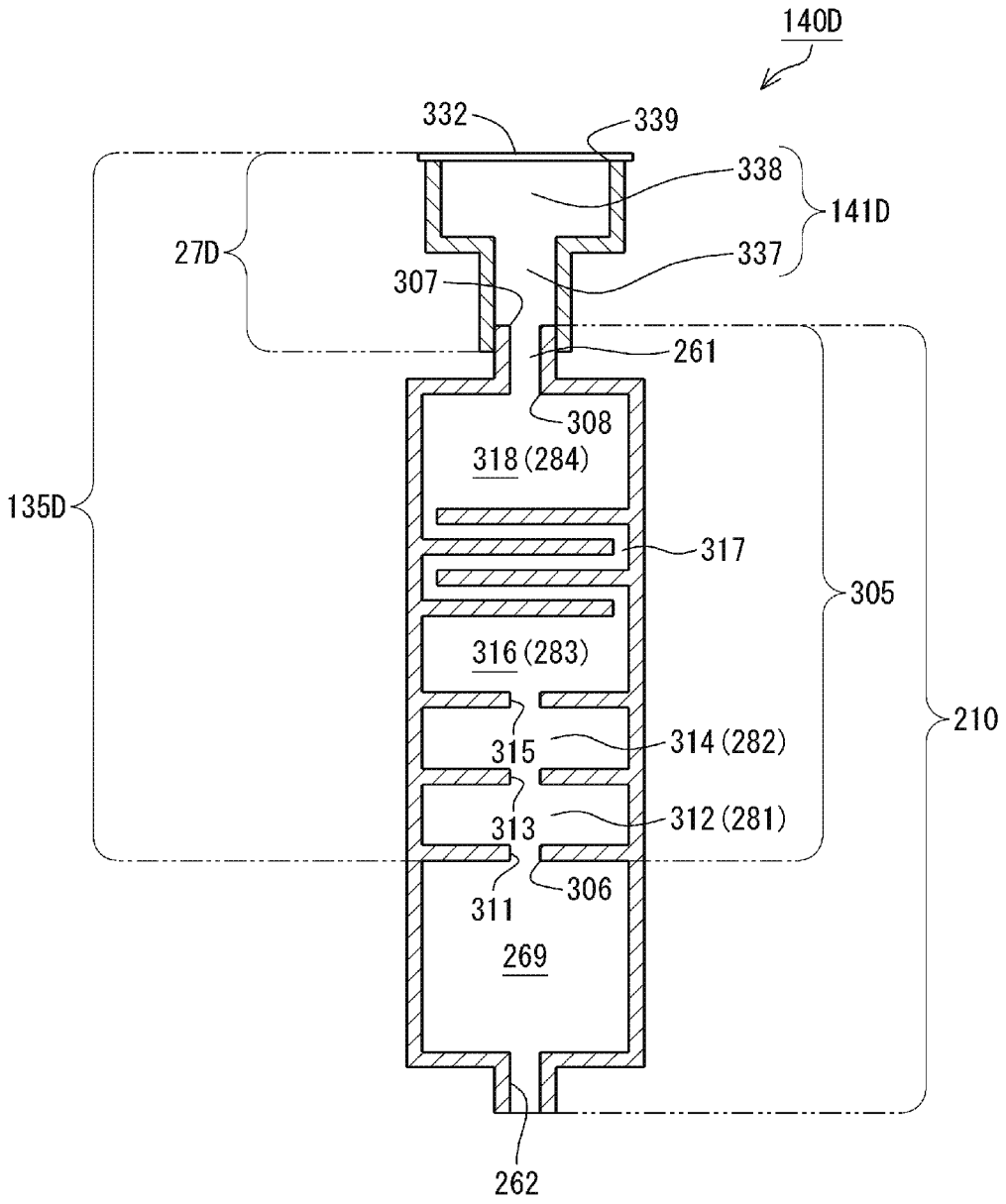
FIG. 45 is a diagram schematically showing a flow channel in the sixth working example.

The flow channel (also called a path) from the air inlet 339 to the liquid supply portion 262 will be described below with reference to a schematic diagram. Here, in order to facilitate understanding, the flow channel from the air inlet 339 to the liquid supply portion 262 will be described schematically. Note that the flow direction side of the liquid is a direction from the air inlet 339 toward the liquid supply portion 262. This direction serves as a reference for the terms "upstream" and "downstream". As shown in FIG. 45, a flow channel 140D from the air inlet 339 to the liquid supply portion 262 includes an air introduction portion 135D, the liquid storage portion 269, and the liquid supply portion 262.

The air introduction portion 135D includes the buffer chamber 338, the communication hole 337, the communication portion 261, the fourth buffer chamber 318, the communication passage 317, the third buffer chamber 316, the communication passage 315, the second buffer chamber 314, the communication passage 313, the first buffer chamber 312, and the communication passage 311. Here, the buffer chamber 338 of the buffer unit 27D and the communication hole 337 constitute the introduction passage 141D. In other words, in this working example, the buffer unit 27D has the introduction passage 141D. Also, the buffer chamber 338, which is one example of an air chamber, constitutes at least a portion of the introduction passage 141D. For this reason, the buffer unit 27D has the buffer chamber 338 that constitutes at least a portion of the introduction passage 141D.

The buffer chamber 338 is provided on the downstream side of the air inlet 339. Note that the air inlet 339 is blocked by the waterproof ventilation film 332 on the upstream side. For this reason, the buffer chamber 338 is located on the downstream side of the waterproof ventilation film 332. The communication hole 337 is provided on the downstream side of the buffer chamber 338. The tank 210 is provided on the downstream side of the buffer unit 27D. The communication portion 261 of the tank 210 is provided on the downstream side of the communication hole 337 of the buffer unit 27D.

The fourth buffer chamber 318 is provided on the downstream side of the communication portion 261. The communication passage 317 is provided on the downstream side of the fourth buffer chamber 318. The third buffer chamber 316 is provided on the downstream side of the communication passage 317. The communication passage 315 is provided on the downstream side of the third buffer chamber 316.

The second buffer chamber 314 is provided on the downstream side of the communication passage 315. The communication passage 313 is provided on the downstream side of the second buffer chamber 314. The first buffer chamber 312 is provided on the downstream side of the communication passage 313. The communication passage 311 is provided on the downstream side of the first buffer chamber 312. The liquid storage portion 269 is provided on the downstream side of the communication passage 311. Also, the liquid supply portion 262 is provided on the downstream side of the liquid storage portion 269. In this working example, the flow channel 140D from the air inlet 339 to the liquid supply portion 262 has the configuration described above.

When ink in the liquid storage portion 269 is supplied to the recording portion 229 (FIG. 32) via the liquid supply portion 262, the amount of ink in the liquid storage portion 269 decreases. When the amount of ink in the liquid storage portion 269 decreases, the pressure inside the liquid storage portion 269 tends to fall below atmospheric pressure. In this working example, the air introduction portion 135D, which extends from the air inlet 339 to the connection opening 306 (FIG. 45), is in communication with the liquid storage portion 269. For this reason, when the amount of ink in the liquid storage portion 269 decreases, and the pressure inside the liquid storage portion 269 falls below atmospheric pressure, air can be introduced into the liquid storage portion 269 via the air introduction portion 135D. As a result, the pressure inside the liquid storage portion 269 is readily maintained at atmospheric pressure.

At this time, the air introduced into the liquid storage portion 269 flows from the air inlet 339 into the buffer chamber 338 through the waterproof ventilation film 332. The air that flowed into the buffer chamber 338 then flows to the outside of the buffer unit 27D through the communication hole 337. The air that flowed to the outside of the buffer unit 27D then flows into the communication portion 261 of the tank 210. The air that flowed into the communication portion 261 of the tank 210 flows into the fourth buffer chamber 318.

The air that flowed into the fourth buffer chamber 318 then flows through the communication passage 317 and into the third buffer chamber 316. The air that flowed into the third buffer chamber 316 then flows through the communication passage 315 and into the second buffer chamber 314. The air that flowed into the second buffer chamber 314 then flows through the communication passage 313 and into the first buffer chamber 312. The air that flowed into the first buffer chamber 312 then flows through the communication passage 311 and into the liquid storage portion 269.

The buffer unit 27D provided in this working example constitutes at least a portion of the air introduction portion 135D that can introduce air into the liquid storage portion 269 of the tank 210. The buffer unit 27D, which is one example of a ventilation unit, has the introduction passage 141D that constitutes at least a portion of an air path, and the buffer chamber 338 that constitutes at least a portion of the introduction passage 141D. Also, the waterproof ventilation film 332 is provided on the upstream side of the buffer chamber 338. According to this configuration, even if ink in the liquid storage portion 269 flows into the air introduction portion 135D, the advancement of the ink is readily stopped in the buffer chamber 338 of the buffer unit 27D. Accordingly, this readily prevents ink in the liquid storage portion 269 from leaking to the outside of the tank 210 through the air introduction portion 135D.

Also, in this working example, the buffer unit 27D is configured to be detachable from the tank 210. In other words, the tank 210 and the buffer unit 27D are configured to be separate from each other. According to this configuration, it is possible to add the air introduction portion 135D to the tank 210 and extend the air introduction portion 135D. Accordingly, this more readily prevents ink from leaking out from the tank 210. Accordingly, the configuration of the liquid supply unit 132D (FIG. 41) can be changed for various types (also called models, etc.) of the liquid ejection system 201. As a result, the degree of freedom in design of the liquid ejection system 201 is readily improved.

Also, in this working example, the buffer unit 27D is configured to be detachable from the tank 210, and therefore the position of the buffer unit 27D relative to the tank 210 can be readily changed. Accordingly, the position of the buffer unit 27D relative to the tank 210 can be changed for various types of the liquid ejection system 201. As a result, the degree of freedom in design of the liquid ejection system 201 is readily improved.

Seventh Working Example

Figure 46:
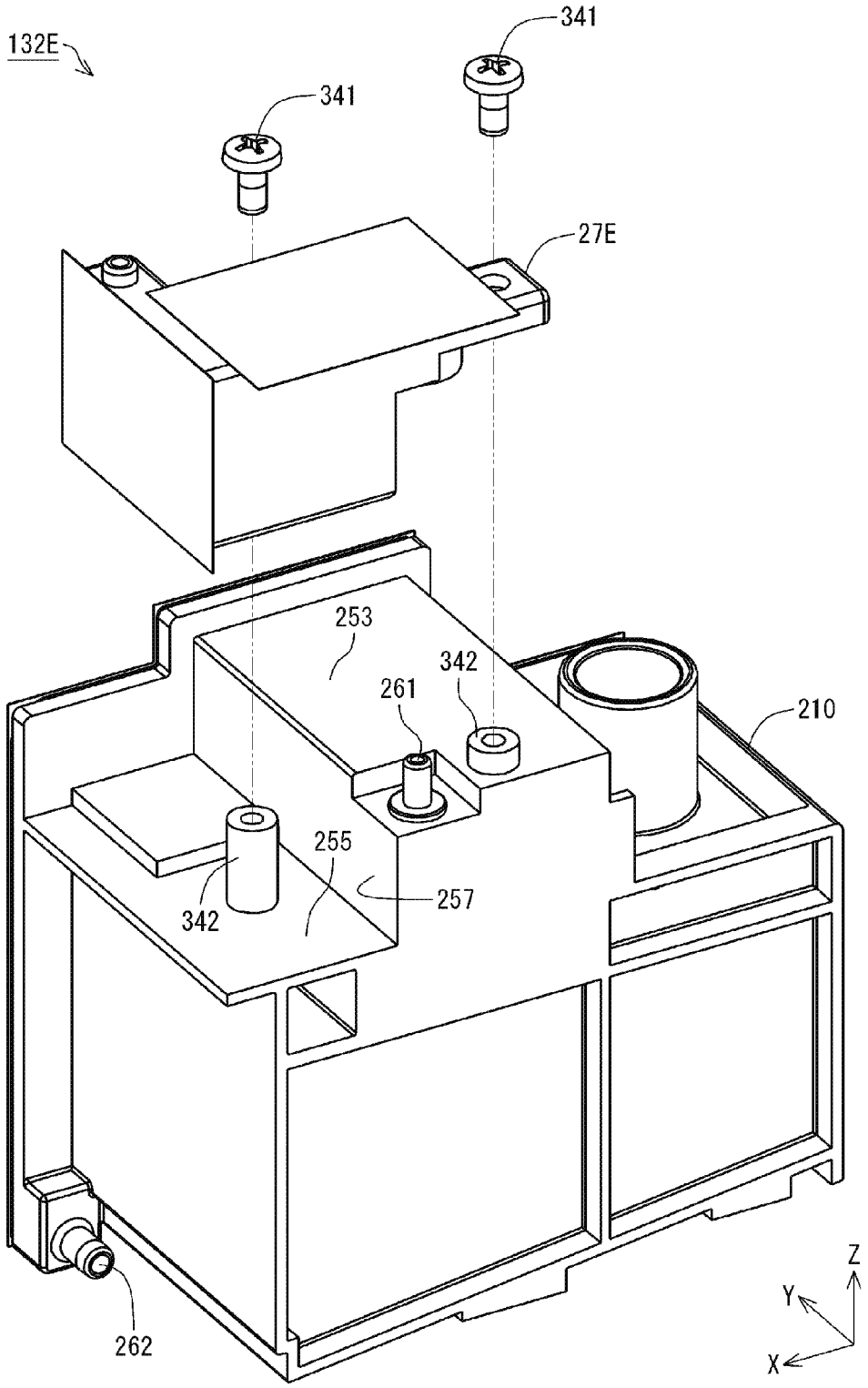
FIG. 46 is an exploded perspective view of a liquid supply unit that connects a buffer unit in a seventh working example to a tank.

As shown in FIG. 46, a buffer unit 27E of a seventh working example is fixed to the tank 210 by screws 341. Note that the configuration in which the buffer unit 27E is connected to the tank 210 will be referred to as a liquid supply unit 132E. In the liquid supply unit 132E, the buffer unit 27E is configured to be detachable from the tank 210.

Note that in the tank 210 of the liquid supply unit 132E in the seventh working example, the communication portion 261 is provided on the upper surface 253. Also, in the tank 210 of the seventh working example, screw fixing portions 342 are provided on the upper surface 253 and the upper surface 255. With the exception of the above points, the tank 210 of the seventh working example has the same configuration as the tank 210 of the sixth working example. For this reason, configurations of the tank 210 of the seventh working example that are the same as in the tank 210 of the sixth working example will be denoted by the same reference signs as in the sixth working example, and will not be described in detail.

In the tank 210 of the seventh working example, the communication portion 261 protrudes from the upper surface 253 in the Z axis direction. The communication portion 261 is in communication with the fourth buffer chamber 318 (FIG. 40) of the tank 210. The screw fixing portions 342 respectively protrude from the upper surface 253 and the upper surface 255 in the Z axis direction. Threaded holes that correspond to the screws 341 are formed in the screw fixing portions 342. The screws 341 are screwed into the screw fixing portions 342.

Figure 47:
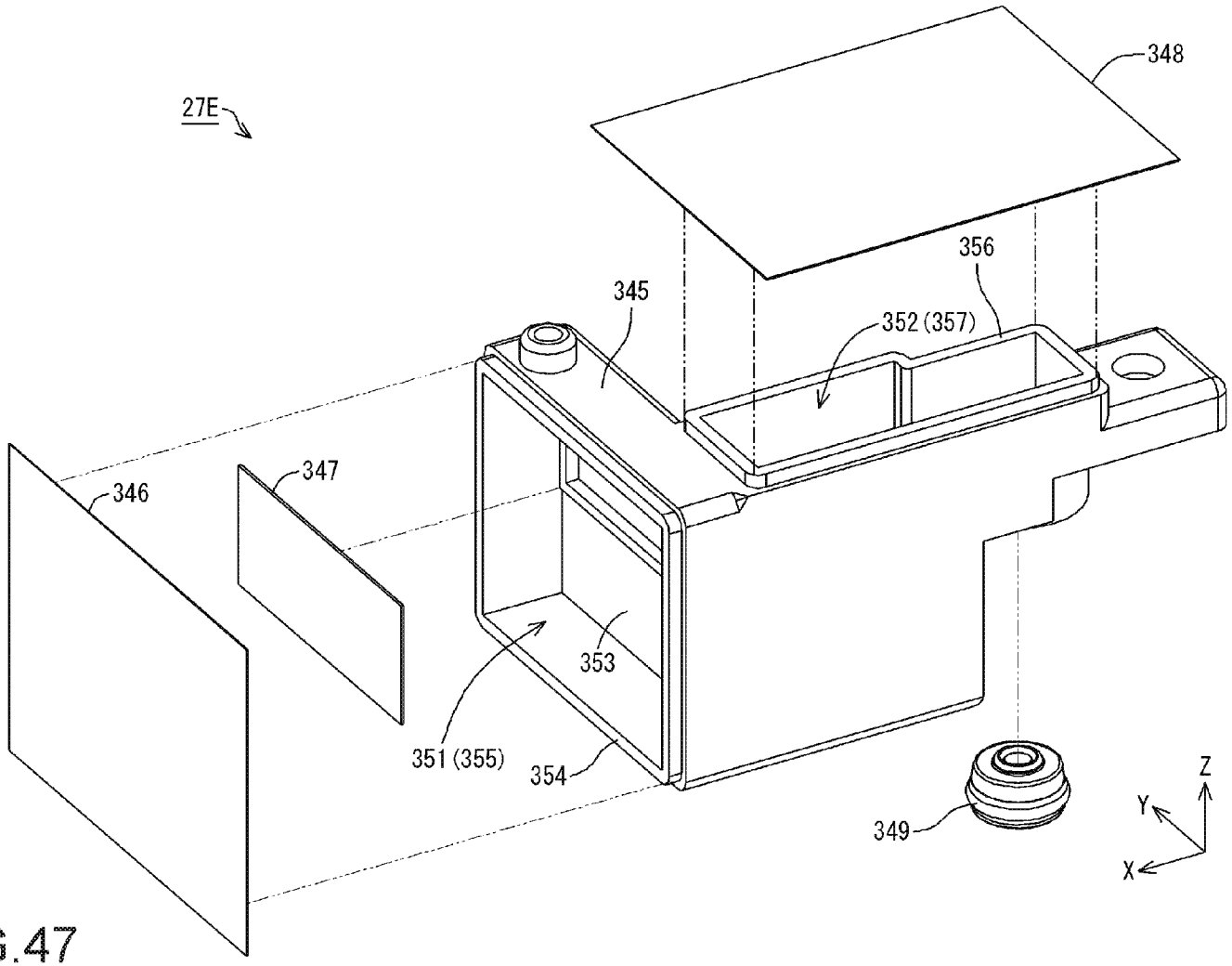
FIG. 47 is an exploded perspective view of the buffer unit in the seventh working example.

As shown in FIG. 47, the buffer unit 27E has a case 345, a sheet member 346, a waterproof ventilation film 347, a sheet member 348, and a sealing member 349. The case 345 is constituted by a synthetic resin such as nylon or polypropylene, for example. Also, the sheet member 346 and the sheet member 348 are each formed in the shape of a film using a synthetic resin (e.g., nylon or polypropylene), and are bendable. The waterproof ventilation film 347, which is one example of a waterproof ventilation member, has the same functions as the waterproof ventilation film 332, and can be constituted by the same material as the waterproof ventilation film 332.

A recessed portion 351 and a recessed portion 352 are formed in the case 345. In the case 345, the recessed portion 351 is formed so as to recede in the −X axis direction. In other words, the recessed portion 351 is open in the X axis direction. Also, the recessed portion 352 is formed so as to recede in the −Z axis direction. In other words, the recessed portion 352 is open in the Z axis direction. The recessed portion 351 and the recessed portion 352 are formed at positions that overlap each other in a plan view of the case 345 in the −X axis direction. The recessed portion 351 and the recessed portion 352 are separated from each other by a wall 353.

In the buffer unit 27E, the sheet member 346 is located on the X axis direction side of the case 345. The waterproof ventilation film 347 has a size and shape capable of being accommodated in the recessed portion 351. Also, the waterproof ventilation film 347 is accommodated in the recessed portion 351. The sheet member 346 is joined to the edge of the opening of the recessed portion 351, that is to say a joining portion 354 provided on the end portion, on the X axis direction side, of the recessed portion 351. The joining portion 354 surrounds the recessed portion 351 in a plan view of the case 345 in the −X axis direction. The sheet member 346 has a size and shape capable of covering the recessed portion 351 and the joining portion 354. When the sheet member 346 is joined to the joining portion 354, the recessed portion 351 is blocked by the sheet member 346. The region surrounded by the recessed portion 351 and the sheet member 346 will be referred to as a buffer chamber 355.

The sheet member 348 is located on the Z axis direction side of the case 345. The sheet member 348 is joined to the edge of the opening of the recessed portion 352, that is to say a joining portion 356 provided on the end portion, on the Z axis direction side, of the recessed portion 352. The joining portion 356 surrounds the recessed portion 352 in a plan view of the case 345 in the −Z axis direction. The sheet member 348 has a size and shape capable of covering the recessed portion 352 and the joining portion 356. When the sheet member 348 is joined to the joining portion 356, the recessed portion 352 is blocked by the sheet member 348. The region surrounded by the recessed portion 352 and the sheet member 348 will be referred to as a buffer chamber 357.

Figure 48:
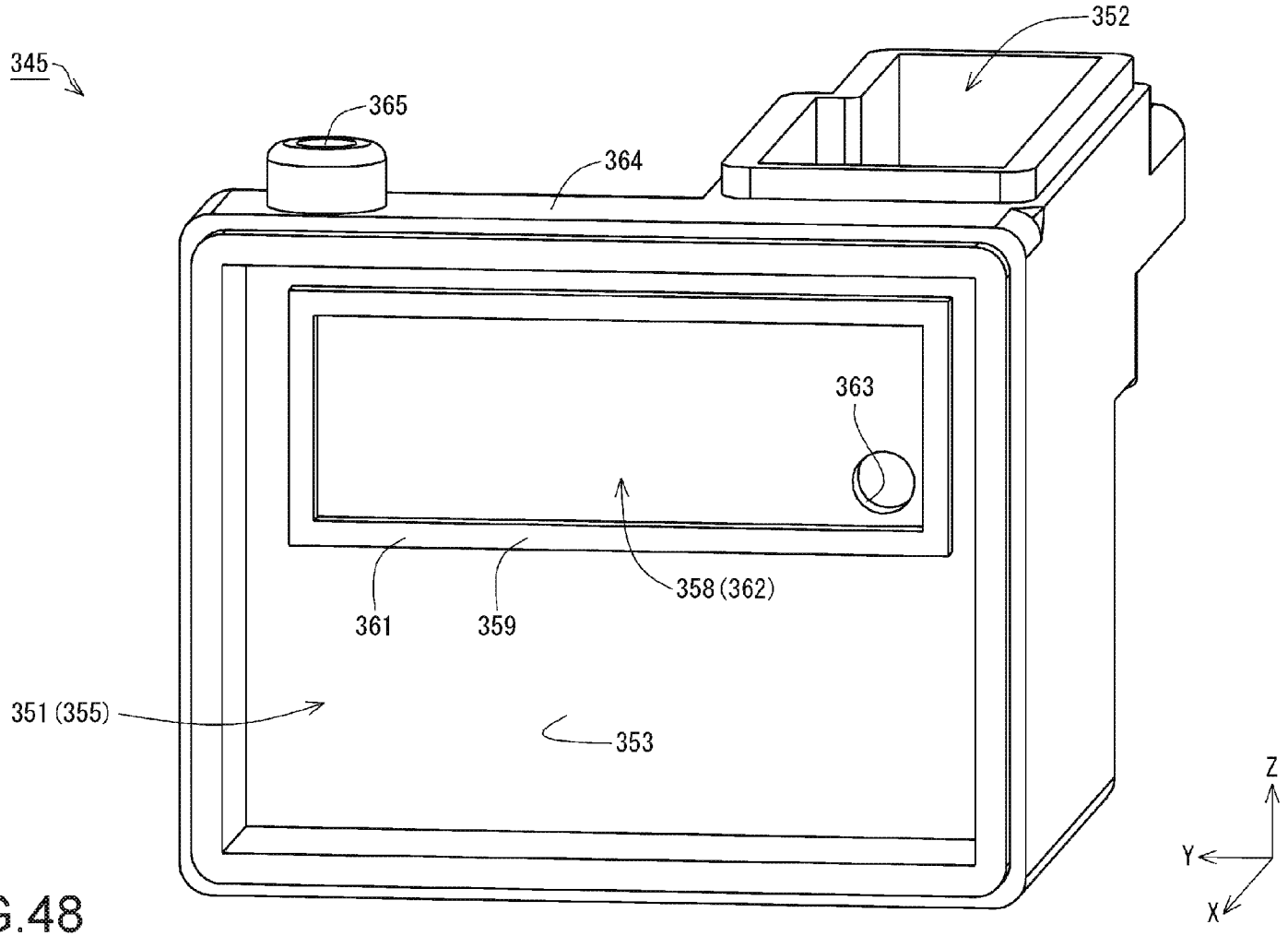
FIG. 48 is a perspective view of a case of the buffer unit in the seventh working example.

As shown in FIG. 48, an annular embankment portion 359 that defines a recessed portion 358 is provided in the recessed portion 351. The embankment portion 359 is formed on the wall 353, and protrudes from the wall 353 in the X axis direction. The recessed portion 358 is constituted by the wall 353 and the embankment portion 359. A joining portion 361 is provided on an end portion, on the X axis direction side, of the embankment portion 359. The waterproof ventilation film 347 shown in FIG. 47 is joined to the edge of the opening of the recessed portion 358, that is to say the joining portion 361. The joining portion 361 surrounds the recessed portion 358 in a plan view of the case 345 in the −X axis direction. The waterproof ventilation film 347 has a size and shape capable of covering the recessed portion 358 and the joining portion 361.

When the waterproof ventilation film 347 is joined to the joining portion 361, the recessed portion 358 is blocked by the waterproof ventilation film 347. The region surrounded by the recessed portion 358 and the waterproof ventilation film 347 will be referred to as a buffer chamber 362. In other words, in the buffer unit 27E, the buffer chamber 362 is provided inside the buffer chamber 355.

A communication hole 363 is formed in the recessed portion 358. The communication hole 363 and the recessed portion 352 are formed at positions that overlap each other in a plan view of the wall 353 in the −X axis direction. The communication hole 363 passes through the wall 353. Accordingly, the recessed portion 358 and the recessed portion 352 are in communication with each other via the communication hole 363. Also, an air inlet portion 365 is provided in a side wall 364, which is located on the Z axis direction side among the side walls that define the recessed portion 351. The air inlet portion 365 passes through the side wall 364 along the Z axis. For this reason, the buffer chamber 355 is in communication with the outside of the buffer chamber 355 via the air inlet portion 365.

Figure 49:
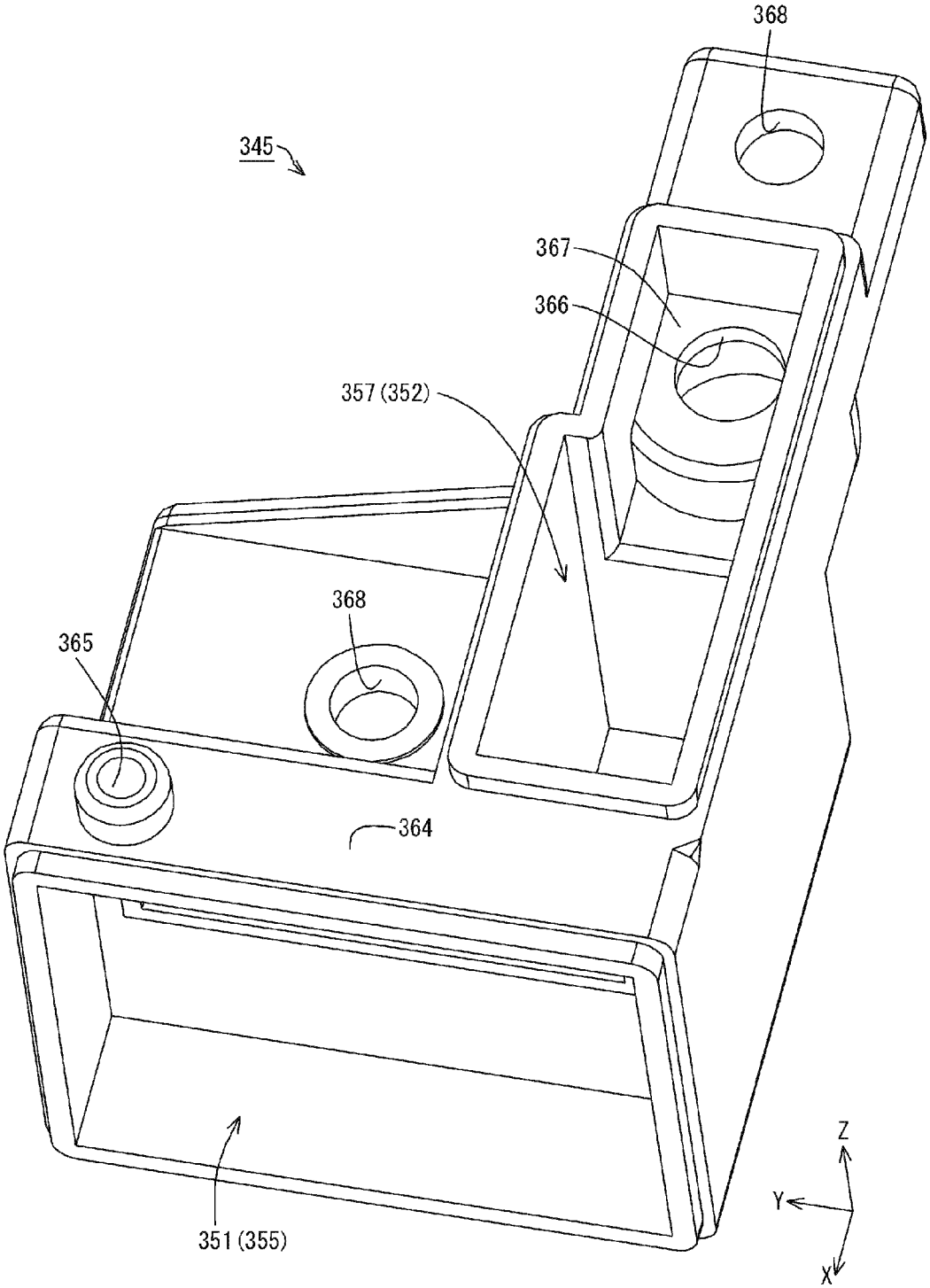
FIG. 49 is a perspective view of the case of the buffer unit in the seventh working example.

Also, as shown in FIG. 49, a connection hole 366 is formed in the recessed portion 352 of the case 345. The connection hole 366 is formed in the bottom portion 367 of the recessed portion 352. The connection hole 366 passes through the bottom portion 367 along the Z axis. An insertion portion 368 is formed on the outward side of the recessed portion 351 and recessed portion 352. One of the screws 341 (FIG. 46) is inserted into the insertion portion 368.

Figure 50:
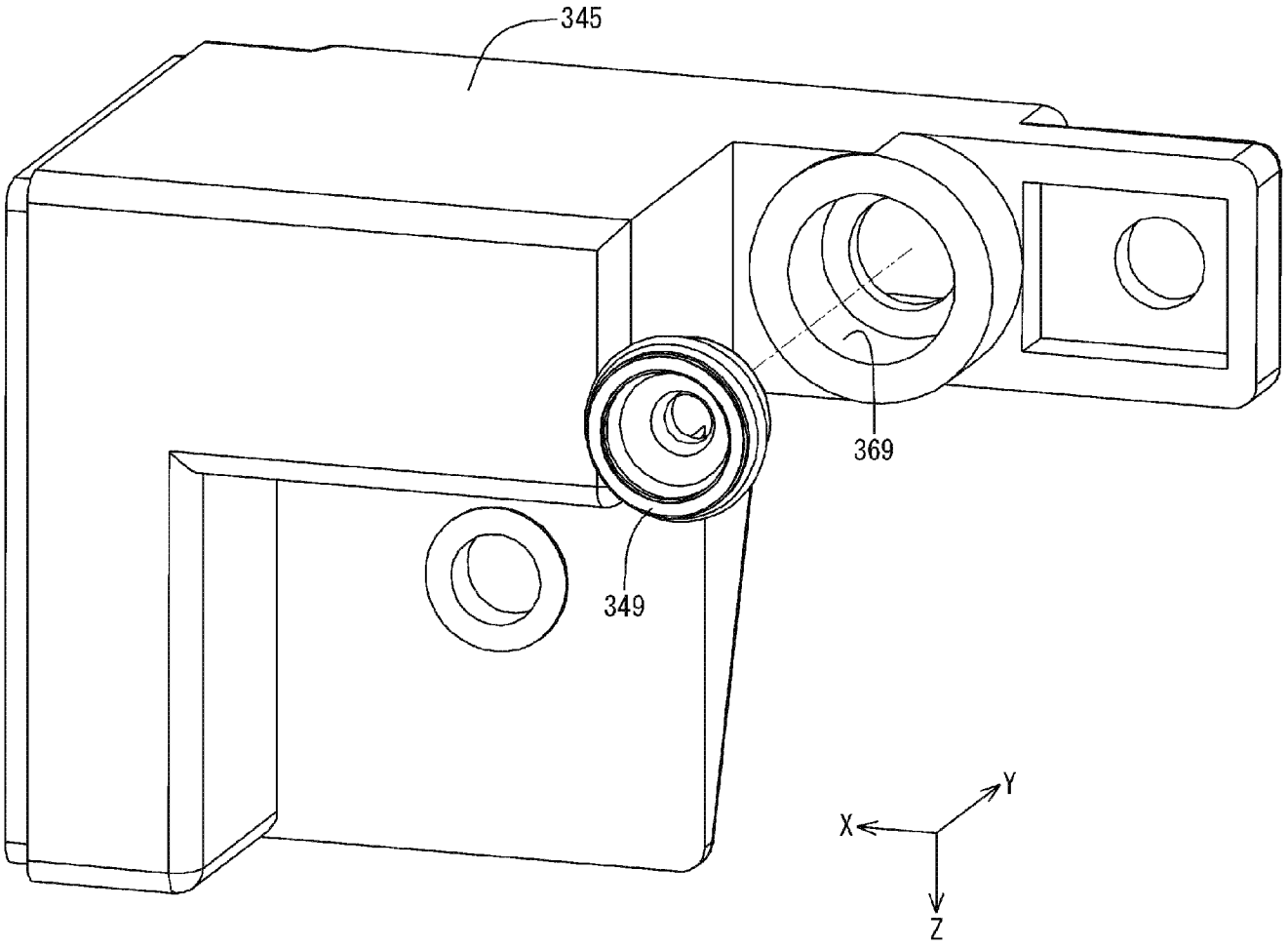
FIG. 50 is an exploded perspective view of a sealing member and the case of the buffer unit in the seventh working example.

As shown in FIG. 50, an insertion portion 369 is provided on the −Z axis direction side of the bottom portion 367 of the recessed portion 352. The insertion portion 369 is provided at a position that is overlapped with the connection hole 366. The sealing member 349 is inserted into the insertion portion 369. In this working example, the sealing member 349 is press-fitted into the insertion portion 369. The sealing member 349 is constituted by an elastic material such as rubber or an elastomer, and is formed in an annular shape.

Figure 51:
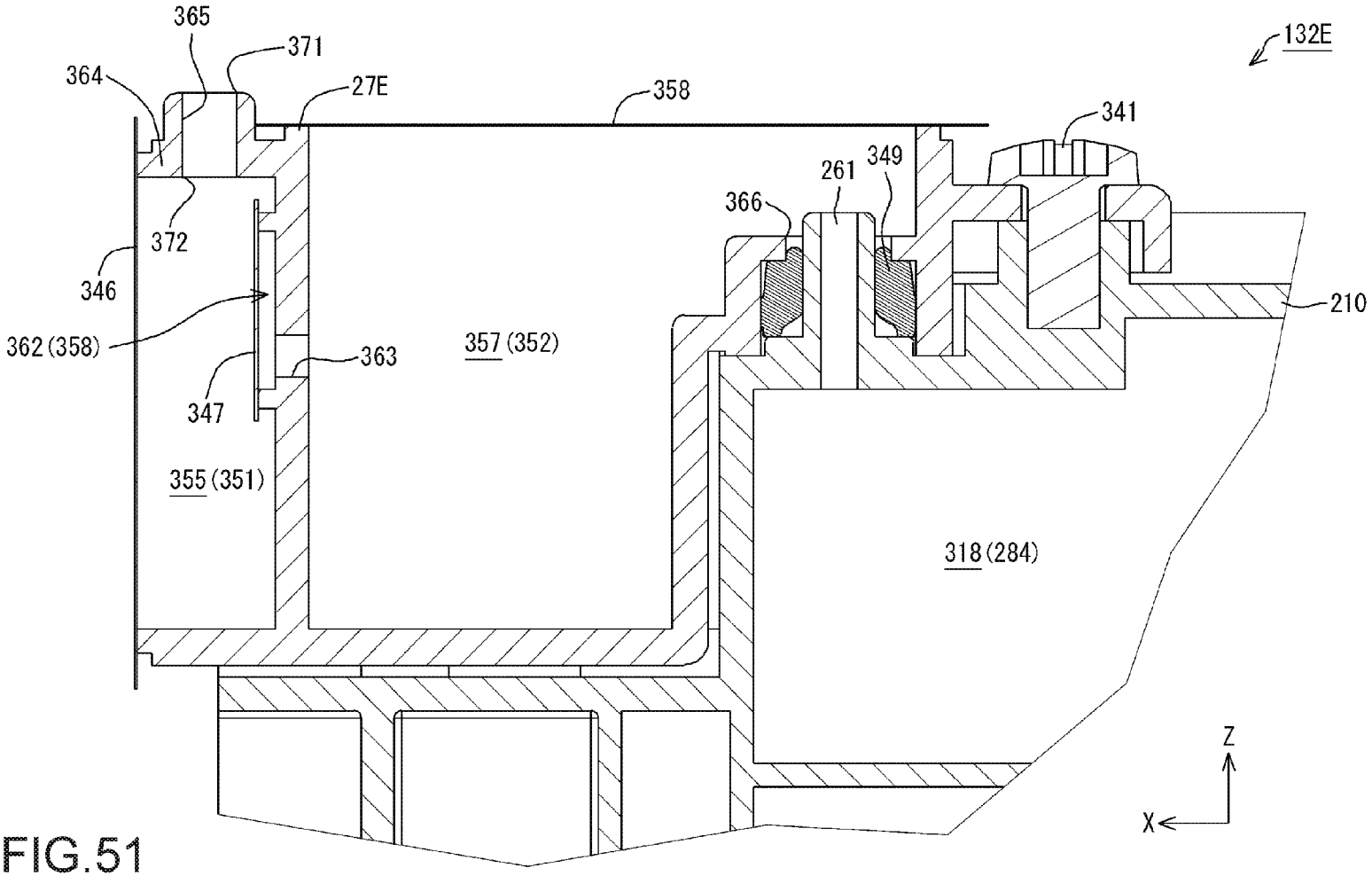
FIG. 51 is a cross-sectional view of a communication portion of the tank and the buffer unit in the seventh working example.

As shown in FIG. 51, which is a cross-sectional view of the buffer unit 27E and the communication portion 261 of the tank 210, when the buffer unit 27E is connected to the tank 210, the communication portion 261 is press-fitted into the sealing member 349. The sealing member 349 is interposed between the communication portion 261 and the connection hole 366. The air-tightness between the communication portion 261 and the connection hole 366 is increased by the sealing member 349. Note that FIG. 51 shows a cross-section of the tank 210 and the buffer unit 27E taken along an XZ plane that passes through the air inlet portion 365, communication hole 363, and sealing member 349 of the buffer unit 27E, and the communication portion 261 of the tank 210.

When the buffer unit 27E is connected to the tank 210, the fourth buffer chamber 318 of the tank 210 and the buffer chamber 357 of the buffer unit 27E are put into communication with each other via the communication portion 261. Accordingly, the liquid supply unit 132E is provided with the flow channel 140E from the air inlet portion 365 to the liquid supply portion 262.

Note that in the buffer unit 27E, the air inlet portion 365 has an air inlet 371 and an introduction opening 372. The air inlet 371 is an opening that is open toward the outside of the buffer chamber 355. The introduction opening 372 is an opening that is open toward the interior of the buffer chamber 355. Also, the introduction opening 372 can be considered to be an opening formed in the intersection portion where the inner wall of the buffer chamber 355 and the air inlet portion 365 intersect each other. In other words, the introduction opening 372 is the portion where the air inlet portion 365 is connected to the buffer chamber 355.

The air inlet portion 365 protrudes from the side wall 364 in the Z axis direction. The air inlet portion 365 includes the thickness of the side wall 364 and a portion that protrudes from the side wall 364 in the Z axis direction. For this reason, the passage length of the air inlet portion 365 is equal to the sum of the length of the portion that protrudes from the side wall 364 in the Z axis direction and the thickness dimension of the side wall 364. Note that a configuration is possible in which the portion of the air inlet portion 365 that protrudes in the Z axis direction is omitted. In a buffer unit 27E in which the portion of the air inlet portion 365 that protrudes in the Z axis direction is omitted, the passage length of the air inlet portion 365 is the same as the thickness dimension of the side wall 364.

Figure 52:
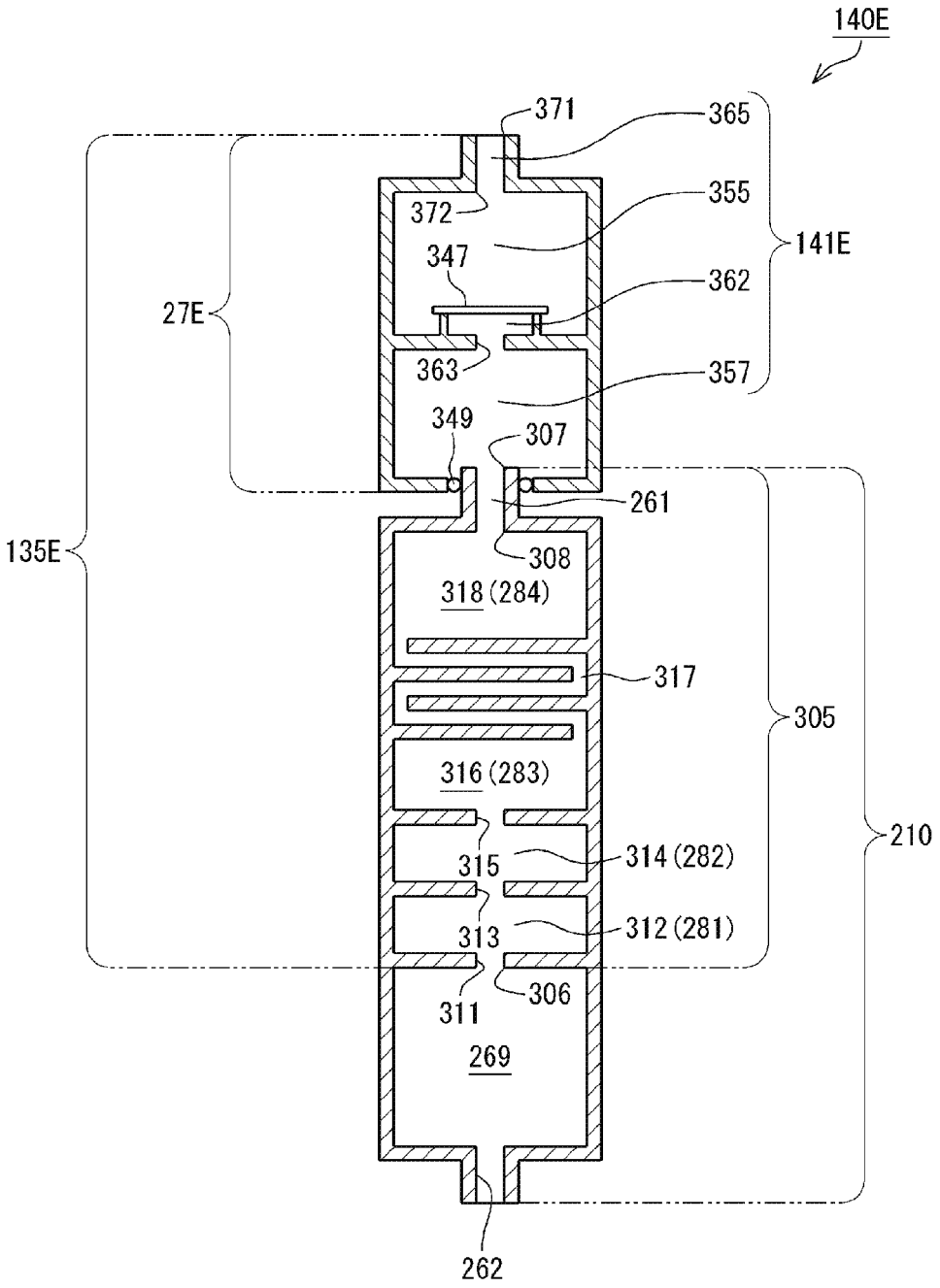
FIG. 52 is a diagram schematically showing a flow channel in the seventh working example.

The following describes a flow channel 140E from the air inlet portion 365 to the liquid supply portion 262. As shown in FIG. 52, the flow channel 140E of this working example has an air introduction portion 135E. The air introduction portion 135E includes an introduction passage 141E and the air introduction passage 305. The introduction passage 141E includes the air inlet portion 365, the buffer chamber 355, the buffer chamber 362, and the buffer chamber 357 of the buffer unit 27E. For this reason, the buffer unit 27E constitutes at least a portion of the air introduction portion 135E. The air introduction passage 305 in this working example is similar to that of the sixth working example, and therefore the same reference signs as in the sixth working example will be used, and a detailed description will not be given.

The buffer chamber 355 is provided on the downstream side of the air inlet portion 365. The buffer chamber 362 is provided on the downstream side of the buffer chamber 355. The buffer chamber 355 and the buffer chamber 362 are separated by the waterproof ventilation film 347. The buffer chamber 355 and the buffer chamber 362 are in communication with each other via the waterproof ventilation film 347.

The buffer chamber 357 is provided on the downstream side of the buffer chamber 362. The buffer chamber 357 and the buffer chamber 362 are in communication with each other via the communication hole 363. The communication hole 363 is blocked by the waterproof ventilation film 347 on the upstream side. Accordingly, the introduction passage 141E is blocked by the waterproof ventilation film 347 on the upstream side of the buffer chamber 357. Also, the communication portion 261 of the tank 210 is arranged on the downstream side of the buffer chamber 357.

Air that has flowed through the air inlet 371 and into the air inlet portion 365 flows through the introduction opening 372 and into the buffer chamber 355. The air that flowed into the buffer chamber 355 then passes through the waterproof ventilation film 347 and flows into the buffer chamber 362. The air that flowed into the buffer chamber 362 then passes through the communication hole 363 and flows into the buffer chamber 357. The air that flowed into the buffer chamber 357 then passes through the communication portion 261 and flows into the fourth buffer chamber 318 of the tank 210. The subsequent flow path is the same as in the sixth working example, and therefore will not be described in detail.

The same effects as in the sixth working example are obtained in the seventh working example as well. Furthermore, in the seventh working example, the buffer chamber 362 is interposed between the air inlet portion 365 and the buffer chamber 357. For this reason, even if ink in the liquid storage portion 269 flows into the buffer chamber 357 for example, the advancement of the ink is readily stopped in the buffer chamber 362 provided on the upstream side of the buffer chamber 357. Accordingly, this more readily prevents ink in the liquid storage portion 269 from leaking to the outside of the tank 210 through the air introduction portion 135E.

Furthermore, in the seventh working example, the buffer chamber 355 is interposed between the air inlet portion 365 and the buffer chamber 362. For this reason, even if ink in the liquid storage portion 269 flows into the buffer chamber 362 for example, the advancement of the ink is readily stopped in the buffer chamber 355 provided on the upstream side of the buffer chamber 362. Accordingly, this more readily prevents ink in the liquid storage portion 269 from leaking to the outside of the tank 210 through the air introduction portion 135E.

Furthermore, in the seventh working example, the buffer chamber 362 and the buffer chamber 355 are separated from each other by the waterproof ventilation film 347. For this reason, even if ink in the liquid storage portion 269 flows into the buffer chamber 362 for example, it is possible to suppress the flow of the ink from the buffer chamber 362 into the buffer chamber 355. Accordingly, this more readily prevents ink in the liquid storage portion 269 from leaking to the outside of the tank 210 through the air introduction portion 135E. Note that the waterproof ventilation film 347 is one example of a waterproof ventilation sheet as well.

Eighth Working Example

Figure 53:
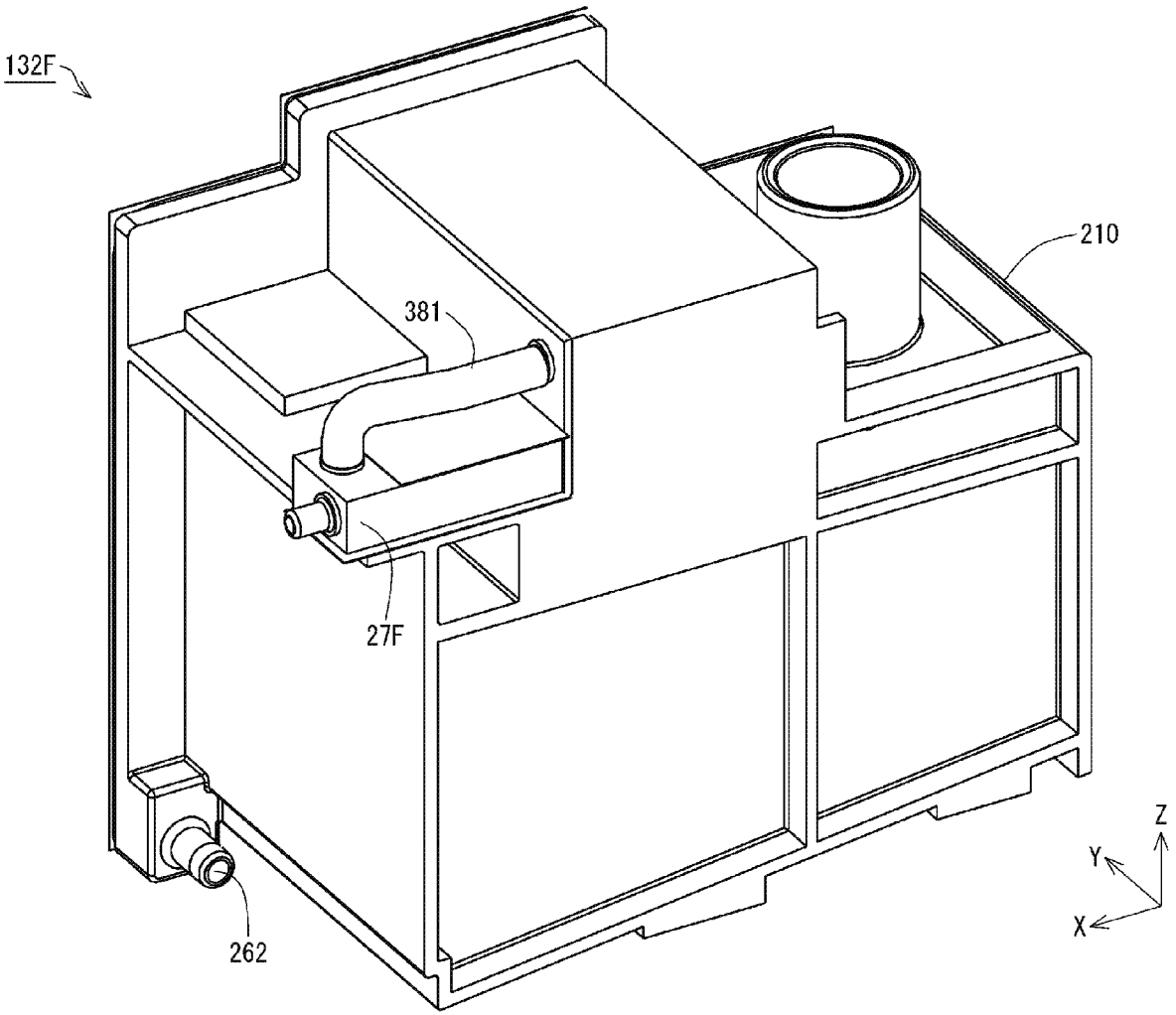
FIG. 53 is a perspective view of a liquid supply unit that connects the tank according to the second embodiment to a buffer unit in an eighth working example.

As shown in FIG. 53, a buffer unit 27F of an eighth working example is configured to be able to be connected to the tank 210 via a tube 381. Note that the configuration in which the buffer unit 27F is connected to the tank 210 will be referred to as a liquid supply unit 132F. In the liquid supply unit 132F, the buffer unit 27F is configured to be detachable from the tank 210.

Figure 54:
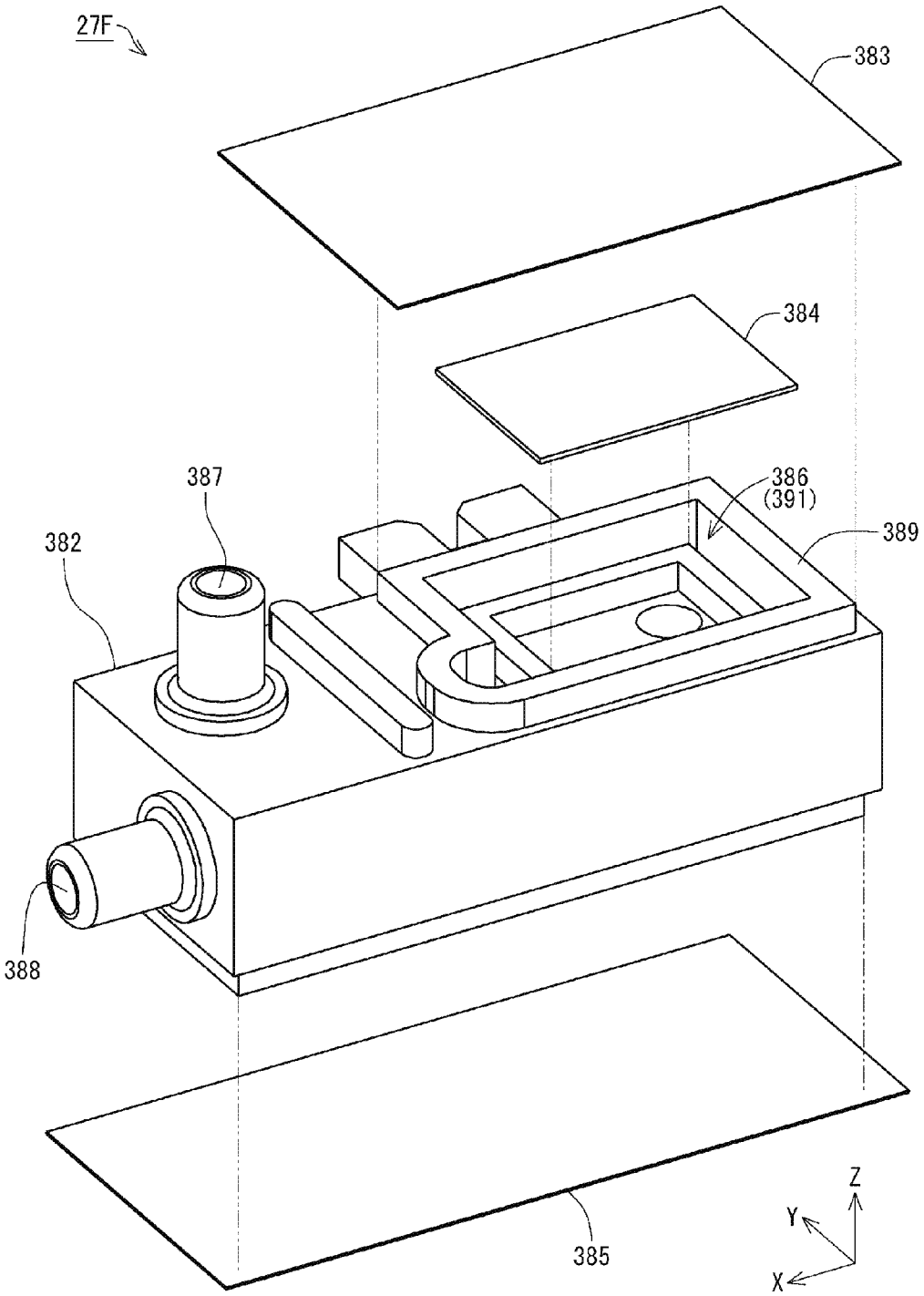
FIG. 54 is an exploded perspective view of the buffer unit in the eighth working example.

As shown in FIG. 54, the buffer unit 27F has a case 382, a sheet member 383, a waterproof ventilation film 384, and a sheet member 385. The case 382 is constituted by a synthetic resin such as nylon or polypropylene, for example. Also, the sheet member 383 and the sheet member 385 are each formed in the shape of a film using a synthetic resin (e.g., nylon or polypropylene), and are bendable. The waterproof ventilation film 384, which is one example of a waterproof ventilation member, has the same functions as the waterproof ventilation film 332, and can be constituted by the same material as the waterproof ventilation film 332.

A recessed portion 386 is formed in the case 382. In the case 382, the recessed portion 386 is formed so as to recede in the −Z axis direction. In other words, the recessed portion 386 is open in the Z axis direction. Also, the case 382 is provided with a connection portion 387 and an air inlet portion 388. The connection portion 387 protrudes from the case 382 in the Z axis direction. The air inlet portion 388 protrudes from the case 382 in the X axis direction.

In the buffer unit 27F, the sheet member 383 is located on the Z axis direction side of the case 382. The waterproof ventilation film 384 has a size and shape capable of being accommodated in the recessed portion 386. Also, the waterproof ventilation film 384 is accommodated in the recessed portion 386. The sheet member 383 is joined to the edge of the opening of the recessed portion 386, that is to say a joining portion 389 provided on the end portion, on the Z axis direction side, of the recessed portion 386. The joining portion 389 surrounds the recessed portion 386 in a plan view of the case 382 in the −Z axis direction. The sheet member 383 has a size and shape capable of covering the recessed portion 386 and the joining portion 389. When the sheet member 383 is joined to the joining portion 389, the recessed portion 386 is blocked by the sheet member 383. The region surrounded by the recessed portion 386 and the sheet member 383 will be referred to as a buffer chamber 391.

Figure 55:
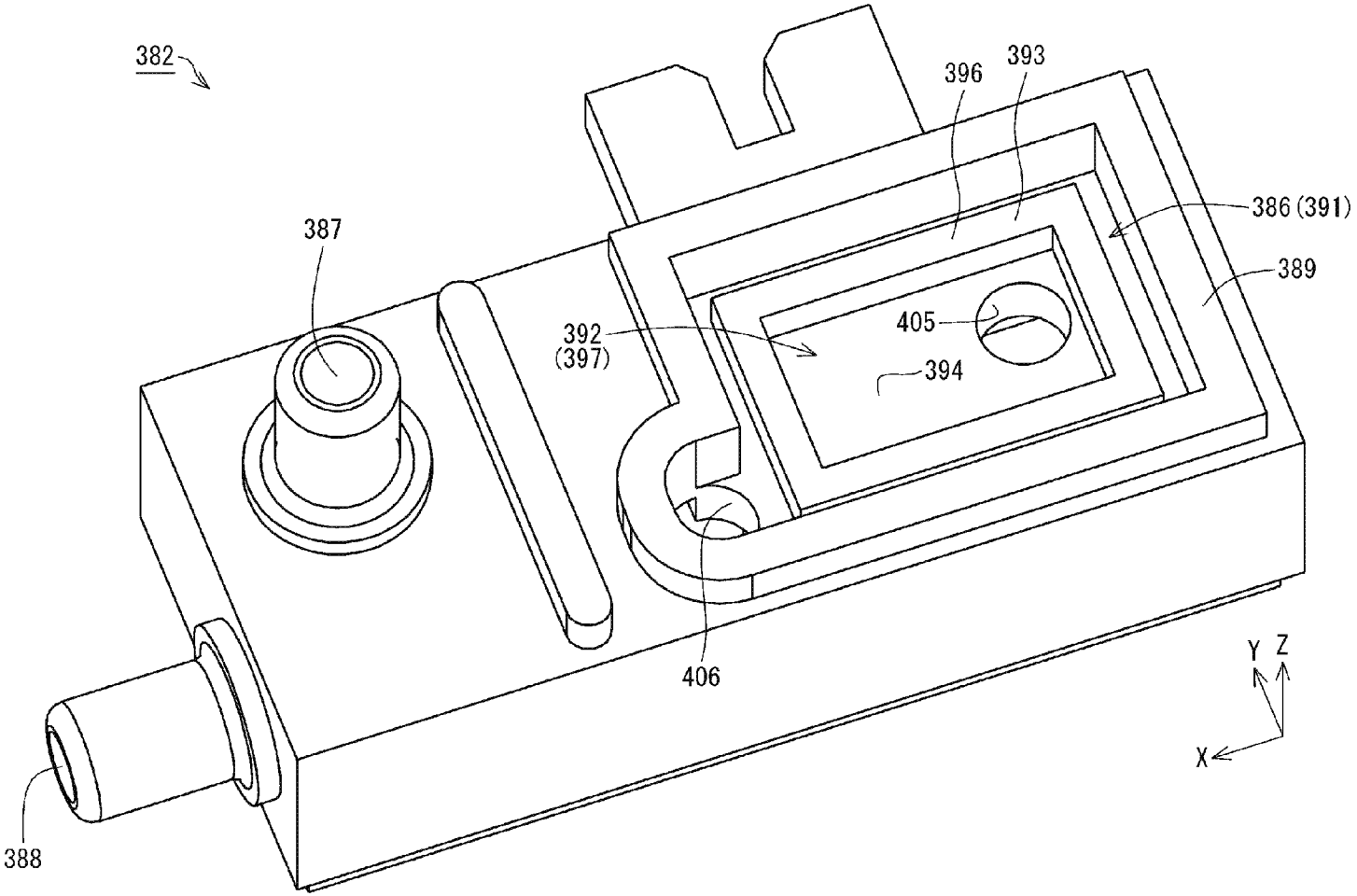
FIG. 55 is a perspective view of a case of the buffer unit in the eighth working example.

As shown in FIG. 55, a recessed portion 392 is formed in the recessed portion 386 of the case 382. An annular embankment portion 393 that defines the recessed portion 392 is provided in the recessed portion 386. The embankment portion 393 is formed on a wall 394, and protrudes from the wall 394 in the Z axis direction. The recessed portion 392 is constituted by the wall 394 and the embankment portion 393. A joining portion 396 is provided on an end portion, on the Z axis direction side, of the embankment portion 393. The waterproof ventilation film 384 shown in FIG. 54 is joined to the edge of the opening of the recessed portion 392, that is to say the joining portion 396. The joining portion 396 surrounds the recessed portion 392 in a plan view of the case 382 in the −Z axis direction. The waterproof ventilation film 384 has a size and shape capable of covering the recessed portion 392 and the joining portion 396.

When the waterproof ventilation film 384 is joined to the joining portion 396, the recessed portion 392 is blocked by the waterproof ventilation film 384. The region surrounded by the recessed portion 392 and the waterproof ventilation film 384 will be referred to as a buffer chamber 397. In other words, in the buffer unit 27F, the buffer chamber 397 is provided inside the buffer chamber 391.

Figure 56:
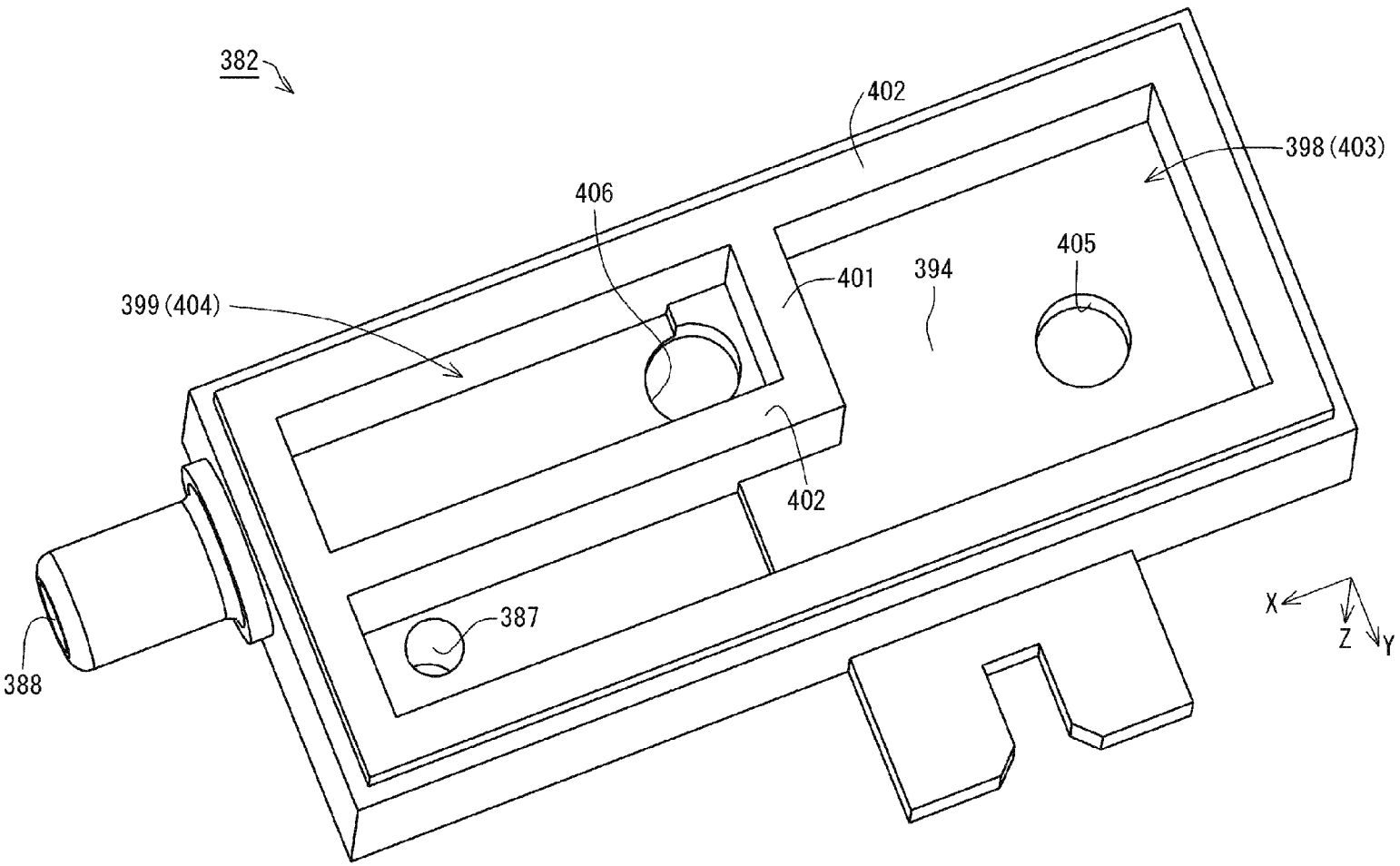
FIG. 56 is a perspective view of the case of the buffer unit in the eighth working example.

As shown in FIG. 56, a recessed portion 398 and a recessed portion 399 are formed on the −Z axis direction side of the recessed portion 386. In the case 382, the recessed portion 398 and the recessed portion 399 are formed so as to recede in the Z axis direction. In other words, the recessed portion 398 and the recessed portion 399 are open in the −Z axis direction. The recessed portion 398 and the recessed portion 399 are separated from each other by a partition wall 401. Also, the recessed portion 392 (FIG. 55) is formed in a region that is overlapped with the recessed portion 398 in a plan view of the case 382 in the −Z axis direction. The recessed portion 392 and the recessed portion 398 are separated from each other by a wall 394.

The sheet member 385 (FIG. 54) is located on the −Z axis direction side of the case 382. The sheet member 385 is joined to the edges of the openings of the recessed portion 398 and the recessed portion 399 shown in FIG. 56, that is to say a joining portion 402 provided on the end portions, on the −Z axis direction side, of the recessed portion 398 and the recessed portion 399. The joining portion 402 surrounds the recessed portion 398 and the recessed portion 399 in a plan view of the case 382 in the Z axis direction. The joining portion 402 is provided on the partition wall 401 as well. In other words, the sheet member 385 is joined to the end portion, on the −Z axis direction side, of the partition wall 401 as well.

The sheet member 385 has a size and shape capable of covering the recessed portion 398, the recessed portion 399, and the joining portion 402. When the sheet member 385 is joined to the joining portion 402, the recessed portion 398 and the recessed portion 399 are blocked by the sheet member 385. The region surrounded by the recessed portion 398 and the sheet member 385 will be referred to as a buffer chamber 403. The region surrounded by the recessed portion 399 and the sheet member 385 will be referred to as a buffer chamber 404.

As shown in FIG. 56, the connection portion 387 is in communication with the interior of the recessed portion 398. The connection portion 387 (FIG. 55), which protrudes from the case 382 in the Z axis direction, passes through the case 382 along the Z axis, and is in communication with the interior of the recessed portion 398. Also, as shown in FIG. 56, a communication hole 405 is formed in the recessed portion 398. Also, a communication hole 406 is formed in the recessed portion 399. The communication hole 405 and the recessed portion 392 (FIG. 55) are arranged at positions that are overlapped with each other in a plan view of the wall 394 in the Z axis direction. Also, the communication hole 406 is arranged at a position that is outside of the recessed portion 392 (FIG. 55) and is overlapped with the recessed portion 386 in a plan view of the wall 394 in the Z axis direction.

The communication hole 405 passes through the wall 394. Accordingly, the recessed portion 392 and the recessed portion 398 are in communication with each other via the communication hole 405. The communication hole 406 also passes through the wall 394. Accordingly, the recessed portion 386 and the recessed portion 399 are in communication with each other via the communication hole 406. Also, the air inlet portion 388 shown in FIG. 56 is in communication with the recessed portion 399. For this reason, the buffer chamber 404 is in communication with the outside of the buffer chamber 404 via the air inlet portion 388.

Figure 57:
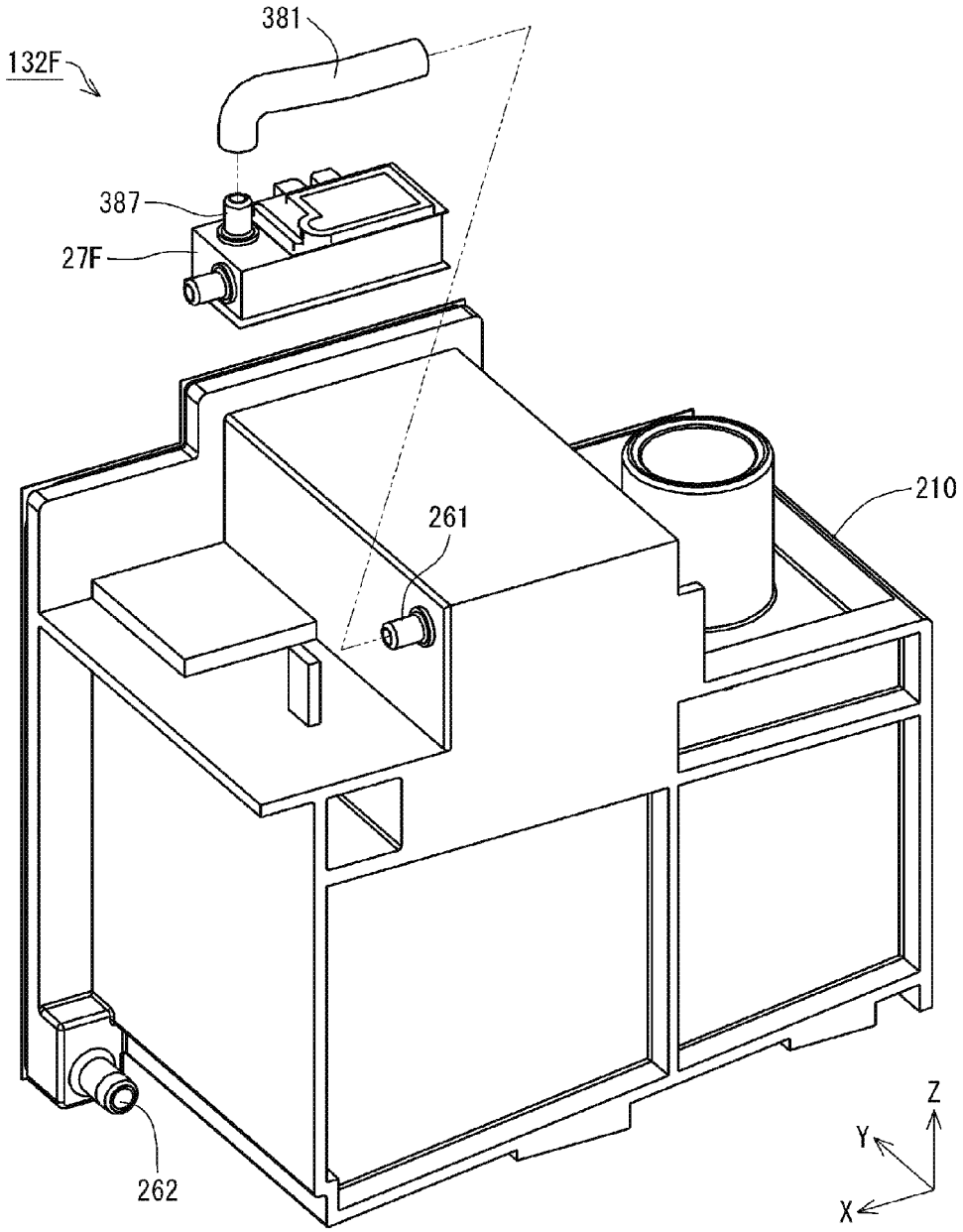
FIG. 57 is an exploded perspective view of the liquid supply unit that connects the tank according to the second embodiment to the buffer unit in the eighth working example.

As shown in FIG. 57, the tube 381, which connects the buffer unit 27F to the tank 210, is connected to the connection portion 387 of the buffer unit 27F and the communication portion 261 of the tank 210. When the buffer unit 27F is connected to the tank 210 via the tube 381, a flow channel 140F from the air inlet portion 388 to the liquid supply portion 262 is constituted in the liquid supply unit 132F.

Figure 58:
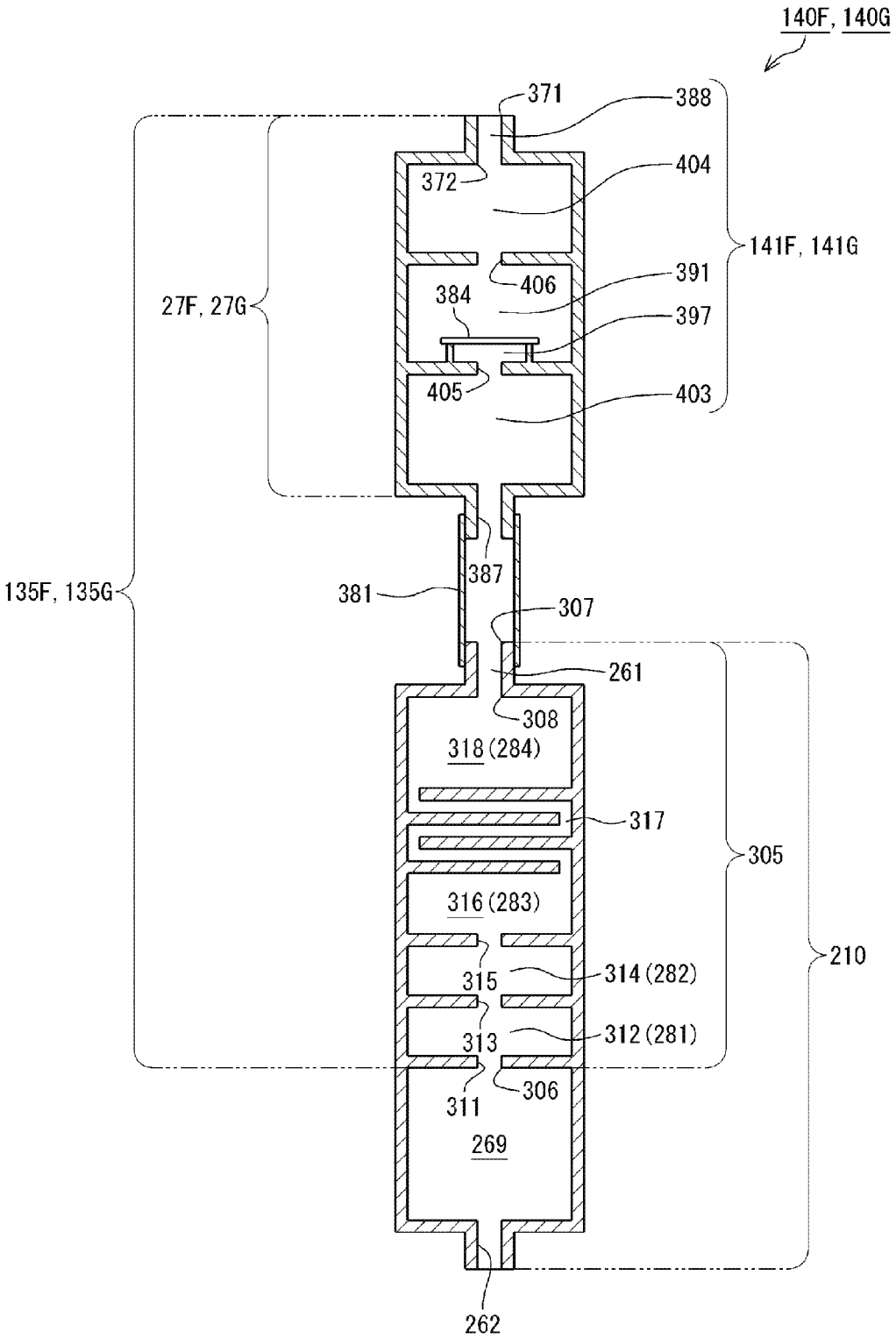
FIG. 58 is a diagram schematically showing a flow channel in the eighth working example.

The following describes the flow channel 140F from the air inlet portion 388 to the liquid supply portion 262. As shown in FIG. 58, the flow channel 140F of this working example has an air introduction portion 135F. The air introduction portion 135F includes the introduction passage 141F, the tube 381, and the air introduction passage 305. The introduction passage 141F includes the air inlet portion 388, the buffer chamber 404, the buffer chamber 391, the buffer chamber 397, and the buffer chamber 403 of the buffer unit 27F. For this reason, the buffer unit 27F constitutes at least a portion of the air introduction portion 135F.

Note that the air introduction passage 305 in this working example is similar to that of the sixth working example, and therefore the same reference signs as in the sixth working example will be used, and a detailed description will not be given. Also, in the buffer unit 27F, the air inlet portion 388 has the air inlet 371 and the introduction opening 372. The air inlet 371 and the introduction opening 372 are the same as in the seventh working example, and therefore will not be described in detail. Also, in the buffer unit 27F, a configuration is possible in which the portion of the air inlet portion 388 that protrudes from the case 382 is omitted, but this is the same as in the seventh working example, and therefore will not be described in detail.

The buffer chamber 404 is provided on the downstream side of the air inlet portion 388. The buffer chamber 391 is provided on the downstream side of the buffer chamber 404. The buffer chamber 391 and the buffer chamber 404 are in communication with each other via the communication hole 406. The buffer chamber 397 is provided on the downstream side of the buffer chamber 391. The buffer chamber 391 and the buffer chamber 397 are separated by the waterproof ventilation film 384. The buffer chamber 391 and the buffer chamber 397 are in communication with each other via the waterproof ventilation film 384.

The buffer chamber 403 is provided on the downstream side of the buffer chamber 397. The buffer chamber 403 and the buffer chamber 397 are in communication with each other via the communication hole 405. The communication hole 405 is blocked by the waterproof ventilation film 384 on the upstream side. Accordingly, the introduction passage 141F is blocked by the waterproof ventilation film 384 on the upstream side of the buffer chamber 403. Also, the communication portion 261 of the tank 210 is arranged on the downstream side of the buffer chamber 403.

Air that has flowed through the air inlet 371 and into the air inlet portion 388 flows through the introduction opening 372 and into the buffer chamber 404. The air that flowed into the buffer chamber 404 then passes through the communication hole 406 and flows into the buffer chamber 391. The air that flowed into the buffer chamber 391 then passes through the waterproof ventilation film 384 and flows into the buffer chamber 397. The air that flowed into the buffer chamber 397 then passes through the communication hole 405 and flows into the buffer chamber 403. The air that flowed into the buffer chamber 403 then passes through the communication portion 261 and flows into the fourth buffer chamber 318 of the tank 210. The subsequent flow path is the same as in the sixth working example, and therefore will not be described in detail.

The same effects as in the sixth and seventh working examples are obtained in the eighth working example as well. Furthermore, in the eighth working example, the buffer chamber 397 is interposed between the air inlet portion 388 and the buffer chamber 403. For this reason, even if ink in the liquid storage portion 269 flows into the buffer chamber 403 for example, the advancement of the ink is readily stopped in the buffer chamber 397 provided on the upstream side of the buffer chamber 403. Accordingly, this more readily prevents ink in the liquid storage portion 269 from leaking to the outside of the tank 210 through the air introduction portion 135F.

Furthermore, in the eighth working example, the buffer chamber 404 is interposed between the air inlet portion 365 and the buffer chamber 391. For this reason, even if ink in the liquid storage portion 269 flows into the buffer chamber 391 for example, the advancement of the ink is readily stopped in the buffer chamber 404 provided on the upstream side of the buffer chamber 391. Accordingly, this more readily prevents ink in the liquid storage portion 269 from leaking to the outside of the tank 210 through the air introduction portion 135F.

Furthermore, in the eighth working example, the buffer chamber 397 and the buffer chamber 391 are separated from each other by the waterproof ventilation film 384. For this reason, even if ink in the liquid storage portion 269 flows into the buffer chamber 397 for example, it is possible to suppress the flow of the ink from the buffer chamber 397 into the buffer chamber 391. Accordingly, this more readily prevents ink in the liquid storage portion 269 from leaking to the outside of the tank 210 through the air introduction portion 135F. Note that the waterproof ventilation film 384 is one example of a waterproof ventilation sheet as well.

In the sixth to eighth working examples, the buffer unit 27 is arranged on the side of the tank 210 that is opposite to the front surface 236 side. However, the arrangement of the buffer unit 27 is not limited in this way. The buffer unit 27 can be arranged at various positions in the periphery of the tank 210. Examples of positions in the periphery of the tank 210 include various positions on the Y axis direction side or the −Y axis direction side of the tank 210, and on the Z axis direction side or the −Z axis direction side of the tank 210.

Furthermore, in the case where the buffer unit 27 is arranged on the side of the tank 210 that is opposite to the front surface 236 side, the buffer unit 27 can be arranged at a position on the X axis direction side of the tank 210. In this case, the buffer unit 27 can be arranged so as to be contained within the casing 207 shown in FIG. 33, or be arranged outward of the casing 207, for example. In a configuration in which the buffer unit 27 is arranged outward of the casing 207, the buffer unit 27 can be arranged between the ink supply apparatus 204 and printer 203, or the buffer unit 27 can be arranged inside the casing 206 (FIG. 32) of the printer 203, for example.

Ninth Working Example

Figure 59:
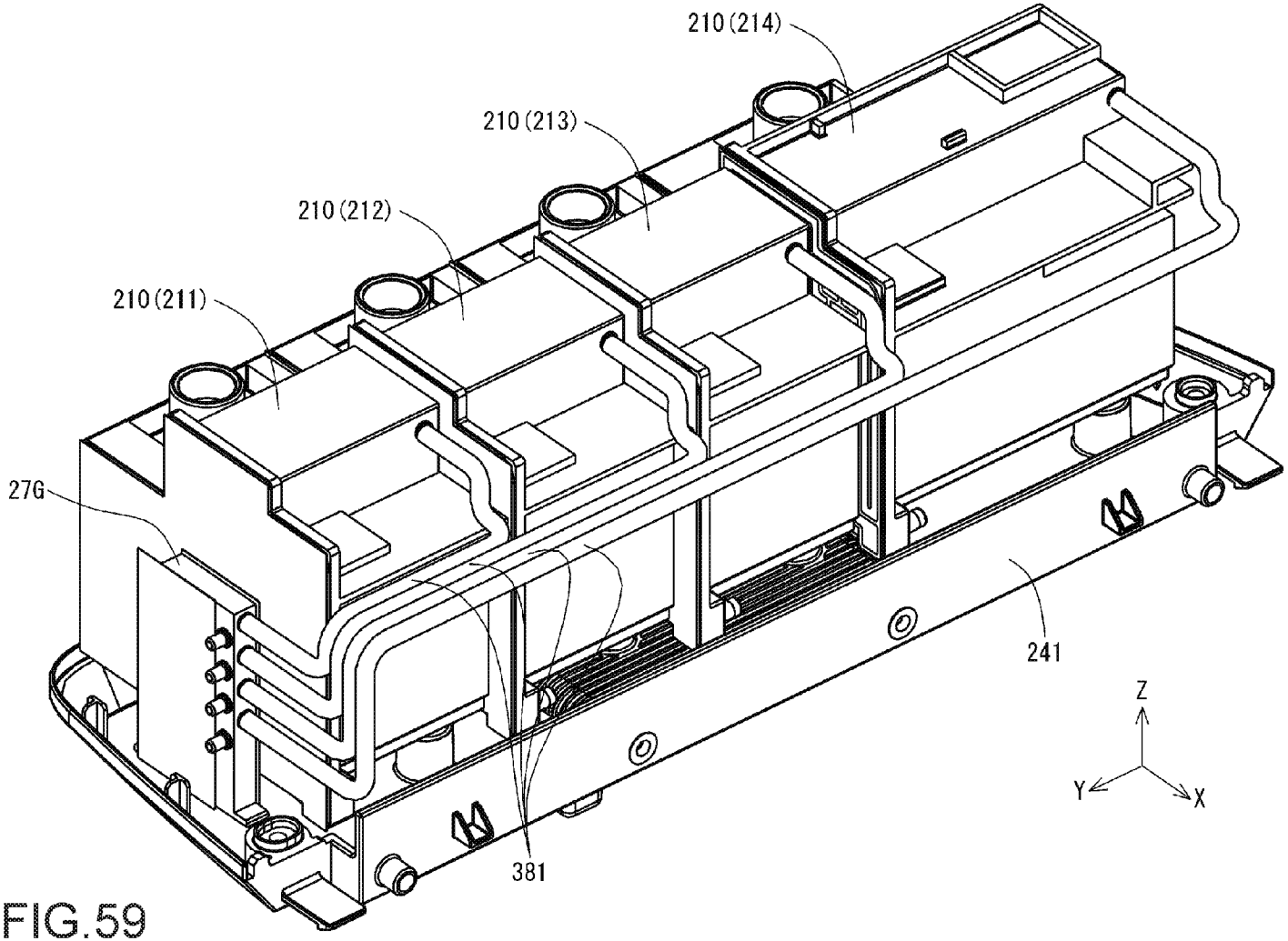
FIG. 59 is a perspective view of a tank and a buffer unit in a ninth working example.

As shown in FIG. 59, a buffer unit 27G of a ninth working example is configured to be able to be connected to multiple tanks 210 via multiple (two or a number greater than two) tubes 381. The liquid ejection system 201 of this embodiment has four tanks 210, and therefore the buffer unit 27G is connected to the four tanks 210 via four tubes 381. The buffer unit 27G of the ninth working example has a configuration in which multiple buffer units 27F (FIG. 57) are formed in an integrated manner. Note that the buffer unit 27G is arranged on the Y axis direction side of the tank 211 among the four tanks 210. Also, the buffer unit 27G is contained within the region of the first casing 241 in a plan view of the first casing 241 in the −Z axis direction.

Figure 60:
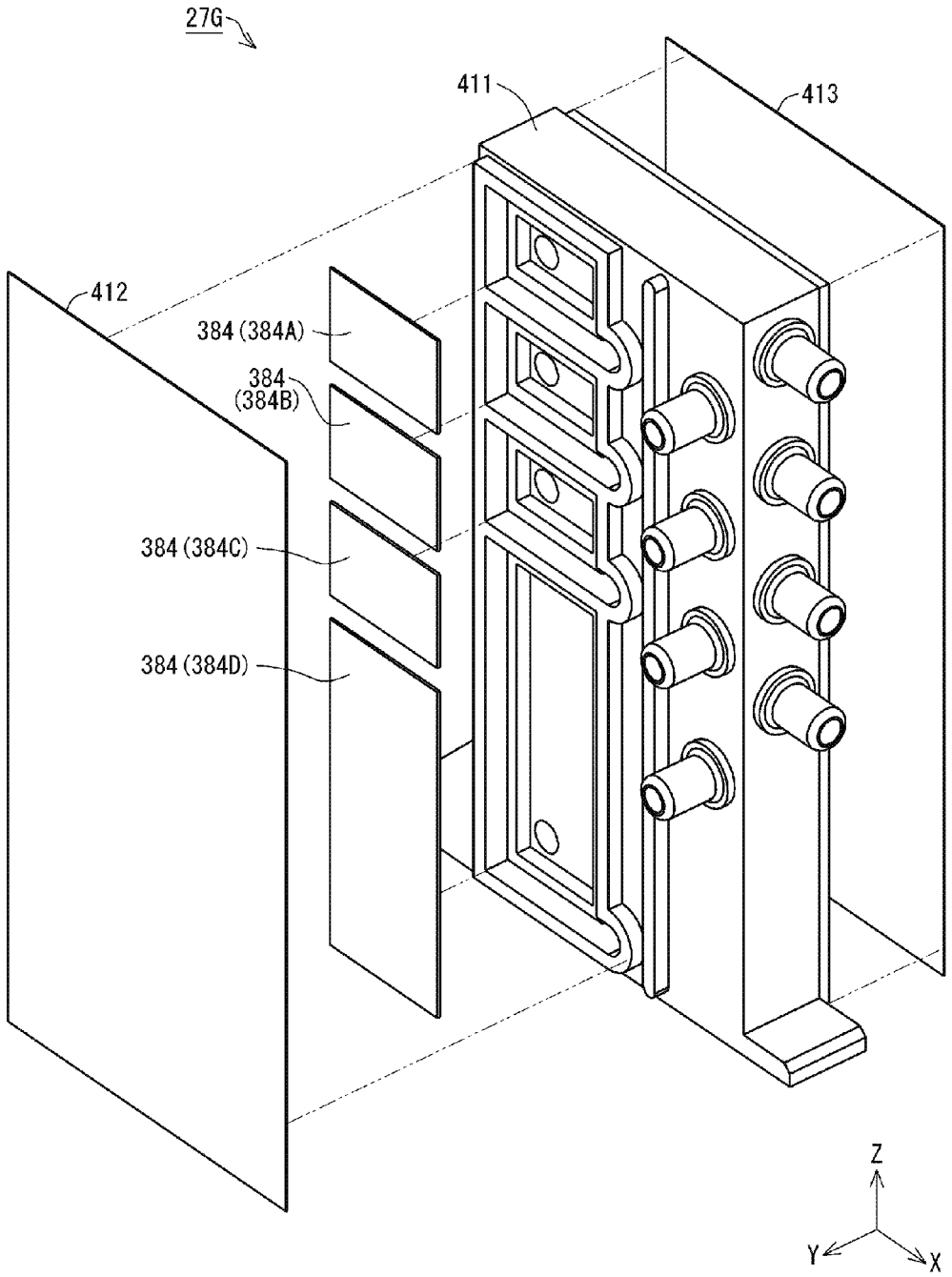
FIG. 60 is an exploded perspective view of the buffer unit in the ninth working example.

As shown in FIG. 60, the buffer unit 27G has a case 411, a sheet member 412, four waterproof ventilation films 384, and a sheet member 413. The case 411 can be constituted by the same material as the case 382 in the eighth working example. The sheet member 412 and the sheet member 413 can be constituted by the same material as the sheet member 383 and the sheet member 385 in the eighth working example. The four waterproof ventilation films 384 can be constituted by the same material as the waterproof ventilation film 384 in the eighth working example. Hereinafter, when individually identifying the four waterproof ventilation films 384, the four waterproof ventilation films 384 will be respectively denoted as the waterproof ventilation film 384A, the waterproof ventilation film 384B, the waterproof ventilation film 384C, and the waterproof ventilation film 384D.

Figure 61:
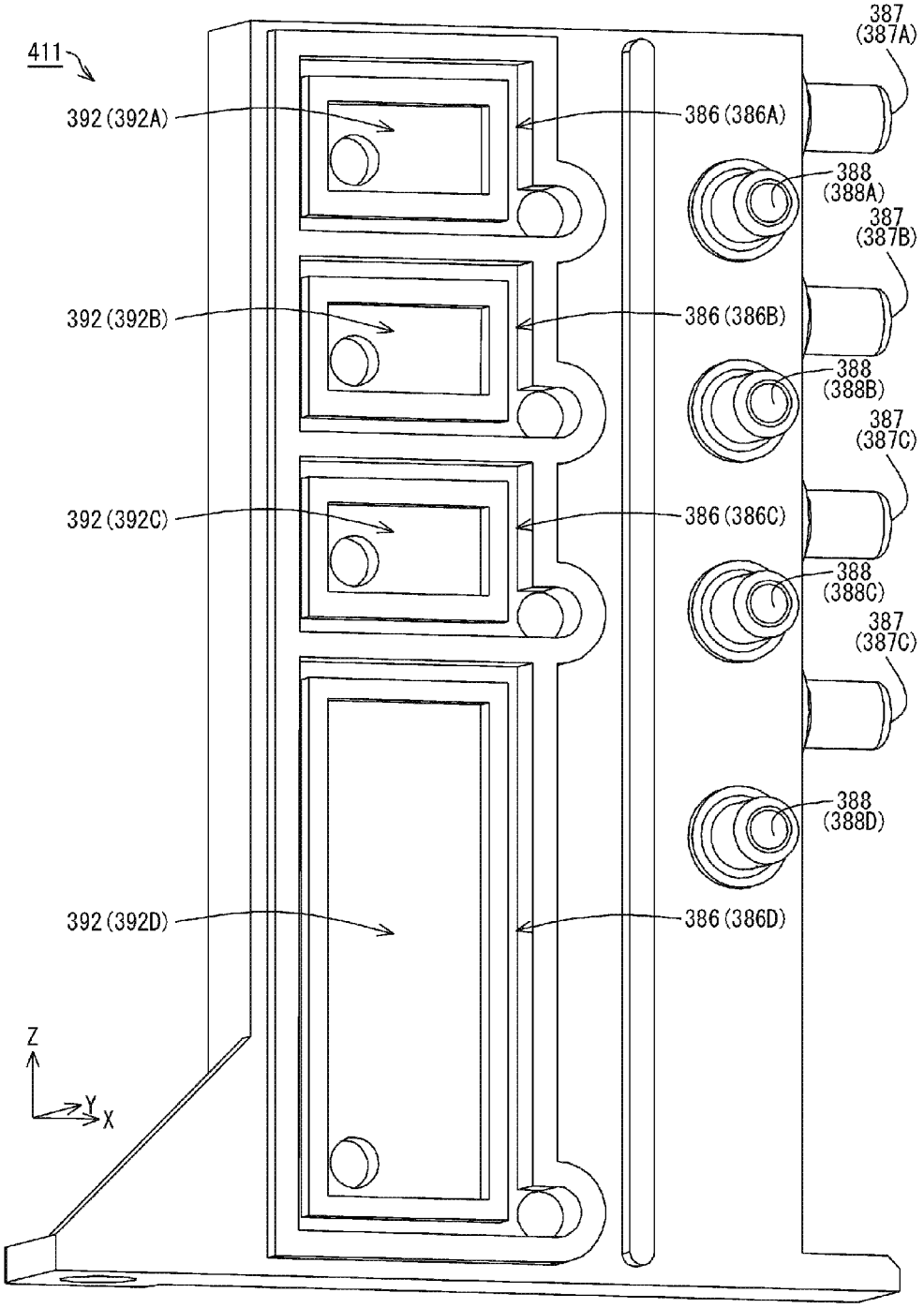
FIG. 61 is a perspective view of a case of the buffer unit in the ninth working example.

The case 411 has a configuration in which four cases 382 (FIG. 55) are formed side-by-side in an integrated manner. For this reason, hereinafter, configurations of the case 411 that are the same as in the case 382 of the eighth working example will be denoted by the same reference signs as in the eighth working example, and will not be described in detail. As shown in FIG. 61, four recessed portions 386 are formed in the case 411. The four recessed portions 386 are formed so as to recede in the −Y axis direction. A recessed portion 392 is formed in each of the recessed portions 386.

The four recessed portions 386 are aligned along the Z axis. When individually identifying the four recessed portions 386, the four recessed portions 386 will be respectively denoted as the recessed portion 386A, the recessed portion 386B, the recessed portion 386C, and the recessed portion 386D in order from the Z axis direction side to the −Z axis direction side. Also, when individually identifying the four recessed portions 392, the four recessed portions 392 will be respectively denoted as the recessed portion 392A, the recessed portion 392B, the recessed portion 392C, and the recessed portion 392D in order from the Z axis direction side to the −Z axis direction side. The recessed portion 392A is provided in correspondence with the recessed portion 386A. Similarly, the recessed portion 392B is provided in correspondence with the recessed portion 386B, the recessed portion 392C is provided in correspondence with the recessed portion 386C, and the recessed portion 392D is provided in correspondence with the recessed portion 386D.

Also, the case 411 is provided with four connection portions 387 and four air inlet portions 388 in correspondence with the four recessed portions 386. When individually identifying the four connection portions 387, the four connection portions 387 will be respectively denoted as the connection portion 387A, the connection portion 387B, the connection portion 387C, and the connection portion 387D in correspondence with the four recessed portions 386.

Similarly, when individually identifying the four air inlet portions 388, the four air inlet portions 388 will be respectively denoted as the air inlet portion 388A, the air inlet portion 388B, the air inlet portion 388C, and the air inlet portion 388D in correspondence with the four recessed portions 386.

Figure 62:
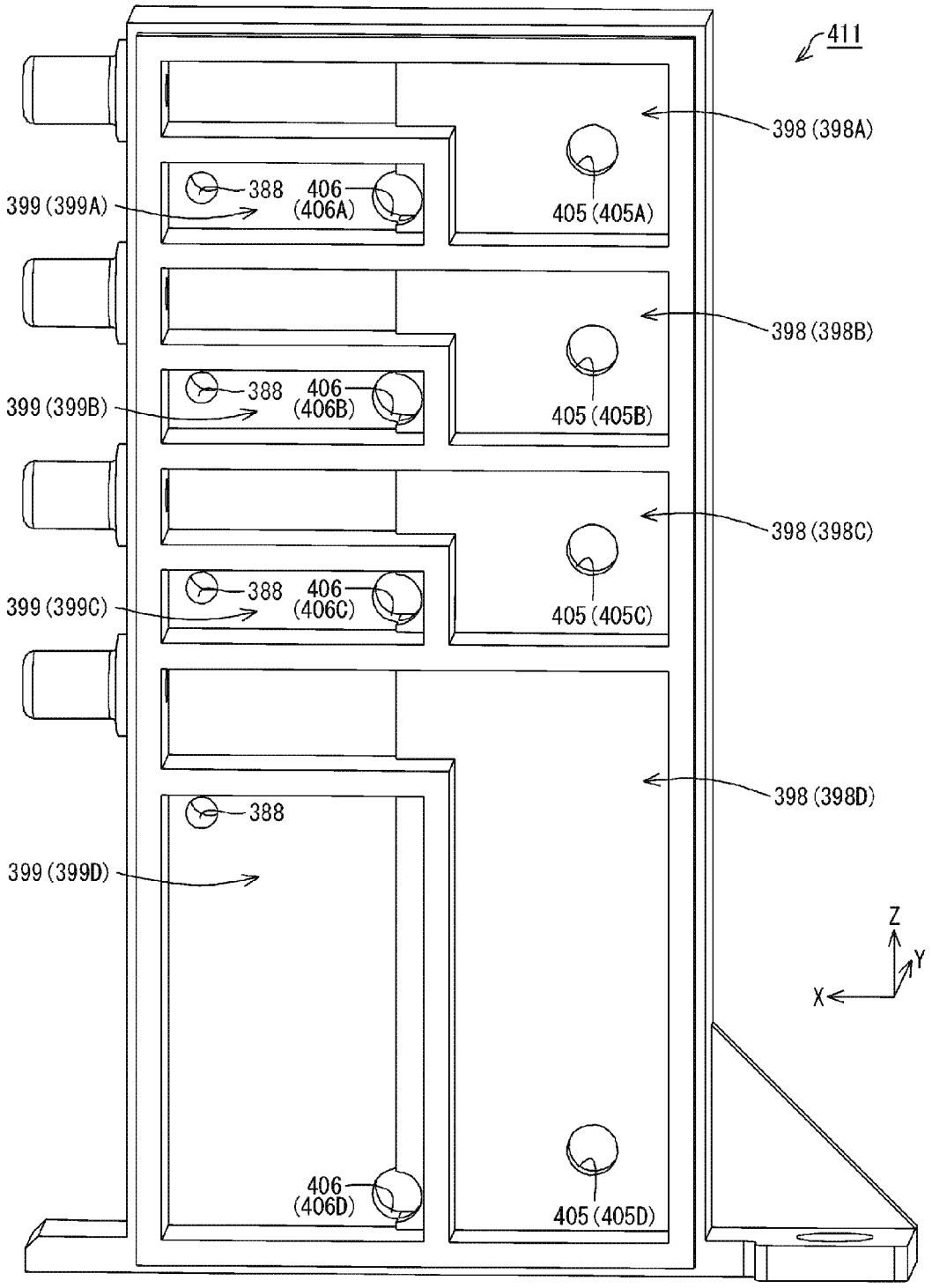
FIG. 62 is a perspective view of the case of the buffer unit in the ninth working example.

As shown in FIG. 62, four recessed portions 398, four recessed portions 399, four communication holes 405, and four communication holes 406 are provided on the −Y axis direction side of the case 411. Note that the arrangement of the connection portions 387 and the air inlet portions 388 in the case 411 of the ninth working example is different from that in the case 382 of the eighth working example. According to this configuration, it is possible to reduce the amount of space needed for arranging the tubes 381 when the buffer unit 27G is arranged on the Y axis direction side of the tank 211 as shown in FIG. 59. With the exception of the different arrangement of the connection portions 387 and the air inlet portions 388, the case 411 of the ninth working example has the same configuration as the case 382 of the eighth working example. Also, in the case 411, a configuration is possible in which the portion of the air inlet portion 388 that protrudes from the case 411 is omitted, but this is the same as in the eighth working example, and therefore will not be described in detail.

When individually identifying the four recessed portions 398 shown in FIG. 62, the letters A to D are appended to the reference signs for the four recessed portions 398 in correspondence with the four recessed portions 386. Also, when individually identifying the four recessed portions 399, the four communication holes 405, and the four communication holes 406, the letters A to D are likewise appended to the reference signs in correspondence with the four recessed portions 386.

The sheet member 412 shown in FIG. 60 has a size and shape capable of covering the four recessed portions 386 (FIG. 61). In this working example, the one sheet member 412 blocks all of the four recessed portions 386. Also, the sheet member 413 shown in FIG. 60 has a size and shape capable of covering the four recessed portions 398 (FIG. 62) and the four recessed portions 399. In this working example, the one sheet member 413 blocks all of the four recessed portions 398 and the four recessed portions 399.

In this working example, the connection portion 387A (FIG. 61) of the buffer unit 27G is connected to the tank 211 among the four tanks 210 shown in FIG. 59 via one tube 381. Also, the connection portion 387B (FIG. 61) of the buffer unit 27G is connected to the tank 212 among the four tanks 210 via one tube 381. Moreover, the connection portion 387C (FIG. 61) of the buffer unit 27G is connected to the tank 212 among the four tanks 210 via one tube 381. Furthermore, the connection portion 387D (FIG. 61) of the buffer unit 27G is connected to the tank 214 among the four tanks 210 via one tube 381.

As previously described, the capacity of the liquid storage portion 269 of the tank 214 is greater than the capacity of the liquid storage portions 269 of the other tanks 210. For this reason, the volume of the recessed portion 398D (FIG. 62) connected to the tank 214 is greater than the volume of the other recessed portions 398. In other words, the volume of the recessed portion 398D among the four recessed portions 398 is set larger than that of the other recessed portions 398, in correspondence with the capacity of the liquid storage portion 269. Accordingly, even if the capacity of the liquid storage portion 269 of the tank 214 is greater than the capacity of the liquid storage portions 269 of the other tanks 210, it is possible to reduce the possibility of ink leaking out from the buffer unit 27G. The same follows for the recessed portion 386D (FIG. 61), the recessed portion 392D (FIG. 61), and the recessed portion 386D as well.

The following describes flow channels 140G from the air inlet portions 388 to the liquid supply portion 262. The four tanks 210 are connected in parallel in the buffer unit 27G. For this reason, when the four tanks 210 are connected to the buffer unit 27G, four flow channels 140G are constituted in parallel. The four flow channels 140G constituted in parallel have the same configuration as each other. Also, the flow channels 140G of this working example have the same configuration as the flow channel 140F (FIG. 58) of the eighth working example. For this reason, configurations of the flow channel 140G of the ninth working example that are the same as configurations in the eighth working example shown in FIG. 58 will be denoted by the same reference signs, and will not be described in detail.

Note that the recessed portion 386, the recessed portion 392, the recessed portion 398, and the recessed portion 399 of the buffer unit 27G respectively correspond to the recessed portion 386, the recessed portion 392, the recessed portion 398, and the recessed portion 399 of the buffer unit 27F. For this reason, in the buffer unit 27G shown in FIG. 58 as well, the recessed portion 386 constitutes the buffer chamber 391, the recessed portion 392 constitutes the buffer chamber 397, the recessed portion 398 constitutes the buffer chamber 403, and the recessed portion 399 constitutes the buffer chamber 404.

The same effects as in the eighth working example are obtained in the ninth working example as well. Furthermore, in the ninth working example, the one sheet member 412 blocks all of the four recessed portions 386. For this reason, it is possible to reduce the number of sheet members 412 compared to the case of individually blocking the four recessed portions 386. Also, in the ninth working example, the sheet member 413 blocks all of the four recessed portions 398 and the four recessed portions 399. For this reason, it is possible to reduce the number of sheet members 413 compared to the case of individually blocking the four recessed portions 398 and the four recessed portions 399.

Furthermore, in the ninth working example, multiple tanks 210 can be connected to the one buffer unit 27G. Accordingly, the arrangement location of the buffer unit 27 is more readily concentrated compared to the case of a configuration in which a separate buffer unit 27 is connected to each of the tanks 210.

Tenth Working Example

Figure 63:
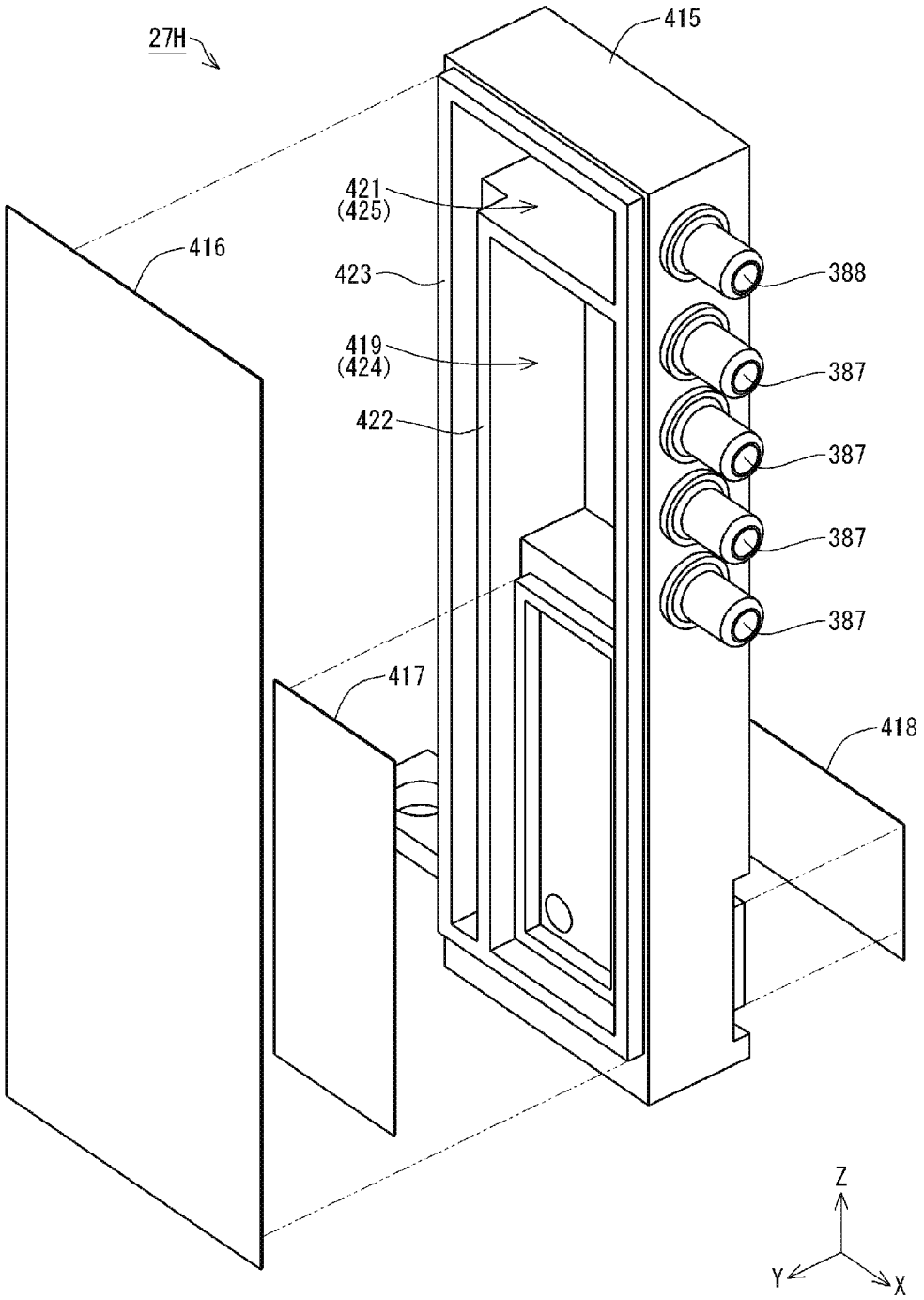
FIG. 63 is an exploded perspective view of a buffer unit in a tenth working example.

As shown in FIG. 63, a buffer unit 27H of a tenth working example has a case 415, a sheet member 416, a waterproof ventilation film 417, and a sheet member 418. Note that configurations in the tenth working example that are the same as configurations in the ninth working example will be denoted by the same reference signs as in the ninth working example, and will not be described in detail.

The case 415 can be constituted by the same material as the case 411 of the ninth working example. The sheet member 416 and the sheet member 418 can be constituted by the same material as the sheet member 412 and the sheet member 413 in the ninth working example. The waterproof ventilation film 417 can be constituted by the same material as the waterproof ventilation film 384 of the ninth working example.

A recessed portion 419 and a recessed portion 421 are formed in the case 415. In the case 415, the recessed portion 419 and the recessed portion 421 are formed so as to recede in the −Y axis direction. In other words, the recessed portion 419 and the recessed portion 421 are open in the Y axis direction. Also, the case 415 is provided with four connection portions 387 and one air inlet portion 388. The connection portions 387 protrude from the case 415 in the X axis direction. The air inlet portion 388 protrudes from the case 415 in the X axis direction. The recessed portion 419 and the recessed portion 421 are separated from each other by a partition wall 422.

In the buffer unit 27H, the sheet member 416 is located on the Y axis direction side of the case 415. The waterproof ventilation film 417 has a size and shape capable of being accommodated in the recessed portion 419. Also, the waterproof ventilation film 417 is accommodated in the recessed portion 419. The sheet member 416 is joined to the edges of the openings of the recessed portion 419 and the recessed portion 421, that is to say a joining portion 423 provided on the end portions, on the Y axis direction side, of the recessed portion 419 and the recessed portion 421. The joining portion 423 is provided on the partition wall 422 as well. In other words, the sheet member 416 is joined to the end portion, on the Y axis direction side, of the partition wall 422 as well.

The joining portion 423 surrounds the recessed portion 419 and the recessed portion 421 in a plan view of the case 415 in the −Y axis direction. The sheet member 416 has a size and shape capable of covering the recessed portion 419, the recessed portion 421, and the joining portion 423. When the sheet member 416 is joined to the joining portion 423, the recessed portion 419 and the recessed portion 421 are blocked by the sheet member 416. The region surrounded by the recessed portion 419 and the sheet member 416 will be referred to as a buffer chamber 424. Also, the region surrounded by the recessed portion 421 and the sheet member 416 will be referred to as a buffer chamber 425. Note that the four connection portions 387 are in communication with the recessed portion 419. Also, the air inlet portion 388 is in communication with the recessed portion 421.

Figure 64:
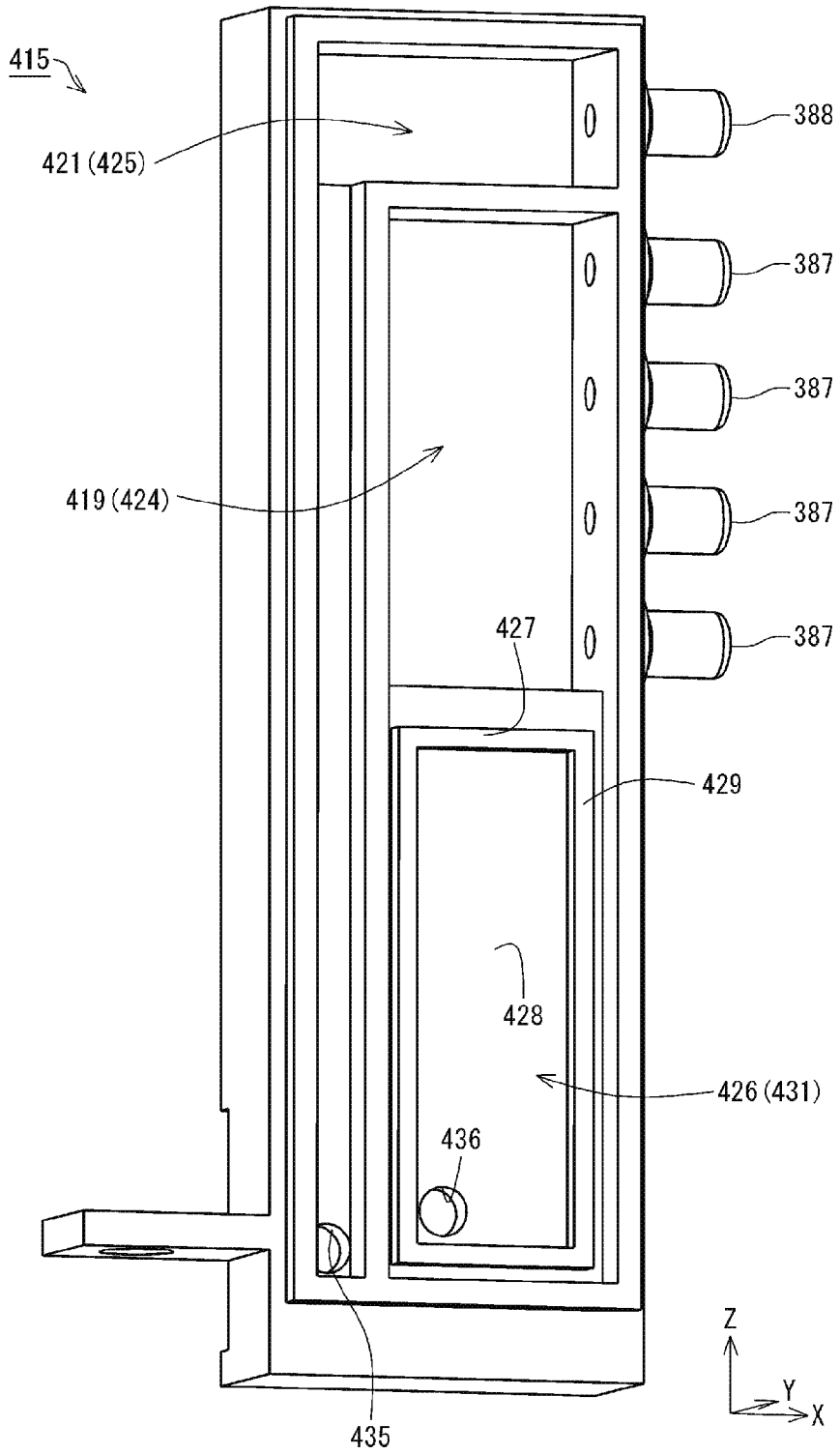
FIG. 64 is a perspective view of a case of the buffer unit in the tenth working example.

As shown in FIG. 64, a recessed portion 426 is formed in the recessed portion 419 of the case 415. An annular embankment portion 427 that defines the recessed portion 426 is provided in the recessed portion 419. The embankment portion 427 is formed on a wall 428, and protrudes from the wall 428 in the Y axis direction. The recessed portion 426 is constituted by the wall 428 and the embankment portion 427. A joining portion 429 is provided on an end portion, on the Y axis direction side, of the embankment portion 427. The waterproof ventilation film 417 shown in FIG. 63 is joined to the edge of the opening of the recessed portion 426, that is to say the joining portion 429. The joining portion 429 surrounds the recessed portion 426 in a plan view of the case 415 in the −Y axis direction. The waterproof ventilation film 417 has a size and shape capable of covering the recessed portion 426 and the joining portion 429.

When the waterproof ventilation film 417 is joined to the joining portion 429, the recessed portion 426 is blocked by the waterproof ventilation film 417. The region surrounded by the recessed portion 426 and the waterproof ventilation film 417 will be referred to as a buffer chamber 431. In other words, in the buffer unit 27H, the buffer chamber 431 is provided inside the buffer chamber 424.

Figure 65:
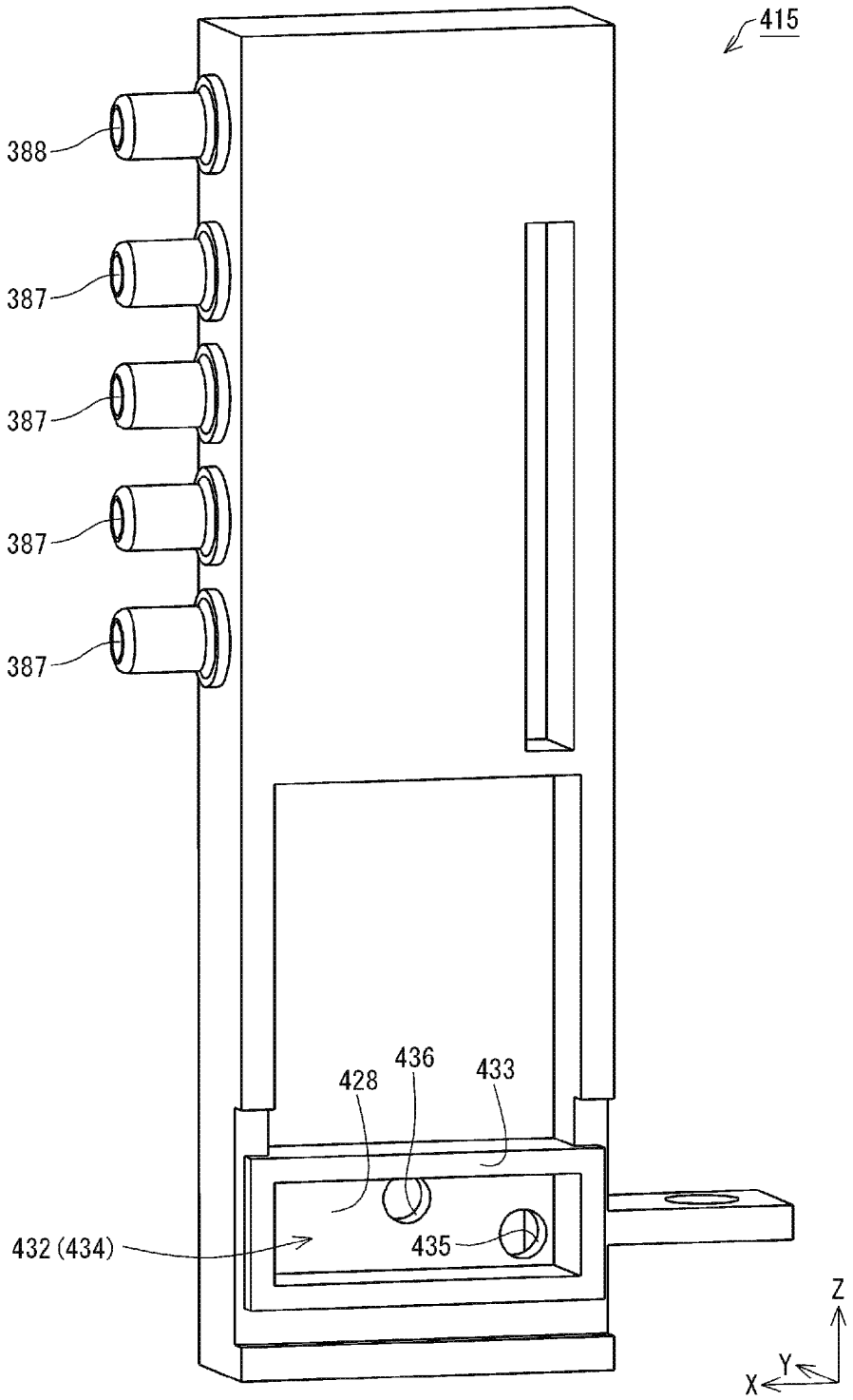
FIG. 65 is a perspective view of the case of the buffer unit in the tenth working example.

As shown in FIG. 65, a recessed portion 432 is formed on the −X axis direction side of the recessed portion 426. In the case 415, the recessed portion 432 is formed so as to recede in the Y axis direction. In other words, the recessed portion 432 is open in the −Y axis direction. The recessed portion 432 is overlapped with a portion of the recessed portion 426 (FIG. 64) and a portion of the recessed portion 421 in a plan view of the case 415 in the Y axis direction. The recessed portion 432 and the recessed portion 426 are separated from each other by a wall 428.

The sheet member 418 (FIG. 63) is located on the −Y axis direction side of the case 415. The sheet member 418 is joined to the edge of the opening of the recessed portion 432 shown in FIG. 65, that is to say a joining portion 433 provided on the end portion, on the −Y axis direction side, of the recessed portion 432. The joining portion 433 surrounds the recessed portion 432 in a plan view of the case 415 in the Y axis direction.

The sheet member 418 has a size and shape capable of covering the recessed portion 432 and the joining portion 433. When the sheet member 418 is joined to the joining portion 433, the recessed portion 432 is blocked by the sheet member 418. The region surrounded by the recessed portion 432 and the sheet member 418 will be referred to as a buffer chamber 434.

As shown in FIG. 65, the communication hole 435 and the communication hole 436 are in communication with the interior of the recessed portion 432. The communication hole 435 and the recessed portion 421 (FIG. 64) are arranged at positions that are overlapped with each other in a plan view of the wall 428 in the Y axis direction. Also, the communication hole 436 and the recessed portion 426 (FIG. 64) are arranged at positions that are overlapped with each other in a plan view of the wall 428 in the Y axis direction.

As shown in FIG. 64, the communication hole 435 passes through the wall 428. Accordingly, the recessed portion 432 and the recessed portion 421 are in communication with each other via the communication hole 435. The communication hole 436 also passes through the wall 428. Accordingly, the recessed portion 432 and the recessed portion 426 are in communication with each other via the communication hole 436.

The buffer unit 27H and the tank 210 are connected via tubes (not shown). Tubes 381 similar to those in the ninth working example can be employed as the tubes. The tubes 381 are connected to the connection portions 387 of the buffer unit 27H shown in FIG. 63 and the communication portions 261 of the tank 210. When the buffer unit 27H is connected to the tank 210 via the tubes 381, a flow channel 140H from the air inlet portion 388 to the liquid supply portion 262 is constituted.

Figure 66:
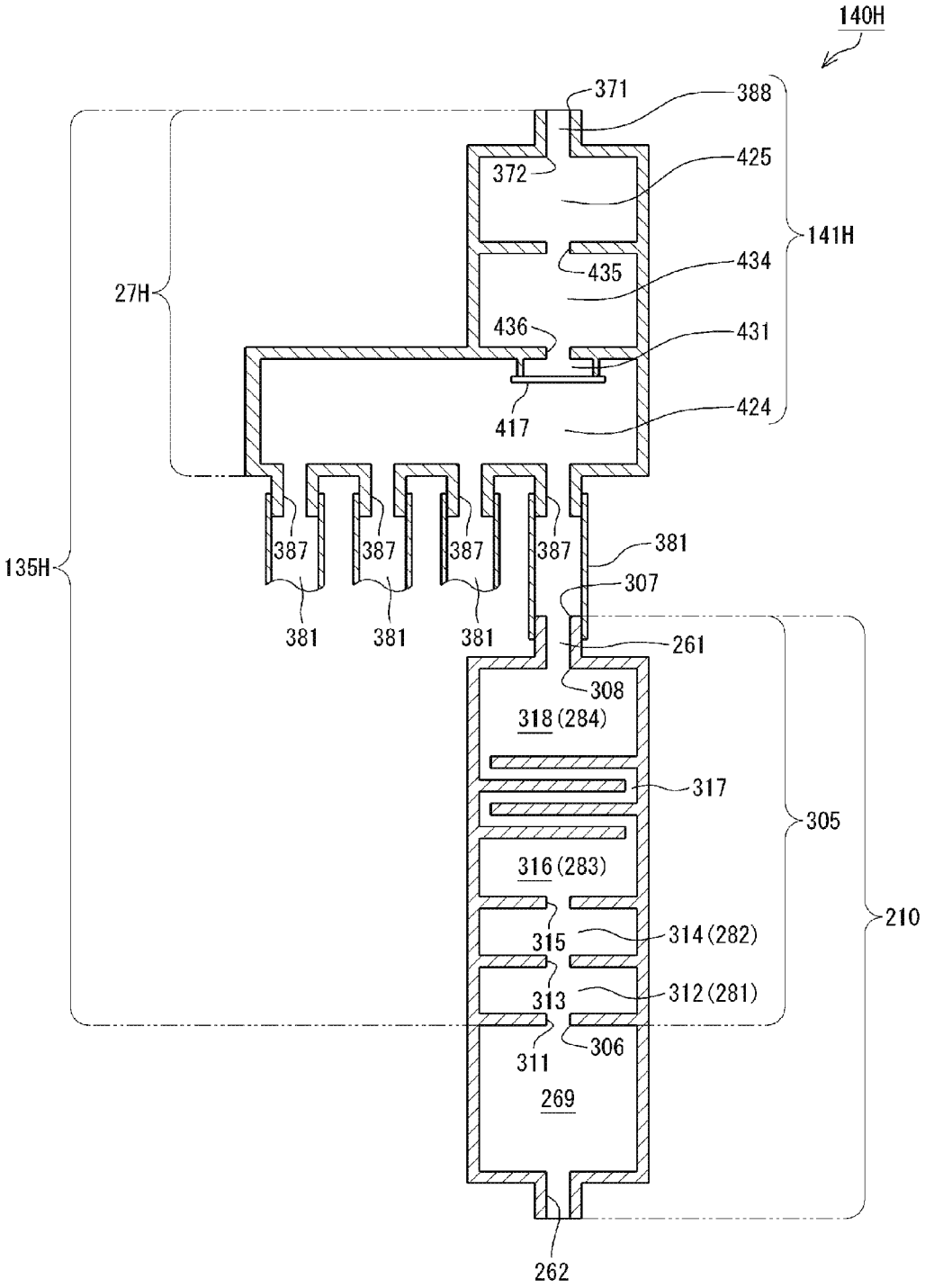
FIG. 66 is a diagram schematically showing a flow channel in the tenth working example.

The following describes the flow channel 140H from the air inlet portion 388 to the liquid supply portion 262. As shown in FIG. 66, the flow channel 140H of this working example has an air introduction portion 135H. The air introduction portion 135H includes the introduction passage 141H, a tube 381, and the air introduction passage 305. The introduction passage 141H includes the air inlet portion 388, the buffer chamber 425, the buffer chamber 434, the buffer chamber 431, and the buffer chamber 424 of the buffer unit 27H. For this reason, the buffer unit 27H constitutes at least a portion of the air introduction portion 135H.

In the buffer unit 27H, multiple connection portions 387 are in communication with the buffer chamber 424. In other words, in the buffer unit 27H, multiple connection portions 387 are in communication with one introduction passage 141H. From another viewpoint, in the buffer unit 27H, it can be said that multiple connection portions 387 are in communication with the same introduction passage 141H. Note that FIG. 66 shows one tank 210 among the four tanks 210, and the other three tanks 210 are not shown.

Note that the air introduction passage 305 in this working example is similar to that of the sixth working example, and therefore the same reference signs as in the sixth working example will be used, and a detailed description will not be given. Also, in the buffer unit 27H, the air inlet portion 388 has the air inlet 371 and the introduction opening 372. The air inlet 371 and the introduction opening 372 are the same as in the seventh working example, and therefore will not be described in detail. Also, in the buffer unit 27H, a configuration is possible in which the portion of the air inlet portion 388 that protrudes from the case 415 is omitted, but this is the same as in the seventh working example, and therefore will not be described in detail.

The buffer chamber 425 is provided on the downstream side of the air inlet portion 388. The buffer chamber 434 is provided on the downstream side of the buffer chamber 425. The buffer chamber 434 and the buffer chamber 425 are in communication with each other via the communication hole 435. The buffer chamber 431 is provided on the downstream side of the buffer chamber 434. The buffer chamber 434 and the buffer chamber 431 are in communication with each other via the communication hole 436. The buffer chamber 424 is provided on the downstream side of the buffer chamber 431. The buffer chamber 431 and the buffer chamber 424 are in communication with each other via the waterproof ventilation film 417.

The buffer chamber 424 and the buffer chamber 431 are separated by the waterproof ventilation film 417. Accordingly, the introduction passage 141H is blocked by the waterproof ventilation film 417 on the upstream side of the buffer chamber 424. The tube 381 is provided on the downstream side of the buffer chamber 424. The tube 381 is connected to the connection portion 387 of the buffer unit 27H. The buffer chamber 424 of the buffer unit 27H and the tube 381 are in communication via the connection portion 387. Also, the communication portion 261 of the tank 210 is arranged on the downstream side of the tube 381.

Air that has flowed through the air inlet 371 and into the air inlet portion 388 flows through the introduction opening 372 and into the buffer chamber 425. The air that flowed into the buffer chamber 425 then passes through the communication hole 435 and flows into the buffer chamber 434. The air that flowed into the buffer chamber 434 then passes through the communication hole 436 and flows into the buffer chamber 431. The air that flowed into the buffer chamber 431 then passes through the waterproof ventilation film 417 and flows into the buffer chamber 424. The air that flowed into the buffer chamber 424 can then be distributed among the four connection portions 387. The air that flowed through the buffer chamber 424 and into the connection portions 387 then passes through the tubes 381 and flows into the fourth buffer chamber 318 of the tank 210. The subsequent flow path is the same as in the sixth working example, and therefore will not be described in detail.

The same effects as in the sixth to ninth working examples are obtained in the tenth working example as well. Furthermore, in the tenth working example, multiple connection portions 387 are in communication with the same introduction passage 141H. According to this configuration, the size of the introduction passage 141H can be readily reduced.

In the ninth and tenth working examples, the buffer unit 27 is arranged on the Y axis direction side of the tank 211. However, the arrangement of the buffer unit 27 is not limited in this way. The buffer unit 27 can be arranged at various positions in the periphery of the tank 210. Examples of positions in the periphery of the tank 210 include various positions on the −Y axis direction side of the tank 214, and on the Z axis direction side, the −Z axis direction side, or the X axis direction side of the tank 210. Also, a position between two adjacent tanks 210 can be employed for the arrangement of the buffer unit 27.

In the eighth to tenth working examples, the buffer unit 27 and the tank 210 are connected via tubes 381. According to this configuration, the setting of the position of the buffer unit 27 relative to the tank 210 can be readily changed according to the setting of the length and arrangement of the tubes 381. For this reason, in the liquid ejection systems 201 and the ink supply apparatuses 204 that have the liquid supply unit 132F, the liquid supply unit 132G, and the liquid supply unit 132H in the eighth to tenth working examples, the setting of the position of the buffer unit 27 relative to the tank 210 can be changed readily.

Furthermore, in the case where the buffer unit 27 is arranged on the side of the tank 210 that is opposite to the front surface 236 side, the buffer unit 27 can be arranged at a position on the X axis direction side of the tank 210. In this case, the buffer unit 27 can be arranged so as to be contained within the casing 207 shown in FIG. 33, or be arranged outward of the casing 207, for example. In a configuration in which the buffer unit 27 is arranged outward of the casing 207, the buffer unit 27 can be arranged between the ink supply apparatus 204 and printer 203, or the buffer unit 27 can be arranged inside the casing 206 (FIG. 32) of the printer 203, for example.

Also, the buffer unit 27 of the second to fourth working examples of the first embodiment can be applied to the ink supply apparatus 204 and the liquid ejection system 201 of the second embodiment. The same effects as in the second to fourth working examples are obtained in these configurations as well. Also, the buffer unit 27 of the sixth to tenth working examples can be applied to the ink supply apparatus 4 and the liquid ejection system 1 of the first embodiment. The same effects as in the sixth to tenth working examples are obtained in these configurations as well.

In the above embodiments, the liquid ejection apparatus may be a liquid ejection apparatus that consumes a liquid other than ink by ejecting, discharging, or applying the liquid. Note that the states of liquid discharged as very small droplets from the liquid ejection apparatus includes a granular shape, a tear-drop shape, and a shape having a thread-like trailing end. Furthermore, the liquid mentioned here may be any kind of material that can be consumed by the liquid ejection apparatus. For example, the liquid need only be a material whose substance is in the liquid phase, and includes fluids such as an inorganic solvent, an organic solvent, a solution, a liquid resin, and a liquid metal (metal melt) in the form of a liquid body having a high or low viscosity, a sol, gel water, or the like. Furthermore, the liquid is not limited to being a one-state substance, and also includes particles of a functional material made from solid matter, such as pigment or metal particles, that are dissolved, dispersed, or mixed in a solvent. Representative examples of the liquid include ink such as that described in the above embodiments, liquid crystal, or the like. Here, "ink" encompasses general water-based ink and oil-based ink, as well as various types of liquid compositions such as gel ink and hot melt-ink. Moreover, sublimation transfer ink can be used as the ink. Sublimation transfer ink is ink that includes a sublimation color material such as a sublimation dye. One example of a printing method is a method in which sublimation transfer ink is ejected onto a transfer medium by a liquid ejection device, a printing target is brought into contact with the transfer medium and heated to cause the color material to sublimate and be transferred to the printing target. The printing target is a T-shirt, a smartphone, or the like. In this way, if the ink includes a sublimation color material, printing can be performed on a diverse range of printing targets (printing media). Specific examples of the liquid ejection apparatus include a liquid ejection apparatus that ejects liquid including a material, such as an electrode material or a color material that is used for manufacturing a liquid crystal display, an EL (electro-luminescence) display, a surface emission display, or a color filter, for example, in the form of being dispersed or dissolved. The liquid ejection apparatus may also be a liquid ejection apparatus that ejects biological organic matter used in manufacturing of a biochip, a liquid ejection apparatus that is used as a precision pipette and ejects a liquid serving as a sample, a textile printing apparatus, a microdispenser, or the like. Furthermore, the liquid ejection apparatus may be a liquid ejection apparatus that ejects lubricating oil in a pinpoint manner to a precision machine such as a watch or a camera, or a liquid ejection apparatus that ejects, onto a substrate, transparent resin liquid such as UV-cured resin for forming, for example, a micro-hemispherical lens (optical lens) that is used in an optical communication element or the like. The liquid ejection apparatus may also be a liquid ejection apparatus that ejects acid or alkaline etchant, for example, for etching substrates or the like.

Note that the invention is not limited to the above embodiments and examples, and can be achieved as various configurations without departing from the gist of the invention. For example, the technical features in the embodiments and examples that correspond to the technical features in the modes described in the summary of the invention may be replaced or combined as appropriate in order to solve a part of, or the entire foregoing problem, or to achieve some or all of the above-described effects. The technical features that are not described as essential in the specification may be deleted as appropriate.

What is claimed is:

1. A liquid ejection system comprising:

a liquid ejection head configured to eject liquid;

a liquid storage container including a liquid storage portion configured to store the liquid;

a liquid supply member that is provided at the liquid storage container and that fluidically communicates with the liquid storage portion at a first position so as to supply the liquid to the liquid ejection head; and a ventilation unit that is provided at the liquid storage container and that constitutes at least a portion of an air introduction portion, the air introduction portion fluidically communicating with the liquid storage portion at a second position which is different from the first position, the air introduction portion being configured to introduce air into the liquid storage portion, the ventilation unit being detachable from the liquid storage container, wherein the ventilation unit further includes an introduction passage that constitutes at least a portion of a path of air flowing toward the liquid storage portion in the air introduction portion, and an air chamber that constitutes at least a portion of the introduction passage, and the ventilation unit is arranged in a periphery of the liquid storage container.

2. The liquid ejection system according to claim 1, wherein the liquid storage container includes a liquid injection portion through which the liquid is injected into the liquid storage portion, when the liquid storage container is in use orientation, the liquid injection portion is shifted toward one side of the liquid storage container from a center of the liquid storage container in a plan view, and the ventilation unit is arranged closer to an opposite side of the liquid storage container than the one side of the liquid storage container.

3. The liquid ejection system according to claim 1, wherein the liquid storage container includes a liquid injection portion through which the which the liquid is injected into the liquid storage portion, when the liquid storage container is in use orientation, the liquid injection portion is shifted toward one side in of the liquid storage container from a center of the liquid storage container in a plan view, a direction from the one side toward an opposite side of the liquid storage container is defined as an X+ direction, a vertically upward direction in the use orientation is defined as a Z+ direction, and a direction orthogonal to the X+ direction and the Z+ direction is defined as a Y+ direction, and the ventilation unit is arranged at a first farthest end position of the liquid storage container in the Y+ direction when viewed in the X+ direction.

4. The liquid ejection system according to claim 1, wherein the liquid storage container includes a liquid injection portion through which the liquid is injected into the liquid storage portion, when the liquid storage container is in use orientation, the liquid injection portion is shifted toward one side of the liquid storage container from a center of the liquid storage container in a plan view, a direction from the one side toward an opposite side of the liquid storage container is defined as an X+ direction, a vertically upward direction in the use orientation is defined as a Z+ direction, and a direction orthogonal to the X direction and the Z direction is defined as a Y+ direction, and the ventilation unit is arranged at a second farthest end position of the liquid storage container in a Y− direction opposite to the Y+ direction when viewed in the X+ direction.

5. The liquid ejection system according to claim 1, wherein the liquid storage container includes a liquid injection portion through which the liquid is injected into the liquid storage portion, when the liquid storage container is in use orientation, the liquid injection portion is shifted toward one side of the liquid storage container from a center of the liquid storage container in a plan view, a direction from the one side toward an opposite side of the liquid storage container is defined as an X+ direction, a vertically upward direction in the use orientation is defined as a Z+ direction, and the X+ direction is orthogonal to the Z+ direction, and the ventilation unit is arranged at a third farthest end position of the liquid storage container in the Z+ direction when viewed in the X+ direction.

6. The liquid ejection system according to claim 1, wherein the liquid storage container includes a liquid injection portion through which the liquid is injected into the liquid storage portion, when the liquid storage container is in use orientation, the liquid injection portion is shifted toward one side of the liquid storage container from a center of the liquid storage container in a plan view, and direction from the one side toward an opposite side of the liquid storage container is defined as an X+ direction, a vertically upward direction in the use orientation is defined as a Z+ direction, and X+ direction is orthogonal to the Z direction, and the ventilation unit is arranged at a fourth farthest end position of the liquid storage container in a Z− direction opposite to the Z+ direction when viewed in the X+ direction.

7. The liquid ejection system according to claim 1, wherein a waterproof ventilation member that blocks the introduction passage is arranged at a position in an upstream side of the air chamber in the path of air.

8. The liquid ejection system according to claim 7, wherein the waterproof ventilation member is a valve that allows air to flow into the air chamber from the upstream side of the air chamber through the path of air, and the valve is also configured to prevent a flow of the liquid from the air chamber to the upstream side of the air chamber.

9. The liquid ejection system according to claim 7, wherein the waterproof ventilation member is a waterproof ventilation sheet.

10. The liquid ejection system according to claim 1, wherein the liquid storage portion is configured with a plurality of liquid storage portions, wherein the ventilation unit includes a plurality of connection portions that fluidically communicate with the introduction passage, the plurality of connection portions are in one-to-one correspondence with the plurality of liquid storage portions, each of the plurality of connection portions is connected to the air introduction portion at a location in a downstream side of the ventilation unit in the path of air so that the plurality of connection portions fluidically communicate with the plurality of liquid storage portions, and the plurality of connection portions and the ventilation unit are formed as a monolithic body.

11. The liquid ejection system according to claim 10, wherein the plurality of connection portions fluidically communicate with the introduction passage in the ventilation unit.

12. The liquid ejection system according to claim 1, wherein the liquid storage container and the ventilation unit are connected via a tube.

13. The liquid ejection system according to claim 1, further comprising:

a casing that covers the liquid ejection head, the liquid storage container, and the ventilation unit.

14. A ventilation unit that is configured to be applied to a liquid ejection system, the liquid election system includes:

a liquid ejection head configured to eject a liquid;

a liquid storage container including a liquid storage portion configured to store the liquid; and a liquid supply member that is provided at the liquid storage container and that fluidically communicates with the liquid storage portion at a first position so as to supply the liquid to the liquid ejection head, the ventilation unit comprising:

an air introduction portion that is configured to introduce air into the liquid storage portion, the air introduction portion fluidically communicating with the liquid storage portion at a second position which is different from the first position;

an introduction passage that constitutes at least a portion of a path of air flowing toward the liquid storage portion in the air introduction portion;

an air chamber that constitutes at least a portion of the introduction passage; and a waterproof ventilation member that blocks the introduction passage and that is arranged at a position in an upstream side of the air chamber in the path of air, wherein the ventilation unit is detachably provided at the liquid storage container.

15. The ventilation unit according to claim 14, wherein the liquid storage portion is configured with a plurality of liquid storage portions, the ventilation unit includes a plurality of connection portions that fluidically communicate with the introduction passage, the plurality of connection portions are in one-to-one correspondence with the plurality of liquid storage portions, each of the plurality of connection portions is connected to the air introduction portion at a location in a downstream side of the ventilation unit in the path of air so that the plurality of connection portions fluidically communicate with the plurality of liquid storage portions, and the plurality of connection portions and the ventilation unit are formed as a monolithic body.

16. A liquid supply apparatus that is configured to be applied to a liquid ejection device, the liquid ejection device including a liquid ejection head configured to eject a liquid, the liquid supply apparatus comprising:

a liquid storage container including a liquid storage portion configured to store the liquid;

a liquid supply member that is provided at the liquid storage container and that fluidically communicates with the liquid storage portion at a first position so as to supply the liquid to the liquid ejection head, an air introduction portion that fluidically communicates with the liquid storage portion at a second position which is different from the first position and that is configured to introduce air into the liquid storage portion;

a ventilation unit that is provided at the liquid storage container and that constitutes at least a portion of the air introduction portion, the ventilation unit being detachable from the liquid storage container, wherein the ventilation unit further includes an introduction passage that constitutes at least a portion of a path of air flowing toward the liquid storage portion in the air introduction portion, and an air chamber that constitutes at least a portion of the introduction passage; and a waterproof ventilation member that blocks the introduction passage and that is arranged at a position in an upstream side of the air chamber in the path of air.

17. The liquid supply apparatus according to claim 16, wherein the waterproof ventilation member is a valve that allows air to move into the air chamber from the upstream side of the air chamber through the path of air, and the valve is also configured to prevent movement of the liquid from the air chamber to the upstream side of the air chamber.

18. The liquid supply apparatus according to claim 16, wherein the waterproof ventilation member is a waterproof ventilation sheet.

19. The liquid supply apparatus according to claim 16, wherein the ventilation unit is arranged in a periphery of the liquid storage container.

20. The liquid supply apparatus according to claim 19, wherein the liquid storage container includes a liquid injection portion through which the liquid is injected into the liquid storage portion, when the liquid storage container is in use orientation, the liquid injection portion is shifted toward one side of the liquid storage container from a center of the liquid storage container in a plan view, and the ventilation unit is arranged closer to an opposite side of the liquid storage container than the one side of the liquid storage container.

* * * * *